US007527922B2

(12) United States Patent
Shibayama et al.

(10) Patent No.: US 7,527,922 B2
(45) Date of Patent: May 5, 2009

(54) SILVER HALIDE COLOR PHOTOGRAPHIC LIGHT-SENSITIVE MATERIAL

(75) Inventors: Shigeru Shibayama, Minami-ashigara (JP); Toshihiro Kariya, Minami-ashigara (JP); Akito Yokozawa, Minami-ashigara (JP); Kenji Naoi, Minami-ashigara (JP); Katsuhisa Ohzeki, Minami-ashigara (JP); Hiroyuki Suzuki, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/592,319

(22) PCT Filed: Mar. 10, 2005

(86) PCT No.: PCT/JP2005/004725

§ 371 (c)(1), (2), (4) Date: Oct. 5, 2006

(87) PCT Pub. No.: WO2005/088394

PCT Pub. Date: Sep. 22, 2005

(65) Prior Publication Data

US 2007/0202448 A1 Aug. 30, 2007

(30) Foreign Application Priority Data

| | | |
|---|---|---|
| Mar. 11, 2004 | (JP) | 2004-068408 |
| Mar. 25, 2004 | (JP) | 2004-089336 |
| Mar. 1, 2005 | (JP) | 2005-056468 |
| Mar. 1, 2005 | (JP) | 2005-056705 |
| Mar. 1, 2005 | (JP) | 2005-056707 |
| Mar. 1, 2005 | (JP) | 2005-056712 |

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |
| ***G03C 1/06*** | (2006.01) |

(52) U.S. Cl. ..... 430/505; 430/502; 430/503; 430/506; 430/543; 430/556; 430/557; 430/599; 430/600; 430/603

(58) Field of Classification Search ..... 430/502–503, 430/506, 543, 556–557, 567, 599–600, 603, 430/505

See application file for complete search history.

(56) References Cited

U.S. PATENT DOCUMENTS

| | | | | |
|---|---|---|---|---|
| 3,297,446 | A | 1/1967 | Dunn | |
| 3,297,447 | A | 1/1967 | McVeigh | |
| 5,284,743 | A | 2/1994 | Ohshima et al. | |
| 5,415,991 | A | 5/1995 | Kase et al. | |
| 5,783,373 | A | 7/1998 | Mydlarz et al. | |
| 5,783,378 | A | 7/1998 | Mydlarz et al. | |
| 7,220,537 | B2 * | 5/2007 | Kondo et al. | 430/599 |
| 2003/0203328 | A1 * | 10/2003 | Murakami et al. | 430/567 |

FOREIGN PATENT DOCUMENTS

| | | | |
|---|---|---|---|
| DE | 196 17 767 | A1 | 10/1997 |
| EP | 1 174 760 | A2 | 1/2002 |
| EP | 1 180 723 | A2 | 2/2002 |
| EP | 1 376 223 | A2 | 1/2004 |
| GB | 1 527 435 | | 10/1978 |
| JP | 57-22090 | | 5/1982 |
| JP | 4-335336 | | 11/1992 |
| JP | 4-335338 | | 11/1992 |
| JP | 4-335348 | | 11/1992 |
| JP | 6-308652 | | 11/1994 |
| JP | 7-34103 | | 4/1995 |
| JP | 8-62764 | | 3/1996 |
| JP | 10-186601 | | 7/1998 |
| JP | 2000-89421 | | 3/2000 |
| JP | 2000-352792 | | 12/2000 |
| JP | 2001-343719 | | 12/2001 |
| JP | 2001-343719 | A | 12/2001 |
| JP | 2003-287838 | | 10/2003 |
| JP | 2003-287838 | A | 10/2003 |
| JP | 2004-4144 | | 1/2004 |
| JP | 2004-004144 | A | 1/2004 |
| JP | 2004-170923 | | 6/2004 |
| JP | 2004-347981 | | 12/2004 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material having, on a support, at least one red-sensitive silver halide emulsion layer, at least one green-sensitive silver halide emulsion layer and at least one blue-sensitive silver halide emulsion layer, characterized in that at least one of the silver halide emulsion layers contains a silver halide emulsion having a silver chloride content of 90 mole % or above, the silver halide emulsion contains at least one kind of selenium compound, and the silver halide emulsion layer containing the silver halide emulsion has a characteristic curve satisfying the following relation (1);

$$2.0 \geqq \gamma_H/\gamma_L \geqq 0.5 \qquad \text{Relation (1)}$$

wherein $\gamma$ represents a gradient of the characteristic curve, $\gamma_H$ represents a gradient in the case of $1\times10^{-6}$-second exposure and $\gamma_L$ represents a gradient in the case of 100-second exposure.

10 Claims, No Drawings

SILVER HALIDE COLOR PHOTOGRAPHIC LIGHT-SENSITIVE MATERIAL

TECHNICAL FIELD

The present invention relates to a silver halide color photographic light-sensitive material. More specifically, the present invention relates to a silver halide color photographic light-sensitive material for prints that can ensure high contrast when it is subjected to high illumination intensity exposure, and that is suitable for a digital exposure system, and further to a silver halide color photographic light-sensitive material for prints that is suitable for rapid processing, and that can provide a white background of high quality.

In addition, the present invention relates to a silver halide color photographic light-sensitive material excellently suitable for rapid processing, and further to a silver halide color photographic light-sensitive material that undergoes minute performance changes by fluctuation for processing conditions.

Furthermore, the present invention relates to a silver halide color photographic light-sensitive material suitable for digital exposure and rapid processing, and particularly to a silver halide color photographic light-sensitive material that has high sensitivity; that can reproduce high-saturation colors and high gray densities, and that can ensure unevenness reduction.

In addition, the present invention relates to a silver halide color photographic light-sensitive material that can provide high-quality images in rapid processing.

BACKGROUND ART

Silver halide photographic light-sensitive materials, which are also referred to as silver halide photographic materials, hereinafter, have so far been widely used as materials capable of providing images of high and consistent quality at low prices. Recent years have also seen progress of digitization at an accelerated pace in the field of color prints utilizing silver halide color photographic materials. For instance, widespread usage of digital exposure, typified by laser scanning exposure, has grown dramatically, in contrast to traditional analog exposure, by which direct printing from processed color negative films is performed via a color printer. Digital exposure features image processing that permits production of high-quality prints, and it plays an important role in improving qualities of prints utilizing silver halide color photographic materials. As digital camera penetration increases, it also becomes an important factor for high-quality color prints to be easily obtained from electronic recording materials. Under these circumstances, digital exposure is expected to come into wider use.

On the other hand, printing technologies, including inkjet printing, dye-sublimation printing, and color xerography, have made respective strides to be at a level of producing photographic print quality, and they are on their way to being recognized as color print systems. Of these competing print systems, the print system that combines silver halide color photographic materials and digital exposure provides advantages in high image quality, high productivity, and guarantee of high fastness for images. Therefore, it is desired to expand these advantages and to offer high-quality print services at low prices in a short time.

For instance, if it becomes possible to offer one-stop service of color prints, such that a recording medium bearing data taken by a digital camera is received over the counter, printing from the recording medium is finished in a short turnaround time, on the order of several minutes, and the recording medium is returned together with prints of high quality, then, color prints using silver halide color photographic materials can gain higher superiority than ever. In addition, if rapid processing suitability of silver halide color photographic materials is further improved, processing devices can be downsized, to result in production of printing equipment having high productivity while being compact and inexpensive, and it can be expected that one-stop service of color prints will become increasingly pervasive.

In addition, requirements for curtailments and speeding up of processing processes have grown in recent years. The purpose of these requirements is to further enhance high productivity, which is one point of superiority of the print production system using color photographic paper over other color print systems, such as inkjet and dye-sublimation systems.

Therefore, it is necessary to study silver halide color photographic materials from various viewpoints, including viewpoints of reducing the exposure time, reducing the time lapse between the end of exposure and the start of development (so-called latent-image time), reducing the processing time, and reducing the drying time after processing. For reductions in those individual times, various suggestions have been made until now.

Silver halide emulsions incorporated in silver halide color printing photographic materials are required to meet various requirements as mentioned above. As to halide composition, silver halide emulsions having high silver chloride contents (also referred to as "silver-chloride-rich emulsions") are adopted in response to the rapid processing requirement. Further, it is known that the development speed is increased by reducing the size of emulsion grains (also referred to as "grain diameter") contained in a silver halide emulsion, and techniques relating thereto are already disclosed (See, e.g., abstracts of papers read at The 2004 Autumn Convention of The Society of Photographic Science and Technology of Japan, (pages 20-21)). However, reducing the size of emulsion grains also causes a drop in sensitivity, which causes the problem that the sensitivity necessary for digital exposure cannot be attained. This being the case, techniques for increasing sensitivities of silver-chloride-rich emulsions have been required.

In recent years, arts of increasing sensitivities of photograph-taking color photosensitive materials by using selenium (Se) compounds for chemical sensitization have been widely known and adopted. However, it has also been known that the use of selenium compounds is liable to cause an increase in fogging, so techniques for improving this situation have also been-studied.

In the case of color negative films as recording materials, however, an increase in fogging can be corrected substantially as part of mask density at the time of printing, even when the fogging of silver halide emulsions is somewhat increased. With color reversal films also serving as viewing materials, on the other hand, the fogging of silver halide emulsions results in a lowering of the maximum density (Dmax), on account of the image formation method adopted therein, so a little change becomes substantially insignificant.

In contrast to the above cases, an increase in fogging of silver halide emulsions results in color stains on a white background area, in the case of color printing photographic materials, typified by color paper, and so it becomes a significant defect. Even a slight increase in fogging results in fatal quality loss. In other words, it is required for color printing photographic materials to ensure a good-quality white background not only immediately after production but also after prolonged storage. Likewise, it is required for them to cause no increase in fogging even when subjected to rapid processing. Therefore, antifogging requirements become very severe when selenium compounds are used in silver-chloride-rich emulsions intended for use in silver halide color printing photographic materials.

Since silver iodobromide emulsions are exclusively used in photograph-taking color photosensitive materials, antifogging techniques in the case of using selenium compounds are also limited to the technical disclosures in the region of those emulsions. Further, these techniques are insufficient to meet the aforesaid severe requirements.

Very recently, techniques to attain compatibility between digital exposure and rapid processing, in the case of using a silver-chloride-rich emulsion and a selenium compound, have been studied. A technique for providing emulsions that can ensure high sensitivity and high contrast when they are subjected to high illumination intensity exposure or laser scanning exposure, as well as reduced fogging and an excellent white background even with rapid processing, is disclosed in JP-A-2003-287838 ("JP-A" means unexamined published Japanese patent application). While this reference demonstrates the effect of making improvement in photographic fog immediately after the production of silver halide color photographic materials, it makes no mention of improving storability on the assumption that the sensitive material would undergo changes by aging. Further, it has a description of gradations in the cases of 10-second exposure and $10^{-4}$-second exposure, but they are expressed in relative values to a standard sample. Accordingly, the present invention cannot be anticipated by that description.

Although JP-A-4-335336 and JP-A-4-335338 describe gradations in the cases of 10-second exposure and $10^{-2}$-second exposure, the concerns of their technical disclosures are improvements in pressure characteristic and latent-image storability, respectively, and they do not mention fogging.

JP-A-6-308652 relates to improvements in storability, and discloses the art of reducing photographic fog that develops with aging. Although laser scanning exposure is described therein, its influences on gradation are not clarified. In addition, mention is made of rapid processing, but no disclosure is made in the Examples.

Silver halide emulsions used in color photographic printing paper are silver halide emulsions with high silver chloride contents to meet demands for rapid processing. While photosensitive materials with high silver chloride contents are advantageous to rapid processing in particular, they have disadvantages of low sensitivity and difficulty in both chemical sensitization and spectral sensitization, their sensitivities attained are labile, and they tend to bring about photographic fog. In addition, it is known that the rapid processing suitability can be further enhanced by use of silver halide emulsions having small grain sizes. As to spectrally sensitized emulsions, however, their sensitivities are proportional to the surface areas of silver halide grains, so reduction in grain size of silver halide results in a significant drop in sensitivity. Accordingly, further increase in sensitivity is required to enhance rapid processing suitability.

To improve high illumination intensity failure of a silver chloride emulsion and attain hard gradation under high illumination intensity, it is known to dope the emulsion with iridium. However, an iridium-doped silver chloride emulsion is known to undergo latent-image sensitization in a short time after exposure, and JP-B-7-34103 ("JP-B" means examined Japanese patent publication) discloses that the problem of latent-image sensitization is solved by preparing localized phases having high silver bromide contents, and doping them with iridium. Although the silver halide emulsions prepared according to such a method can provide high sensitivity and hard gradation and avoid causing the problem of latent-image sensitization even when they undergo exposure with relatively high illumination intensity for a time on the order of 1/100 second, it has been discovered that they caused a problem of reducing their tendency toward hard gradation, in the case of aiming to retain high sensitivities up to the level of 1μ-second ultrahigh illumination intensity exposure required in digital exposure systems utilizing laser scanning exposure.

U.S. Pat. Nos. 5,783,373 and 5,783,378 disclose a method of gradation hardening in which at least three kinds of dopants are used to reduce high illumination intensity failure. However, hard graduation is obtained because of using a dopant having functions of desensitization and hard graduation. Accordingly, this method is incompatible fundamentally with enhancement in sensitivity.

As mentioned above, further increase in sensitivity is required for color photographic printing paper also. To increase the sensitivities of silver-chloride-rich emulsions, various improvements in chemical sensitization methods and methods of forming silver halide emulsion grains have been made. As typical methods for chemical sensitization of silver halide emulsions, various sensitization methods, including sulfur sensitization, selenium sensitization, tellurium sensitization, sensitizations using precious metals such as gold, reduction sensitization, and combinations of these sensitizations, have been developed.

To mention selenium sensitization, in particular, of those sensitization methods, it is known that selenocarboxylic acid esters, i.e. seleno esters, are usable as selenium sensitizers (e.g. in U.S. Pat. Nos. 3,297,446 and 3,297,447, and JP-B-57-22090). Generally speaking, selenium sensitization produces a greater sensitization effect than sulfur sensitization carried out in the photographic industry, but it brings about a great degree of fogging and tends to enhance soft gradation. Therefore, selenium sensitization has been unsuitable for color photographic printing paper.

Most of the patents hitherto disclosed, though instrumental in improving such defects, do not deal with the problem of fogging associated with variations in processing factors. Laboratories on the market are not always under satisfactory processing-solution management, and sometimes photographic processing is performed under situations in which the replenishment rate, pH setting, processing temperature, and washing condition deviate from their respective correct values. When selenium sensitization, in particular, is applied, there occurs a serious problem that changes in processing temperature and processing pH, as well as the mixing of a bleach-fix solution into a color developer, tend to cause variations in fogging, and the qualities of finished photographs are dependent to great degrees on them.

An important property required for color photographic printing paper to ensure high-quality color prints is the ability to reproduce not only colors with high saturation and reduced dullness but also higher gray densities. High saturation of reproduced colors makes it possible to express vivid color tones, and reproduction of high gray densities makes it possible to express extended perspective images. As long as color photographic printing paper has the ability to reproduce colors with reduced dullness and high saturation, colors lower in saturation can be produced via image processing on a computer. Conversely, colors higher in saturation cannot be reproduced if color photographic printing paper does not have the ability to reproduce colors higher in saturation. Since gray images are produced by simultaneous development of yellow, magenta, and cyan colors, it becomes possible to reproduce higher gray densities by heightening every developed color density.

Our study found that, although application of selenium sensitization certainly increased the sensitivity under rapid processing, in some cases streaky unevenness showed up in prints obtained, or color saturation is lowered, or gray densities were lowered.

In color photographic printing paper, use of silver halide emulsions least susceptible to fogging is suitable for expressing white color beautifully. Although there may be cases in which selenium sensitization exhibits a greater sensitization effect than the sulfur sensitization carried out in the photographic industry, selenium sensitization was unsuitable for color photographic printing paper, because it caused a considerable degree of fogging and was apt to enhance soft gradation. In addition, the combined use of selenium sensitization and gold sensitization results in a remarkable sensitivity increase, but at the same time, it causes a great rise in fogging and soft gradation enhancement. As such, it has been desired intensely to develop selenium sensitization capable of ensuring fog reduction and hard gradation.

In still more rapid processing, which has been urgently required in recent years, imparting rapid processing suitability to photosensitive materials tends to cause dullness in developed colors. In addition, there has been a strong request for running processing suitability. As such, further improvements in these abilities have been intensely desired.

In the case of processing a great many sheets of photosensitive material, the first sheet and the last sheet are required to have equivalent print quality. On the other hand, selenium sensitization of photosensitive materials occasionally causes a problem of print reproducibility, or running processing suitability. As such, it becomes necessary to improve the running processing suitability.

Depending on the type of yellow coupler that is used, there may be cases in which a sensitivity difference is caused by the difference in the emulsion-making scale (which is an indication of the amount of an emulsion made and expressed in silver content therein, in moles). In general, there is apprehension that the sensitivity difference caused by a difference in the emulsion-making scale gives rise to a difference in print reproducibility.

Other and further features and advantages of the invention will appear more fully from the following description.

DISCLOSURE OF INVENTION

According to the present invention, there is provided the following means;

(1) A silver halide color photographic light-sensitive material having, on a support, at least one red-sensitive silver halide emulsion layer, at least one green-sensitive silver halide emulsion layer and at least one blue-sensitive silver halide emulsion layer, characterized in that at least one of the silver halide emulsion layers contains a silver halide emulsion having a silver chloride content of 90 mole % or above, the silver halide emulsion contains at least one kind of selenium compound, and the silver halide emulsion layer containing the silver halide emulsion has a characteristic curve satisfying the following relation (1);

$$2.0 \geqq \gamma_H/\gamma_L \geqq 0.5 \qquad \text{Relation (1)}$$

wherein $\gamma$ represents a gradient of the characteristic curve, $\gamma_H$ represents a gradient in the case of $1\times10^{-6}$-second exposure and $\gamma_L$ represents a gradient in the case of 100-second exposure.

(2) The silver halide color photographic light-sensitive material according to the above item (1), wherein the silver halide emulsion containing the selenium compound further contains at least one metal complex represented by the following formula (D1);

$$[M^{D1}X^{D1}_{n1}L^{D1}_{(6-n1)}]^{m1} \qquad \text{Formula (D1)}$$

wherein, in formula (D1), $M^{D1}$ represents Cr, Mo, Re, Fe, Ru, Os, Co, Rh, Pd, or Pt; $X^{D1}$ represents a halogen ion; $L^{D1}$ represents a ligand different from $X^{D1}$; $n_1$ represents 3, 4, 5, or 6; and $m_1$ is an electric charge of the metal complex and represents 4−, 3−, 2−, 1−, 0, or 1+; plural $X^{D1}$s may be the same or different; and when plural $L^{D1}$s exist, the plural $L^{D1}$s may be the same or different; provided that the metal complex represented by formula (D1) has no or only one cyano ($CN^-$) ion as a ligand.

(3) The silver halide color photographic light-sensitive material according to the above item (1) or (2), wherein the silver halide emulsion containing the selenium compound further contains at least one metal complex represented by the following formula (D2);

$$[IrX^{D2}_{n2}L^{D2}_{(6-n2)}]^{m2} \qquad \text{Formula (D2)}$$

wherein, in formula (D2), $X^{D2}$ represents a halogen ion or a pseudohalogen ion other than a cyanate ion $OCN^-$; $L^{D2}$ represents a ligand different from $X^{D2}$; $n_2$ represents 3, 4, or 5; $m_2$ is an electric charge of the metal complex and represents 4−, 3−, 2−, 1−, 0, or 1+; plural $X^{D2}$s may be the same or different; and when plural $L^{D2}$s exist, the plural $L^{D2}$s may be the same or different.

(4) The silver halide color photographic light-sensitive material according to any one of the above items (1) to (3), wherein the silver halide emulsion containing the selenium compound includes silver halide grains having an average sphere-equivalent grain diameter of 0.65 μm or below.

(5) The silver halide color photographic light-sensitive material according to any one of the above items (1) to (4), wherein a total coating amount of silver is from 0.2 g/m$^2$ to 0.5 g/m$^2$.

(6) The silver halide color photographic light-sensitive material according to any one of the above items (1) to (5), wherein a total coating amount of gelatin is from 3 g/m$^2$ to 6 g/m$^2$.

(7) A silver halide color photographic light-sensitive material having, on a support, photographic constituent layers including at least one cyan-dye-forming-coupler-containing silver halide emulsion layer, at least one magenta-dye-forming-coupler-containing silver halide emulsion layer, at least one yellow-dye-forming-coupler-containing silver halide emulsion layer and at least one light-insensitive hydrophilic colloid layer, characterized in that a coating amount of total silver in the photographic constituent layers is 0.5 g/m$^2$ or below, at least one of the silver halide emulsion layers contains a silver halide emulsion having a selenium-sensitized silver chloride content of 90 mole % or above, and at least one of the yellow-dye-forming-coupler-containing silver halide emulsion layers contains at least one of couplers represented by the following formula (Y);

Formula (Y)

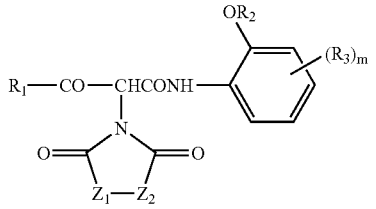

wherein $R_1$ represents an alkyl group or a cycloalkyl group; $R_2$ represents an alkyl group, a cycloalkyl group, an acyl group or an aryl group; $R_3$ represents a hydrogen atom, a halogen atom, an alkyl group, an alkoxy group, an aryloxy group, an alkoxycarbonyl group, an alkylsulfonyl group, an alkylcarbamoyl group, an arylcarbamoyl group, an alkylsulfamoyl group, an arylsulfamoyl group, an alkylcarbonamido group, an alkylsulfonamido group, an arylsulfonamido group, a sulfamoyl group or an imido group; m represents an integer of 0 or 1 to 4; $Z_1$ represents —O— or —$NR_A$—; and $Z_2$ represents —$NR_B$— or —$C(R_C)R_D$—, wherein $R_A$, $R_B$, $R_C$ and $R_D$ each independently represent a hydrogen atom or a substituent.

(8) A silver halide color photographic light-sensitive material having, on a support, photographic constituent layers including at least one cyan-dye-forming-coupler-containing silver halide emulsion layer, at least one magenta-dye-forming-coupler-containing silver halide emulsion layer, at least one yellow-dye-forming-coupler-containing silver halide emulsion layer and at least one light-insensitive hydrophilic colloid layer, characterized in that a coating amount of total silver in the photographic constituent layers is 0.5 g/$m^2$ or below and at least one of the silver halide emulsion layers contains (1) a silver halide emulsion having a selenium-sensitized silver chloride content of 90 mole % or above and (2) a crown ether fused with at least one aromatic ring.

(9) A silver halide color photographic light-sensitive material having, on a support, photographic constituent layers including at least one cyan-dye-forming-coupler-containing silver halide emulsion layer, at least one magenta-dye-forming-coupler-containing silver halide emulsion layer, at least one yellow-dye-forming-coupler-containing silver halide emulsion layer and at least one light-insensitive hydrophilic colloid layer, characterized in that a coating amount of total silver in the photographic constituent layers is 0.5 g/$m^2$ or below, at least one of the silver halide emulsion layers contains (1) a silver halide emulsion having a selenium-sensitized silver chloride content of 90 mole % or above and (2) a crown ether fused with at least one aromatic ring, and besides, at least one of the yellow-dye-forming-coupler-containing silver halide emulsion layers contains at least one of couplers represented by the foregoing formula (Y).

(10) The silver halide color photographic light-sensitive material according to any one of the above items (7) to (9), wherein the selenium-sensitized silver halide emulsion further contains at least two types of compounds having oxidizing action on clusters of metal silver.

(11) The silver halide color photographic light-sensitive material according to any one of the above items (7) to (10), wherein a coating amount of total gelatin is from 3 g/$m^2$ to 6 g/$m^2$.

(12) The silver halide color. photographic light-sensitive material as according to any one of the above items (7) to (11), wherein silver halide grains of the selenium-sensitized silver halide emulsion have an average sphere-equivalent diameter of 0.60 μm or below.

(13) A silver halide color photographic light-sensitive material having, on a reflective support, at least one cyan-dye-forming-coupler-containing silver halide emulsion layer, at least one magenta-dye-forming-coupler-containing silver halide emulsion layer and at least one yellow-dye-forming-coupler-containing silver halide emulsion layer, characterized in that at least one of the dye-forming-coupler-containing silver halide emulsion layers contains a silver halide emulsion having a selenium-sensitized silver chloride content of 90 mole % or above; maximum density of developed yellow color (DYmax) attained by subjecting only the silver halide emulsion in the yellow-dye-forming-coupler-containing layer to $1\times10^{-4}$-second exposure and then to color-development processing is from 1.90 to 2.30; maximum density of developed magenta color (DMmax) attained by subjecting only the silver halide emulsion layer in the magenta-dye-forming-coupler-containing layer to $1\times10^{-4}$-second exposure and then to color-development processing is from 1.95 to 2.30; maximum density of developed cyan color (DCmax) attained by subjecting only the silver halide emulsion in the cyan-dye-forming-coupler-containing layer to $1\times10^{-4}$-second exposure and then to color-development processing is from 1.85 to 2.40; maximum density of developed yellow color (DGYmax), maximum density of developed magenta color (DGMmax) and maximum density of developed cyan color (DGCmax) attained by sensitizing all the dye-forming-coupler-containing silver halide emulsion layers under $1\times10^{-4}$-second exposure and then subjecting them to color-development processing are from 2.10 to 2.40, from 2.30 to 2.70 and from 2.10 to 2.45, respectively; and the photographic light-sensitive material has a curling degree of −15 to +15 at a temperature of 25° C. and a relative humidity of 20%.

(14) The silver halide color photographic light-sensitive material according to the above item (13), wherein the cyan-dye-forming coupler, the magenta-dye-forming coupler and the yellow-dye-forming coupler amount to a sum of 1.1 g/$m^2$ or below.

(15) The silver halide color photographic light-sensitive material according to the above item (13) or (14), wherein the selenium-sensitized silver halide emulsion is chemically sensitized with a selenium sensitizer represented by the following formula (SE1);

Formula (SE1)

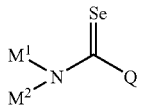

wherein, in formula (SE1), $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group or a carbamoyl group; Q represents an alkyl group, an alkenyl group, an alkynyl group, an aryl group, a heterocyclic group, $OM^3$, or $NM^4M^5$; $M^3$, $M^4$ and $M^5$ each independently represent a hydrogen atom, an alkyl group, an alkenyl group, an alkynyl group, an aryl group or a heterocyclic group; and any two groups of $M^1$, $M^2$ and Q may bond together, to form a cyclic structure.

(16) The silver halide color photographic light-sensitive material according to the above item (13) or (14), wherein the selenium-sensitized silver halide emulsion is chemically sensitized with a selenium sensitizer represented by the following formula (SE2);

Formula (SE2)

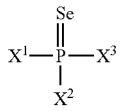

wherein, $X^1$, $X^2$ and $X^3$ each independently represent an alkyl group, an alkenyl group, an alkynyl group, an aryl group, a heterocyclic group, $OJ^1$, or $NJ^2J^3$; and $J^1$, $J^2$ and $J^3$ each independently represent a hydrogen atom, an alkyl group, an alkenyl group, an alkynyl group, an aryl group or a heterocyclic group.

(17) The silver halide color photographic light-sensitive material according to the above item (13) or (14), wherein the selenium-sensitized silver halide emulsion is chemically sensitized with a selenium sensitizer represented by the following formula (SE3);

$E^1$-Se-$E^2$ Formula (SE3)

wherein $E^1$ and $E^2$, which may be the same or different, each represent an alkyl group, an alkenyl group, an alkynyl group, an aryl group, a heterocyclic group, an acyl group, an alkoxycarbonyl group, an aryloxycarbonyl group or a carbamoyl group.

(18) The silver halide color photographic light-sensitive material according to the above item (13) or (14), wherein the selenium-sensitized silver halide emulsion is chemically sensitized with any of selenium sensitizers represented by the following formulae (PF1) to (PF6).

Formula (PF1)

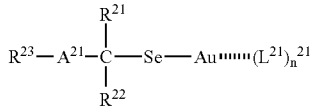

Formula (PF2)

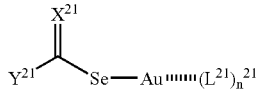

Formula (PF3)

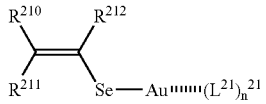

Formula (PF4)

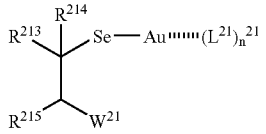

Formula (PF5)

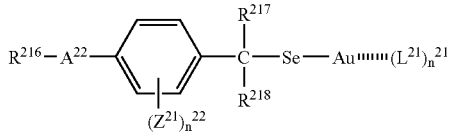

-continued

Formula (PF6)

$[Q^{21}\text{-}Au\text{-}(Q^{22})_{n^{23}}]\ J^{21}$ wherein, in formula (PF1), $L^{21}$ represents a compound capable of coordinating with gold via an N atom, an S atom, an Se atom, a Te atom or a P atom; $n^{21}$ represents 0 or 1; $A^{21}$ represents O, S or $NR^{24}$; $R^{21}$ to $R^{24}$ each represent a hydrogen atom or a substituent; and $R^{23}$ may form a 5- to 7-membered ring together with $R^{21}$ or $R^{22}$;

wherein, in formula (PF2), $L^{21}$ represents a compound capable of coordinating with gold via an N atom, an S atom, an Se atom, a Te atom or a P atom; $n^{21}$ represents 0 or 1; $X^{21}$ represents O, S or $NR^{25}$; $Y^{21}$ represents an alkyl group, an alkenyl group, an alkynyl group, an aryl group, a hetero ring group, $OR^{26}$, $SR^{27}$, or $N(R^{28})R^{29}$; $R^{25}$ to $R^{29}$ each represent a hydrogen atom, an alkyl group, an alkenyl group, an alkynyl group, an aryl group or a hetero ring group; and $X^{21}$ and $Y^{21}$ may be bound to each other to form a ring;

wherein, in formula (PF3), $L^{21}$ represents a compound capable of coordinating with gold via an N atom, an S atom, an Se atom, a Te atom or a P atom; $n^{21}$ represents 0 or 1; $R^{210}$, $R^{211}$ and $R^{212}$ each independently represent a hydrogen atom or a substituent, at least one of $R^{210}$ and $R^{211}$ represents an electron attractive group;

wherein, in formula (PF4), $L^{21}$ represents a compound capable of coordinating with gold via an N atom, an S atom, an Se atom, a Te atom or a P atom; $n^{21}$ represents 0 or 1; $W^{21}$ represents an electron attractive group; and $R^{213}$ to $R^{215}$ each represent a hydrogen atom or a substituent, with $W^{21}$ and $R^{213}$ optionally being bound to each other to form a cyclic structure;

wherein, in formula (PF5), $L^{21}$ represents a compound capable of coordinating with gold via an N atom, an S atom, an Se atom, a Te atom or a P atom; $n^{21}$ represents 0 or 1; $A^{22}$ represents O, S, Se, Te or $NR^{219}$; $R^{216}$ represents a hydrogen atom, an alkyl group, an alkenyl group, an alkynyl group, an aryl group, a hetero ring group or acyl group; $R^{217}$ to $R^{219}$ each represent a hydrogen atom, an alkyl group, an alkenyl group, an alkynyl group, an aryl group or a hetero ring group; $Z^{21}$ represents a substituent; $n^{22}$ represents an integer of from 0 to 4; and when $n^{22}$ is 2 or more, $Z^{21}$ may be the same or different from each other;

wherein, in formula (PF6), $Q^{21}$ and $Q^{22}$ represent compounds selected from among the selenium sensitizers of the formulae (SE1) to (SE3), the selenium atoms in $Q^{21}$ and $Q^{22}$ form coordinate bonds together with Au; $n^{23}$ represents 0 or 1; and $J^{21}$ represents a counter anion; when $n^{23}$ is 1, $Q^{21}$ and $Q^{22}$ may be the same or different; provided that the compounds represented by the formula (PF6) do not include the compounds represented by any of the formulae (PF1) to (PF5).

(19) The silver halide color photographic light-sensitive material according to any one of the above items (13) to (18), wherein silver halide grains of the selenium-sensitized silver halide emulsion have an average sphere-equivalent diameter of 0.60 μm or below.

(20) The silver halide color photographic light-sensitive material according to any one of the above items (13) to (19), wherein a coating amount of total silver is from 0.2 g/m$^2$ to 0.5 g/m$^2$.

(21) A silver halide color photographic light-sensitive material having, on a support, at least one cyan-dye-forming-coupler-containing silver halide emulsion layer, at least one magenta-dye-forming-coupler-containing silver halide emulsion layer and at least one yellow-dye-forming-coupler-containing silver halide emulsion layer, characterized in that at least one of the yellow-dye-forming-coupler-containing silver halide emulsion layers contains (1) a silver halide emulsion having a selenium-sensitized silver chloride content of 90 mole % or above, and containing silver halide grains having an average sphere-equivalent diameter of 0.75 μm or below, and (2) at least one of yellow-dye-forming couplers represented by the following formula (Y), and the silver halide color photographic light-sensitive material satisfies a condition (a).

Formula (Y)

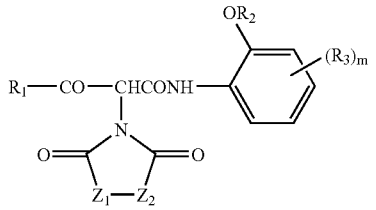

wherein $R_1$ represents an alkyl group or a cycloalkyl group; $R_2$ represents an alkyl group, a cycloalkyl group, an acyl group or an aryl group; $R_3$ represents a hydrogen atom, a halogen atom, an alkyl group, an alkoxy group, an aryloxy group, an alkoxycarbonyl group, an alkylsulfonyl group, an alkylcarbamoyl group, an arylcarbamoyl group, an alkylsulfamoyl group, an arylsulfamoyl group, an alkylcarbonamido group, an alkylsulfonamido group, an arylsulfonamido group, a sulfamoyl group or an imido group; m represents an integer of 0 or 1 to 4; $Z_1$ represents —O— or —$NR_A$—; and $Z_2$ represents —$NR_B$— or —$C(R_C)R_D$—, wherein $R_A$, $R_B$, $R_C$ and $R_D$ each independently represent a hydrogen atom or a substituent;

Condition (a): at least one peak in its spectral sensitivity distribution is in a range of 450 to 490 nm and a difference between exposure wavelengths on long-wavelength and short-wavelength sides which provide 70% of the sensitivity at the peak in the spectral sensitivity distribution is from 20 nm to 100 nm.

(22) The silver halide color photographic light-sensitive material according to the above item (21), wherein at least one sensitizing dye represented by the following formula (II) is incorporated;

Formula (II)

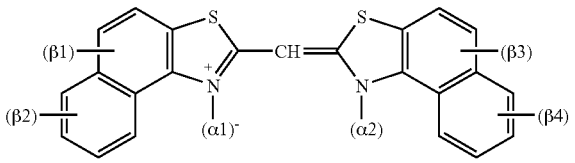

wherein α1, α2 and β1 to β4 each represent a hydrogen atom, an alkyl group, an alkenyl group, an alkynyl group, an aryl group, a heterocyclic group, an acyl group, an amino group, an alkoxy group, a hydroxyl group or a carbamoyl group, and each of these groups may be substituted.

(23) The silver halide color photographic light-sensitive material according to the above item (21) or (22), having a curling degree of −15 to +15 at a temperature of 25° C. and a relative humidity of 20%.

(24) The silver halide color photographic light-sensitive material according to any one of the above items (21) to (23), wherein at least one of the cyan-dye-forming-coupler-containing silver halide emulsion layers, and/or at least one of the magenta-dye-forming-coupler-containing silver halide emulsion layers contain a silver halide emulsion having a selenium-sensitized silver chloride content of 90 mole % or more, and containing silver halide grains having an average sphere-equivalent diameter of 0.50 μm or below.

Hereinafter, a first embodiment of the present invention means to include the silver halide color photographic light-sensitive materials described in the above items (1) to (6).

A second embodiment of the present invention means to include the silver halide color photographic light-sensitive materials described in the above items (7) to (12).

A third embodiment of the present invention means to include the silver halide color photographic light-sensitive materials described in the above items (13) to (20).

A fourth embodiment of the present invention means to include the silver halide color photographic light-sensitive materials described in the above items (21) to (24).

Herein, the present invention means to include all of the above first, second, third and fourth embodiments, unless otherwise specified.

BEST MODE FOR CARRYING OUT THE INVENTION

The present invention is described below in detail.

In the present invention, e.g., in the first embodiment of the present invention, γ stands for a gradient of a characteristic curve, and it is defined as follows. In a usual manner, each color-sensitive silver halide emulsion layer is subjected to their individual color-separation exposures and, after a lapse of 30 minutes, they are subjected to color-development processing. Then, density measurements are carried out in spectral ranges corresponding to developed color hues of the individual layers, thereby plotting characteristic curves.

In the case of general color paper, light exposure is applied to the blue-sensitive emulsion layer, the green-sensitive emulsion layer or the red-sensitive emulsion layer via an SP-1 filter, an SP-2 filter or an SP-3 filter (trade name, made by Fuji Photo Film Co., Ltd.), respectively. In other words, the so-called blue-separation exposure, green-separation exposure and red-separation exposure are each applied to color paper independently. The thus exposed color paper is let stand for 30 minutes, and then subjected to color-development processing. Reflection densities of each of yellow, magenta and cyan images formed therein are measured with an optical densitometer, and a characteristic curve of images of each color is prepared by plotting the density data obtained, with reflection density (D) as ordinate and exposure amount expressed in a logarithmic scale (logE) as abscissa. Herein, yellow images are associated with the characteristic curve of the blue-sensitive emulsion layer, magenta images are associated with the characteristic curve of the green-sensitive emulsion layer, and cyan images are associated with the characteristic curve of the red-sensitive emulsion layer.

In each of the characteristic curves plotted, a minimum density (Dmin) corresponding to an unexposed portion is defined as photographic fog. In addition, a reciprocal of an exposure amount at a point A providing the density of 0.5 is defined as sensitivity S. Further, a point providing the density of 1.5 is termed B, and a slope of a straight line that links the two points A and B is defined as gradient γ. As to the exposure, 100-second exposure and $1\times10^{-6}$-second exposure are performed, and γ and S values determined under the former exposure condition are termed $\gamma_L$ and $S_L$, while those determined under the latter exposure condition are termed $\gamma_H$ and $S_H$.

In each of silver halide color photographic materials of the present invention, preferably in the first embodiment of the invention, it is desirable that at least one of the silver halide emulsion layers contains a silver halide emulsion having a silver chloride content of 90 mole % or above, and that this silver halide emulsion contains at least one kind of selenium compound, and a characteristic curve of the silver halide emulsion layer containing the aforesaid silver halide emulsion satisfy the following relation (1):

$$2.0 \geqq \gamma_H/\gamma_L \geqq 0.5. \qquad \text{Relation (1)}$$

When $\gamma_H/\gamma_L$ is out of this range, an increase in photographic fog, a drop in sensitivity, enhancement of soft gradation or deterioration in storability occurs, so there may be cases where the present invention cannot achieve its effects. The value $\gamma_H/\gamma_L$ is preferably 0.75 or above, far preferably 0.95 or above, particularly preferably 1.05 or above. In addition, the value $\gamma_H/\gamma_L$ is preferably 1.8 or below, far preferably 1.6 or below.

In the first embodiment of the present invention, the silver halide emulsion used in the photographic material contains specific silver halide grains, and the silver halide grains have no particular restriction as to their shapes. It is, however, preferable that the grains are made up of cubic or tetradecahedral crystal grains having substantially {100} faces, (these may be round in their vertexes and may have higher-order planes), octahedral crystal grains, or tabular grains having principal faces formed of {100} faces or {111} faces and an aspect ratio of 3 or more. The term "aspect ratio" as used herein refers to the value obtained by dividing the diameter of a circle equivalent to the projected area of a grain by the gain thickness.

In the first embodiment of the present invention, the structure of the silver halide grains is preferably cubic or tetradecahedral crystal grains having substantially {100} faces.

The silver halide photographic material of the first embodiment of the present invention is required to contain a specific emulsion in at least one of the silver halide emulsion layers thereof. The term specific emulsion refers to the silver halide emulsion having a silver chloride content of 90 mole % or above and containing at least one kind of selenium compound.

In the first embodiment of the present invention, the silver chloride content of the specific silver halide emulsion is required to 90 mol % or more, and is preferably 94 mol % or more from the viewpoint of rapid processing suitability. The silver bromide content is preferably 0.1 to 8 mol %, more preferably 0.5 to 6 mol %, from the viewpoints of high sensitivity and hard graduation. The silver iodide content is preferably 0.02 to 1 mole %, more preferably 0.05 to 0.50 mole %, and most preferably 0.07 to 0.40 mole %, from viewpoints of obtaining high sensitivity and hard gradation in high illumination intensity. In the first embodiment of the present invention, the specific silver halide grains are preferably silver iodobromochloride grains, particularly preferably silver iodobromochloride grains having halide compositions as recited above.

The silver halide grains in the specific silver halide emulsion for use in the first embodiment of the present invention, each preferably have a silver bromide-containing phase and/or a silver iodide-containing phase. Herein, the term "silver bromide-containing phrase" or "silver iodide-containing phase" means a region where the content of silver bromide or silver iodide is higher than that in the surrounding regions. The halogen compositions of the silver bromide-containing phase or the silver iodide-containing phase and of the surrounding region (outer periphery) may vary either continuously or drastically. Such a silver bromide-containing phase or silver iodide-containing phase may form a layer which has an approximately constant concentration in a certain width at a portion in the grain, or it may form a maximum point having no spread. The local silver bromide content in the silver bromide-containing phase is preferably 5 mol % or more, more preferably from 10 to 80 mol %, and most preferably from 15 to 50 mol %. The local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form within the grain, and the phases may have different silver bromide or silver iodide contents from each other, but the silver halide grain for use in the present invention is required to contain both of at least one silver bromide-containing phase and at least one silver iodide-containing phase.

It is important that the silver bromide-containing phase or silver iodide-containing phase that the silver halide grains in the specific silver halide emulsion for use in the first embodiment of the present invention have, are each formed in the layer form so as to surround the grain center. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or of an edge of the grain can be different from that of a principal face of the grain. Further, aside from the silver bromide-containing phase or silver iodide-containing phase formed in the layer form so as to surround the grain, another silver bromide-containing phase or silver iodide-containing phase not surrounding the grain may exist in isolation at a specific portion of the surface of the grain.

In a case where the silver halide grains in the specific silver halide emulsion for use in the first embodiment of the present invention contains a silver bromide-containing phase, it is preferable that said silver bromide-containing phase be formed in a layer form so as to have a concentration maximum of silver bromide inside the grain. Likewise, in a case where the silver halide emulsion for use in the first embodiment of the present invention contains a silver iodide-containing phase, it is preferable that said silver iodide-containing phase be formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide grain of the silver halide emulsion for use in the first embodiment of the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase be formed more internally than the silver iodide-containing phase. In such a case, another silver bromide-containing phase may be provided further outside the silver iodide-containing phase in the vicinity of the surface of the grain.

A silver bromide content or a silver iodide content necessary for exhibiting the effects of the present invention such as achievement of high sensitivity and realization of hard gradation, each increase with the silver bromide-containing phase or the silver iodide-containing phase being formed in more inside of the grain. This causes the silver chloride content to decrease to more than necessary, resulting in the possibility of impairing rapid processing suitability. Accordingly, to integrate functions of these phases for controlling photographic actions, in the vicinity of the surface of the grain, it is preferred that the silver bromide-containing phase and that the silver iodide-containing phase be placed adjacent to each other. From these points, it is preferred that the silver bromide-containing phase be formed at any of the position ranging from 50% to 100% of the grain volume measured from the inside, and that the silver iodide-containing phase be formed at any of the position ranging from 85% to 100% of the grain volume measured from the inside. Further, it is more preferred that the silver bromide-containing phase be formed at any of the position ranging from 70% to 100% of the grain volume measured from the inside, and that the silver iodide-containing phase be formed at any of the position ranging from 90% to 100% of the grain volume measured from the inside.

In order to introduce bromide ions or iodide ions to make the specific silver halide emulsion for use in the first embodiment of the present invention contain silver bromide or silver iodide, a bromide salt or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The silver halide emulsions in the silver halide color photographic material of the second, third or fourth embodiment of the present invention contains silver halide grains, and the silver halide grains have no particular restriction as to their shapes. It is, however, preferable that the grains are made up of cubic or tetradecahedral crystal grains having substantially {100} faces (these may be round in their vertexes and may have higher-order planes), octahedral crystal grains, or tabular grains having principal faces formed of {100} faces or {111} faces and an aspect ratio of 3 or more. The term "aspect ratio" as used herein refers to the value obtained by dividing the diameter of a circle equivalent to the projected area of a grain by the gain thickness.

In the silver halide color photographic light-sensitive material of the present invention, cubic or tetradecahedral crystal grains are further preferable.

The silver halide emulsions in the second embodiment of the present invention contains silver chloride, and the content of the silver chloride is 90 mole % or above, with the content of total silver halide in the emulsion being taken as 100 mole %. From the viewpoint of rapid processing suitability, the silver chloride content is preferably 93 mole % or above, far preferably 95 mole % or above. Further, the silver chloride is preferably silver chloride selenium-sensitized by use of a selenium sensitizer, such as a selenium compound represented by formulae (SE1) to (SE3), or a gold-selenium compound represented by formulae (PF1) to (PF6). In addition, it is preferable that the silver chloride contained in at least one of the silver halide emulsion layers is selenium-sensitized silver chloride, and it is further preferable that the silver halide contained in every silver halide emulsion layer is selenium-sensitized silver chloride.

In the second embodiment of the present invention, it is preferable that the silver halide emulsion contains silver bromide and/or silver iodide. From the viewpoints of hard gradation and excellent latent-image stability, the silver bromide content is preferably from 0.1 to 7 mole %, further preferably from 0.5 to 5 mole %. The silver iodide content is preferably from 0.02 to 1 mole %, further preferably from 0.05 to 0.50 mole %, particularly preferably from 0.07 to 0.40 mole %, in terms of high sensitivity and high contrast under high illumination intensity exposure.

Further, the silver halide emulsion is preferably a silver iodobromochloride emulsion, further preferably a silver iodobromochloride emulsion having a halide composition as specified above.

In the silver halide emulsion in the silver halide color photographic material of the third embodiment of the present invention, the silver chloride content is required to be 90 mole % or above in order to ensure rapid processing suitability, preferably to be 93 mole % or above, further preferably to be 95 mole % or above. The silver bromide content is preferably from 0.1 to 7 mole %, further preferably from, 0.5 to 5 mole %. The silver iodide content is preferably from 0.02 to 1 mole %, further preferably from 0.05 to 0.50 mole %, especially preferably from 0.07 to 0.40 mole %, in terms of high sensitivity and high contrast under high illumination intensity exposure. The specific silver halide grains in the third embodiment of the present invention are preferably silver iodobromochloride grains, further preferably iodobromochloride grains having a halide composition as specified above.

In the silver halide color photographic material of the fourth embodiment of the present invention, the silver halide emulsion has a silver chloride content of 90 mole % or above, preferably 93 mole % or above, particularly preferably 95 mole % or above, from the viewpoint of rapid processing suitability, when the content of total silver halide is taken as 100 mole %. The composition of silver halide, though may be pure silver chloride, preferably includes minor amounts of different halides, namely a minor amount of silver bromide and/or silver iodide.

In the silver halide color photographic material of the fourth embodiment of the present invention, it is preferable that the silver halide emulsion has a silver-bromide-containing phase and/or a silver-iodide-containing phase. When the silver halide emulsion has a silver-bromide-containing phase, the silver bromide content is preferably from 0.1 to 6 mole %, further preferably from 0.5 to 5 mole %, particularly preferably from 1 to 4 mole %. When the silver halide emulsion has a silver-iodide-containing phase, the silver iodide content is preferably from 0.01 to 1 mole %, further preferably from 0.05 to 0.5 mole %, particularly preferably from 0.1 to 0.4 mole %.

In the present invention, the silver halide grains preferably have a silver bromide-containing phase and/or a silver iodide-containing phase. Herein, the term "a silver bromide- or silver iodide-containing phase" means a region where the content of silver bromide or silver iodide is higher than that in the surrounding regions. The halogen compositions of the silver bromide-containing phase or the silver iodide-containing phase and of the surrounding region (outer periphery) may vary either continuously or drastically. Such a silver bromide-containing phase or silver iodide-containing phase may form a layer which has an approximately constant concentration in a certain width at a portion in the grain, or it may form a maximum point having no spread. The local silver bromide content in the silver bromide-containing phase is preferably 5 mol % or more, more preferably from 10 to 80 mol %, and most preferably from 15 to 50 mol %. The local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form within the grain, and the phases may have different silver bromide or silver iodide contents from each other, but the silver halide grain for use in the present invention is required to contain both of at least one silver bromide-containing phase and at least one silver iodide-containing phase.

In the present invention, when the silver-bromide-containing phase or the silver-iodide-containing phase is incorporated into the silver halide emulsion, it is preferable that the phase takes the form of a layer and surrounds individual grains. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-obtaining phase or silver iodide-containing phase formed in the layer form so as to surround the grain in the vicinity of the grain surface, the silver bromide or silver iodide concentration of a corner portion or of an edge of the grain can be different from that of a principal face of the grain. Further, aside from the silver bromide-containing phase or silver iodide-containing phase formed in the layer form so as to surround the grain, another silver bromide-containing phase or silver iodide-containing phase not surrounding the grain may exist in isolation at a specific portion of the surface of the grain.

In the present invention, in a case where the silver halide emulsion contains a silver bromide-containing phase, it is preferable that said silver bromide-containing phase be formed in a layer form so as to have a concentration maximum of silver bromide inside the grain. Likewise, in a case where the silver halide emulsion in the present invention contains a silver iodide-containing phase, it is preferable that said silver iodide-containing phase be formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

In the present invention, the silver halide emulsion preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase be formed more internally than the silver iodide-containing phase. In such a case, another silver bromide-containing phase may be provided further outside the silver iodide-containing phase in the vicinity of the surface of the grain.

A silver bromide content or a silver iodide content necessary for exhibiting the effects of the present invention such as achievement of high sensitivity and realization of hard gradation, each increase with the silver bromide-containing phase or the silver iodide-containing phase being formed in more inside of the grain. This causes the silver chloride content to decrease to more than necessary, resulting in the possibility of impairing rapid processing suitability. Accordingly, to integrate functions of these silver bromide-or silver iodide-containing phases for controlling photographic actions, in the vicinity of the surface of the grain, it is preferred that the silver bromide-containing phase. Therefore, it is preferred that the silver iodide-containing phase be placed adjacent to each other. From these points, it is preferred that the silver bromide-containing phase be formed at any of the position ranging from 50% to 100% of the grain volume measured from the inside, and that the silver iodide-containing phase be formed at any of the position ranging from 85% to 100% of the grain volume measured from the inside. Further, it is more preferred that the silver bromide-containing phase be formed at any of the position ranging from 70% to 95% of the grain volume measured from the inside, and that the silver iodide-containing phase be formed at any of the position ranging from 90% to 100% of the grain volume measured from the inside.

In the silver halide color photographic material of the present invention, when the silver halide emulsion has a silver bromide-containing phase, another preferable mode of the silver halide emulsion having a silver bromide-containing phase is a mode in which the silver halide emulsion has a region ranging in silver bromide content from 0.5 to 20 mole % at a depth of 20 nm or less below the emulsion grain surface. Herein, it is preferable for the silver bromide-containing phase to be situated at a depth of 10 nm or less below the emulsion grain surface and to range in silver bromide content from 0.5 to 10 mole %, more preferably from 0.5 to 5 mole %. In this case, it is not always required that the silver bromide-containing phase take a layer form. For maximizing the effects of the silver halide color photographic material of the invention, however, it is preferable that the silver bromide-containing phase be formed so as to take a layer form to surround the emulsion grain.

In the present invention, in order to introduce bromide ions or iodide ions to make the silver halide emulsion contain silver bromide or silver iodide, a bromide salt or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of iodide ions to a high chloride emulsion may be limited. The deeper in the emulsion grain iodide ions are introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight-Secondary Ion Mass Spectrometry) method by means of, for example, TRIFT II Model TOF-SIMS apparatus (trade name, manufactured by Phi Evans Co.). A TOF-SIMS method is specifically described in, Nippon Hyomen Kagakukai edited, *Hyomen Bunseki Gijutsu Sensho Niji Ion Shitsuryo Bunsekiho* (*Surface Analysis Technique Selection—Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the silver halide emulsion used in the present invention have the maximum concentration of iodide ions at the surface of the grain, that the iodide ion concentration decrease inwardly in the grain, and that the bromide ions have the maximum concentration in the inside of the grain. The local concentration of silver bromide can also be measured with X-ray diffractometry, as long as the silver bromide content is high to some extent.

It is preferable that the emulsion in the silver halide color photographic material of the present invention is made up of grains having a monodisperse grain-size distribution. In the silver halide grains that the silver halide color photographic material of the present invention contains, a coefficient of variation in sphere-equivalent diameters of all the emulsion grains is preferably 20% or below, more preferably 15% or below, particularly preferably 10% or below. Herein the coefficient of variation in sphere-equivalent diameters is expressed in terms of the percentage of the standard deviation of sphere-equivalent diameters of individual grains to the average of the sphere-equivalent diameters. To achieve wide latitude, it is preferably carried out to use a blend of two or more of the monodisperse emulsions as mentioned above in one and the same layer or to coat in the form of multiple layers.

Next, the size of silver halide grains are described.

In the present invention, the grain diameter of silver halide grains means the average sphere-equivalent diameter unless otherwise noted. The term sphere-equivalent diameter as used herein refers to the value expressed in terms of the diameter of a sphere having the same volume as each grain has.

In the first embodiment of the present invention, the grain size is represented by the length of an edge of a cube having the same volume as each grain has (edge length), or by the diameter of a sphere having the same volume as each grain has. The emulsions used in the color photographic materials of the first embodiment of the present invention are preferably the so-called monodisperse emulsions, namely emulsions which made of the grains having a monodisperse distribution with respect to the grain sizes. The variation coefficient on grain sizes of all the grains contained in each silver halide emulsion is preferably 20% or below, far preferably 15% or below, further preferably 10% or below. The variation coefficient on grain sizes is expressed in terms of the percentage of a value obtained by dividing the standard deviation of the edge lengths or sphere-equivalent diameters of individual grains by the average value of the edge lengths or the sphere-equivalent diameters. With the intention of acquiring a wide latitude, it is preferably carried out that monodisperse emulsions are blend and used in one and the same layer, or coated in the form of multiple layers having the same color sensitivity.

In the first embodiment of the present invention, the sphere-equivalent diameter of grains contained in the selenium-compound-containing silver halide emulsion is preferably 0.65 μm or below, far preferably 0.6 μm or below, further preferably 0.5 μm or below, particularly preferably 0.4 μm or below. Additionally, the lower limit of the sphere-equivalent diameter of silver halide grains is preferably 0.05 μm, far preferably 0.1 μm. The grain having a sphere-equivalent diameter of 0.6 μm is comparable to a cubic grain having a side length of about 0.48 μm, the grain having a sphere-equivalent diameter of 0.5 μm is comparable to a cubic grain having a side length of about 0.4 μm, and the grain having a sphere-equivalent diameter of 0.4 μm is comparable to a cubic grain having a side length of about 0.32 μm.

In the second embodiment of the present invention, the sphere-equivalent diameter of grains contained in the silver halide emulsion is preferably 0.6 μm or below, far preferably 0.5 μm or below, further preferably 0.4 μm or below. Additionally, the lower limit of the sphere-equivalent diameter of silver halide grains is preferably 0.05 μm, far preferably 0.1 μm.

In the third embodiment of the present invention, the sphere-equivalent diameter of the emulsion grains in the silver halide emulsion in the yellow-dye-forming-coupler-containing silver halide emulsion layer is preferably 0.6 μm or below, more preferably 0.5 μm or below, and particularly preferably 0.4 μm or below. The lower limit of the sphere-equivalent diameter of emulsion grains contained in any of these silver halide emulsion is preferably 0.05 μm, or above more preferably 0.1 μm, and further preferably 0.2 μm.

The silver halide color photographic material of the fourth embodiment of the present invention has at least one yellow-dye-forming-coupler-containing silver halide emulsion layer, at least one magenta-dye-forming-coupler-containing silver halide emulsion layer and at least one cyan-dye-forming-coupler-containing silver halide emulsion layer. The average sphere-equivalent diameter of silver halide grains contained in the yellow-dye-forming-coupler-containing silver halide emulsion layer is 0.75 μm (upper limit) or below, preferably 0.68 μm or below, further preferably 0.60 μm or below, particularly preferably 0.56 μm or below. The average sphere-equivalent diameter of silver halide grains contained in the magenta-dye-forming-coupler-containing silver halide emulsion layer or the cyan-dye-forming-coupler-containing silver halide emulsion layer is preferably 0.50 μm (upper limit) or below, further preferably 0.40 μm or below, particularly preferably 0.32 μm or below. In any of the silver halide emulsions, the lower limit of the average sphere-equivalent diameter is preferably 0.05 μm, further preferably 0.1 μm.

The grain having a sphere-equivalent diameter of 0.60 μm is comparable to a cubic grain having a side length of about 0.48 μm, the grain having a sphere-equivalent diameter of 0.50 μm is comparable to a cubic grain having a side length of about 0.40 μm, the grain having a sphere-equivalent diameter of 0.40 μm is comparable to a cubic grain having a side length of about 0.32 μm, and the grain having a sphere-equivalent diameter of 0.30 μm is comparable to a cubic grain having a side length of about 0.24 μm.

The silver halide emulsions in the silver halide color photographic material of the present invention may contain silver halide grains having sphere-equivalent diameters greater than the upper limits for the layers they are incorporated in, respectively. In each layer, however, it is preferable that silver halide grains having their sphere-equivalent diameters between the upper limit and the lower limit (generally 0.05 μm), which are also referred to as silver halide grains within the upper-to-lower limit range from now on, make up 50% or more of the total grains on a projected-area basis. Further, it is more preferable that the silver halide grains within the upper-to-lower limit range make up 80% or more, especially 90% or more, of the total grains on a projected-area basis. The sphere-equivalent diameters of silver halide grains can be determined from electron microscope photographs of the silver halide grains, and calculated from the edge lengths of cubes having the same volumes as the silver halide grains have. The edge lengths of silver halide grains numbering in a statistically significant numeric value (e.g., 600 or more) are measured, and the average thereof can be determined as the average sphere-equivalent diameter.

Next, the selenium compound for use in the silver halide color photographic light-sensitive material of present invention is described.

As the selenium compound, compounds represented by the following formulae (SE1), (SE2), or (SE3) can be preferably used.

Formula (SE1)

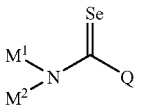

-continued

Formula (SE2)

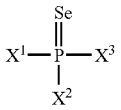

Formula (SE3)

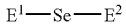

In formula (SE1), $M^1$ and $M^2$ represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, $OM^3$, or $NM^4M^5$, herein $M^3$, $M^4$, and $M^5$ represent a hydrogen atom, an alkyl group, an alkenyl group, an alkynyl group, an aryl group, or a heterocyclic group. $M^1$, $M^2$, and Q may bond together, to form a ring structure.

In formula (SE2), $X^1$, $X^2$, and $X^3$ represent an alkyl group, an alkenyl group, an alkynyl group, an aryl group, a heterocyclic group, $OJ^1$, or $NJ^2J^3$, herein $J^1$, $J^2$, and $J^3$ represent a hydrogen atom, an alkyl group, an alkenyl group, an alkynyl group, an aryl group, or a heterocyclic group.

In formula (SE3), $E^1$ and $E^2$ represent an alkyl group, an alkenyl group, an alkynyl group, an aryl group, a heterocyclic group, an acyl group, an alkoxycarbonyl group, an aryloxycarbonyl group, or a carbamoyl group. $E^1$ and $E^2$ may be the same or different.

In the following, the selenium compound represented by formula (SE1) will be explained in detail.

In formula (SE1), "alkyl group" represented by $M^1$ to $M^5$ and Q means a straight-chain, branched, or cyclic, substituted or unsubstituted alkyl group. Preferred examples thereof include a straight-chain or branched, substituted or unsubstituted alkyl group having 1 to 30 carbon atoms (e.g., a methyl group, an ethyl group, an isopropyl group, an n-propyl group, an n-butyl group, a t-butyl group, a 2-pentyl group, an n-hexyl group, an n-octyl group, a t-octyl group, a 2-ethylhexyl group, a 1,5-dimethylhexyl group, an n-decyl group, an n-dodecyl group, an n-tetradecyl group, an n-hexadecyl group, a hydroxyethyl group, a hydroxypropyl group, a 2,3-dihydroxypropyl group, a carboxymethyl group, a carboxyethyl group, a sodiumsulfoethyl group, a diethylaminoethyl group, a diethylaminopropyl group, a butoxypropyl group, an ethoxyethoxyethyl group, and an n-hexyloxypropyl group); a substituted or unsubstituted cycloalkyl group having 3 to 18 carbon atoms (e.g., a cyclopropyl group, a cyclopentyl group, a cyclohexyl group, a cyclooctyl group, an adamanthyl group, and cyclododecyl group); a substituted or unsubstituted bicycloalkyl group having 5 to 30 carbon atoms (that is, a monovalent group formed by removing one hydrogen atom from a bicycloalkane having 5 to 30 carbon atoms, e.g., a bicyclo[1,2,2]heptane-2-yl group, a bicyclo[2,2,2]octane-3-yl group); and a tricycloalkyl group and the like, which may have more ring structures. Examples of the alkenyl group represented by M1 to M5 and Q include an alkenyl group having 2 to 16 carbon atoms (e.g., an allyl group, a 2-butenyl group, and a 3-pentenyl group). Examples of the alkynyl group represented by M1 to M5 and Q include an alkynyl group having 2 to 10 carbon atoms (e.g., a propargyl group, and a 3-pentynyl group).

Examples of the aryl group represented by M1 to M5 and Q include a substituted or unsubstituted phenyl or naphthyl group having 6 to 20 carbon atoms (such as unsubstituted phenyl, unsubstituted naphthyl, 3,5-dimethyl phenyl, 4-butoxyphenyl, and 4-dimethylaminophenyl). Examples of the heterocyclic group include pyridyl, furyl, imidazolyl, piperidyl and morpholyl.

In formula (SE1), examples of the acyl group represented by $M^1$ and $M^2$ include an acetyl group, a formyl group, a benzoyl group, a pivaloyl group, a caproyl group, and an n-nonanoyl group; examples of the amino group include an unsubstituted amino group, a methylamino group, a hydroxyethylamino group, an n-octylamino group, a dibenzylamino group, a dimethylamino group, and a diethylamino group; examples of the alkoxy group include a methoxy group, an ethoxy group, an n-butyloxy group, a cyclohexyloxy group, an n-octyloxy group, and an n-decyloxy group; and examples of the carbamoyl group include an unsubstituted carbamoyl group, an N,N-diethylcarbamoyl group, and an N-phenylcarbamoyl group.

In formula (SE1), $M^1$ and $M^2$, Q and $M^1$, or Q and $M^2$ may bond together to form a ring structure. Moreover, when Q represents $NM^4M^5$, $M^4$ and $M^5$ may bond together to form a ring structure.

$M^1$ to $M^5$ and Q in formula (SE1) may have a substituent(s) as many as possible. Examples of the substituent include a halogen atom (fluorine, chlorine, bromine, or iodine), an alkyl group (any of linear, branched, or cyclic alkyl groups including a bicycloalkyl group and an active methine group), an alkenyl group, an alkynyl group, an aryl group, a heterocyclic group (substitution position not questioned), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (including a group containing ethyleneoxy or propyleneoxy units as repeating units), an aryloxy group, a heterocyclic oxy group, an acyloxy group, an alkoxy- or aryloxycarbonyloxy group, a carbamoyloxy group, a sulfonyloxy group, an amino group, an alkyl-, aryl- or heterocyclic-amino group, an acylamino group, a sulfonamido group, a ureido group, a thioureido group, an N-hydroxyureido group, an imido group, an alkoxy- or aryloxy-carbonylamino group, a sulfamoylamino group, a semicarbazide group, a thiosemicarbazide group, a hydrazino group, an ammonio group, an oxamoylamino group, an N-alkyl- or N-aryl-sulfonylureido group, an N-acylureido group, an N-acylsulfamoylamino group, a hydroxylamino group, a nitro group, a heterocyclic group containing a quaternary nitrogen atom (e.g., pyridinio, imidazolio, quinolinio, or isoquinolinio), an isocyano group, an imino group, a mercapto group, an alkyl-, aryl-, or heterocyclic-thio group, an alkyl-, aryl-, or heterocyclic-dithio group, an alkyl- or aryl-sulfonyl group, an alkyl- or aryl-sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group. Herein, the active methine group refers to a methine group substituted by two electron-withdrawing groups, and the electron-withdrawing group refers to an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. These two electron-withdrawing groups may be bonded with each other to form a ring structure. Additionally, the term "salt" as used herein is intended to include cations of alkali metals, alkaline earth metals, and heavy metals, and organic cations such as ammonium ions and phosphonium ions. Those substituents may further be substituted with any of those substituents.

As the compound represented by formula (SE1), the following case is more preferable: $M^1$ and $M^2$ each independently represent a hydrogen atom, a substituted or unsubstituted, straight-chain or branched alkyl group having 1 to 6 carbon atoms, a substituted or unsubstituted cycloalkyl group having 3 to 6 carbon atoms, an alkenyl group having 2 to 6 carbon atoms, a substituted or unsubstituted aryl group having 6 to 10 carbon atoms, a heterocyclic group, or an acyl group; and Q represents a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted aryl group having 6 to 10 carbon atoms, or $NM^4M^5$, in which $M^4$ and $M^5$ represent a hydrogen atom, a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted aryl group having 6 to 10 carbon atoms, or a heterocyclic group.

As the compound represented by formula (SE1), the following case is further preferable: $M^1$ and $M^2$ each independently represent a hydrogen atom, a substituted or unsubstituted, straight-chain or branched alkyl group having 1 to 6 carbon atoms, an alkenyl group having 2 to 6 carbon atoms, or a substituted or unsubstituted aryl group having 6 to 10 carbon atoms; and Q represents a substituted or unsubstituted, straight-chain or branched alkyl group having 1 to 6 carbon atoms, a substituted or unsubstituted aryl group having 6 to 10 carbon atoms, or $NM^4M^5$, in which $M^4$ and $M^5$ a hydrogen atom, a substituted or unsubstituted, straight-chain or branched alkyl group having 1 to 6 carbon atoms, an alkenyl group having 2 to 6 carbon atoms, or a substituted or unsubstituted aryl group having 6 to 10 carbon atoms.

As the compound represented by formula (SE1), the following case is further more preferable: Q represents $NM^4M^5$ in which $M^4$ and $M^5$ represent a hydrogen atom, a substituted or unsubstituted, straight-chain or branched alkyl group having 1 to 6 carbon atoms, an alkenyl group having 2 to 6 carbon atoms, or a substituted or unsubstituted aryl group having 6 to 10 carbon atoms.

The compound represented by formula (SE1) may be synthesized referring to, for example, the methods described in Chem. Rev., 55, 181-228 (1955); J. Org. Chem., 24, 470-473 (1959); J. Heterocycl. Chem., 4, 605-609 (1967); J. Drug (Yakushi), 82, 36-45 (1962); JP-B-39-26203, JP-A-63-229449, and OLS-2,043,944.

The formula (SE2) will be described in detail.

In formula (SE2), the alkyl, alkenyl, alkynyl, aryl, and heterocyclic groups represented by $X^1$ to $X^3$ and $J^1$ to $J^3$ have the same meanings as those represented by $M^1$ to $M^5$ and Q in formula (SE1). $X^1$ to $X^3$ and $J^1$ to $J^3$ each may have a substituent(s) as many as possible, and examples of the substituent include the same examples that are mentioned above.

As the compound represented by formula (SE2), the following case is preferable: $X^1$ to $X^3$ each independently represent a substituted or unsubstituted, straight-chain or branched alkyl group having 1 to 6 carbon atoms, a substituted or unsubstituted aryl group having 6 to 10 carbon atoms, or a heterocyclic group. As the compound represented by formula (SE2), the following case is more preferable: $X^1$ to $X^3$ each independently represent a substituted or unsubstituted aryl group having 6 to 10 carbon atoms.

The compound represented by formula (SE2) may be synthesized referring to, for example, the methods described in Organic Phosphorus Compounds, vol. 4, pp. 1-73; J. Chem. Soc. B, p. 1416 (1968); J. Org. Chem., vol. 32, p. 1717 (1967); J. Org. Chem., vol. 32, p. 2999 (1967); Tetrahedron, vol. 20, p. 449 (1964); and J. Am. Chem. Soc., vol. 91, p. 2915 (1969).

The selenium compound represented by formula (SE3) will be explained.

The alkyl, alkenyl, alkynyl, aryl, and heterocyclic groups represented by $E^1$ and $E^2$ in formula (SE3) have the same meanings as those represented by $M^1$ to $M^5$ and Q in formula (SE1). Examples of the acyl group represented by $E^1$ and $E^2$ include an acetyl group, a formyl group, a benzoyl group, a pivaloyl group, a caproyl group, and an n-nonanoyl group; examples of the alkoxycarbonyl group represented by $E^1$ and $E^2$ include a methoxycarbonyl group, an ethoxycarbonyl group, an n-butyloxycarbonyl group, a cyclohexyloxycarbonyl group, an n-octyloxycarbonyl group, and an n-decyloxycarbonyl group; examples of the aryloxycarbonyl group represented by $E^1$ and $E^2$ include a phenoxycarbonyl group, and a naphthoxycarbonyl group; and examples of the carbamoyl group represented by $E^1$ and $E^2$ include an unsubstituted carbamoyl group, an N,N-diethylcarbamoyl group, and an N-phenylcarbamoyl group. $E^1$ and $E^2$ each may further have a substituent(s) as far as possible. Examples of such substituents include the same examples of the substituent described above.

In preferred compounds among those represented by formula (SE3) both $E^1$ and $E^2$ are groups selected from the groups represented by formulae (T1) to (T4). In these cases, $E^1$ and $E^2$ may be the same or different.

Formula (T1)

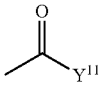

Formula (T2)

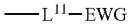

Formula (T3)

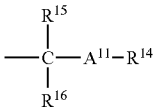

Formula (T4)

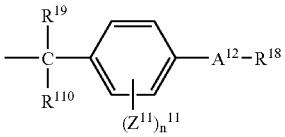

In formula (T1), $Y^{11}$ represents an alkyl group, an alkenyl group, an alkynyl group, an aryl group, a heterocyclic group, $OR^{11}$, or $NR^{12}R^{13}$, in which $R^{11}$, $R^{12}$, and $R^{13}$ represent an alkyl group, an alkenyl group, an alkynyl group, an aryl group, or a heterocyclic group. In formula (T2), $L^{11}$ represents a divalent linking group, and EWG represents an electron-withdrawing group. In formula (T3), $A^{11}$ represents an oxygen atom, a sulfur atom, or $NR^{17}$; and $R^{14}$, $R^{15}$, $R^{16}$, and $R^{17}$ represent a hydrogen atom, an alkyl group, an alkenyl group, an alkynyl group, an aryl group, or a heterocyclic group. In formula (T4), $A^{12}$ represents an oxygen atom, a sulfur atom, or $NR^{111}$; $R^{18}$ represents a hydrogen atom, an alkyl group, an alkenyl group, an alkynyl group, an aryl group, a heterocyclic group, or an acyl group; $R^{19}$, $R^{110}$, and $R^{111}$ represent a hydrogen atom, an alkyl group, an alkenyl group, an alkynyl group, an aryl group, or a heterocyclic group. $Z^{11}$ represents a substituent; $n^{11}$ is an integer from 0 to 4. When $n^{11}$ is 2 or more, $Z^{11}$s may be the same or different.

In formula (T1), $Y^{11}$ represents an alkyl group, an alkenyl group, an alkynyl group, an aryl group, a heterocyclic group, —OR11, or —NR12R13, in which R11, R12, and R13 represent an alkyl group, an alkenyl group, an alkynyl group, an aryl group, or a heterocyclic group. Where the alkyl group is concerned, it has the same meaning as those represented by $M^1$ to $M^5$ and Q in formula (SE1), and they are identical in the scope of preferred ones. Likewise, the alkenyl group, the alkynyl group, the aryl group, and the heterocyclic group have the same meanings as the alkenyl group, the alkynyl group, the aryl group, and the heterocyclic group each of $M^1$ to $M^5$ and Q in formula (SE1) can represent, respectively, and the scope of preferred ones in regard to each of these groups is also identical.

In formula (T1), $Y^{11}$ is preferably an alkyl group, an alkenyl group, an alkynyl group, an aryl group, or a heterocyclic group; and more preferably an alkyl group or an aryl group.

In formula (T2), the divalent linking group represented by $L^{11}$ represents an alkylene, alkenylene, or alkynylene group having 2 to 20 carbon atoms; especially represents a straight-chain, branched or cyclic alkylene group having 2 to 10 carbon atoms (e.g., ethylene, propylene, cyclopentylene, and cyclohexylene), an alkenylene group (e.g., vinylene), or an alkynylene group (e.g., propynylene). $L^{11}$ is preferably a group represented by formula (L1) or (L2).

Formula (L1)

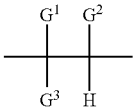

Formula (L2)

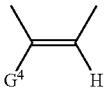

In formulae (L1) and (L2), $G^1$, $G^2$, $G^3$, and $G^4$ represent a hydrogen atom, an alkyl group having 1 to 10 carbon atoms, an aryl group having 6 to 20 carbon atoms, or a heterocyclic group having 1 to 10 carbon atoms. $G^1$, $G^2$, and $G^3$ may bond together, to form a ring. $G^1$, $G^2$, $G^3$, and $G^4$ each are preferably a hydrogen atom, an alkyl group, or an aryl group, and more preferably a hydrogen atom or an alkyl group.

In formula (T2), EWG represents an electron-withdrawing group. The term "electron-withdrawing group" so-called herein means a group having a positive value of Hammett's substituent constant $\sigma_m$ value (or $\sigma_p$ value), and preferably a $\sigma_m$ value of 0.12 or more (or a $\sigma_p$ value of 0.2 or more), with its upper limit being 1.0 or less. Specific examples of the electron-withdrawing group having a positive $\sigma_m$ value (or a $\sigma_p$ value of 0.2 or more), include an alkoxy group (preferably an alkoxy group substituted with at least two or more halogen atoms), an aryloxy group (preferably an aryloxy group substituted with at least two or more halogen atoms), an alkylthio group (preferably an alkylthio group substituted with at least two or more halogen atoms), an arylthio group, an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an imino group, an imino group substituted with an N atom, a carboxy group (or its salt), an alkyl group substituted with at least two or more halogen atoms, an acylamino group, an alkylamino group substituted with at least two or more halogen atoms, an aryl group substituted with other electron withdrawing group having a positive $\sigma_m$ value (or a $\sigma_p$ value of 0.2 or more), a heterocyclic group, a halogen atom, an azo group, and a selenocyanate group. EWG is preferably an alkoxy group, an acyl group, a formyl group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom; a phosphoryl group, a carboxy group (or its salt), an alkyl group substituted with at least two or more halogen atoms, an aryl group substituted with other electron-withdrawing group having a positive $\sigma_m$ value (or a $\sigma_p$ value of 0.2 or more), a heterocyclic group, or a halogen atom; more preferably an alkoxy group, an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; and further preferably an alkoxy group, an acyl group, a formyl group, a cyano group, a nitro group, an alkylsulfonyl group, an arylsulfonyl group, or an alkyl group substituted with at least two or more halogen atoms.

The Hammett's rule is an empirical rule proposed by L. P. Hammett in 1935 to quantitatively describe the effect of a substituent on the reaction or equilibrium of a benzene derivative. There are $\sigma_p$ and $\sigma_m$ as constants of substitution obtained by the Hammett's rule, these values are described in many common books. For example, details of these values are described in "Lange's Handbook of Chemistry", edited by J. A. Dean, 12th edition, 1979 (McGraw-Hill); "Extra issue of Kagakuno Ryoiki", No. 122, pp. 96-103, 1979 (Nankodo Publishing Co., Ltd.); and "Chemical Reviews", Vol. 91, pp. 165-195, 1991. In the present invention, substituents are defined and explained using Hammett's constant of substitution. However, it must be noted that substituents are not necessarily limited to the substituents having Hammett's constants which are known and described in the literature. Therefore, needless to say, even if the Hammett's constant of a substituent is not described in the literature, the substituent whose Hammett's constant falls within the range when measured based on the Hammett's rule is included in the scope of the present invention.

In formula (T2), cases are preferred where $L^{11}$ is preferably represented by formula (L1), $G^1$ to $G^3$ each represent a hydrogen atom or an alkyl group, and EWG represents an alkoxy group, an acyl group, a formyl group, a carbamoyl group, an alkoxycarbonyl group, an aryloxycarbonyl group, a cyano group, a nitro group, an alkylsulfonyl group, an arylsulfonyl group, a carboxyl group or an alkyl group substituted by at least two halogen atoms. And cases are far preferred where $L^{11}$ is preferably represented by formula (L1), $G^1$ to $G^3$ each represent a hydrogen atom or an alkyl group, and EWG represents an alkoxy group, an acyl group, a formyl group, a cyano group, a nitro group, an alkylsulfonyl group, an arylsulfonyl group or an alkyl group substituted by at least two halogen atoms.

In formula (T3), $R^{14}$ to $R^{17}$ represent a hydrogen atom, an alkyl group, an alkenyl group, an alkynyl group, an aryl group, or a heterocyclic group. The alkyl group so-called herein has the same meaning as the aforementioned alkyl group represented by $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group, represented by $M^1$ to $M^5$ and Q in formula (SE1), respectively, and the preferable ranges are also the same.

$R^{14}$ is preferably an alkyl group. $R^{15}$ and $R^{16}$ each are preferably a hydrogen atom, an alkyl group, or an aryl group, and more preferably a hydrogen atom, or an alkyl group. The case where one of $R^{15}$ and $R^{16}$ is a hydrogen atom and the other is a hydrogen atom or an alkyl group is still more preferable. $R^{17}$ is preferably a hydrogen atom, an alkyl group, or an aryl group, more preferably a hydrogen atom or an alkyl group, and still more preferably an alkyl group.

In formula (T3), $A^{11}$ represents an oxygen atom, a sulfur atom, or $NR^{17}$. $A^{11}$ is preferably an oxygen atom or a sulfur atom, and more preferably an oxygen atom.

In formula (T3), cases are preferred where $A^{11}$ is an oxygen atom or a sulfur atom, $R^{14}$ is an alkyl group, and $R^{15}$ and $R^{16}$ are each a hydrogen atom, an alkyl group or an aryl group. And cases are far preferred where $A^{11}$ is an oxygen atom, $R^{14}$ is an alkyl group and $R^{15}$ and $R^{16}$ are each a hydrogen atom or an alkyl group.

Next, the formula (T4) will be explained.

In formula (T4), the alkyl group represented by $R^{18}$, $R^{19}$, $R^{110}$ and $R^{111}$ has the same meaning as the aforementioned alkyl group represented by $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group represented by $M^1$ to $M^5$ and Q in formula (SE1), respectively, and the preferable ranges are also the same. Examples of the acyl group represented by $R^{18}$ include an acetyl group, a formyl group, a benzoyl group, a pivaloyl group, a caproyl group, and an n-nonanoyl group.

$Z^{11}$ in formula (T4) represents a substituent, and examples thereof include the same ones as described above.

Preferable examples of Z11 include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group (including a salt thereof), a cyano group, a formyl group, a hydroxy group, an alkoxy group, an aryloxy group, a heterocyclic oxy group, an acyloxy group, a nitro group, an amino group, an alkyl-, aryl- or heterocyclic-amino group, an acylamino group, a sulfonamido group, a ureido group, a thioureido group, an alkylthio group, an arylthio group, a heterocyclic thio group, an alkyl- or aryl-sulfonyl group, an alkyl- or aryl-sulfinyl group, a sulfo group (including a salt thereof), and a sulfamoyl group. More preferable examples thereof include a halogen atom, an alkyl group, an aryl group, a heterocyclic group, a carboxy group (including a salt thereof), a hydroxy group, an alkoxy group, an aryloxy group, a heterocyclic oxy group, an acyloxy group, an amino group, an alkyl-, aryl-, or heterocyclic-amino group, an acylamino group, a ureido group, a thioureido group, an alkylthio group, an arylthio group, a heterocyclic thio group, and a sulfo group (including a salt thereof). Further more preferred examples thereof include an alkyl group, an aryl group, a carboxy group (including a salt thereof), a hydroxy group, an alkoxy group, an aryloxy group, an alkyl-, aryl-, or heterocyclic-amino group, a ureido group, an alkylthio group, an arylthio group, and a sulfo group (including a salt thereof).

In formula (T4), $n^{11}$ represents an integer of from 0 to 4. $\underline{n}^{11}$ is preferably an integer of from 0 to 2, and more preferably an integer of 0 or 1.

In formula (T4), $A^{12}$ represents an oxygen atom, a sulfur atom, or $NR^{111}$. $A^{12}$ preferably represents an oxygen atom or a sulfur atom, and more preferably an oxygen atom.

In formula (T4), cases are preferred where $A^{12}$ is an oxygen atom or a sulfur atom, $R^{18}$ is a hydrogen atom, an alkyl group or an acyl group, $R^{19}$ and $R^{110}$ are each a hydrogen atom, an alkyl group or an aryl group, $n^{11}$ is from 0 to 2, and $Z^{11}$ is an alkyl group, an aryl group, a carboxyl group (including salts thereof), a hydroxyl group, an alkoxy group, an aryloxy group, an alkyl-, aryl- or heterocyclic-amino group, a ureido group, an alkylthio group, an arylthio group or a sulfo group (including salts thereof). Cases are far preferred where $A^{12}$ is an oxygen atom, $R^{18}$ is a hydrogen atom or an alkyl group, $R^{19}$ and $R^{110}$ are each a hydrogen atom or an alkyl group, $n^{11}$ is from 0 to 2, and $Z^{11}$ is an alkyl group, an aryl group, a carboxyl group (including salts thereof), an alkoxy group, a ureido group or a sulfo group (including salts thereof). And Cases are further preferred where $A^{12}$ is an oxygen atom, $R^{18}$ is an alkyl group, $R^{19}$ and $R^{110}$ are each a hydrogen atom, $n^{11}$ is from 0 to 2, and $Z^{11}$ is an alkyl group, a carboxyl group (including salts thereof), an alkoxy group or a sulfo group (including salts thereof).

Of compounds represented by formula (SE3), preferred ones correspond to a case where $E^1$ is a group of formula (T1) and $E^2$ is a group of formula (T1), a case where $E^1$ is a group of formula (T1) and $E^2$ is a group of formula (T2), a case where $E^1$ is a group of formula (T1) and $E^2$ is a group of formula (T3), a case where $E^1$ is a group of formula (T1) and $E^2$ is a group of formula (T4), a case where $E^1$ is a group of formula (T2) and $E^2$ is a group of formula (T3), a case where $E^1$ is a group of formula (T2) and $E^2$ is a group of formula (T4), a case where $E^1$ is a group of formula (T3) and $E^2$ is a group of formula (T3), a case where $E^1$ is a group of formula (T3) and $E^2$ is a group of formula (T4), and a case where $E^1$ is a group of formula (T4) and $E^2$ is a group of formula (T4), respectively. Of these cases, the case where $E^1$ is a group of formula (T1) and $E^2$ is a group of formula (T1), the case where $E^1$ is a group of formula (T1) and $E^2$ is a group of formula (T2), the case where $E^1$ is a group of formula (T1) and $E^2$ is a group of formula (T3), the case where $E^1$ is a group of formula (T1) and $E^2$ is a group of formula (T4), the case where $E^1$ is a group of formula (T2) and $E^2$ is a group of formula (T3), the case where $E^1$ is a group of formula (T3) and $E^2$ is a group of formula (T4), and the case where $E^1$ is a group of formula (T4) and $E^2$ is a group of formula (T4) are more preferred over the others; and the case where $E^1$ is a group of formula (T1) and $E^2$ is a group of formula (T2), the case where $E^1$ is a group of formula (T1) and $E^2$ is a group of formula (T3), the case where $E^1$ is a group of formula (T1) and $E^2$ is a group of formula (T4), the case where $E^1$ is a group of formula (T2) and $E^2$ is a group of formula (T3), and the case where $E^1$ is a group of formula (T3) and $E^2$is a group of formula (T4) are particularly favorable. Of these cases, the most favorable ones are the case where $E^1$ is a group of formula (T1) and $E^2$ is a group of formula (T2), the case where $E^1$ is a group of formula (T1) and $E^2$ is a group of formula (T3), and the case where $E^1$ is a group of formula (T2) and $E^2$ is a group of formula (T3).

Alternatively, of the compounds represented by formula (SE3), preferable compounds correspond to cases where at least either $E^1$ or $E^2$ is selected from formula (T1), or at least either of them is selected from formula (T4). Cases are far preferred where either $E^1$ or $E^2$ is selected from formula (T1) and the other is selected from formula (T1), (T2) or (T4), or where either $E^1$ or $E^2$ is selected from formula (T4) and the other is selected from formula (T3) or (T4). Cases are further preferred where either $E^1$ or $E^2$ is selected from formula (T1) and the other is selected from formula (T2) or (T4), or where both $E^1$ and $E^2$ are selected from formula (T4). And the optimum are cases where either $E^1$ or $E^2$ is selected from formula (T1) and the other is selected from formula (T2), or where both E1 and $E^2$ are selected from formula (T4).

The compound represented by formula (SE3) may be synthesized according to the methods described in the following already known documents: The Chemistry of Organic Selenium and Tellurium Compounds, Vol. 1 (1986) and ibid. Vol. 2 (1987) edited by S. Patai and Z. Rappoport; and Organoselenium Chemistry (1987) by D. Liotta.

Specific examples of the compound represented by any one of the formulae (SE1) to (SE3) will be shown below, but the compound used in the silver halide color photographic material of the present invention is not limited to these. Further, with respect to the compounds that may have a plurality of stereoisomers, their stereostructure is not limited to these.

SE1-1

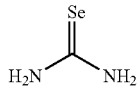

SE1-2

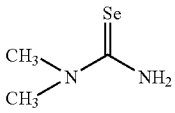

SE1-3

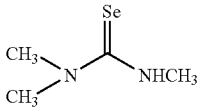

SE1-4

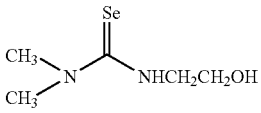

SE1-5

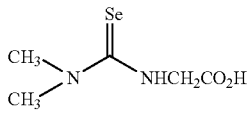

SE1-6

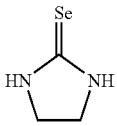

SE1-7

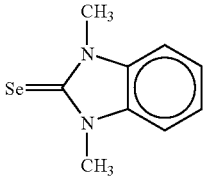

-continued
SE1-8
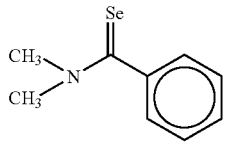
SE1-9
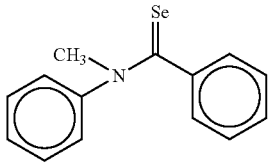
SE1-10
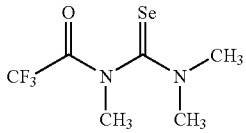
SE1-11
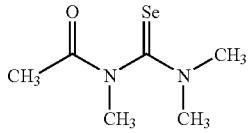
SE1-12
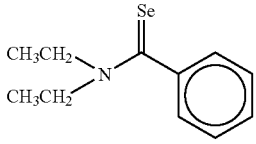
SE1-13
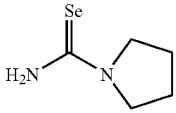
SE1-14
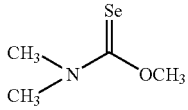
SE1-15
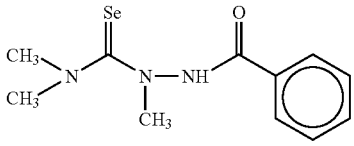
SE1-16
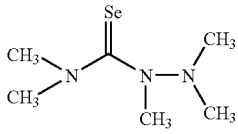
SE1-17
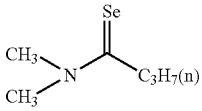
-continued
SE2-1
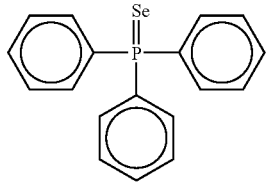
SE2-2
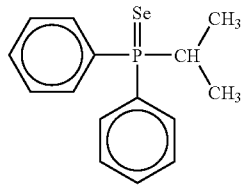
SE2-3
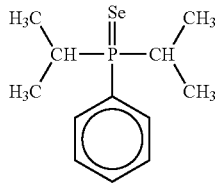
SE2-4
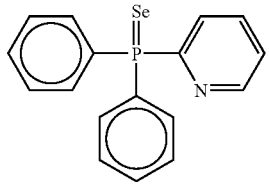
SE2-5
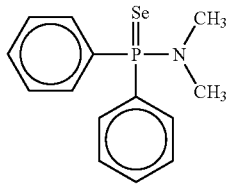
SE2-6
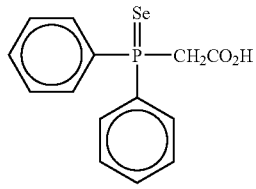
SE2-7
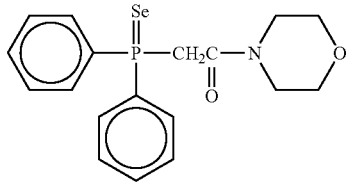

-continued
SE2-8
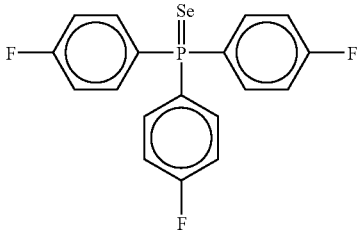
SE2-9
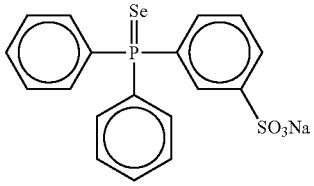
SE2-10
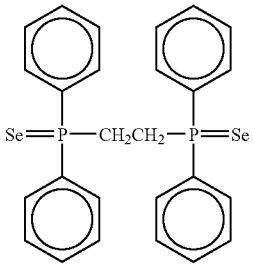
SE2-11
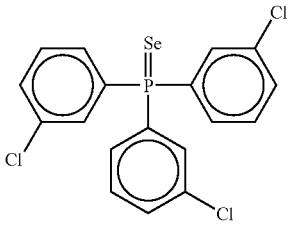
SE2-12
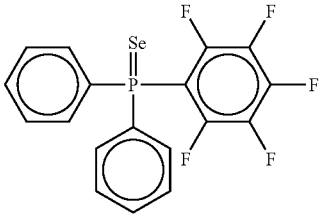
SE2-13
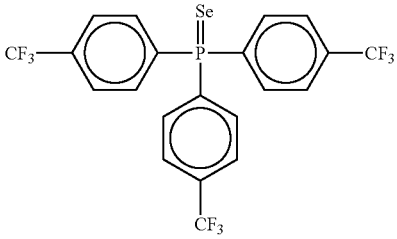
-continued
SE2-14
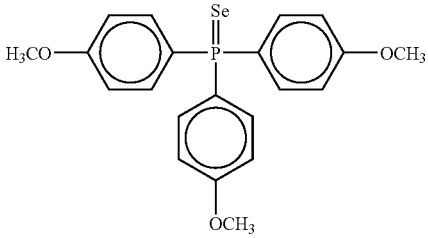
SE2-15
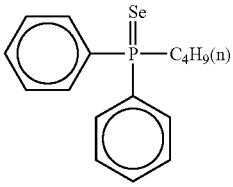
SE2-16
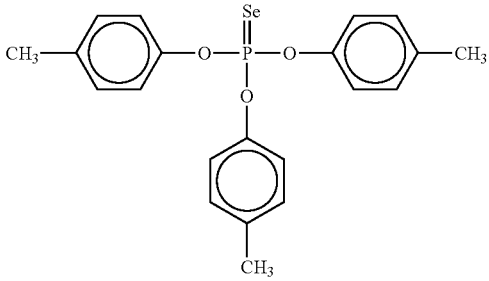
SE2-17
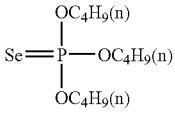
SE2-18
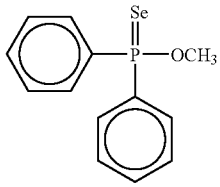
SE2-19
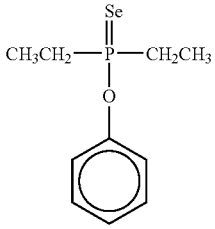
SE2-20
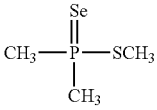
SE3-1
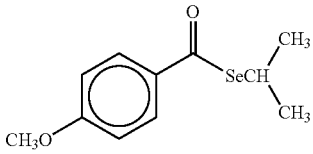

-continued
SE3-2
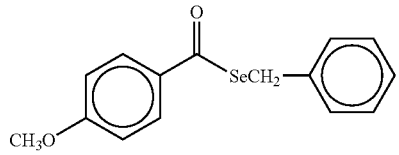
SE3-3
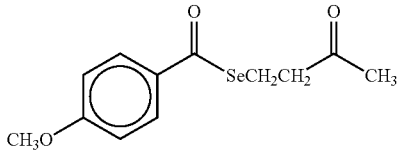
SE3-4
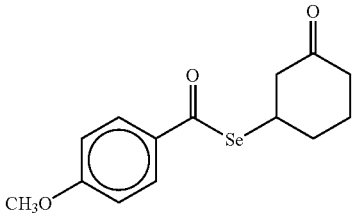
SE3-5
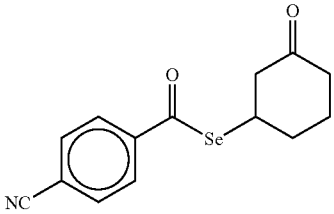
SE3-6
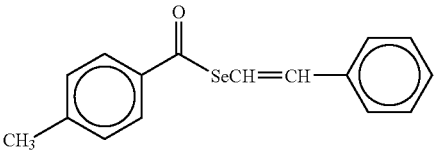
SE3-7
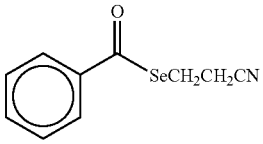
SE3-8
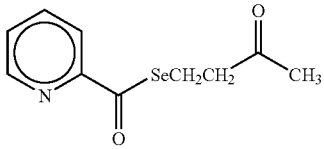
SE3-9
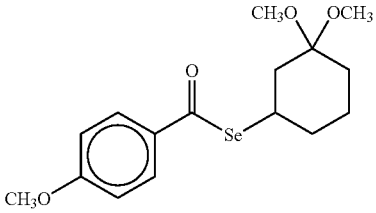
-continued
SE3-10
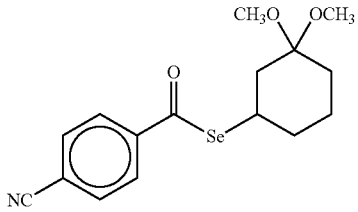
SE3-11
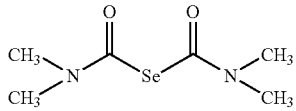
SE3-12
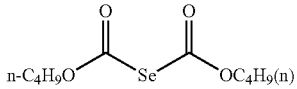
SE3-13
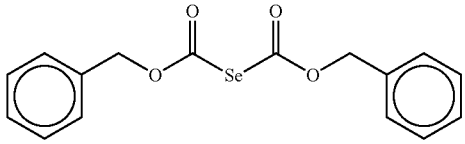
SE3-14
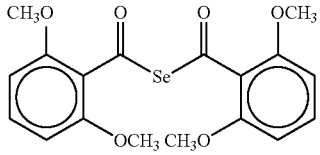
SE3-15
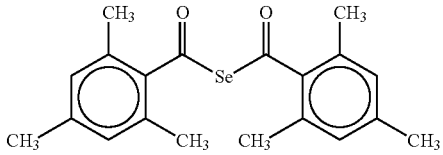
SE3-16
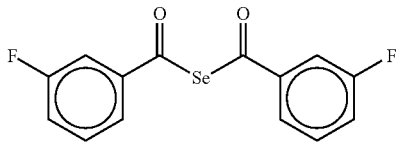
SE3-17
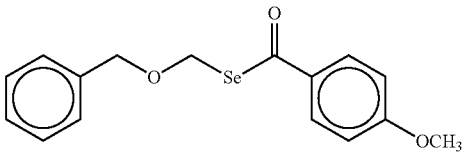
SE3-18
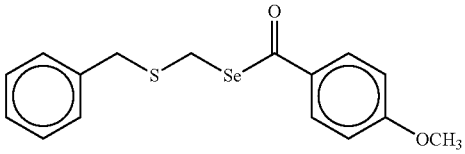

-continued
SE3-19
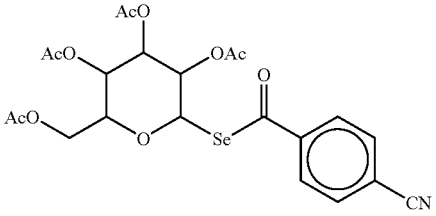
SE3-20
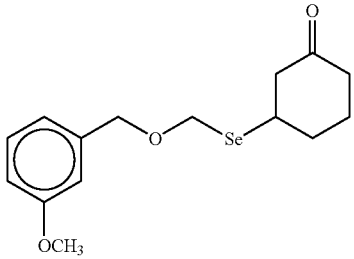
SE3-21
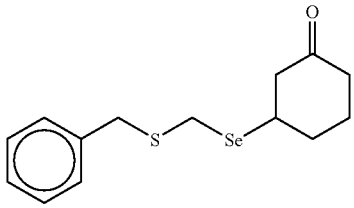
SE3-22
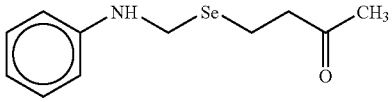
SE3-23
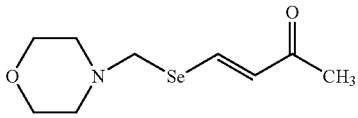
SE3-24
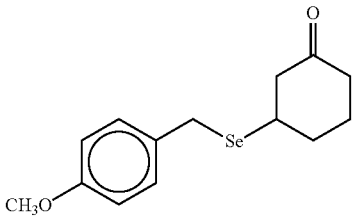
SE3-25
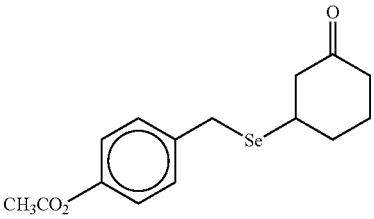
SE3-26
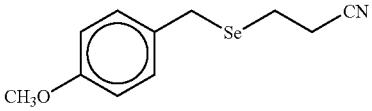
-continued
SE3-27
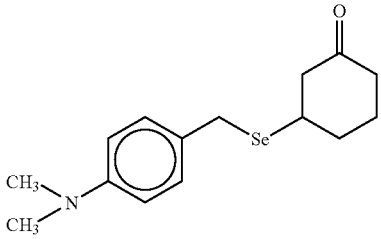
SE3-28
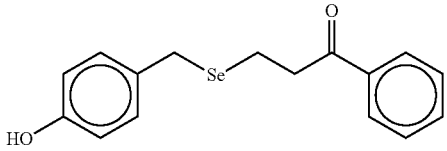
SE3-29
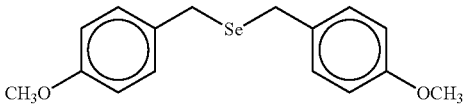
SE3-30
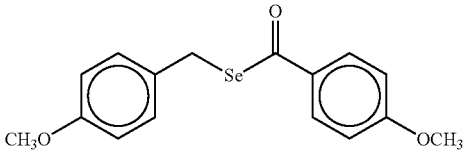
SE3-31
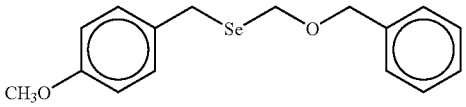
SE3-32
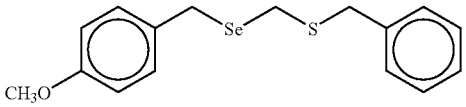
SE3-33
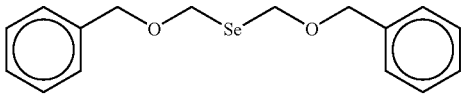
SE3-34
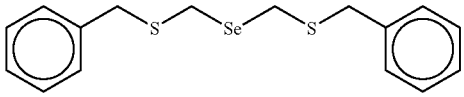
SE3-35
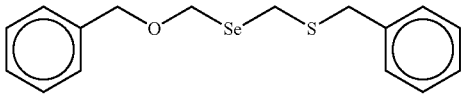
SE3-36
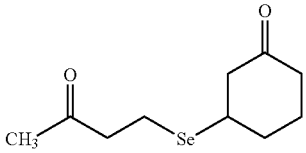
SE3-37
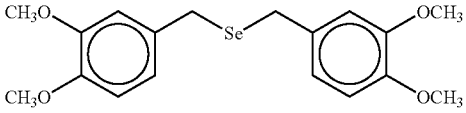

-continued

SE3-38

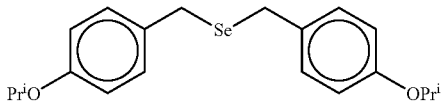

In addition to the foregoing ones, selenium compounds as described in JP-B-43-13489, JP-B-44-15748, JP-A-4-25832, JP-A-4-109240, JP-A-4-271341, JP-A-5-40324, JP-A-5-11385, JP-A-6-51415, JP-A-6-175258, JP-A-6-180478, JP-A-6-208186, JP-A-6-208184, JP-A-6-3 17867, JP-A-7-92599, JP-A-7-98483, JP-A-7-140579, JP-A-7-301879, JP-A-7-301880, JP-A-8-114882, JP-A-9-138475, JP-A-9-197603, and JP-A-10-10666, specifically colloidal metallic selenium, selenoketones (e.g., selenobenzophenone), isoselenocyanates, and selenocarboxylic acid compounds, can be used in the silver halide color photographic material of the present invention. Further, the non-labile selenium compounds as described in JP-B-46-4553 and JP-B-52-34492, including selenous acid compounds, selenocyanic acid compounds (such as potassium selenocyanate), selenazoles, and selenides, can also be used. Of these compounds, selenocyanic acid compounds are preferred over the others.

The selenium compounds described above should not be construed as limiting the selenium compounds that can be used in the silver halide color photographic light-sensitive material of the present invention. From the viewpoints of hard gradation enhancement and fog reduction, it is preferable that the 3d-orbital electron of a selenium atom in the selenium compound for use in the silver halide color photographic material of the present invention has bound energy of from 54.0 eV to 65.0 eV, as measured with an X-ray photoelectron spectroscope.

The amount of a selenium sensitizer for use in the silver halide color photographic material of the present invention, though it varies depending on the selenium compound used, the silver halide grains used in combination therewith and the chemical ripening conditions adopted, is generally from about $1\times10^{-8}$ to about $1\times10^{-4}$ mole, preferably from about $1\times10^{-7}$ to about $1\times10^{-5}$ mole, per mole of silver halide. The present invention has no particular restriction as to conditions for chemical sensitization, but the pCl is preferably from 0 to 7, more preferably from 0 to 5, and particularly preferably from 1 to 3, and the temperature is preferably from 40 to 95° C., and more preferably from 50 to 85° C. Alternatively, the temperature is preferably from 40° C. to 80° C., far preferably from 50° C. to 70° C. As to the compounds represented by formulae (SE1) to (SE3), only one kind thereof may be used, or two or more kinds thereof may be used as a mixture. Additionally, they may be added concurrently with other selenium sensitizers.

The selenium compounds according to the silver halide color photographic material of the present invention can be added at any stage during the period from the instant following the grain formation to the instant preceding the completion of chemical sensitization. The preferable addition time is within a period between the instant following completion of desalting and the chemical sensitization process inclusive.

The compounds represented by formulae (SE1) to (SE3) may be used alone, or two or more of them may be mixed and used in the same layer or a plurality of layers. Additionally, they may be added concurrently with other selenium sensitizers.

In the next place, gold-selenium compounds which can be preferably used in the second or third embodiment of the present invention are illustrated.

As gold-selenium compounds usable in the present invention, compounds represented by any of the following formulae (PF1) to (PF6) are suitable.

Formula (PF1)

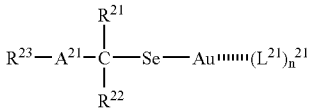

Formula (PF2)

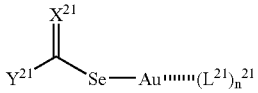

Formula (PF3)

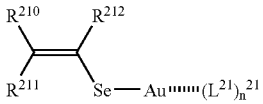

Formula (PF4)

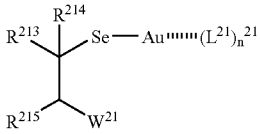

Formula (PF5)

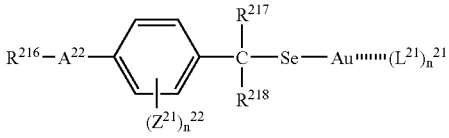

Formula (PF6)

$[Q^{21}\text{---}Au\text{------}(Q^{22})_n{}^{23}]\ J^{21}$

In formula (PF1), $L^{21}$ represents a compound capable of coordinating with gold via an N atom, an S atom, an Se atom, a Te atom or a P atom; $n^{21}$ represents 0 or 1; $A^{21}$ represents O, S or $NR^{24}$; $R^{21}$ to $R^{24}$ each represents a hydrogen atom or a substituent; and $R^{23}$ may form a 5- to 7-membered ring together with $R^{21}$ or $R^{22}$.

In formula (PF2), $L^{21}$ represents a compound capable of coordinating with gold via an N atom, an S atom, an Se atom, a Te atom or a P atom; $n^{21}$ represents 0 or 1; $X^{21}$ represents O, S or $NR^{25}$; $Y^{21}$ represents an alkyl group, an alkenyl group, an alkynyl group, an aryl group, a hetero ring group, $OR^{26}$, $SR^{27}$, or $N(R^{28})R^{29}$; $R^{25}$ to $R^{29}$ each represents a hydrogen atom, an alkyl group, an alkenyl group, an alkynyl group, an aryl group or a hetero ring group; and $X^{21}$ and $Y^{21}$ may be bound to each other to form a ring.

In formula (PF3), $L^{21}$ represents a compound capable of coordinating with gold via an N atom, an S atom, an Se atom, a Te atom or a P atom; $n^{21}$ represents 0 or 1; $R^{210}$, $R^{211}$ and $R^{212}$ each independently represents a hydrogen atom or a substituent, with at least one of $R^{210}$ and $R^{211}$, representing an electron attractive group.

In formula (PF4), $L^{21}$ represents a compound capable of coordinating with gold via an N atom, an S atom, an Se atom, a Te atom or a P atom; $n^{21}$ represents 0 or 1; $W^{21}$ represents an electron attractive group; and $R^{213}$ to $R^{215}$ each represents a hydrogen atom or a substituent, with $W^{21}$ and $R^{213}$ optionally being bound to each other to form a cyclic structure.

In formula (PF5), $L^{21}$ represents a compound capable of coordinating with gold via an N atom, an S atom, an Se atom, a Te atom or a P atom; $n^{21}$ represents 0 or 1; $A^{22}$ represents O, S, Se, Te or $NR^{219}$; $R^{216}$ represents a hydrogen atom, an alkyl group, an alkenyl group, an alkynyl group, an aryl group, a hetero ring group or acyl group; $R^{217}$ to $R^{219}$ each represents a hydrogen atom, an alkyl group, an alkenyl group, an alkynyl group, an aryl group or a hetero ring group; $Z^{21}$ represents a substituent; $n^{22}$ represents an integer of from 0 to 4; and when $n^{22}$ is 2 or more, $Z^{21}$ may be the same or different from each other.

In formula (PF6), $Q^{21}$ and $Q^{22}$ represent compounds selected from among the selenium sensitizers of the formulae (SE1) to (SE3), the selenium atoms in $Q^{21}$ and $Q^{22}$ form coordinate bonds together with Au; $n^{23}$ represents 0 or 1; and $J^{21}$ represents a counter anion. When $n^{23}$ is 1, $Q^{21}$ and $Q^{22}$ may be the same or different, provided that the compounds represented by formula (PF6) do not include the compounds represented by any of formulae (PF1) to (PF5).

Next, the gold-selenium compounds represented by formula (PF1) are described below.

In formula (PF1), $R^{21}$ and $R^{22}$ each preferably represents a hydrogen atom, an alkyl group, an aryl group, a hetero ring group, a hydroxyl group, an alkoxy group, an aryloxy group, a hetero ring oxy group, an amino group, a mercapto group, an alkylthio group, an arylthio group or a hetero ring thio group, more preferably a hydrogen atom, an alkyl group, an aryl group or a hetero ring group, most preferably a hydrogen atom or an alkyl group.

$R^{23}$ preferably represents a hydrogen atom, an alkyl group, an aryl group or a hetero ring group; more preferably an alkyl group, an aryl group or a hetero ring group; and most preferably an alkyl group or an aryl group. $R^{24}$ preferably represents a hydrogen atom, an alkyl group, an alkenyl group, an alkynyl group, an aryl group, a hetero ring group, an amino group, an acylamino group, an alkyl- or aryl-sulfonylamino group, an alkyl- or aryl-sulfonyl group, an acyl group, an aryloxycarbonyl group, an alkoxycarbonyl group or a carbamoyl group; and further preferably a hydrogen atom, an alkyl group, an aryl group or a hetero ring group.

$R^{23}$ may form a 5- to 7-membered ring structure together with $R^{21}$ or $R^{22}$. The ring structure to be formed is a non-aromatic, oxygen-, sulfur- or nitrogen-containing hetero ring. Also, this ring structure may form a fused ring together with an aromatic or non-aromatic carbon ring or a hetero ring. In the present invention, it is more preferred for $R^{23}$ to form the 5- to 7-membered ring structure together with $R^{21}$ or $R^{22}$.

In the present invention, among the compounds represented by formula (PF1), preferred are those wherein $A^{21}$ represents O, S or $NR^{24}$; $R^{21}$ and $R^{22}$ each represents a hydrogen atom, an alkyl group, an aryl group, a hetero ring group, an alkoxy group, an aryloxy group, a hetero ring oxy group, an alkylthio group, an arylthio group or a hetero ring thio group; $R^{23}$ represents a hydrogen atom, an alkyl group, an aryl group or a hetero ring group; and $R^{24}$ represents a hydrogen atom, an alkyl group, an aryl group, a hetero ring group, an amino group, an acylamino group, an alkyl- or aryl-sulfonylamino group, an alkyl- or aryl-sulfonyl group or an acyl group. More preferred are those wherein $A^{21}$ represents O or S; $R^{21}$ and $R^{22}$ each represents a hydrogen atom, an alkyl group, an aryl group or a hetero ring; and $R^{23}$ represents an alkyl group, an aryl group or a hetero ring group. Still more preferred are those wherein $A^{21}$ represents O or S; $R^{21}$ and $R^{22}$ each represents a hydrogen atom, an alkyl group or an aryl group; and $R^{23}$ represents an alkyl group or an aryl group. Particularly preferred are those wherein $R^{23}$ forms a ring structure of a sugar derivative together with $R^{21}$ or $R^{22}$ such as glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine or glucuronic acid (in the case where $A^{21}$ in the formula (PF1) represents O) and the sulfur analogue thereof (in the case where $A^{21}$ in the formula (PF1) represents S). The term "sugar derivatives" as used herein refers to the compounds prepared by replacing hydroxyl groups, amino groups or carboxyl groups present in sugar structures, with alkoxy groups (including groups containing ethylene oxide moieties or propylene oxide moieties as repeating units), aryloxy groups, heterocyclyloxy groups, acyloxy groups, alkoxycarbonyloxy groups, aryloxycarbonyloxy groups, carbamoyloxy groups, sulfonyloxy groups, silyloxy groups, alkyl-, aryl- or heteroclic-amino groups, acylamino groups, sulfonamido groups, ureido groups, thioureido groups, N-hydroxyureido groups, alkoxycarbonylamino groups, aryloxycarbonylamino groups, sulfamoylamino groups, semicarbazido groups, thiosemicarbazido groups, oxamoylamino groups, N-(alkyl or aryl)sulfonylureido groups, N-acylureido groups, N-acylsulfamoylamino groups, hydroxyamino groups, acyl groups, alkoxycarbonyl groups, aryloxycarbonyl groups, heterocyclyloxycarbonyl groups, carbamoyl groups, N-hydroxycarbamoyl groups, N-acylcarbamoyl groups, N-sulfonylcarbamoyl groups, N-carbamoylcarbamoyl groups or N-sulfamoylcarbamoyl groups. In these sugar structures, there exist α-isomers and β-isomers which are different from each other in the 1-position steric structure and D-isomers and L-isomers which are in a relation of mirror image with each other. In the present invention, however, these isomers are not discriminated from each other. In this case, examples of preferred compounds include auroselenoglucose, auroselenomannose, auroselenogalactose, auroselenolyxose and sugur derivatives thereof.

Next, the compounds represented by formula (PF2) are described below.

In formula (PF2), $X^{21}$ preferably represents O or S, and more preferably O. $Y^{21}$ preferably represents an alkyl group having 1 to 30 carbon atoms, an alkenyl group, an alkynyl group, an aryl group, a 5- to 7-membered hetero ring group containing at least one of N atom, O atom and S atom, $OR^{26}$, $SR^{27}$ or $N(R^{28})R^{29}$; preferably an alkyl group, an aryl group, a hetero ring group, $OR^{26}$, $SR^{27}$ or $N(R^{28})R^{29}$; more preferably an alkyl group, an aryl group, a hetero ring group or $N(R^{28})R^{29}$; and still more preferably an alkyl group, an aryl group or a hetero ring group.

$R^{25}$ to $R^{29}$ each represents a hydrogen atom, an alkyl group, an alkenyl group, an alkynyl group, an aryl group or a hetero ring group; preferably a hydrogen atom, an alkyl group, an aryl group or a hetero ring group; and more preferably an alkyl group or an aryl group.

In formula (PF2), $X^{21}$ and $Y^{21}$ may be bound to each other to form a ring. In this case, the ring is a 3- to 7-membered, nitrogen-containing hetero ring, and examples thereof include pyrroles, indoles, imidazoles, benzimidazoles, thiazoles, benzothiazoles, isoxazoles, oxazoles, benzoxazoles, indazoles, purines, pyridines, pyrazines, pyrimidines, quinolines and quinazolines.

Of the compounds represented by the formula (PF2), preferred compounds are those wherein $X^{21}$ represents O or S; $Y^{21}$ represents an alkyl group, an aryl group, a hetero ring group, $OR^{26}$, $SR^{27}$ or $N(R^{28})R^{29}$; and $R^{26}$ to $R^{29}$ each represents an alkyl group, an aryl group or a hetero ring group. Still more preferred are those wherein $X^{21}$ represents O; and $Y^{21}$ represents an alkyl group, an aryl group or a hetero ring group. Most preferred are those wherein $X^{21}$ represents O; and $Y^{21}$ represents an alkyl group, an aryl group or a hetero ring group.

Next, the compounds represented by formula (PF3) are described below.

In formula (PF3), at least one of $R^{210}$ and $R^{211}$ represents an electron attractive group. The term "electron attractive group" as used herein means a substituent having a positive Hammett's substituent constant $\sigma_p$ value, preferably a $\sigma_p$ value of 0.2 or more, with the upper limit being 1.0. Specific examples of the electron attractive group having a $\sigma_p$ value of 0.2 or more include an acyl group, a formyl group, an acyloxy group, an acylthio group, a carbamoyl group, an alkoxycarbonyl group, an aryloxycarbonyl group, a cyano group, a nitro group, a dialkylphosphono group, diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, an imino group, an imino group substituted by N atom, a carboxy group (or its salt), an alkyl group substituted by at least two halogen atoms, an alkoxy group substituted by at least two halogen atoms, an aryloxy group substituted by at least two halogen atoms, an acylamino group, an alkylamino group substituted by at least two halogen atoms, an alkylthio group substituted by at least two halogen atoms, an aryl group substituted by other electron attractive group having a $\sigma_p$ value of 0.2 or more, a hetero ring group, a halogen atom, an azo group and a selenocyanato group. In the present invention, are preferred an acyl group, a formyl group, a carbamoyl group, an alkoxycarbonyl group, an aryloxycarbonyl group, a cyano group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted by N atom, a phosphoryl group, a carboxy group (or its salt), an alkyl group substituted by at least two halogen atoms, an aryl group substituted by other electron attractive group having a $\sigma_p$ value of 0.2 or more, a hetero ring group or a halogen atom; and more preferred, an acyl group, a carbamoyl group, an alkoxycarbonyl group, an aryloxycarbonyl group, a cyano group, a carboxy group, an alkyl group substituted by at least two halogen atoms, an aryl group substituted by other electron attractive group having a $\sigma_p$ value of 0.2 or more or a hetero ring group.

In formula (PF3), both $R^{210}$ and $R^{211}$ preferably represent electron attractive groups. $R^{212}$ preferably represents a hydrogen atom, an alkyl group, an aryl group, a hetero ring group, an alkoxy group, an aryloxy group, a hetero ring oxy group, an amino group, an acylamino group, an alkylthio group, an arylthio group, a hetero ring thio group, an alkyl- or arylsulfonyl group, an acyl group, an aryloxycarbonyl group, an alkoxycarbonyl group or a carbonyl group; and more preferably, a hydrogen atom, an alkyl group, an aryl group, a hetero ring group, an alkoxy group, an aryloxy group, a hetero ring oxy group, an amino group or an acylamino group.

In formula (PF3), $R^{210}$ $R^{211}$ and $R^{212}$ are also preferably bound to each other to form a ring. The ring to be formed is a non-aromatic carbon ring or hetero ring, and is preferably 5- to 7-membered ring. $R^{210}$ forming the ring is preferably an acyl group, a carbamoyl group, an oxycarbonyl group, a thiocarbonyl group or a sulfonyl group, and $R^{211}$ is preferably an acyl group, a carbamoyl group, an oxycarbonyl group, a thiocarbonyl group, a sulfonyl group, an imino group, an imino group substituted by N atom, an acylamino group or a carbonylthio group.

Of the compounds represented by formula (PF3), preferred are those wherein $R^{210}$ and $R^{211}$ represent electron attractive groups; and $R^{212}$ represents a hydrogen atom, an alkyl group, an aryl group, a hetero ring group, an alkoxy group, an aryloxy group, a hetero ring oxy group, an amino group or an acylamino group. More preferred are those wherein $R^{210}$ and $R^{211}$ represent electron attractive groups; and $R^{212}$ represents a hydrogen atom, an alkyl group, an aryl group or a hetero ring group. Most preferred are those wherein $R^{210}$ and $R^{211}$ represent electron attractive groups; and $R^{212}$ represents a hydrogen atom, an alkyl group, an aryl group or a hetero ring group.

Also, of the compounds represented by formula (PF3), those wherein $R^{210}$ and $R^{211}$ form a 5- to 7-membered non-aromatic ring are also preferred. In this case, $R^{212}$ represents a hydrogen atom, an alkyl group, an aryl group, a hetero ring group, an alkoxy group, an aryloxy group, a hetero ring oxy group, an amino group or an acylamino group. More preferred are those wherein $R^{210}$ and $R^{211}$ form a 5- to 7-membered non-aromatic ring; and $R^{212}$ represents a hydrogen atom, an alkyl group, an aryl group or a hetero ring group. Most preferred are those compounds wherein $R^{210}$ and $R^{211}$ form a 5- to 7-membered non-aromatic ring; and $R^{212}$ represents a hydrogen atom, an alkyl group, an aryl group or a hetero ring group.

Next, the compounds represented by formula (PF4) are described below.

In formula (PF4), the electron attractive group represented by $W^{21}$ is the same as the electron attractive group represented by the foregoing $R^{210}$ and $R^{211}$ and its preferred scope is also the same.

In formula (PF4), preferred examples of $R^{213}$ to $R^{215}$ include a hydrogen atom, a halogen atom, an alkyl group, an alkenyl group, an alkynyl group, an aryl group, a hetero ring group, a cyano group, a carboxy group, a sulfamoyl group, a sulfo group, an alkyl- or aryl-sulfonyl group, an acyl group, an aryloxycarbonyl group, an alkoxycarbonyl group and a carbamoyl group. More preferred examples thereof include a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group and a carbamoyl group.

$W^{21}$ and $R^{213}$ may be bound to each other to form a ring. The ring to be formed is a non-aromatic hydrocarbon ring or a hetero ring, preferably, a 5- to 7-membered ring. $W^{21}$ forming the ring is preferably an acyl group, a carbamoyl group, an oxycarbonyl group, a thiocarbonyl group or a sulfonyl group, and $R^{213}$ is preferably an alkyl group, an alkenyl group, an aryl group or a hetero ring group.

Of the compounds represented by formula (PF4), preferred are those compounds wherein $W^{21}$ represents an electron attractive group; and $R^{213}$ to $R^{215}$ each represents a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group. More preferred are those compounds wherein $W^{21}$ represents an electron attractive group; and $R^{213}$ to $R^{215}$ each represents a hydrogen atom, a halogen atom, an alkyl group, an alkenyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $W^{21}$ represents an electron attractive group; and $R^{213}$ to $R^{215}$ each represents a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group.

Also, of the compounds represented by formula (PF4), those compounds wherein $W^{21}$ and $R^{213}$ are bound to each other to form a non-aromatic 5- to 7-membered ring are preferred as well. In this case, $R^{213}$ represents an alkyl group, an alkenyl group, an aryl group, a hetero ring group or the like, and $R^{214}$ and $R^{215}$ each represents a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group. More preferred are those compounds wherein $W^{21}$ and $R^{213}$ are bound to each other to form a non-aromatic 5- to 7-membered ring; and $R^{214}$ and $R^{215}$ each represents a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $W^{21}$ and $R^{213}$ are bound to each other to form a non-aromatic 5- to 7-membered ring; and $R^{214}$ and $R^{215}$ each represents a hydrogen atom, a halogen atom, an alkyl group, an alkenyl group, an alkynyl group, an aryl group, a hetero ring group, a cyano group, a carboxy group, a sulfo group, an alkyl- or aryl-sulfonyl group, an acyl group, an aryloxycarbonyl group, an alkoxycarbonyl group or a carbamoyl group.

Next, the compounds represented by formula (PF5) are described below.

In formula (PF5), $R^{216}$ is preferably a hydrogen atom, an alkyl group, an aryl group or an acyl group, far preferably a hydrogen atom, an alkyl group or an acyl group, especially preferably an alkyl group. $R^{217}$ and $R^{218}$ each are preferably a hydrogen atom, an alkyl group or an aryl group, far preferably a hydrogen atom or an alkyl group, and the case where one of $R^{217}$ and $R^{218}$ is a hydrogen atom and the other is a hydrogen atom or an alkyl group is especially preferred. $R^{219}$ is preferably a hydrogen atom, an alkyl group or an aryl group, far preferably a hydrogen atom or an alkyl group, especially preferably an alkyl group.

In formula (PF5), though $A^{22}$ represents O, S, Se, Te or $NR^{219}$, the case where $A^{22}$ is O, S or $NR^{219}$ is preferred in the invention, the case where $A^{22}$ is O or S is far preferred, and the case where $A^{22}$ is O is especially preferred.

In formula (PF5), $Z^{21}$ represents a substituent. Examples of such a substituent include the same groups as recited above as substituents. The substituent preferred as $Z^{21}$ in the present invention is a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, an N-sulfamoylcarbamoyl group, a carbazolyl group, a carboxyl group (including salts thereof), a cyano group, a formyl group, a hydroxyl group, an alkoxy group, an aryloxy group, a heterocyclyloxy group, an acyloxy group, a nitro group, an amino group, an (alkyl, aryl or heterocyclyl)amino group, an acylamino group, a sulfonamido group, a ureido group, a thioureido group, an alkylthio group, an arylthio group, a heterocyclylthio group, an (alkyl or aryl)sulfonyl group, an (alkyl or aryl)sulfinyl group, a sulfo group (including salts thereof) or a sulfamoyl group, the substituent far preferred as $Z^{21}$ is a halogen atom, an alkyl group, an aryl group, a heterocyclic group, a carboxyl group (including salts thereof), a hydroxyl group, an alkoxy group, an aryloxy group, a heterocyclyloxy group, an acyloxy group, an amino group, an (alkyl, aryl or heterocyclyl)amino group, an acylamino group, a ureido group, a thioureido group, an alkylthio group, an arylthio group, a heterocyclylthio group or a sulfo group (including salts thereof), and the substituent further preferred as $Z^{21}$ is an alkyl group, an aryl group, a carboxyl group (including salts thereof), a hydroxyl group, an alkoxy group, an aryloxy group, an (alkyl, aryl or heterocyclyl)amino group, a ureido group, an alkylthio group, an arylthio group or a sulfo group (including salts thereof).

In formula (PF5), $n^{22}$ represents an integer of 0 to 4, but the present invention prefers the case that $n^{22}$ represents 0 to 2, far prefers the case that $n^{22}$ represents 0 or 1.

In formula (PF5), cases are preferred where $A^{22}$ represents O, S or $NR^{219}$, $R^{216}$ represents a hydrogen atom, an alkyl group, an aryl group or an acyl group, $R^{217}$ and $R^{218}$ each represent a hydrogen atom, an alkyl group or an aryl group, $R^{219}$ represents a hydrogen atom, an alkyl group or an aryl group, $n^{22}$ represents 0 to 2, and $Z^{21}$ represents an alkyl group, an aryl group, a carboxyl group (including salts thereof), a hydroxyl group, an alkoxy group, an aryloxy group, an (alkyl, aryl or heterocyclyl)amino group, a ureido group, an alkylthio group, an arylthio group or a sulfo group (including salts thereof). And cases are far preferred where $A^{22}$ represents O, S or $NR^{219}$, $R^{216}$ represents an alkyl group, $R^{217}$ and $R^{218}$ each represent a hydrogen atom or an alkyl group, $R^{219}$ represents an alkyl group or an aryl group, $n^{22}$ represents 0 to 2, and $Z^{21}$ represents an alkyl group, an aryl group, a carboxyl group (including salts thereof), a hydroxyl group, an alkoxy group, an aryloxy group, an (alkyl, aryl or heterocyclyl) amino group, a ureido group, an alkylthio group, an arylthio group or a sulfo group (including salts thereof). Further preferred are cases where $A^{22}$ represents O, S or $NR^{219}$, $R^{216}$ represents an alkyl group, $R^{217}$ and $R^{218}$ each represent a hydrogen atom or an alkyl group, $R^{219}$ represents an alkyl group, $n^{22}$ represents 0 to 2, and $Z^{21}$ represents an alkyl group, an aryl group, a carboxyl group (including salts thereof), a hydroxyl group, an alkoxy group, an aryloxy group, an (alkyl, aryl or heterocyclyl)amino group, a ureido group, an alkylthio group, an arylthio group or a sulfo group (including salts thereof). And especially preferred are cases where $A^{22}$ represents O, $R^{216}$ represents an alkyl group, either $R^{217}$ or $R^{218}$ represents a hydrogen atom and the remainder represents a hydrogen atom or an alkyl group, $n^{22}$ represents 0 or 1 and $Z^{21}$ represents an alkyl group, an aryl group, a carboxyl group (including salts thereof), a hydroxyl group, an alkoxy group, an aryloxy group, an (alkyl, aryl or heterocyclyl)amino group, a ureido group, an alkylthio group, an arylthio group or a sulfo group (including salts thereof).

In formulae (PF1) to (PF5), $n^{21}$ represents 0 or 1 and, when $n^{21}$ is 1, $L^{21}$ represents a compound capable of coordinating to gold via an N, S, Se, Te or P atom. Examples of such a compound include substituted or unsubstituted amine compounds (preferably primary, secondary or tertiary arylamine or alkylamine having 1 to 30 carbon atoms), 5- or 6-membered nitrogen-containing heterocyclic rings (which refer to a 5- or 6-membered nitrogen-containing heterocyclic ring made up of any one of combinations of N, O, S and C, and may have a substituent; such a heterocyclic ring may coordinate to gold via its N atom or substituent, and examples thereof include benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine and morpholine), meso-ionic compounds (the term "meso-ionic compound" as used herein refers to a 5- or 6-membered heterocyclic compound which cannot be represented satisfactorily by any one covalent or polar structural formula, but which is a compound having a sextet of it electrons in association with all the atoms forming the ring, wherein the ring bears partially positive charge and this charge is in balance with the same amount of negative charge on out-of-ring atoms or groups; and examples of a meso-ionic ring include an imidazolium ring, a pyrazolium ring, an oxazolium ring, a thiazolium ring, a triazolium ring, a tetrazolium ring, a thiadiazolium ring, an oxadiazolium ring, a thiatriazolium ring and an oxatriazolium ring), thiol compounds (preferably alkylthiols having 1 to 30 carbon atoms, arylthiols having 6 to 30 carbon atoms or 5- to 7-membered ring heterocyclic thiols which contain at least one N, O or S atom), thioether compounds (preferably a compound which contains an S atom combining with any groups selected from alkyl groups having 1 to 30 carbon atoms, aryl groups or 5- to 7-membered ring heterocyclic groups containing at least one N, O or S atom as each individual hetero atom, and which may be symmetric or asymmetric; with examples including dialkyl thioethers, diaryl thioethers, diheterocyclyl thioethers, alkyl aryl thioethers, alkyl heterocyclyl thioethers and aryl heterocyclyl thioethers), disulfide compounds (preferably a compound which contains two S atoms combining respectively with any two groups selected from alkyl groups having 1 to 30 carbon atoms, aryl groups or 5- to 7-membered ring heterocylic groups containing at least one N, O or S atom as each individual hetero atom, and which may be symmetric or asymmetric; with examples including dialkyl disulfides, diaryl disulfides, diheterocyclyl disulfides, alkyl aryl disulfides, alkyl heterocyclyl disulfides and aryl heterocyclyl disulfides, preferably dialkyl disulfides, diaryl disulfides and alkyl aryl disulfides), thioamide compounds (the thioamide may be part of a cyclic structure, or may be a non-cyclic thioamide; useful thioamides can be selected from those disclosed, e.g., in U.S. Pat. Nos. 4,030,925, 4,031,127, 4,080,207, 4,245,037, 4,255,511, 4,266,031 and 4,276,364, and *Research Disclosure*, volume 151, item 15162 (November, 1976), and volume 176, item 17626 (December, 1978); specifically, they include thiourea, thiourethane, dithiocarbamates, 4-thiazoline-2-thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione, which each may be substituted), selenol compounds (preferably alkylselenols having 1 to 30 carbon atoms, arylselenols or 5- to 7-membered heterocyclylselenols containing at least one N, O or S atom), selenoether compounds (preferably a selenoether compound which contains an Se atom combining with alkyl groups having 1 to 30 carbon atoms, aryl groups or heterocylic groups, and which may be symmetric or asymmetric with respect to the Se atom, with examples including dialkyl selenoethers, diaryl selenoethers, diheterocyclyl selenoethers, alkyl aryl selenoethers, alkyl heterocyclyl selenoethers and aryl heterocyclyl selenoethers, preferably dialkyl selenoethers, diaryl selenoethers and alkyl aryl selenoethers), diselenide compounds (preferably a diselenide compound which contains two Se atoms combining respectively with any two groups selected from alkyl groups having 1 to 30 carbon atoms, aryl groups or heterocylic groups, and which may be symmetric or asymmetric with respect to the selenido group, with examples including dialkyl diselenides, diaryl diselenides, diheterocyclyl diselenides, alkyl aryl diselenides, alkyl heterocyclyl diselenides and aryl heterocyclyl diselenides, preferably dialkyl diselenides, diaryl diselenides and alkyl aryl diselenides), selenoamide compounds (with examples including the compounds which correspond to the foregoing thioamide compounds whose S atoms are replaced with Se atoms), tellurol compounds (with examples including the compounds which correspond to the foregoing selenol compounds whose Se atoms are replaced with Te atoms), telluroether compounds (with examples including the compounds which correspond to the foregoing selenoether compounds whose Se atoms are replaced with Te atoms), ditelluride compounds (with examples including the compounds which correspond to the foregoing diselenide compounds whose Se atoms are replaced with Te atoms), telluroamide compounds (with examples including the compounds which correspond to the foregoing selenoamide compounds whose Se atoms are replaced with Te atoms), alkylphosphine compounds (preferably primary, secondary or tertiaryalkylphosphine having 1 to 20 carbon atoms) and arylphosphine compounds (preferably primary, secondary or tertiaryarylphosphine having 1 to 20 carbon atoms).

$L^{21}$ is preferably 5- or 6-membered nitrogen-containing heterocyclic compounds, meso-ionic compounds, thiol compounds, thioether compounds, thioamide compounds, selenol compounds, selenoether compounds, selenoamide compounds, alkylphosphine compounds or arylphosphine compounds; far preferably 5- or 6-membered nitrogen-containing heterocyclic compounds, meso-ionic compounds, thiol compounds, thioether compounds, thioamide compounds, selenol compounds, alkylphosphine compounds or arylphosphine compounds; most preferably meso-ionic compounds, thiol compounds, thioether compounds, thioamide compounds, selenol compounds, alkylphosphine compounds or arylphosphine compounds. And compounds particularly preferred as $L^{21}$ are selected from compounds represented by any of formulae (PL1) to (PL5).

Formula (PL1)

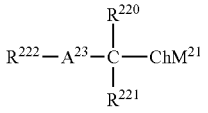

Formula (PL2)

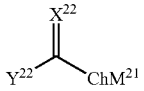

Formula (PL3)

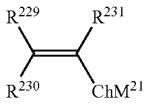

Formula (PL4)

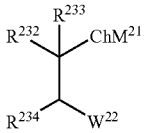

Formula (PL5)

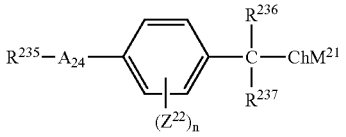

In formulae (PL1) to (PL5), Ch represents S, Se or Te; and $M^{21}$ represents a hydrogen atom or a counter cation for neutralizing electric charge of each compound. In formula (PL1), $A^{23}$ represents O, S or $NR^{223}$; and $R^{220}$, $R^{221}$, $R^{222}$ and $R^{223}$ have the same meanings as the foregoing $R^{21}$, $R^{22}$, $R^{23}$ and $R^{24}$, respectively, and the same goes for individual preferred ranges.

In formula (PL2), $X^{22}$ represents O, S or $NR^{224}$; and $Y^{22}$ represents H, an alkyl group, an alkenyl group, an alkynyl group, an aryl group, a heterocyclic group, $OR^{225}$, $SR^{226}$, or $N(R^{227})R^{228}$. $R^{224}$, $R^{225}$, $R^{226}$, $R^{227}$ and $R^{228}$ have the same meanings as the foregoing $R^{25}$, $R^{26}$, $R^{27}$, $R^{28}$ and $R^{29}$, respectively, and the same goes for individual preferred ranges.

In formula (PL3), $R^{229}$, $R^{230}$ and $R^{231}$ have the same meanings as the foregoing $R^{210}$, $R^{211}$ and $R^{212}$, respectively, and the same goes for individual preferred ranges.

In formula (PL4), $W^{22}$, $R^{232}$, $R^{233}$ and $R^{234}$ have the same meanings as the foregoing $W^{21}$, $R^{213}$, $R^{214}$ and $R^{215}$, respectively, and the same goes for individual preferred ranges.

In formula (PL5), $A_{24}$ represents O, S, Se, Te or $NR^{238}$. $R^{235}$, $R^{236}$, $R^{237}$, $R^{238}$, $Z^{22}$ and $n^{23}$ have the same meanings as the foregoing $R^{216}$, $R^{217}$, $R^{218}$, $R^{219}$, $Z^{21}$ and $n^{22}$, respectively, and the same goes for individual preferred ranges .

When $L^{21}$ is selected from compounds represented by any of formulae (PL1) to (PL5), the compounds represented by any of formulae (PF1) to (PF5) can become symmetric complexes or asymmetric complexes with respect to Au(I). In the present invention, both symmetric and asymmetric complexes are appropriate, but symmetric complexes with respect to Au(I) are more suitable.

In formulae (PL1) to (PL5), Ch represents S, Se or Te, but in the present invention S or Se is preferred and S is far preferred as Ch.

In formulae (PL1) to (PL5), $M^{21}$ represents a hydrogen atom or a counter cation for neutralizing electric charge of each compound. When $M^{21}$ represents a counter cation, it is specifically an inorganic cation such as an alkali metal (e.g., Li, Na, K, Rb, Cs) or an alkaline earth metal (e.g., Mg, Ca, Ba), or an organic cation such as a substituted or unsubstituted ammonium ion or phosphonium ion. However, $M^{21}$ represents neither $Ag^+$ nor $Au^+$ in the invention when it is an inorganic cation. In the invention, $M^{21}$ is preferably a hydrogen atom, an alkali metal cation, an alkaline earth metal cation or a substituted or unsubstituted ammonium ion, far preferably an alkali metal cation or a substituted or unsubstituted ammonium ion, still further preferably an alkali metal cation or a substituted or unsubstituted ammonium ion.

Of compounds represented by formula (PL1), cases are preferred in the invention where $M^{21}$ is an alkali metal cation, Ch is S or Se, $A^{23}$ is O or S, $R^{220}$ and $R^{221}$ are each a hydrogen atom, an alkyl group or an aryl group and $R^{222}$ is an alkyl group or an aryl group. The far preferred are cases where $M^{21}$ is an alkali metal cation, Ch is S, $A^{23}$ is O or S, $R^{220}$ and $R^{221}$ are each a hydrogen atom, an alkyl group or an aryl group and $R^{222}$ is an alkyl group or an aryl group. The especially preferred are cases where the cyclic structure formed by combining $R^{222}$ with $R^{220}$ or $R^{221}$ is glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine, glucuronic acid, any one of their sugar derivatives (corresponding to the cases where $A^{23}$ in formula (PL1) is an oxygen (O) atom), or any one of their sulfur analogs (corresponding to the cases where $A^{23}$ in formula (PL1) is a sulfur (S) atom). As to each of these sugar structures, there exist α- and β-isomers which are different in configuration at the 1-position, and D- and L-bodies which are mirror images of each other, but the present invention draws no distinctions among these isomers. Examples of a compound suitable as $L^{21}$ include thioglucose, thiomannose, thiogalactose, thiolyxose, thioxylose, thioarabinose, selenoglucose, selenomannose, selenogalactose, selenolyxose, selenoxylose, selenoarabinose, telluroglucose, their alkali metal salts, their sulfur analogs, and derivatives thereof.

Of compounds represented by formula (PL2), cases are preferred where $M^{21}$ represents an alkali metal cation, Ch is S or Se, $X^{22}$ is O or S, $Y^{22}$ is H, an alkyl group, an aryl group, a heterocyclic group, $OR^{225}$, $SR^{226}$ or $N(R^{227})R^{228}$, and $R^{224}$ to $R^{228}$ are each an alkyl group, an aryl group or a heterocyclic group. The far preferred are cases where $M^{21}$ represents an alkali metal cation, Ch is S or Se, $X^{22}$ is O, and $Y^{22}$ is an alkyl group, an aryl group or a heterocyclic group. And the optimum are cases where $M^{21}$ represents an alkali metal cation, Ch is S. $X^{22}$ is O, and $Y^{22}$ is an alkyl group, an aryl group or a heterocyclic group.

Of compounds represented by formula (PL3), cases are preferred where $M^{21}$ is an alkali metal cation, Ch is S or Se, $R^{229}$ and $R^{230}$ are each an electron-attracting group, and $R^{231}$ is a hydrogen atom, an alkyl group, an aryl group, a heterocyclic group, an alkoxy group, an aryloxy group, a heterocyclyloxy group, an amino group or an acylamino group. The far preferred are cases where $M^{21}$ is an alkali metal cation, Ch is S or Se, $R^{229}$ and $R^{230}$ are each an electron-attracting group, and $R^{231}$ is a hydrogen atom, an alkyl group, an aryl group or a heterocyclic group. The optimum are case where $M^{21}$ is an alkali metal cation, Ch is S, $R^{229}$ and $R^{230}$ are each an electron-attracting group, and $R^{231}$ is a hydrogen atom, an alkyl group, an aryl group or a heterocyclic group.

Of compounds represented by formula (PL3), compounds having non-aromatic 5- to 7-membered rings formed by binding between $R^{229}$ and $R^{230}$ are also preferred. Herein, $M^{21}$ is an alkali metal cation, Ch is S or Se, $R^{231}$ is a hydrogen atom, an alkyl group, an aryl group, a heterocyclic group, an alkoxy group, an aryloxy group, a heterocyclyloxy group, an amino group or an acylamino group. In formula (PL3) representing far preferred compounds, $R^{229}$ and $R^{230}$ combine to form a non-aromatic 5- to 7-membered ring, $M^{21}$ is an alkali metal cation, Ch is S or Se, and $R^{231}$ is a hydrogen atom, an alkyl group, an aryl group or a heterocyclic group. In the case of optimum compounds, $M^{21}$ is an alkali metal cation, Ch is S, $R^{229}$ and $R^{230}$ combine to form a non-aromatic 5- to 7-membered ring, and $R^{231}$ is a hydrogen atom, an alkyl group, an aryl group or a heterocyclic group.

Of compounds represented by formula (PL4), cases are preferred where $M^{21}$ is an alkali metal cation, Ch is S or Se, $W^{22}$ is an electron-attracting group, and $R^{232}$ to $R^{234}$ are each a hydrogen atom, a halogen atom, an alkyl group, an alkenyl group, an alkynyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group. The far preferred are case where $M^{21}$ is an alkali metal cation, Ch is S or Se, $W^{22}$ is an electron-attracting group, and $R^{232}$ to $R^{234}$ are each a hydrogen atom, a halogen atom, an alkyl group, an alkenyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group. The optimum are case where $M^{21}$ is an alkali metal cation, Ch is S, $W^{22}$ is an electron-attracting group, and $R^{232}$ to $R^{234}$ are each a hydrogen atom, a halogen atom, an alkyl group, an alkenyl group, an alkynyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group.

Of compounds represented by formula (PL4), compounds having nonaromatic 5- to 7-membered rings formed by binding between $W^{22}$ and $R^{232}$ are also preferred. Herein, $M^{21}$ is an alkali metal cation, Ch is S or Se, $R^{26}$ is an alkyl group, an alkenyl group, an aryl group or a heterocyclic group, and $R^{223}$ and $R^{234}$ are each a hydrogen atom, a halogen atom, an alkyl group, an alkenyl group, an alkynyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group. The far preferred are cases where $M^{21}$ is an alkali metal cation, Ch is S or Se, $W^{22}$ and $R^{232}$ combine with each other to form a nonaromatic 5- to 7-membered ring, and $R^{233}$ and $R^{234}$ are each a hydrogen atom, a halogen atom, an alkyl group, an alkenyl group, an alkynyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group. The optimum are cases where $M^{21}$ is an alkali metal cation, Ch is S, $W^{22}$ and $R^{232}$ combine with each other to form a nonaromatic 5- to 7-membered ring, and $R^{233}$ and $R^{234}$ are each a hydrogen atom, a halogen atom, an alkyl group, an alkenyl group, an alkynyl group, an aryl group, a heterocyclic group, a cyano group, a carboxyl group, a sulfo group, an alkyl- or aryl-sulfonyl group, an acyl group, an aryloxycarbonyl group, an alkoxycarbonyl group or a carbamoyl group.

Of compounds represented by formula (PL5), cases are preferred where Ch is S or Se, $A_{24}$ represents O, S or $NR^{238}$, $R^{235}$ is a hydrogen atom, an alkyl group, an aryl group or an acyl group, $R^{236}$ and $R^{237}$ each represent a hydrogen atom, an alkyl group or an aryl group, $R^{238}$ represents a hydrogen atom, an alkyl group or an aryl group, $n^{23}$ represents 0 to 2, and $Z^{22}$ represents an alkyl group, an aryl group, a carboxyl group (including salts thereof), a hydroxyl group, an alkoxy group, an aryloxy group, an (alkyl-, aryl- or heterocyclyl) amino group, a ureido group, an alkylthio group, an arylthio group or a sulfo group (including salts thereof). The far preferred are case where Ch is S or Se, $A_{24}$ represents O, S or $NR^{238}$, $R^{235}$ is an alkyl group, $R^{236}$ and $R^{237}$ each represent a hydrogen atom or an alkyl group, $R^{238}$ represents an alkyl group or an aryl group, $n^{23}$ represents 0 to 2, and $Z^{22}$ represents an alkyl group, an aryl group, a carboxyl group (including salts thereof), a hydroxyl group, an alkoxy group, an aryloxy group, an (alkyl-, aryl- or heterocyclyl)amino group, a ureido group, an alkylthio group, an arylthio group or a sulfo group (including salts thereof). The further preferred are cases where $A_{24}$ represents O, S or $NR^{238}$, $R^{235}$ is an alkyl group, $R^{236}$ and $R^{237}$ each represent a hydrogen atom or an alkyl group, $R^{238}$ represents an alkyl group, $n^{23}$ represents 0 to 2, and $Z^{22}$ represents an alkyl group, an aryl group, a carboxyl group (including salts thereof), a hydroxyl group, an alkoxy group, an aryloxy group, an (alkyl-, aryl- or heterocyclyl)amino group, a ureido group, an alkylthio group, an arylthio group or a sulfo group (including salts thereof). The optimum are case where Ch is S, $A_{24}$ represents O, $R^{235}$ is an alkyl group, either R236 or R237 represents a hydrogen atom and the remainder represents a hydrogen atom or an alkyl group, $n^{23}$ represents 0 to 1, and $Z^{22}$ represents an alkyl group, an aryl group, a carboxyl group (including salts thereof), a hydroxyl group, an alkoxy group, an aryloxy group, an (alkyl-, aryl- or heterocyclyl)amino group, a ureido group, an alkylthio group, an arylthio group or a sulfo group (including salts thereof).

Compounds represented by any of formulae (PL1) to (PL5) can be synthesized in accordance with the method disclosed in JP-A-2004-4446.

Of compounds represented by any of formulae (PL1) to (PL5), those represented by any of formulae (PL1), (PL2) and (PL5) are preferred as $L^{21}$, those represented by either formula (PL1) or (PL5) are far preferred as $L^{21}$, and those represented by formula (PL1) are especially preferred as $L^{21}$.

Then, compounds represented by formula (PF6) are described.

In formula (PF6), $J^{21}$ represents a counter anion. Examples of such a counter anion include a halogen ion (e.g., $F^-$, $Cl^-$, $Br^-$, $I^-$), a tetrafluoroboronate ion ($BF_4^-$), a hexafluorophosphonate ion ($PF_6^-$), a hexafluoroantimonate ion ($SbF_6^-$), an arylsulfonate ion (e.g., p-toluenesulfonate ion), an alkylsulfonate ion (e.g., methanesulfonate ion, trifluoromethanesulfonate ion) and a carboxylate ion (e.g., acetate ion, trifluoroacetate ion, benzoate ion). Additionally, it is preferable that these counter anions do not have any groups capable of adsorbing to gold, typified by a mercapto group (—SH), a thioether group (—S—), a selenoether group (—Se—) and a telluroether group (—Te—).

In the present invention, $J^{21}$ is preferably a halogen ion, a tetrafluoroboronate ion, a hexafluorophosphonate ion, an arylsulfonate ion or an alkylsulfonate ion, far preferably a halogen ion, a tetrafluoroboronate ion or a hexafluorophosphonate ion, further preferably a halogen ion. Of halogen ions, $Cl^-$, $Br^-$ or $I^-$ is preferred, $Cl^-$ or $Br^-$ is far preferred, and $Cl^-$ is further preferred.

In formula (PF6), $Q^{21}$ and $Q^{22}$ are selected from the compounds represented by any of formulae (SE1) to (SE3) illustrated hereinbefore.

When $Q^{21}$ or $Q^{22}$ is a compound represented by formula (SE1), it is preferable that each of $M^1$ and $M^2$ is a hydrogen atom, an alkyl group, an alkenyl group, an aryl group, a heterocyclic group or an acyl group, Q is an alkyl group, an alkenyl group, an aryl group or $NM^4M^5$, and $M^4$ and $M^5$ are hydrogen atoms, alkyl groups, alkenyl groups, aryl groups or heterocyclic groups. Cases are far preferred where each of $M^1$ and $M^2$ is a hydrogen atom, an alkyl group, an alkenyl group or an aryl group, Q is an alkyl group, an aryl group or $NM^4M^5$, and $M^4$ and $M^5$ are hydrogen atoms, alkyl groups, alkenyl groups or aryl groups. And cases are further preferred where each of $M^1$ and $M^2$ is a hydrogen atom, an alkyl group or an aryl group, Q is $NM^4M^5$, and $M^4$ and $M^5$ are hydrogen atoms, alkyl groups or aryl groups.

When $Q^{21}$ or $Q^{22}$ is a compound represented by formula (SE2), it is preferable that $X^1$ to $X^3$ each represent an alkyl group, an aryl group or a heterocyclic group, and it is preferable by far that $X^1$ to $X^3$ each represent an aryl group.

When $Q^{21}$ or $Q^{22}$ is represented by formula (SE3), it is preferred that $E^1$ and $E^2$ are each selected from formulae (T2) to (T4), it is far preferred that either $E^1$ or E2 is selected from formula (T4) and the remainder is selected from formula (T2), (T3) or (T4), it is further preferred that either $E^1$ or $E^2$ is selected from formula (T4) and the remainder is selected from formula (T3) or (T4), and it is especially preferred that both $E^1$ and $E^2$ are selected from formula (T4).

Of the compounds represented by formula (PF6) in the present invention, the preferred are cases where $J^{21}$ is a halogen ion, a tetrafluoroboronate ion, a hexafluorophosphonate ion, an arylsulfonate ion or an alkylsulfonate ion, $n^{23}$ is 0 or 1, and $Q^{21}$ and $Q^{22}$ are each selected from compounds represented by formula (SE1) or formula (SE3), the far preferred are cases where $J^{21}$ is a halogen ion, a tetrafluoroboronate ion or a hexafluorophosphonate ion, $n^{23}$ is 0 and $Q^{21}$ is selected from compounds represented by formula (SE3), and the further preferred are cases where $J^{21}$ is a halogen ion, $n^{23}$ is 0 and $Q^{21}$ is selected from compounds represented by formula (SE3).

Of the compounds represented by any one of formulae (PF1) to (PF6), preferred compounds are those represented by any one of formulae (PF1), (PF5) and (PF6), more preferred are those represented by formula (PF1) or (PF6), most preferred are those represented by formula (PF6).

Next, specific examples of the compounds represented by any one of formulae (PF1) to (PF6) are shown below which, however, do not limit the present invention. Also, as to compounds with which a plurality of steric isomers exist, they do not limit the steric structures thereof. Additionally, Et, Me, i-Pr, Ph, Bn and Ac in the above exemplified compounds stand for an ethyl group, a methyl group, an isopropyl group, a phenyl group, a benzyl group and an acetyl group, respectively.

PF1-1

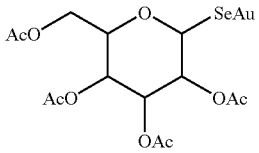

PF1-2

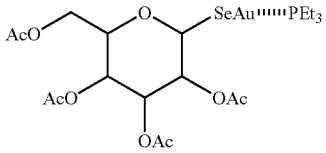

PF1-3

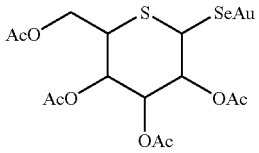

PF1-4

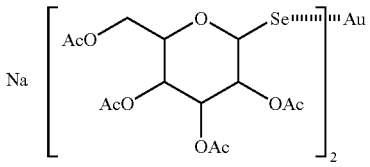

PF1-5

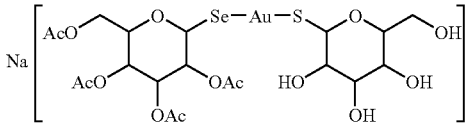

PF1-6

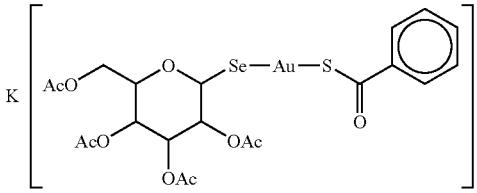

PF1-7

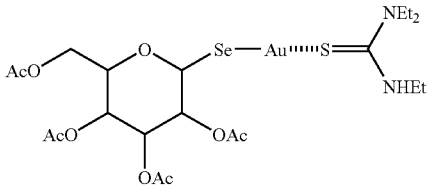

PF1-8

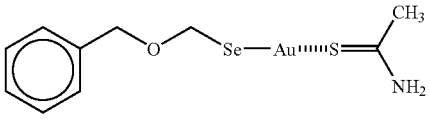

-continued

PF1-9

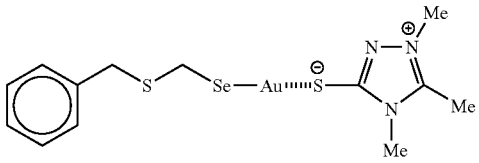

PF1-10

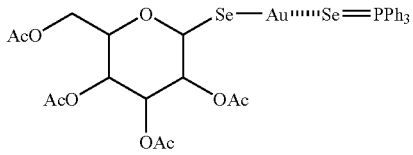

PF2-1

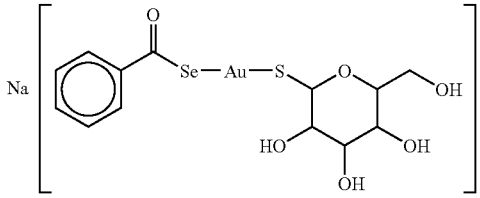

PF2-2

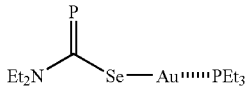

PF2-3

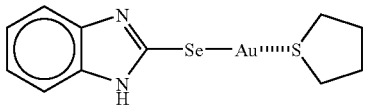

PF2-4

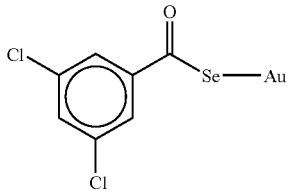

PF2-5

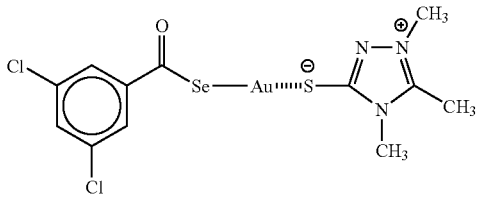

PF2-6

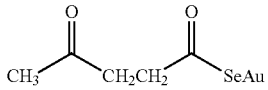

PF2-7

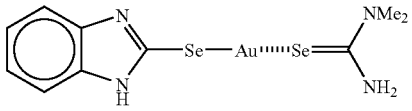

-continued
PF2-8
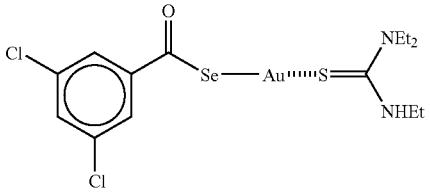
PF2-9
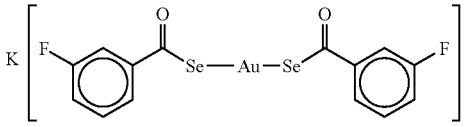
PF2-10
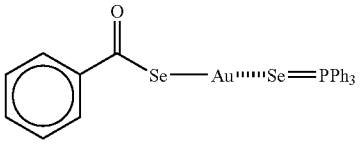
PF3-1
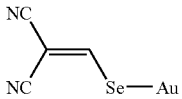
PF3-2
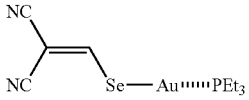
PF3-3
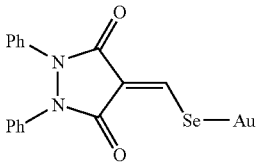
PF3-4
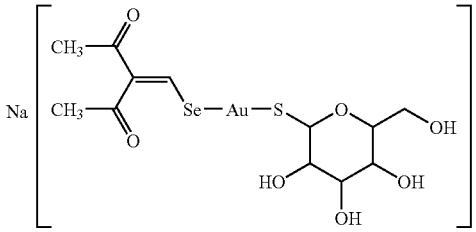
PF3-5
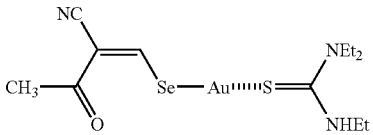
PF3-6
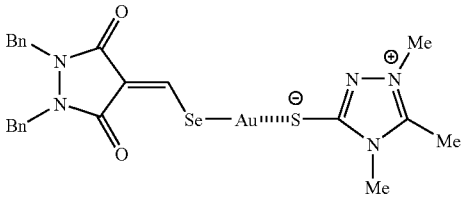
-continued
PF3-7
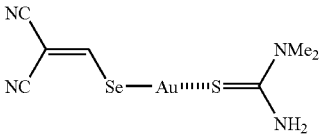
PF3-8
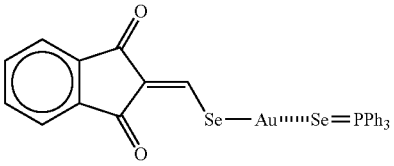
PF3-9
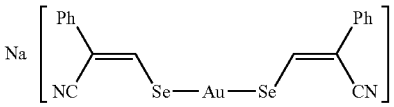
PF3-10
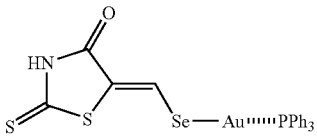
PF4-1
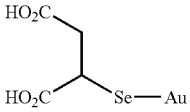
PF4-2
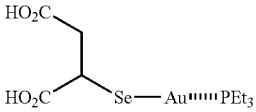
PF4-3
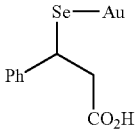
PF4-4
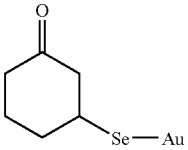
PF4-5
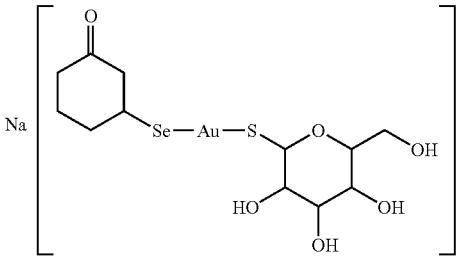
PF4-6
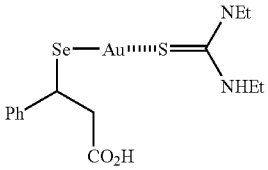

-continued
PF4-7
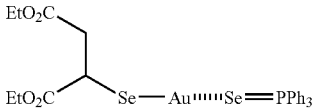
PF4-8
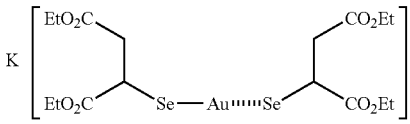
PF4-9
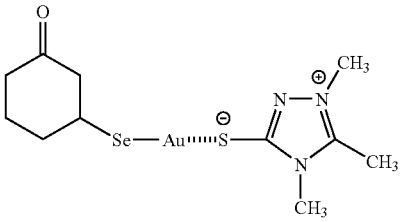
PF4-10
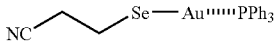
PF5-1
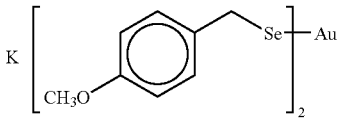
PF5-2
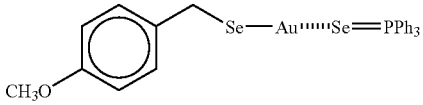
PF5-3
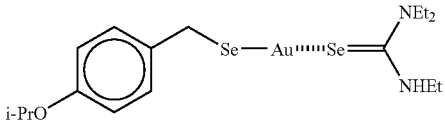
PF5-4
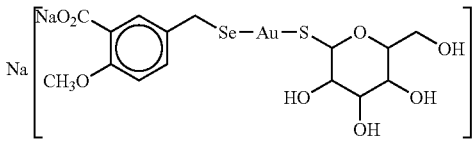
PF5-5
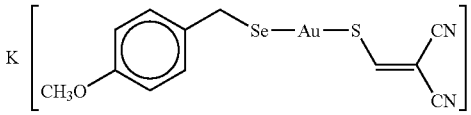
PF5-6
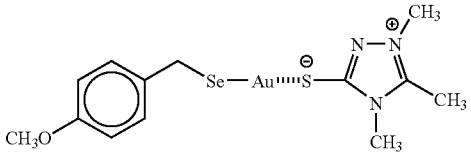
PF5-7
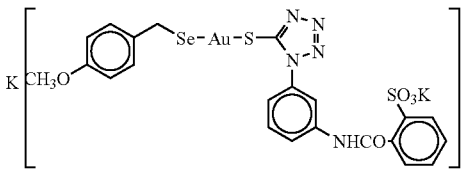
-continued
PF5-8
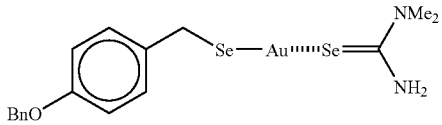
PF5-9
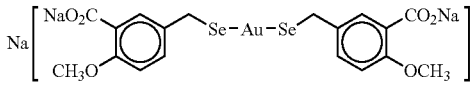
PF5-10
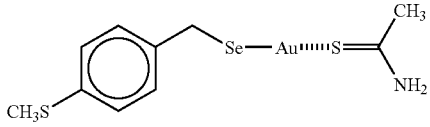
PF6-1
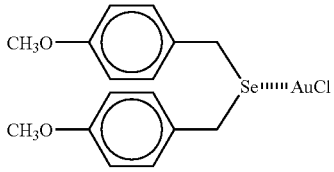
PF6-2
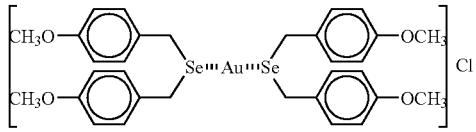
PF6-3 $Ph_3P{=}Se{\cdots}AuCl$
PF6-4
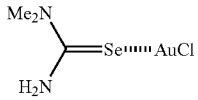
PF6-5 $[Ph_3P{=}Se{\cdots}Au{\cdots}Se{=}PPh_3]\ Cl$
PF6-6
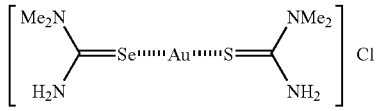
PF6-7
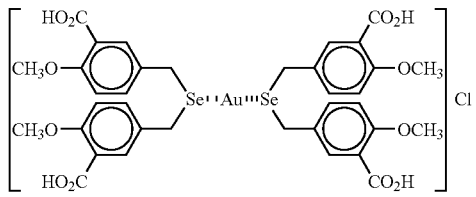
PF6-8
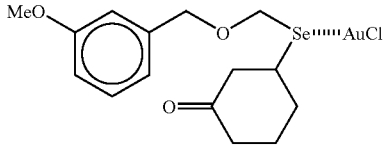

-continued

PF6-9

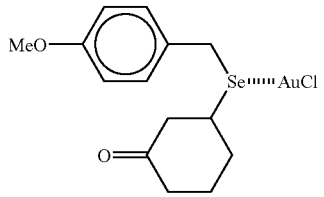

PF6-10

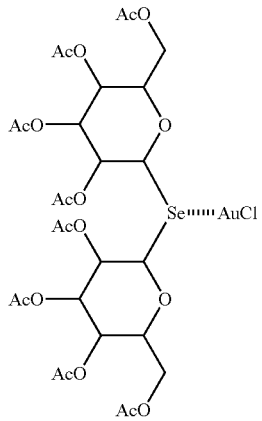

The addition amount of the compound represented by any one of formulae (PF1) to (PF6) that can be used in the invention widely varies depending upon the cases, but is generally $1\times10^{-7}$ to $5\times10^{-3}$ mol, preferably $5\times10^{-6}$ to $5\times10^{-4}$ mol, per mol of silver halide.

The compounds represented by any one of formulae (PF1) to (PF6) may be dissolved in water, an alcohol (such as methanol or ethanol), a ketone (such as acetone) an amide (such as dimethylformamide), a glycol (such as methylpropylene glycol) or an ester (such as ethyl acetate) to add, or may be added as a solid dispersion (fine crystal dispersion) prepared by a known dispersing method.

Addition of the compounds of the present invention represented by any one of formulae (PF1) to (PF6) may be conducted at any stage in the production of the emulsion, but is preferably conducted after formation of silver halide grains and before completion of the chemically sensitizing step. As to the compounds represented by formulae (PF1) to (PF6), only one kind thereof may be used, or two or more kinds thereof may be mixed and used in one and the same layer or in two or more layers. Further, they may be used concurrently with other selenium sensitizers.

The compounds represented by any of formulae (PF1) to (PF6) can be synthesized in accordance with the method disclosed in JP-A-2004-280026.

As selenium sensitizers used in the invention, SE1-2, SE2-1, SE2-12, SE3-16 and SE3-31 are preferred, SE3-4, SE3-9, SE3-17, SE3-29 and SE3-37 are far preferred, PF2-5, PF3-6, PF4-3 and PF5-7 are further preferred, and PF1-1 and PF6-1 are especially preferred.

The selenium compound as a selenium sensitizer used in the silver halide color photographic material of the present invention is preferably Compound (SE1-2), (SE2-1), (SE2-12), (SE3-16), (SE3-31), (SE3-4), (SE3-17) or (SE3-37), and the gold-selenium compound is preferably Compound (PF2-5), (PF3-6), (PF4-3), (PF5-7), (SE3-9), (SE3-29), (PF1-1) or (PF6-1).

Silver halide emulsions are chemically sensitized in ordinary cases.

In the present invention, silver halide emulsions can undergo selenium sensitization in combination with another chemical sensitization. As the chemical sensitization, sulfur sensitization (notably sensitization by addition of an unstable sulfur compound), precious metal sensitization (notably gold sensitization), or reduction sensitization can be used alone or as combinations thereof For the chemical sensitization, the compounds disclosed in JP-A-62-215272, page 18, lower right column, to page 22, upper right column, are preferably used. Of the silver halide emulsions, those sensitized with gold compounds are preferred over the others.

In the invention, gold sensitization and other precious metal sensitization besides sulfur sensitization and tellurium sensitization can also be employed in combination. A gold sensitizer preferably used in combination is colloidal gold sulfide or a gold complex having a stability constant $\log\beta_2$ of 21 to 35. In addition to these gold sensitizers, generally used gold compounds (e.g., chloroaurates, potassium chloroaurate, auric trichloride, potassium auricthiocyanate, potassium iodoaurate, tetracyanoauric acid, ammonium aurothiocyanate, pyridyltrichlorogold) can also be used.

Further, it is possible to use reduction sensitizers in combination with the sensitizers as recited above. Examples of the reduction sensitizer include stannous chloride, aminoiminomethanesulfinic acid, hydrazine derivatives, borane compounds, silane compounds, and polyamine compounds.

Furthermore, it is preferable in the present invention that the chemical sensitization using the selenium compound as recited above is carried out in the presence of a silver halide solvent. Examples of a silver halide solvent usable therein include thiocyanates (such as potassium thiocyanate), thioether compounds (such as the compounds described in U.S. Pat. Nos. 3,021,215 and 3,271,157, JP-B-58-30571 and JP-A-60-136736, especially 3,6-dithia-1,8-octanediol), tetrasubstituted thiourea compounds (such as the compounds described in JP-B-59-11892 and U.S. Pat. No. 4,221,863, especially tetramethylthiourea), the thione compounds described in JP-B-60-11341, the mercapto compounds described in JP-B-63-29727, the meso-ionic compounds described in JP-A-60-163042, the selenoether compounds described in U.S. Pat. No. 4,782,013, the telluroether compounds described in Japanese patent application No. 63-17474, and sulfites. Of these solvents, the thiocyanates, the thioether compounds, the tetrasubstituted thiourea compound and the thione compounds are more preferred. The amount of a silver halide solvent used is from about $1\times10^{-5}$ to $1\times10^{-2}$ mole per mole of silver halide.

Metals (complexes) used in the silver halide color photographic materials of the invention are described below.

The silver halide emulsions preferably contain iridium. It is preferable that the iridium is in a state of forming an iridium complex, and a six-coordinate complex having iridium as its center metal and six ligands is appropriate for homogeneous incorporation into silver halide grains. One appropriate mode of iridium used in the present silver halide color photographic material is a 6-coordinate complex in which the center metal is an iridium (Ir) atom and some ligands are chlorine (Cl), bromine (Br) or iodine (I) atoms, preferably a 6-coordinate complex in which the center metal is an iridium (Ir) atom and all the six ligands are chlorine (Cl), bromine (Br) or iodine (I) atoms. In this case, chlorine atoms, bromine atoms and iodine atoms may be intermingled in the six-coordinate iridium complex. In order to attain hard gradation under high illumination intensity exposure, it is especially advantageous that the 6-coordinate complex having an iridium (Ir) atom as the center metal and chlorine (Cl), bromine (Br) or iodine (I) atoms as some of the ligands is incorporated into a silver bromide-containing phase.

Examples of a 6-coordinate complex in which the center metal is an iridium (Ir) atom and all the six ligands are chlorine (Cl), bromine (Br) or iodine (I) atoms include $[IrCl_6]^{2-}$, $[IrCl_6]^{3-}$, $[IrBr_6]^{2-}$, $[IrBr_6]^{3-}$ and $[IrI_6]^{3-}$, but not limited to these complex ions.

Another appropriate mode of an iridium-containing compound is preferably a 6-coordinate complex having an iridium atom as the center metal and at least one ligand other than halogen atoms and cyano ligands, preferably a 6-coordinate complex having Ir as the center metal and a water molecule ($H_2O$), OH, an oxygen atom (O), OCN, an unsubstituted or substituted thiazole or an unsubstituted or substituted thiadiazole as one of the ligands, far preferably a 6-coordinate complex in which the center metal is Ir and at least one of the ligands is a water molecule ($H_2O$), OH, an oxygen atom (O), OCN, or an unsubstituted or substituted thiazole and the remainder ligands are chlorine (Cl), bromine (Br) or iodine (I) atoms. And an especially preferred 6-coordinate complex has Ir as the center metal, 5-methylthiazole, 2-chloro-5-fluorothiadiazole or 2-bromo-5-fluorothiadiazole as one or two of the ligands and Cl, Br or I atoms as the remainder of the ligands.

Examples of a 6-coordinate complex having an iridium (Ir) atom as the center metal, at least one water molecule ($H_2O$), OH, oxygen atom (O), OCN, or unsubstituted or substituted thiazole, as its ligand, and chlorine (Cl), bromine (Br) or iodine (I) atoms as the remainder of ligands include $[Ir(H_2O)Cl_5]^{2-}$, $[Ir(OH)Br_5]^{3-}$, $[Ir(OCN)Cl_5]^{3-}$, $[Ir(thiazole)Cl_5]^{2-}$, $[Ir(5\text{-methylthiazole})Cl_5]^{2-}$, $[Ir(2\text{-chloro-5-fluorothiadiazole})Cl_5]^{2-}$ and $[Ir(2\text{-bromo-5-fluorothiadiazole})Cl_5]^{2-}$, which, however, do not limit the present invention.

Besides containing the foregoing iridium complexes, silver halide emulsions preferably contain 6-coordinate complexes having CN ligands and iron, ruthenium, rhenium or osmium as their individual center metals, such as $[Fe(CN)_6]^{4-}$, $[Fe(CN)_6]^{3-}$, $[Ru(CN)_6]^{4-}$, $[Re(CN)_6]^{4-}$ and $[Os(CN)_6]^{4-}$. It is preferable that the silver halide emulsions used in the present silver halide color photographic materials further contain pentachloronitrosyl or pentachlorothionitrosyl complexes having ruthenium, rhenium and osmium atoms their individual center metals, and 6-coordinate complexes having a rhodium atom as the centermetal and chlorine, bromine or iodine atoms as their ligands. These ligands may be partially aquated.

The foregoing metal complexes are anionic ions. When these are formed into salts with cationic ions, counter cationic ions are preferably those easily soluble in water. Preferable examples thereof include an alkali metal ion, such as a sodium ion, a potassium ion, a rubidium ion, a cesium ion, and a lithium ion; an ammonium ion, and an alkyl ammonium ion. These metal complexes can be used being dissolved in water or in a mixed solvent of water and an appropriate water-miscible organic solvent (such as alcohols, ethers, glycols, ketones, esters, and amides). The amount of each of these metal complexes added during the grain formation is preferably from $1\times10^{-10}$ mole to $1\times10^{-3}$ mole, particularly preferably from $1\times10^{-9}$ mole to $1\times10^{-5}$ mole, per mole of silver, though the optimum amount depends on the species.

These metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to employ a method in which the metal complex is doped into a silver halide grain, by preparing fine particles doped with the complex in advance and adding the fine particles for carrying out physical ripening. Further, it is also preferable that these methods may be combined, to incorporate the complex into the inside of the silver halide grains.

In the case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free of the complex. Further, as disclosed in U.S. Pat. Nos. 5,252,451 and 5,256,530, it is also preferred that the silver halide grains be subjected to physical ripening in the presence of fine grains having the metal complexes incorporated therein, to modify the grain surface phase. Further, these methods may be used in combination. Two or more kinds of complexes may be incorporated in the inside of an individual silver halide grain. There is no particular limitation on the halogen composition at the site where the above-mentioned metal complexes are incorporated, but it is preferable that the hexacoordinate complex whose central metal is iridium (Ir) atom and whose six ligands are all Chlorine (Cl), Bromine (Br) or iodine (I) atoms be incorporated into maximum silver-bromide concentration region(s).

It is preferable that the specific silver halide emulsion used in the first embodiments of the present invention contains a compound represented by the following formula (D1).

$$[M^{D1}X^{D1}_{n1}L^{D1}_{(6-n1)}]^{m1} \qquad \text{Formula (D1)}$$

In formula (D1), $M^{D1}$ represents Cr, Mo, Re, Fe, Ru, Os, Co, Rh, Pd, or Pt; $X^{D1}$ represents a halogen ion; $L^{D1}$ represents a ligand different from $X^{D1}$; n1 represents an integer of 3, 4, 5, or 6; and m1 represents the electric charge of the metal complex and is 4−, 3−, 2−, 1−, 0, or 1+. Herein, plural $X^{D1}$s may be the same or different each other. When plural $L^{D1}$s exist, the plural $L^{D1}$s may be the same or different each other. However, among ligands each of the metal complexes represented by formula (D1) has, no or only one ligand is cyano (CN—) ligand.

Among the metal complexes represented by formula (D1), metal complexes represented by formula (D1A) are preferred.

$$[M^{D1A}X^{D1A}_{n3}L^{D1A}_{(6-n3)}]^{m3} \qquad \text{Formula (D1A)}$$

In formula (D1A), $M^{D1A}$ represents Re, Ru, Os, or Rh; $X^{D1A}$ represents a halogen ion; $L^{D1A}$ represents NO or NS when $M^{D1A}$ is Re, Ru, or Os, while $L^{D1A}$ represents $H_2O$, OH, or O when $M^{D1A}$ is Rh; n3 represents an integer of 3, 4, 5, or 6; and m3 represents an electronic charge of the metal complex and is 4−, 3−, 2−, 1−, 0, or 1+. $X^{D1A}$ has the same meanings as $X^{D1}$ in formula (D1) and preferable ranges are also identical.

Here, from 3 to 6 $X^{D1A}$s may be the same or different from each other. When $L^{D1A}$ is present in plurality, these plural $L^{D1A}$s may be the same or different from each other.

These metal complexes can be synthesized by reference to, e.g., Shogen Nakahara, *Muki-Kapobutsu Sakutai Jiten* (Dictionary of Inorganic Compounds and Complexes), compiled by Kodansha Scientific, published on Jun. 10, 1997 by Kodansha Ltd.; *Jikken Kapaku Koza* (Lectures on Experimental Chemistry), 4th Ed., Vol. 17, Maruzen Co., Ltd.; *Gmelin Handbook of Inorganic and Organometallic Chemistry; Comprehensive Coordination Chemistry*, Volume 4, Middle Transition Elements, Pergamon Press; and Kagehei Ueno (editor), *Chelate Kagaku* (1) *to* (6), Nankodo Co., Ltd. In addition to these books, U.S. Pat. No. 5,360,712, JP-A-2001-302558, JP-A-2002-155055, JP-A-2002-274855, JP-A-2002-357879 and JP-A-2003-95661 can be also referred to for the syntheses.

Preferable specific examples of the metal complexes represented by formula (D1) are shown below. However, the present invention is not limited to these complexes.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{3-}$
$[OsCl_6]^{2-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

Among them, $[RuCl_5(NO)]^{2-}$, $[OsCl_5(NO)]^{2-}$, $[RhBr_6]^{3-}$ and $[RhCl_6]^{3-}$ are particularly preferable, and $[RuCl_5(NO)]^{2-}$ is particularly preferable.

It is also preferable that the specific silver halide emulsion used in the first embodiment of the present invention contains a compound represented by the following formula (D2).

$$[IrX^{D2}_{n2}L^{D2}_{(6-n2)}]^{m2} \qquad \text{Formula (D2)}$$

In formula (D2), $X^{D2}$ represents a halogen ion or a pseudohalogen ion (other than a cyanate ion $OCN^-$); $L^{D2}$ represents a ligand different from $X^{D2}$; n2 represents an integer of 3, 4, or 5; and m2 represents an electric charge of the metal complex and is 4−, 3−, 2−, 1−, 0, or 1+. Herein, plural $X^{D2}$s may be the same or different each other. When plural $L^{D2}$s are present, these plural $L^{D2}$s may be the same or different each other.

In the above, the pseudohalogen (halogenoid) ion means an ion having a nature similar to that of halogen ion, and examples of the same include cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), fulminate ion ($ONC^-$), and azide ion ($N_3^-$), but do not include cyanate ion ($OCN^-$).

$X^{D2}$ is preferably a fluoride ion, a chloride ion, a bromide ion, an iodide ion, a cyanide ion, an isocyanate ion, a thiocyanate ion, a nitrate ion, a nitrite ion, or an azide ion. Among these, chloride ion and bromide ion are particularly preferable. $L^{D2}$ is not particularly limited, and it may be an organic or inorganic compound that may or may not have electric charge(s), with organic or inorganic compounds with no electric charge being preferable.

Among the metal complexes represented by the formula (D2), metal complexes represented by the following formula (D2A) are preferred.

$$[IrX^{D2A}_{n4}L^{D2A}_{(6-n4)}]^{m4} \qquad \text{Formula (D2A)}$$

In formula (D2A), $X^{D2A}$ represents a halogen ion or a pseudohalogen ion other than a cyanate ion. $L^{D2A}$ represents an inorganic ligand different from $X^{D2A}$. n4 represents an integer of 3, 4, or 5. m4 represents the electric charge of the metal complex and is 4−, 3−, 2−, 1−, 0, or 1+. In formula (D2A), $X^{D2A}$ has the same meanings as $X^{D2}$ in formula (D2) and preferred ranges are also identical. $L^{D2A}$ is preferably water (aqua; $H_20$), OCN, ammonia ($NH_3$), phosphine ($PH_3$), and carbonyl (CO), with water ($H_2O$) being particularly preferred.

Herein, from 3 to 5 $X^{D2A}$s may be the same or different. When plural $L^{D2A}$s are present, these plural $L^{D2A}$s may be the same or different.

Among the metal complexes represented by formula (D2), metal complexes represented by the following formula (D2B) are further preferred.

$$[IrX^{D2B}_{n5}L^{D2B}_{(6-n5)}]^{m5} \qquad \text{Formula (D2B)}$$

In formula (D2B), $X^{D2B}$ represents a halogen ion or a pseudohalogen ion other than cyanate ion; $L^{D2B}$ represents a ligand having a chained or cyclic hydrocarbon as a basic structure, or a ligand in which a portion of carbon atoms or hydrogen atoms of the basic structure is substituted with other atoms or atom groups; n5 represents an integer of 3, 4, or 5; m5 represents the electric charge of the metal complex and is 4−, 3−, 2−, 1−, 0, or 1+. $X^{D2B}$ has the same meanings as $X^{D2}$ in formula (D2) and preferable ranges are also identical. $L^{D2B}$ represents a ligand having a chain or cyclic hydrocarbon as a basic structure, or a ligand in which a portion of carbon atoms or hydrogen atoms of the basic structure is substituted with other atoms or atom groups, but it is not a cyanide ion. $L^{D2B}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Herein, from 3 to 5 $X^{D2B}$s may be the same or different. When plural $L^{D2B}$s are present, these plural $L^{D2B}$s may be the same or different.

Among the metal complexes represented by formula (D2B), metal complexes represented by formula (D2C) are more preferred.

$$[IrX^{D2C}_{n6}L^{D2C}_{(6-n6)}]^{m6} \qquad \text{Formula (D2C)}$$

In formula (D2C), $X^{D2C}$ represents a halogen ion or a pseudohalogen ion other than a cyanate ion; $L^{D2C}$ represents a 5-membered ring ligand having at least one nitrogen atom and at least one sulfur atom in its ring skeleton that may have a substituent on the carbon atoms in said ring skeleton; n6 represents an integer of 3, 4, or 5; and m6 represents the electric charge of the metal complex and is 4−, 3−, 2−, 1−, 0, or 1+.

$X^{D2C}$ has the same meanings as $X^{D2}$ in formula (D2) and preferable ranges are also identical. The substituent on the carbon atoms in said ring skeleton in $L^{D2C}$ is preferably a substituent having a smaller volume than n-propyl group. Preferred examples of the substituent include a methyl group, an ethyl group, a methoxy group, an ethoxy group, a cyano group, an isocyano group, a cyanate group, an isocyanate group, a thiocyanate group, a isothiocyanate group, a formyl group, a thioformyl group, a hydroxyl group, a mercapto group, an amino group, a hydrazino group, an azido group, a nitro group, a nitroso group, a hydroxyamino group, a carboxyl group, a carbamoyl group, a fluoro, chloro, bromo, and iodo.

Herein, from 3 to 5 $X^{D2C}$s may be the same or different. When plural $L^{D2C}$s are present, these plural $L^{D2C}$s may be the same or different.

Among the metal complexes represented by formula (D2C), metal complexes represented by formula (D2D) are more preferred.

$$[IrX^{D2D}_{n7}L^{D2D}_{(6-n7)}]^{m7} \quad \text{Formula (D2D)}$$

In formula (D2D), $X^{D2D}$ represents a halogen ion or a pseudohalogen ion other than a cyanate ion; $L^{D2D}$ represents a 5-membered ring ligand having at least two nitrogen atoms and at least one sulfur atom in its ring skeleton that may have a substituent on the carbon atoms in said ring skeleton; n7 represents an integer of 3, 4, or 5; and m7 represents the electric charge of the metal complex and is 4−, 3−, 2−, 1−, 0, or 1+.

$X^{D2D}$ has the same meanings as $X^{D2}$ in formula (D2) and preferable ranges are also identical. $L^{D2D}$ is preferably a compound containing thiadiazole as a skeleton, and a substituent other than hydrogen is preferably bonded to the carbon atoms in the compound. Preferred examples of the substituent include a halogen atom (such as fluorine, chlorine, bromine, iodine), a methoxy group, an ethoxy group, a carboxyl group, a methoxycarboxyl group, an acyl group, an acetyl group, a chloroformyl group, a mercapto group, a methylthio group, a thioformyl group, a thiocarboxyl group, a dithiocarboxyl group, a sulfino group, a sulfo group, a sulfamoyl group, a methylamino group, a cyano group, an isocyano group, a cyanato group, an isocyanato group, a thiocyanato group, a hydroxyamino group, a hydroxyimino group, a carbamoyl group, a nitroso group, a nitro group, a hydrazino group, a hydrazono group, and an azido group; more preferred examples include a halogen atom (fluorine, chlorine, bromine, iodine), a chlorofornyl group, a sulfino group, a sulfo group, a sulfamoyl group, an isocyano group, a cyanato group, an isocyanato group, a thiocyanato group, a hydroxyimino group, a nitroso group, a nitro group, and an azido group. Among them, chlorine, bromine, a chloroformyl group, an isocyano group, a cyanato group, an isocyanato group, and a thiocyanato group are particularly preferred. n7 preferably represents 4 or 5, and m7 preferably represents 2− or 1−.

Herein, from 3 to 5 $X^{D2D}$s may be the same or different. When plural $L^{D2D}$s are present, these plural $L^{D2D}$s may be the same or different.

Preferable specific examples of the metal complexes represented by formula (D2) are shown below. However, the present invention is not limited to these complexes.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{3-}$
$[IrCl_5(OH)]^{2-}$
$[IrCl_4(OH)_2]^{2-}$
$[IrCl_5(O)]^{4-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{3-}$
$[IrBr_5(OH)]^{2-}$
$[IrBr_4(OH)_2]^{2-}$
$[IrBr_5(O)]^{4-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ Among them, $[IrCl_5(H_2O)]^{2-}$, $[IrCl_5(thiazole)]^{2-}$, and $[IrCl_5(5\text{-methylthiazole})]^{2-}$ are particularly preferred.

The foregoing metal complexes represented by formula (D1) or (D2) are anions, or they are electrically neutral. When the anions combine with cations to form salts, it is preferable that these counter cations have high solubility in water. Preferable examples thereof include an alkali metal ion, such as a sodium ion, a potassium ion, a rubidium ion, a cesium ion, and a lithium ion; an ammonium ion, and an alkyl ammonium ion. These metal complexes can be used being dissolved in water or in a mixed solvent of water and an appropriate water-miscible organic solvent (such as alcohols, ethers, glycols, ketones, esters, and amides). The metal complexes of formula (D1) are added in amounts of, preferably 1×10−11 mole to 1×10−6 mole, and particularly preferably 1×10−10 mole to 1×10−7 mole, per mole of silver atom, during grain formation. These metal complexes of formula (D2) are added in amounts of, preferably 1×10−10 mole to $1\times10^{-3}$ mole, and particularly preferably $1\times10^{-8}$ mole to $1\times10^{-5}$ mole, per mole of silver atom, during grain formation.

In the present invention, the above-mentioned metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to employ a method in which the metal complex is doped into a silver halide grain, by preparing fine particles doped with the complex in advance and adding the fine particles for carrying out physical ripening. Further, it is also preferable that these methods may be combined, to incorporate the complex into the inside of the silver halide grains.

In the case where these metal complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free of the complex. Further, as disclosed in U.S. Pat. Nos. 5,252,451 and 5,256,530, it is also preferred that the silver halide grains be subjected to physical ripening in the presence of fine grains having the metal complexes incorporated therein, to modify the grain surface phase. Further, these methods may be used in combination. Two or more kinds of complexes may be incorporated in the inside of an individual silver halide grain.

In the present invention, it is advantageous to use two or more, preferably three or more, kinds of iridium complexes.

In the first embodiment of the present invention, the specific silver halide grains may contain not only the aforementioned iridium compound represented by formula (D2) but also another iridium complex having six ligands, all of which are Cl, Br, or I. In this case, any two or three of Cl, Br, and I may be mixed and present in the 6-coordination complex. The iridium complex in which the ligands are Cl, Br, or I is particularly preferably incorporated in a silver bromide-containing phase, in order to obtain hard gradation upon high illuminance exposure.

Specific examples of the iridium complex in which all of six ligands are made of Cl, Br, or I are shown below. However, the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

In the third or fourth embodiment of the present invention, it is one of preferred modes for carrying out the present invention that silver halide grains in the silver halide emulsion contain a six-coordinate complex having Ir as the center metal and at least two different kinds of ligands. The particularly preferred as such a six-coordinate complex are a six-coordinate complex in which iridium is the center metal and both halogen and organic ligands are present, and a six-coordinate complex in which iridium is the center metal and not only halogen ligands but also inorganic ligands other than halogen are present. It is more preferable that each of the silver halide grains specific to the present invention contain a combination of a hexacoordinate iridium complex having both halogen ligands and organic ligands and a hexacoordinate iridium complex having both halogen ligands and inorganic ligands other than halogen ligands.

The six-coordinate complexes in which iridium is the center metal suitably used in the third or fourth embodiment of the present invention are metal complexes represented by the following formula (I).

$$[IrX^{I}_{n}L^{I}_{(6-n)}]^{m} \qquad \text{Formula (I)}$$

In formula (I), $X^I$ represents a halogen ion or a pseudohalogen ion other than a cyanate ion; $L^I$ represents an arbitrary ligand differing from $X^I$; n represents 3, 4 or 5; and m represents 4−, 3−, 2−, 1−, 0, or 1+.

Here, from 3 to 5 $X^I$s may be the same or different from each other. When $L^I$ is present in plurality, these plural $L^I$s may be the same or different from each other.

In the above, the pseudohalogen (halogenoid) ion means an ion having a nature similar to that of halogen ion, and examples of the same include cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$), fulminate ion ($ONC^-$), and azide ion ($N_3^-$).

$X^I$ is preferably a fluoride ion, a chloride ion, a bromide ion, an iodide ion, a cyanide ion, an isocyanate ion, a thiocyanate ion, a nitrate ion, a nitrite ion, or an azide ion. Among these, chloride ion and bromide ion are particularly preferable. $L^I$ is not particularly limited, and it may be an organic or inorganic compound that may or may not have electric charge(s), with organic or inorganic compounds with no electric charge being preferable.

Among the metal complexes represented by the formula (I), metal complexes represented by the following formula (IA) are preferred.

$$[IrX^{IA}_{n}L^{IA}_{(6-n)}]^{m} \qquad \text{Formula (IA)}$$

In formula (IA), $X^{IA}$ represents a halogen ion or a pseudohalogen ion other than a cyanate ion. $L^{IA}$ represents an inorganic ligand different from $X^{IA}$. n represents an integer of 3, 4, or 5. m represents 4−, 3−, 2−, 1−, 0, or 1+.

In formula (IA), $X^{IA}$ has the same meanings as $X^I$ in formula (I) and preferred ranges are also identical. $L^{IA}$ is preferably water, OCN, ammonia, phosphine, and carbonyl, with water being particularly preferred.

Herein, from 3 to 5 $X^{IA}$s may be the same or different. When plural $L^{IA}$s are present, these plural $L^{IA}$s may be the same or different.

Among the metal complexes represented by formula (I), metal complexes represented by the following formula (IB) are further preferred.

$$[IrX^{IB}_{n}L^{IB}_{(6-n)}]^{m} \qquad \text{Formula (IB)}$$

In formula (IB), $X^{IB}$ represents a halogen ion or a pseudohalogen ion other than cyanate ion; $L^{IB}$ represents a ligand having a chained or cyclic hydrocarbon as a basic structure, or a ligand in which a portion of carbon atoms or hydrogen atoms of the basic structure is substituted with other atoms or atom groups; n represents an integer of 3, 4, or 5; m represents 4−, 3−, 2−, 1−, 0, or 1+.

$X^{IB}$ has the same meanings as $X^I$ in formula (I) and preferable ranges are also identical. $L^{IB}$ represents a ligand having a chain or cyclic hydrocarbon as a basic structure, or a ligand in which a portion of carbon atoms or hydrogen atoms of the basic structure is substituted with other atoms or atom groups, but it is not a cyanide ion. $L^{IB}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Herein, from 3 to 5 $X^{IB}$s may be the same or different. When plural $L^{IB}$s are present, these plural $L^{IB}$s may be the same or different.

Among the metal complexes represented by formula (IB), metal complexes represented by formula (IC) are more preferred.

$$[IrX^{IC}_{n}L^{IC}_{(6-n)}]^{m} \qquad \text{Formula (IC)}$$

In formula (IC), $X^{IC}$ represents a halogen ion or a pseudohalogen ion other than a cyanate ion; $L^{IC}$ represents a 5-membered ring ligand having at least one nitrogen atom and at least one sulfur atom in its ring skeleton that may have a substituent on the carbon atoms in said ring skeleton; n represents an integer of 3, 4, or 5; and m represents 4−, 3−, 2−, 1−, 0, or 1+.

$X^{IC}$ has the same meanings as $X^I$ in formula (I) and preferable ranges are also identical. The substituent on the carbon atoms in said ring skeleton in $L^{IC}$ is preferably a substituent having a smaller volume than n-propyl group. Preferred examples of the substituent include a methyl group, an ethyl group, a methoxy group, an ethoxy group, a cyano group, an isocyano group, a cyanate group, an isocyanate group, a thiocyanate group, a isothiocyanate group, a formyl group, a thioformyl group, a hydroxyl group, a mercapto group, an amino group, a hydrazino group, an azido group, a nitro group, a nitroso group, a hydroxyamino group, a carboxyl group, a carbamoyl group, fluoro, chloro, bromo, and iodo.

Herein, from 3 to 5 $X^{IC}$s may be the same or different. When plural $L^{IC}$s are present, these plural $L^{IC}$s may be the same or different.

Preferable specific examples of the metal complexes represented by formula (I) are shown below. However, the present invention is not limited to these complexes.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{3-}$ $[IrCl_5(OH)]^{2-}$
$[IrCl_4(OH)_2]^{2-}$
$[IrCl_5(O)]^{4-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{3-}$
$[IrBr_5(OH)]^{2-}$
$[IrBr_4(OH)_2]^{2-}$
$[IrBr_5(O)]^{4-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ In the third and fourth embodiment of the present invention, the specific silver halide grains in the silver halide emulsion contain further preferably a six coordination complex having 6 ligands, all of which are Cl, Br or I, and iridium as a central metal. In this case, Cl, Br or I may be a mixture of them in the six-coordination complex. The six-coordination complex having Cl, Br or I as a ligand, and iridium as a central metal is particularly preferably incorporated in a silver bromide-containing phase in order to obtain hard gradation upon high illuminance exposure.

Specific examples of the six coordination complex having Ir as a center metal in which all of 6 ligands are made of Cl, Br or I are shown below. However, the iridium complex that can be used in the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

The foregoing metal complexes are anionic ions. When these are formed into salts with cationic ions, counter cationic ions are preferably those easily soluble in water. Preferable examples thereof include an alkali metal ion, such as a sodium ion, a potassium ion, a rubidium ion, a cesium ion, and a lithium ion; an ammonium ion, and an alkyl ammonium ion. These metal complexes can be used being dissolved in water or in a mixed solvent of water and an appropriate water-miscible organic solvent (such as alcohols, ethers, glycols, ketones, esters, and amides). The Se metal complexes are added in amounts of, preferably $1\times10^{-10}$ mole to $1\times10^{-3}$ mole, and particularly preferably $1\times10^{-8}$ mole to $1\times10^{-5}$ mole, per mole of silver atom, during grain formation.

In the present invention, the above-mentioned iridium metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to employ a method in which the iridium metal complex is doped into a silver halide grain, by preparing fine particles doped with the complex in advance and adding the fine particles for carrying out physical ripening. Further, it is also preferable that these methods may be combined, to incorporate the complex into the inside of the silver halide grains.

In the case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free of the complex. Further, as disclosed in U.S. Patent Nos. 5,252,451 and 5,256,530, it is also preferred that the silver halide grains be subjected to physical ripening in the presence of fine grains having the metal complexes incorporated therein, to modify the grain surface phase. Further, these methods may be used in combination. Two or more kinds of complexes may be incorporated in the inside of an individual silver halide grain. In the present invention, it is advantageous to use two or more, preferably three or more, kinds of iridium complexes.

Although the foregoing complexes have no particular restriction as to the halide composition of the location in which they are incorporated, six-coordinate complexes having Ir as their individual central metals and Cl, Br or I as all of the six ligands are preferably incorporated in areas having the maximum silver bromide content.

In the present invention, a metal ion other than the above-mentioned metal complexes can be doped in the inside and/or on the surface of the silver halide grains. The metal ions to be used are preferably ions of a transition metal. Preferable examples of the transition metal are iron, ruthenium, osmium, lead, cadmium, and zinc. It is more preferable that these metal ions are used in the form of a six-coordination complex of octahedron-type having ligands. When employing an inorganic compound as a ligand, cyanide ion, halide ion, thiocyanate ion, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isoxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

As a combination of the metal ion and the ligand, a combination of an iron ion and a cyano ligand and a combination of a ruthenium ion and a cyano ligand are preferable. In the present invention, it is preferable to use these compounds and the iridium in combination. In the present invention, preferred of these compounds are those in which the number of cyanide ions accounts for the majority of the coordination number (site) intrinsic to the iron or ruthenium that is the central metal. The remaining sites are preferably occupied by thiocyanato, ammonio, aquo, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of 1×10−8 mol to 1×10−2 mol, most preferably 1×10−6 mol to 5×10−4 mol, per mol of silver atom. In the case of the ruthenium complex and the osmium complex, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of 1×10−10 mol to 1×10−6 mol, more preferably 1×10−9 mol to 1×10−6 mol, per mol of silver atom.

The silver halide emulsion for use in the photographic material of the invention is preferably an emulsion having undergone gold sensitization known in the field. The emulsion can be increased in sensitivity by undergoing gold sensitization, and thereby fluctuations in photographic properties when scanning exposure using laser light is performed can be reduced. To effect gold sensitization, various inorganic gold compounds, gold(I) complexes having an inorganic ligand, and gold(I) complexes having an organic ligand can be utilized. For instance, chloroauric acid and salts thereof can be used as the inorganic gold compounds; and dithiocyanato gold compounds, such as potassium dithiocyanatoaurate(I), and dithiosulfato gold compounds, such as trisodium dithiosulfatoaurate(I), can be used as the gold(I) complex having an inorganic ligand.

As the gold (I) compounds each having an organic ligand (an organic compound), use can be made of bis-gold (I) mesoionic heterocycles described in JP-A-4-267249, e.g. bis (1,4,5-trimethyl-1,2,4-triazolium-3-thiolato) aurate (I) tetrafluoroborate; organic mercapto gold (I) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen-compound anion coordinated therewith, as described in JP-A-4-268550, e.g. bis (1-methylhydantoinato) gold (I) sodium salt tetrahydrate. As these gold (I) compounds having an organic ligand, use can be made of those which are synthesized in advance and isolated, as well as those which are generated by mixing an organic ligand and an Au compound (e.g., chloroauric acid or its salt), to add to an emulsion without isolating the resulting Au compound. Moreover, an organic ligand and an Au compound (e.g., chloroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

The amount of the above compound to be added can vary in a wide range depending on the occasion, and it is generally in the range of $5\times10^{-7}$ mol to $5\times10^{-3}$ mol, and preferably in the range of $5\times10^{-6}$ mol to $5\times10^{-4}$ mol, per mol of silver halide.

Further, colloidal gold sulfide can also be used, to conduct gold sensitization. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1996). In the above Research Disclosure, a method is described in which a thiocyanate ion is used in the production of colloidal gold sulfide. It is, however, possible to use a thioether compound, such as methionine or thiodiethanol, instead.

Colloidal gold sulfide having various grain sizes are applicable, and it is preferable to use those having an average grain diameter of 50 nm or less, more preferably 10 nm or less, and further preferably 3 nm or less. The grain diameter can be measured from a TEM photograph. Also, the composition of the colloidal gold sulfide may be $Au_2S_1$ or may be sulfur-excess compositions such as $Au_2S_1$ to $Au_2S_2$ which are preferable. $Au_2S_{1.1}$ to $Au_2S_{1.8}$ are more preferable.

The composition of the colloidal gold sulfide can be analyzed in the following manner: for example, gold sulfide grains are taken out, to find the content of gold and the content of sulfur, by utilizing analysis methods such as ICP and iodometry, respectively. If gold ions and sulfur ions (including hydrogen sulfide and its salt) dissolved in the liquid phase exist in the gold sulfide colloid, this affects the analysis of the composition of the gold sulfide colloidal grains. Therefore, the analysis is made after the gold sulfide grains have been separated by ultrafiltration or the like. The amount of the colloidal gold sulfide to be added can be varied in a wide range depending on the occasion, and it is generally in the range of $5\times10^{-7}$ mol to $5\times10^{-3}$ mol, and preferably in the range of $5\times10^{-6}$ mol to $5\times10^{-4}$ mol, in terms of gold atom, per mol of silver halide.

Performance of chalcogen sensitization other than the foregoing selenium sensitization (namely, sulfur sensitization, tellurium sensitization and selenium sensitization other than the foregoing selenium sensitization) in combination with gold sensitization can be achieved by use of one and the same molecule. And such a molecule is a molecule capable of releasing $AuCh^-$. Herein, Au represents Au(I), and Ch represents a sulfur atom, a selenium atom or a tellurium atom. Examples of the molecule capable of releasing $AuCh^-$ include gold compounds represented by AuCh-L. Herein, L represents atomic group forming a molecule by combining with AuCh. Another or more ligands may further coordinate to Au together with Ch-L. In addition, the gold compounds represented by AuCh-L have a feature that, when they undergo reaction in a solvent in the presence of silver ion, they are apt to produce AgAuS in the case of which Ch is S, AgAuSe in the case of which Ch is Se and AgAuTe in the case of which Ch is Te. Examples of such gold compounds include not only compounds whose Ls are acyl groups but also compounds represented by the following formula (AuCh1), (AuCh2) or (AuCh3).

$R_1$—X-M-ChAu Formula (AuCh1)

In formula (AuCh1), Au represents Au (I); Ch represents a sulfur atom, a selenium atom, or a tellurium atom; M represents a substituted or unsubstituted methylene group; X represents an oxygen atom, a sulfur atom, a selenium atom, or $NR_2$; $R_1$ represents a group of atoms bonding to X to form the molecule (e.g., an organic group, such as an alkyl group, an aryl group, or a heterocyclic group); $R_2$ represents a hydrogen atom or a substituent (e.g., an organic group, such as an alkyl group, an aryl group, or a heterocyclic group); and $R_1$ and M may combine together to form a ring.

Regarding the compound represented by formula (AuCh1), Ch is preferably a sulfur atom or a selenium atom; X is preferably an oxygen atom or a sulfur atom; and $R_1$ is preferably an alkyl group or an aryl group. More specific examples of the compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Herein, the terms "thiosugar," "selenosugar" and "tellurosugar" mean the compounds in which a hydroxy group in the anomer position of the sugar is substituted with a SH group, a SeH group, and a TeH group, respectively.

$W_1W_2C{=}CR_3ChAu$ Formula (AuCh2)

In formula (AuCh2), Au represents Au(I); Ch represents a sulfur atom, a selenium atom, or a tellurium atom; $R_3$ and $W_2$ each independently represent a substituent (e.g., a hydrogen atom, a halogen atom, or an organic group such as alkyl, aryl, or heterocyclic group); $W_1$ represents an electron-withdrawing group having a positive value of the Hammett's substituent constant $\sigma_p$ value; and $R_3$ and $W_1$, $R_3$ and $W_2$, or $W_1$ and $W_2$ may bond together to form a ring.

In the compound represented by formula (AuCh2), Ch is preferably a sulfur atom or a selenium atom; $R_3$ is preferably a hydrogen atom or an alkyl group; and $W_1$ and $W_2$ each are preferably an electron-withdrawing group having the Hammett's substituent constant $\sigma_p$ value of 0.2 or more. Examples of the specific compound include $(NC)_2C{=}CHSAu$, $(CH_3OCO)_2C{=}CHSAu$, and $CH_3CO(CH_3OCO)C{=}CHSAu$.

$W_3$-E-ChAu Formula (AuCh3)

In formula (AuCh3), Au represents Au(I); Ch represents a sulfur atom, a selenium atom, or a tellurium atom; E represents a substituted or unsubstituted ethylene group; $W_3$ represents an electron-withdrawing group having a positive value of the Hammett's substituent constant $\sigma_p$ value.

In the compound represented by formula (AuCh3), Ch is preferably a sulfur atom or a selenium atom; E is preferably an ethylene group having thereon an electron-withdrawing group whose Hammett's substituent constant $\sigma_p$ value is a positive value; and $W_3$ is preferably an electron-withdrawing group having the Hammett's substituent constant $\sigma_p$ value of 0.2 or more.

An addition amount of these compounds can vary over a wide range according to the occasions, and the amount is generally in the range of $5\times10^{-7}$ to $5\times10^{-3}$ mol, preferably in the range of $3\times10^{-6}$ to $3\times10^{-4}$ mol, per mol of silver halide.

In the silver halide emulsion, the above-mentioned gold sensitization may be combined with other sensitization, such as sulfur sensitization, selenium sensitization, tellurium sensitization, reduction sensitization, and noble metal sensitization using noble metals other than gold compounds. In particular, the gold sensitization is preferably combined with sulfur sensitization and/or selenium sensitization.

Various compounds or precursors thereof can be included in the silver halide emulsion for use in the present invention, to prevent fogging from occurring or to stabilize photographic performance, during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Spectral sensitization can be carried out for the purpose of imparting spectral sensitivity in a desired light wavelength region to the silver halide emulsion for use in the present invention. Examples of spectral sensitizing dyes for spectral sensitization of blue, green, and red light regions, include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

In uses for digital exposure systems, spectral sensitization is also carried out for the purpose of imparting arbitrary spectral sensitivities according to wavelength regions of a light source used, and besides, it is preferable that infrared spectral sensitization is performed as required. The method disclosed in JP-A-5-142712 is preferred as a spectral sensitization method aimed at utilizing digital exposure, and the compounds disclosed therein as infrared spectral sensitizing dyes are suitably used.

In the silver halide photosensitive materials of the invention, as described above, any of known sensitizing dyes can be used. Examples of these dyes include merocyanine dyes having two basic mother nuclei formed by fusing together any of thiazole, selenazole, oxazole and imidazole nuclei and a benzene or naphthalene ring and acidic mother nuclei, such as rhodanine nuclei, thiohydantoin nuclei, 2-thioselenazolidine-2,4-dione nuclei and barbituric acid nuclei, and trinuclear complex merocyanine dyes having three mother nuclei, but preferably cyanine dyes can be employed because they can impart high sensitivity and have considerable effect on reduction in color stain contamination. Additionally, these dyes may be used as combinations of two or more thereof with the intention of attaining the required spectral sensitivity distribution.

In order to incorporate those spectral sensitizing dyes in silver halide emulsions, the dyes may be dispersed directly into the emulsions, or they may be dissolved first in a single solvent, such as water, methanol, ethanol, propanol, methyl cellosolve or 2,2,3,3-tetrafluoropropanol, or a mixture of two or more of these solvents, and then added to emulsions. In another way, aqueous solutions of those dyes may be prepared in the presence of the acids or bases as disclosed in JP-B-44-23389, JP-B-44-27555 and JP-B-57-22089, or aqueous solutions or colloidal dispersions of those dyes may be prepared in the presence of the surfactants as disclosed in U.S. Pat. Nos. 3,822,135 and 4,006,025, and then they are added to the emulsions. In still another way, those dyes may be dissolved in a solvent substantially immiscible with water, such as phenoxyethanol, then dispersed into water or a hydrophilic colloid, and further added to the emulsions. Alternatively, those dyes may be dispersed directly into hydrophilic colloid as disclosed in JP-A-53-102733 and JP-A-58-105141, and then added to the emulsions. The timing of their addition to the emulsions may be set at any of the emulsion-making stages hitherto known to be useful. More specifically, the timing can be chosen from a time period before formation of silver halide emulsion grains, a time period over which emulsion grains are formed, a time period from the end of grain formation to the start of washing, a time period before chemical sensitization, a time period over which chemical sensitization is carried out, a time period from the end of chemical sensitization to solidification of emulsion by cooling, or a time period over which coating solutions are prepared. In the present invention, addition of the sensitizing dye is, most commonly, carried out after completion of chemical sensitization, but before coating. However, the sensitizing dye may be simultaneously added together with a chemical sensitizer, to carry out spectral sensitization and chemical sensitization at the same time, as described in U.S. Pat. Nos. 3,628,969 and 4,225,666. Besides, as described in JP-A-58-113928, the sensitizing dye may be added prior to chemical sensitization, or alternatively the sensitizing dye may be added before completion of formation of precipitation of silver halide grains, to start spectral sensitization. Further, as taught in U.S. Pat. No. 4,225,666, it is possible that the sensitizing dye may be separately added, namely a part of sensitizing dye is added prior to chemical sensitization and the remaining of sensitizing dye is added after chemical sensitization. The sensitizing dye may be added in any stage during grain formation of silver halide, as exemplified by the method disclosed in U.S. Pat. No. 4,183,756. The sensitizing dye is especially preferably add before emulsion washing process or before chemical sensitization.

The amount of these spectral sensitizing dyes to be added can vary in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide color photographic light-sensitive material (hereinafter referred simply to as "photosensitive material", too) as the first embodiment of the present invention is configured so as to have, on a support, at least one red-sensitive silver halide emulsion layer, at least one green-sensitive silver halide emulsion layer and at least one blue-sensitive silver halide emulsion layer, and it is characterized in that at least one of these silver halide emulsion layers contains the specific silver halide emulsion specified by the first embodiment of the present invention and satisfies the foregoing relation (1).

The silver halide color photographic light-sensitive material of the first embodiment of the present invention has preferably, on a support, at least one silver halide emulsion layer containing a yellow-dye-forming coupler, at least one silver halide emulsion layer containing a magenta-dye-forming coupler, and at least one silver halide emulsion layer containing a cyan-dye-forming coupler. In the present invention, the silver halide emulsion layer containing the yellow-dye-forming coupler functions as a yellow-color-forming layer, the silver halide emulsion layer containing the magenta-dye-forming coupler as a magenta-color-forming layer, and the silver halide emulsion layer containing the cyan-dye-forming coupler as a cyan-color-forming layer. It is preferable that silver halide emulsions contained in the yellow-color-forming layer, the magenta-color-forming layer, and the cyan-color-forming layer, respectively, have sensitivities to light in wavelength regions different from one another. A suitable example thereof is a silver halide color photographic material which contains an emulsion having its sensitivity within the blue region in a yellow-color-forming layer, an emulsion having its sensitivity within the green region in a magenta-color-forming layer, and an emulsion having its sensitivity within the red region in a cyan-color-forming layer, but not limited to this type of photographic material.

The photosensitive material as the second embodiment of the present invention has, on a support, photographic constituent layers including at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer, and at least one light-insensitive hydrophilic colloid layer. The silver halide emulsion layer containing a yellow-dye-forming coupler functions as a yellow-color-forming layer (Y), the silver halide emulsion layer containing a magenta-dye-forming coupler as a magenta-color-forming layer (M), and the silver halide emulsion layer containing a cyan-dye-forming coupler as a cyan-color-forming layer (C).

It is preferable that the silver halide emulsions contained in the color-forming layers (Y), (M) and (C), respectively, have their individual sensitivities to light in mutually different three wavelength regions (e.g., blue light, green light and red light in the described order by layer, from Y to C).

In applying a digital exposure system using semiconductor lasers or LEDs as light sources to the foregoing sensitivities, the three different spectral sensitivities can be chosen arbitrarily. Herein, it is appropriate from the viewpoint of color separation that the spectral sensitivity maxima closest to each other be at least 30 nm apart. Color-forming couplers (Y, M and C) may be brought into any correspondence with light-sensitive layers having at least three different spectral sensitivity maxima ($\lambda1$, $\lambda2$ and $\lambda3$) into which they are to be incorporated. Further, it is also possible to use wavelength regions other than those of blue light, green light and red light, and it is also preferable that response to infrared-laser exposure is made possible by imparting infrared spectral sensitivity to any of those light-sensitive layers.

In addition to the yellow-color-forming layer, the magenta-color-forming layer and the cyan-color-forming layer, the photosensitive material as the second embodiment of the present invention may have, if desired, an anti-halation layer, an intermediate layer and a colored layer as the light-insensitive hydrophilic colloidal layers described hereinafter.

The silver halide color photographic material as the third embodiment of the present invention has at least one yellow-dye-forming-coupler-containing silver halide emulsion layer, at least one magenta-dye-forming-coupler-containing silver halide emulsion layer and at least one cyan-dye-forming-coupler-containing silver halide emulsion layer.

In the present invention, the sum of the coating amounts of cyan-dye-forming, magenta-dye-forming and yellow-dye-forming couplers is preferably 1.1 $g/m^2$ or below, far preferably from 0.4 $g/m^2$ to 1.0 $g/m^2$.

Silver halide emulsions present in the silver halide emulsion layers containing different couplers, respectively, are required to differ from one another in color sensitivity. For instance, it is one preferred mode that a blue-sensitive silver halide emulsion is incorporated in the yellow-dye-forming-coupler-containing silver halide emulsion layer, a green-sensitive silver halide emulsion is incorporated in the magenta-dye-forming-coupler-containing silver halide emulsion layer and a red-sensitive silver halide emulsion is incorporated in the cyan-dye-forming-coupler-containing silver halide emulsion layer. In this mode, the peak spectral sensitivity of the blue-sensitive emulsion is preferably in a region of 400 nm to 500 nm, far preferably 420 nm to 480 nm, that of the green-sensitive emulsion is preferably in a region of 510 nm to 590 nm, far preferably 520 nm to 580 nm, and that of the red-sensitive emulsion is preferably in a region of 600 nm to 800 nm, far preferably 620 nm to 720 nm. Further, the difference in wavelength of spectral-sensitivity peak between any two of the light-sensitive silver halide emulsions is preferably 30 nm or above, far preferably 50 nm or above. By making color-sensitivity settings as mentioned above, the photosensitive material of the present invention can reproduce less somber colors and higher color saturation in images obtained by color development after exposures to light beams in at least three different wavelength regions.

In the use of a digital exposure system using semiconductor lasers or LEDs as light sources for the foregoing sensitivities, the three different spectral sensitivities can be chosen arbitrarily. In this choice, it is preferred from the viewpoint of color separation that the spectral sensitivity maxima closest to each other be at least 30 nm apart. In correspondence with the light-sensitive layers having at least three different spectral sensitivity maxima (λ1, λ2 and λ3), color-forming couplers (Y, M and C) may be incorporated into those layers in arbitrary combinations. Further, it is also possible to use wavelength regions other than those of blue light, green light and red light, and it is also preferable to impart infrared spectral sensitivity to any one of those light-sensitive layers and thereby make the layer be ready for infrared-laser exposure.

Besides having the yellow-color-forming layer, the magenta-color-forming layer and the cyan-color-forming layer, the photosensitive material of the present invention may have, if desired, an anti-halation layer, an intermediate layer and a colored layer as the light-insensitive hydrophilic colloidal layers described hereinafter.

The silver halide color photographic material as the fourth embodiment of the present invention has a layer structure that at least one cyan-dye-forming-coupler-containing silver halide emulsion layer, at least one magenta-dye-forming-coupler-containing silver halide emulsion layer and at least one yellow-dye-forming-coupler-containing silver halide emulsion layer are provided on a support.

It is preferable that the silver halide emulsions incorporated in those layers have their individual sensitivities to light in mutually different wavelength regions (e.g., light in a blue region, light in a green region and light in a red region). As the amount of each coupler used for silver, one equivalent is ideal, but 0.6 equivalent or above is suitable and 0.7 equivalent or above is particularly suitable. The term "one equivalent" as used herein refers to the amount of a coupler used for color formation by reaction with silver used in its entirety, and the term "0.5 equivalent" refers to the amount of a coupler used for color formation by reaction with one-half the silver used.

In the present invention, it is preferable that at least two kinds of silver halide emulsions having different sensitivities and silver chloride contents of 90 mole % or above are incorporated in a silver halide emulsion layer. The number of silver halide emulsions differing in sensitivity may be two or more, but the suitable number thereof is two or three from the viewpoint of designing the photosensitive material. On the points of grain size, halide composition, grain structure, and types and addition amounts of sensitizing dyes, chemical sensitizers and antifoggants, the two or more silver halide emulsions may differ or the same.

At least two varieties of silver halide emulsions differing in sensitivity and having silver chloride contents of 90 mole % or more, though preferably mixed in one and the same silver halide emulsion layer, may be coated separately to form different emulsion layers. Herein, however, these layers are required to have almost the same color sensitivity and to generate colors of almost the same hue. The expression "to have almost the same color sensitivity", in the case of color photographic materials, means that the layers have sensitivities to light in the same color range, e.g., light in the blue range, light in the green range, or light in the red range, and that the layers may be different in spectral sensitivity as far as the spectral sensitivities are in the same color range. In addition, the expression "to generate colors of almost the same hue", in the case of color photographic materials, means that the layers generate colors in the same hue range, e.g., yellow colors, magenta colors, or cyan colors, and that the layers may be different in hue of generated color as far as the difference falls within the same color hue.

The light-sensitive material of the present invention may be provided with a hydrophilic colloid layer, an anti-halation layer, an intermediate layer, and a colored layer, if necessary, in addition to the aforementioned yellow color-forming layer, magenta color-forming layer, and cyan color-forming layer.

The following are descriptions of yellow-dye-forming couplers (hereinafter abbreviated to "yellow coupler" in some cases) which are represented by formula (Y) and used in the silver halide color photographic material of the present invention, preferably the second or fourth embodiment of the present invention.

Formula (Y)

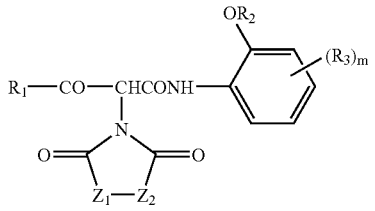

wherein $R_1$ represents an alkyl group or a cycloalkyl group, $R_2$ represents an alkyl group, a cycloalkyl group, an acyl group or an aryl group, $R_3$ represents a hydrogen atom, a halogen atom, an alkyl group, an alkoxy group, an aryloxy group, an alkoxycarbonyl group, an alkylsulfonyl group, an alkylcarbamoyl group, an arylcarbamoyl group, an alkylsulfamoyl group, an arylsulfamoyl group, an alkylcarbonamido group, an alkylsulfonamido group, an arylsulfonamido group, a sulfamoyl group or an imido group, m represents an integer of 0 or 1 to 4, $Z_1$ represents —O— or —$NR_A$—, and $Z_2$ represents —$NR_B$— or —$C(R_C)R_D$—, wherein $R_A$, $R_B$, $R_C$ and $R_D$ are independent of one another and each represents a hydrogen atom or a substituent.

Examples of an alkyl group represented by $R_1$ include methyl, ethyl, isopropyl, t-butyl and dodecyl. The alkyl group represented by $R_1$ can further have a substituent. Examples of such a substituent include a halogen atom (e.g., chlorine atom, bromine atom), an aryl group (e.g., phenyl, p-t-octylphenyl), an alkoxy group (e.g., methoxy), an aryloxy group (e.g., 2,4-di-t-amylphenoxy), a sulfonyl group (e.g., methanesulfonyl), an acylamino group (e.g., acetyl, benzoyl), a sulfonylamino group (e.g., n-dodecanesulfonylamino), and a hydroxyl group.

Examples of a cycloalkyl group represented by $R_1$ include aryl group having 6 to 14 carbon atoms (e.g., phenyl, 1-naphthyl, 9-anthranyl). The aryl group represented by $R_1$ may further have a substituent. Examples of such a substituent include a nitro group, a cyano group, an amino group (e.g., dimethylamino, anilino), and an alkylthio group (e.g., methylthio).

$R_1$ is preferably an alkyl group, far preferably a branched-chain alkyl group, particularly preferably a t-butyl group.

Examples of alkyl and cycloalkyl groups that $R_2$ can represent include the same groups as those which $R_1$ can represent. Examples of an acyl group represented by $R_2$ include acetyl, propionyl, butyryl, hexanoyl and benzoyl. Examples of an aryl group represented by $R_2$ include an phenyl group. These alkyl, cycloalkyl and aryl groups that $R_2$ can represent include those further having the same substituents as $R_1$ may have.

$R_2$ is preferably an alkyl group or an aryl group, particularly preferably an alkyl group.

$R_3$ represents a hydrogen atom, a halogen atom, an alkyl group, an alkoxy group, an aryloxy group, an alkoxycarbonyl group, an alkylsulfonyl group, an alkylcarbamoyl group, an arylcarbamoyl group, an alkylsulfamoyl group, an arylsulfamoyl group, an alkylcarbonamido group, an alkylsulfonamido group, an arylsulfonamido group, a sulfamoyl group, or an imido group.

$R_3$ is preferably a halogen atom, particularly preferably a chlorine atom.

m represents 0 or an integer of 1 to 4, preferably 0, 1, 2 or 3, far preferably 0, 1 or 2, particularly preferably 1.

$Z_1$, represents —O—, or —$NR_A$— (wherein $R_A$ represents a hydrogen atom or a substituent, and the substituent is preferably an alkyl group, a cycloalkyl group, an aryl group or a heterocyclic group).

$Z_2$ represents —$NR_B$— (wherein $R_B$ represents a hydrogen atom or a substituent, and the substituent is preferably an alkyl group, a cycloalkyl group, an aryl group or a heterocyclic group), or —$C(R_C)R_D$— (wherein $R_C$ and $R_D$ each represent a hydrogen atom or a substituent, and suitable examples of such a substituent include a halogen atom (e.g., chlorine atom, bromine atom), an aryl group (e.g., phenyl, p-t-octylphenyl), an alkoxy group (e.g., methoxy), an aryloxy group (e.g., 2,4-di-t-amylphenoxy), a sulfonyl group (e.g., methanesulfonyl), an acylamino group (e.g., acetyl, benzoyl), a sulfonylamino group (e.g., n-dodecanesulfonylamino), a hydroxyl group, a nitro group, a cyano group, an amino group (e.g., dimethylamino, anilino) and an alkylthio group (e.g., methylthio)).

Of the yellow couplers represented by formula (Y), yellow couplers represented by the following formula (Y-I) are preferred over the others.

Formula (Y-I)

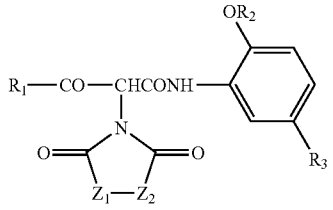

In formula (Y-I), $R_1$ to $R_3$, $Z_1$ and $Z_2$ have the same meanings as those in formula (Y), respectively, and the preferred ranges thereof are the same as those in formula (Y), respectively.

Typical examples of a yellow coupler represented by formula (Y) used in the silver halide color photographic material of the present invention are illustrated below, but the present invention should not be construed as being limited to these examples.

Y-1

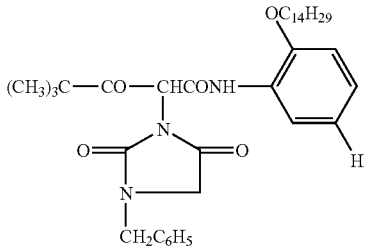

Y-2

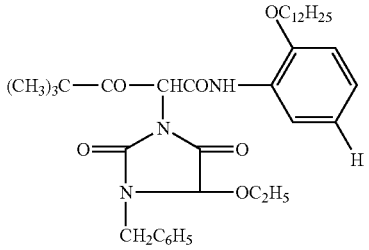

Y-3

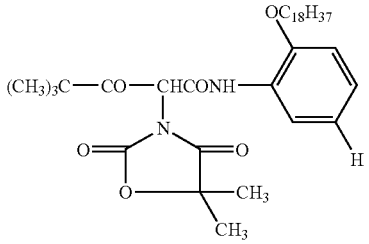

Y-4

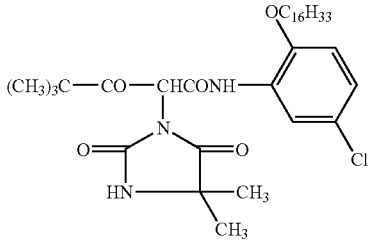

Y-5

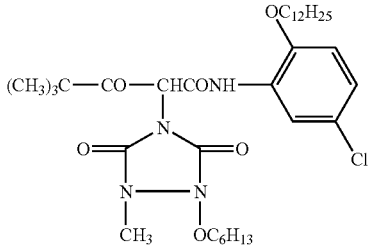

-continued
Y-6
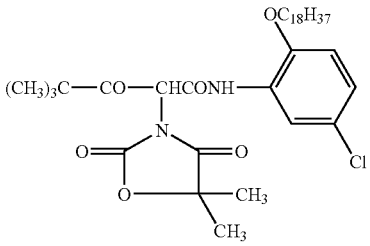
Y-7
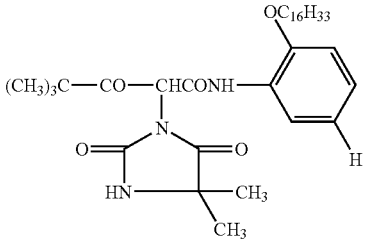
Y-8
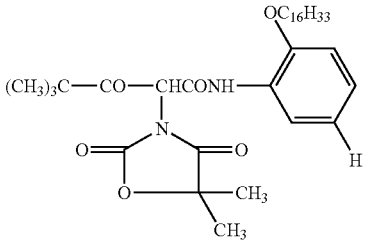
Y-9
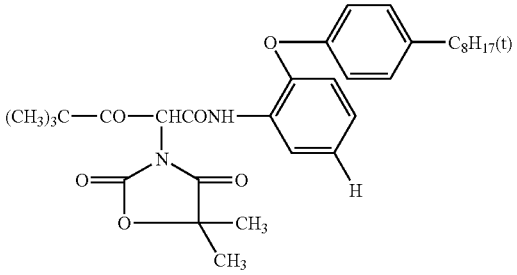
Y-10
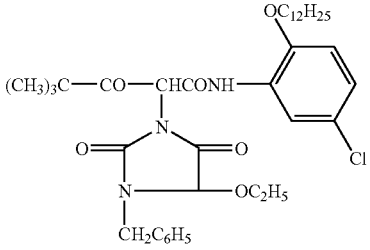
Y-11
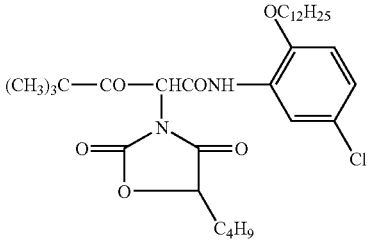
-continued
Y-12
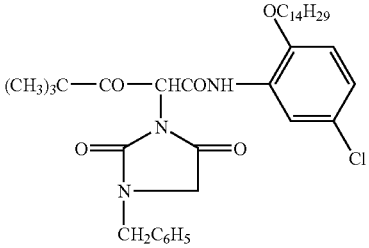
Y-13
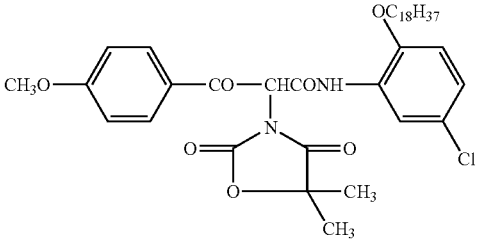
Y-14
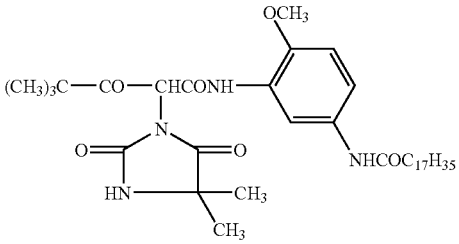
Y-15
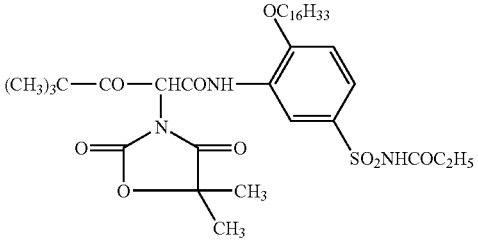
Y-16
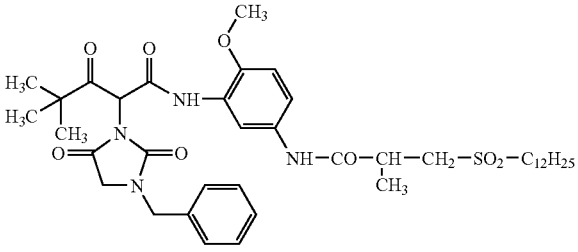

-continued
Y-17
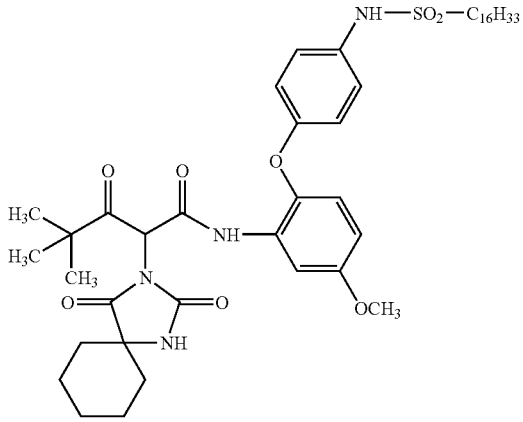
Y-18
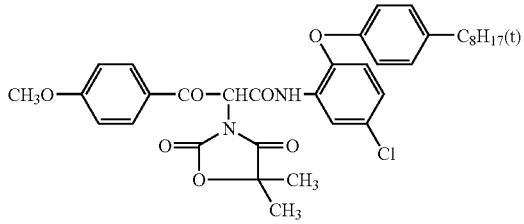
Y-19
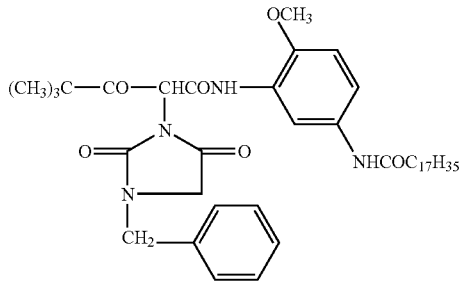
Y-20
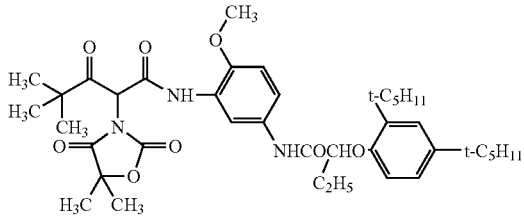
Y-21
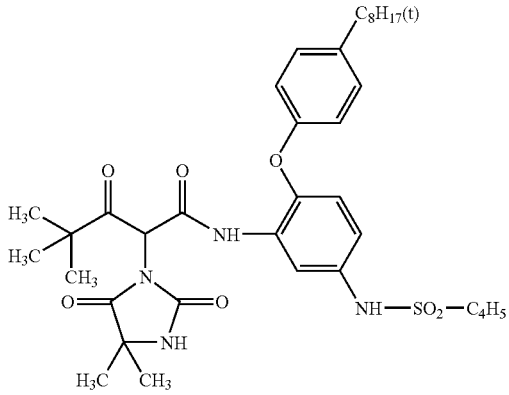
-continued
Y-22
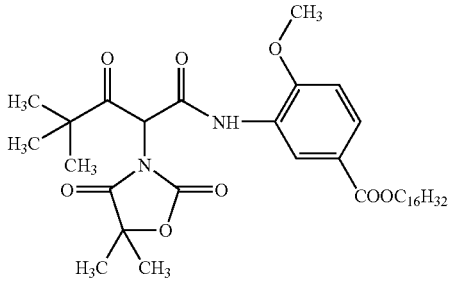
Y-23
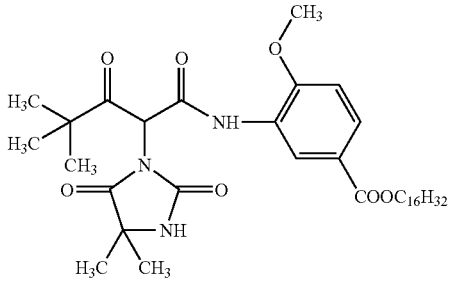
Y-24
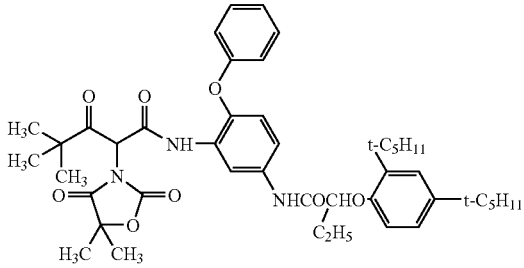
Y-25
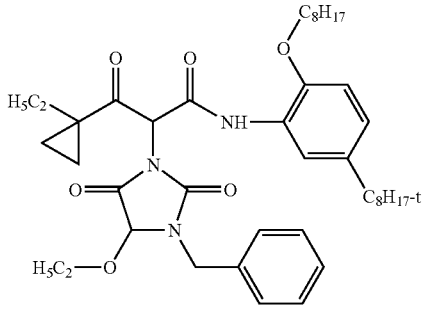
Y-26
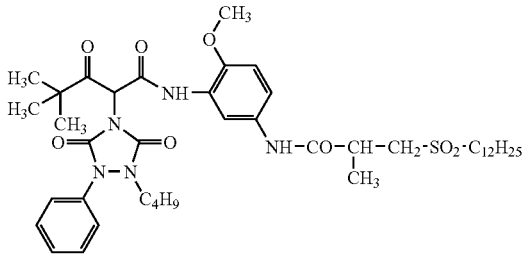
The yellow couplers represented by formula (Y) and usable in silver halide color photographic material of the present invention, preferably the second or fourth embodiment of the present invention, can be easily synthesized by use of the methods disclosed in JP-A-63-123047 and JP-A-3-125141, or methods following them.

The yellow couplers represented by formula (Y) can be used alone or as a combination of two or more thereof in the silver halide color photographic material of the present invention. Further, they can be used in combination with other types of yellow couplers. In the silver halide color photographic material of the present invention, the yellow couplers can be used in an amount ranging generally from about $1\times10^{-3}$ mole to about 1 mole, preferably from $1\times10^{-2}$ mole to $8\times10^{-1}$ mole, per mole of silver halide.

Further, it is preferable that the couplers represented by formula (Y) are added in a state of being emulsified and dispersed typically by using a high-boiling-point solvent as described hereinafter. Additionally, the couplers represented by formula (Y) may be used alone or as combinations of two or more thereof, or in combination with other couplers (e.g., couplers as recited below).

Crown ethers which can be used in the silver halide color photographic material of the present invention, preferably the second embodiment of the present invention, are illustrated below.

These are crown ethers each of which is fused with at least one substituted or unsubstituted aromatic ring. Typical examples of a substituent of the aromatic ring can have include an alkyl group, an aryl group, an anilino group, an acylamino group, a sulfonamido group, an alkylthio group, an arylthio group, an alkenyl group and a cycloalkyl group. In addition to these groups, the aromatic ring may be substituted with a halogen atom, a cycloalkenyl group, an alkynyl group, a heterocyclic group, a sulfonyl group, a sulfinyl group, a phosphonyl group, an acyl group, a carbamoyl group, a sufamoyl group, a cyano group or an alkoxy group. Further, the hetero atoms constituting a crown ring may be replaced with nitrogen atoms, sulfur atoms or selenium atom besides oxygen atoms. A great number of compounds as representatives of crown ethers have been synthesized since Pedersen synthesized his original crown ether in 1967 and reported its unique properties. Detailed descriptions of these compounds can be found, e.g., in C. J. Pedersen, *Journal of American Chemical Society*, vol. 86 (2495), 7017-7036 (1967); G. W. Gokel & S. H. Korzeniowski, *Macrocyclic Polyether Synthesis*, Springer-Verlag. (1982); Oda, Shono & Tabuse (editors), *Crown Ether no Kagaku* (Chemistry of Crown Ether), Kagaku Dojin (1978); Tabuse et al., *Host-Guest*, Kyoritsu Shuppan (1979); and Sasaki & Koga, *Yuki Gosei Kagaku* (Organic Synthesis Chemistry), vol. 45(6), 571-582 (1987).

Examples of crown ethers preferably used in the silver halide color photographic material of the present invention are illustrated below, but crown ethers usable in the present silver halide color photographic materials should not be construed as being limited to these examples.

SS-1

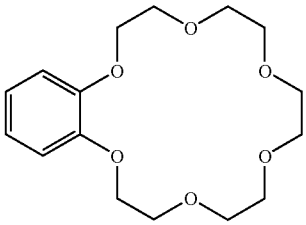

-continued

SS-2

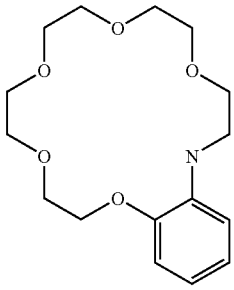

SS-3

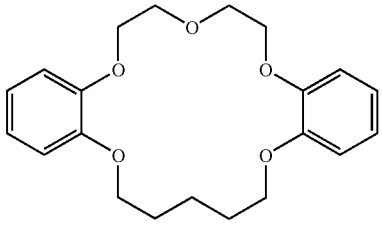

SS-4

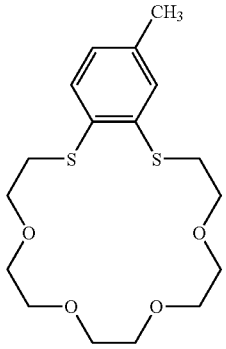

SS-5

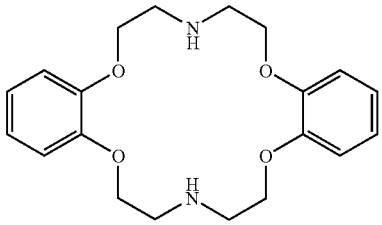

SS-6

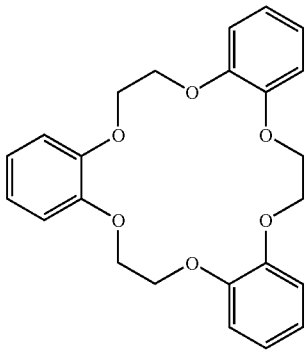

-continued

SS-7

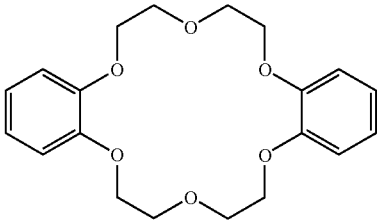

SS-8

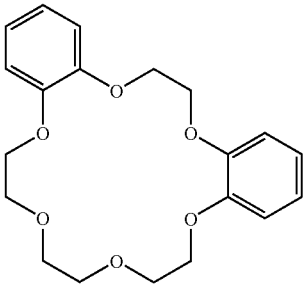

SS-9

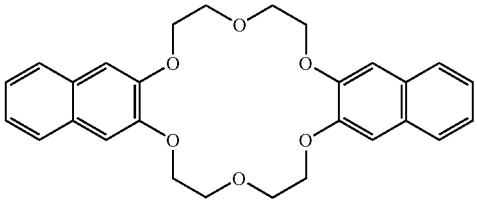

SS-10

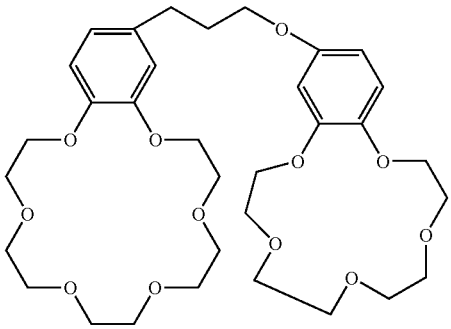

SS-11

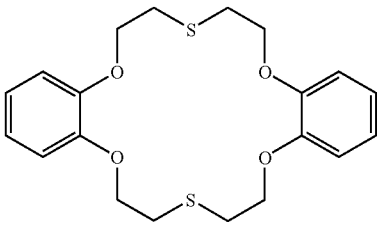

SS-12

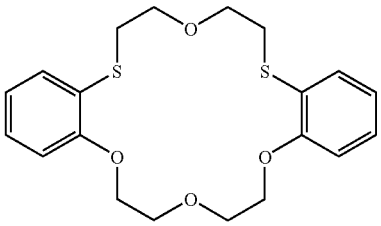

-continued

SS-13

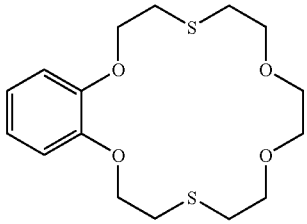

SS-14

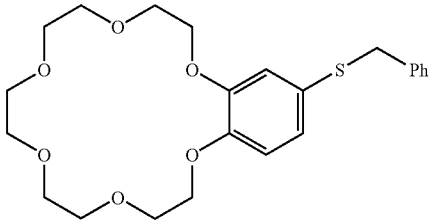

SS-15

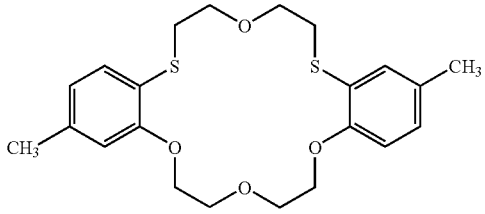

SS-16

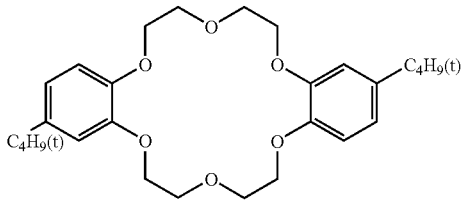

SS-17

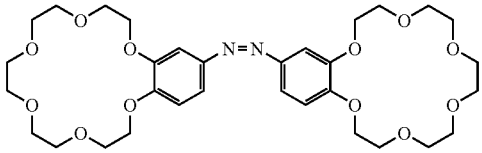

SS-18

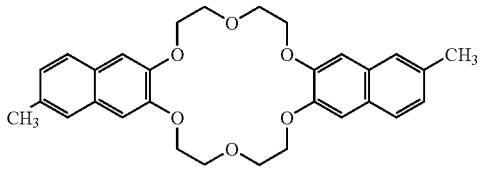

These compounds are described in the references cited above, or can be easily synthesized by the methods described in the references cited above or by methods following those methods.

Crown ethers usable in the silver halide color photographic material of the present invention, preferably the second embodiment of the present invention, may be dissolved in water or hydrophilic organic solvents, such as methanol, ethanol and fluorinated alcohol, and then added to hydrophilic colloids containing silver halide grains for formation of silver halide emulsion layers. The timing of their addition may be set at any stage as long as it is before the emulsions are coated, preferably before the completion of chemical sensitization. Additionally, crown ether is added to at least one of the silver halide emulsion layers, preferably to a cyan-dye-forming-coupler-containing silver halide emulsion layer.

In the silver halide color photographic material of the present invention, preferably the second embodiment of the present invention, the amount of crown ether used, though depends on the crown ether species used, the silver halide grains used and the chemical ripening condition adopted, is generally from $1\times10^{-6}$ to $1\times10^{-1}$ mole, preferably from $1\times10^{-5}$ to $1\times10^{-2}$ mole, per mole of silver halide. The conditions for using the crown ether compound have no particular restrictions, but the pCl is preferably from 0 to 7, far preferably from 0 to 5, further preferably from 1 to 3, and the temperature is preferably from 40° C. to 95° C., far preferably from 50° C. to 85° C. In the silver halide color photographic material of the present invention, preferably the second embodiment of the present invention, crown ethers are preferably used as supersensitizing agents for red-sensitive sensitizing dyes. As to the addition order thereof, either of them may be added earlier, or they may be added at the same time, or they may be added as a mixed solution. And they may be added in several portions. The crown ether compounds may be used alone, or two or more species thereof may be added to one and the same layer, or a mixture thereof may be added to two or more layers.

The compounds having oxidizing action on clusters of metal silver, which are usable in the silver halide color photographic material of the present invention, preferably the second embodiment of the present invention, are defined as the compounds capable of inhibiting photographic fog from developing when a coating sample prepared by applying a silver halide emulsion coating together with a protective gelatin film is immersed in a gold intensifier having, e.g., the composition as described below for 3 min. at 20° C. prior to development processing, and then washed with water for 1 min., and further subjected to usual color development. These compounds have no particular restrictions, but generally known oxidizing agents and thiosulfonic acid compounds can be used, with examples including hydrogen peroxide, nitric acid, nitrous acid, halogen elements such as bromine and iodine, salts of oxyacids such as permanganates (e.g., $KMnO_4$) and chromates (e.g., $K_2CrO$), perhalogenates (e.g., potassium periodate) and high-valent metal salts (e.g., potassium ferricyanide).

An example of a preferred composition of gold intensifier is as follows:

| | |
|---|---|
| 0.1% $H[AuCl_4]$ | 4 ml |
| $H_2O$ | 88 ml |
| 1.0% KSCN | 5 ml |
| 1.2% NaCl | 3 ml |

For reducing dullness of developed colors, known color mixing inhibitors can be used in the present invention. The term "color mixing inhibitors" refers to as the compounds capable of inhibiting an oxidized developing agent produced by reaction between a sensitized silver halide emulsion and a color developer from diffusing into another layer and reacting with a coupler present therein. Of such color mixing inhibitors, those disclosed in the following patent documents are preferred over the others. For instance, it is beneficial to use the high-molecular-weight redox compounds disclosed in JP-A-5-333501, the phenidone-series and hydrazine-series compounds disclosed in WO 98/33760 and U.S. Pat. No. 4,923,787, and the white couplers disclosed in JP-A-5-249637, JP-A-10-282615 and German Patent No. 19629142A1. For special cases where development is speeded up by heightening the developer's pH, it is also advantageous to use the redox compounds disclosed in German Patent No. 19618786A1, European Patent No. 839623A1, European Patent No. 842975A1, German Patent No. 19806846A1 and French Patent No. 2760460A1.

Such a color mixing inhibitor can be incorporated into any of photographic constituent layers, but it is a preferred mode that the color mixing inhibitor is incorporated into an interlayer provided between adjacent silver halide emulsion layers in order to reduce dullness of developed colors. Since color mixing inhibitors react with oxidized developing agents at the time of color development, an increase in content of color mixing inhibitors lowers the densities of developed colors in some cases. Therefore, the content of color mixing inhibitors can influence photographic properties, namely both dullness and density of developed color. The content of color mixing inhibitors, though varies depending on the mode of a silver halide photosensitive material in which they are incorporated, is generally from 0.01 g to 10 g, preferably from 0.04 g to 1 g, per $m^2$ of silver halide photosensitive material.

In the silver halide photographic material of the present invention, preferably the third embodiment of the present invention, it is preferred that the maximum density of developed yellow color (DYmax) attained by subjecting only the silver halide emulsion in the yellow-dye-forming-coupler-containing layer to $1\times10^4$-second exposure and then to color-development processing is from 1.90 to 2.30, the maximum density of developed magenta color (DMmax) attained by subjecting only the silver halide emulsion in the magenta-dye-forming-coupler-containing layer to $1\times10^{-4}$-second exposure and then to color-development processing is from 1.95 to 2.30, the maximum density of developed cyan color (DCmax) attained by subjecting only the silver halide emulsion in the cyan-dye-forming-coupler-containing layer to $1\times10^{-4}$-second exposure and then to color-development processing is from 1.85 to 2.40, the maximum density of developed yellow color (DGYmax), the maximum density of developed magenta color (DGMmax) and the maximum density of developed cyan color (DGCmax) attained by sensitizing all the dye-forming-coupler-containing silver halide emulsion layers under 1×10−4-second exposure and then subjecting them to color-development processing are from 2.10 to 2.40, from 2.30 to 2.70 and from 2.10 to 2.45, respectively. And it is far preferred that (DYmax) is from 1.95 to 2.25, (DMmax) is from 2.00 to 2.25, (DCmax) is from 1.90 to 2.35, and (DGYmax), (DGMmax) and (DGCmax) are from 2.15 to 2.35, from 2.25 to 2.65 and from 2.15 to 2.40, respectively.

The silver halide color photographic material of the present invention, preferably the third embodiment of the present invention, which are adjusted so as to have their settings in the foregoing ranges can reproduce less dullness in the developed colors and higher gray densities even by undergoing rapid processing.

When the foregoing densities fall short of the ranges specified by the present invention, the images obtained are low in densities, so they sometimes become light-colored images or images lacking in pictorial depth. When the foregoing densities exceed the ranges specified by the present invention, the combination of digital exposure and rapid processing causes a drop in developed gray-color densities rather than a rise therein, and increases in dullness of colors and streaky unevenness occur in some cases.

Methods for determining DYmax, DMmax, DCmax, DGYmax, DGMmax and DGCmax are described below in detail.

Grayscale exposure using light of wavelengths capable of sensitizing only the silver halide emulsion incorporated in the yellow-dye-forming-coupler-containing layer is carried out for $1\times10^{-4}$ second, and then the color-development processing as described below is performed. Density measurements of the thus obtained images are made, and thereby a characteristic curve is plotted. On this characteristic curve, the maximum density of the developed yellow color (DYmax) is read.

[Processing]

| Processing Step | Temperature | Time |
|---|---|---|
| Color development | 38.5° C. | 45 seconds |
| Bleach-fix | 38.0° C. | 45 seconds |
| Rinsing (1) | 38.0° C. | 20 seconds |
| Rinsing (2) | 38.0° C. | 20 seconds |
| Rinsing (3) | 38.0° C. | 20 seconds |
| Rinsing (4) | 38.0° C. | 30 seconds |

(Rinsing is carried out from (1) to (4) according to a tank counter-current method.)

The composition of each processing solution is as follows.

| | [Tank Solution] |
|---|---|
| [Color Developer] | |
| Water | 800 ml |
| Dimethylpolysiloxane surfactant (Silicone KF351A, trade name, produced by Shin-Etsu Chemical Co., Ltd.) | 0.1 g |
| Tri(isopropanol) amine | 8.8 g |
| Ethylenediamine tetraacetic acid | 4.0 g |
| Polyethylene glycol (molecular weight: 300) | 10.0 g |
| Sodium 4,5-dihydroxybenzene-1,3-disulfonate | 0.5 g |
| Potassium chloride | 10.0 g |
| Potassium bromide | 0.040 g |
| Triazinylaminostilbene brightening agent (Hakkol FWA-SF, trade name, produced by Showa Chemical) | 2.5 g |
| Sodium sulfite | 0.1 g |
| Disodium-N,N-bis(sulfonatoethyl)hydroxylamine | 8.5 g |
| N-Ethyl-N-(β-methanesulfonamidoethyl)-3-methyl-4-amino-4-aminoaniline ½sulfate monohydrate | 5.0 g |
| Potassium carbonate | 26.3 g |
| Water to make | 1,000 ml |
| pH (at 25° C., adjusted with KOH and $H_2SO_4$) | 10.15 |
| [Bleach-fix Solution] | |
| Water | 700 ml |
| Ammonium salt of (ethylenediaminetetraacetato)iron(III) | 47.0 g |
| Ethylenediaminetetraacetic acid | 1.4 g |
| m-Carboxybenzenesulfinic acid | 8.3 g |
| Nitric acid (67%) | 16.5 g |
| Imidazole | 14.6 g |
| Ammonium thiosulfate (750 g/l) | 107.0 ml |
| Ammonium sulfite | 16.0 g |
| Ammonium bisulfite | 23.1 g |
| Water to make | 1,000 ml |
| pH (at 25° C., adjusted with acetic acid and ammonia) | 6.0 |
| [Rinsing Solution] | |
| Sodium chloroisocyanurate | 0.02 g |
| Demineralized water (conductivity: 5 μS/cm or below) | 1,000 ml |
| pH | 6.5 |

For sensitizing the only silver halide emulsion incorporated in the yellow-dye-forming-coupler-containing layer, it is required to select light with wavelengths at which silver halide emulsions incorporated in other layers have the lowest possible spectral sensitivities, since the spectral sensitivities of each silver halide emulsion are distributed over a some range of wavelengths. In addition, the wavelength range of the light selected is required to be narrow. Such light can be obtained by equipping a light source with a band pass filter. Color formation through sensitization of silver halide emulsions in the other layers by application of light exposure in an amount greater than the exposure amount required for the maximum yellow-color formation becomes no problem in determining the value of DYmax. When the silver halide emulsions in the other layers are sensitized by exposure to light in the amount providing the maximum density of developed yellow color even if the exposure is performed with light of any wavelengths over the spectral sensitivity region, the developed yellow-color density attained by the maximum of exposure amounts causing no color formation in the other layers is taken as DYmax.

The maximum density of developed magenta color (DMmax) is read in the same manner as in the case of determining DYmax, except that the light used for exposure is changed so as to have wavelengths with which the only silver halide emulsion incorporated in the magenta-dye-forming-coupler-containing layer is sensitized. Further, the maximum density of developed cyan color (DCmax) is read in the same manner as in the case of determining DYmax, except that the light used for exposure is changed so as to have wavelengths with which the only silver halide emulsion incorporated in the cyan-dye-forming-coupler-containing layer is sensitized.

Furthermore, the characteristic curves corresponding to images in which all colors have developed, or gray images, are plotted in the same manner as in the case of determining DYmax, except that the light used for exposure is changed to light capable of simultaneously sensitizing silver halide emulsions incorporated in all layers containing dye-forming couplers, and thereon are read the maximum density of developed yellow color (DGYmax), the maximum density of developed magenta color (DGMmax) and the maximum density of developed cyan color (DGCmax).

In addition, it is favorable for unevenness reduction that the silver halide color photographic material of the present invention, preferably the third or fourth embodiment of the present invention, have their curling degree in the range of −15 to +15, preferably −10 to +10, at a temperature of 25° C. and a relative humidity of 20% (hereinafter the relative humidity is sometimes symbolized by RH).

The "curling degree" in the present invention can be determined in the following procedure.

A silver halide photosensitive material in a state of no warpage under the circumstances of 25° C. and 55% RH is cut into sheet measuring 10 cm by 10 cm, and allowed to stand for 24 hours in a dark place under the circumstances of 25° C. and 20% RH. Then, the radii of the curvature (R) (unit: m) of warpage occurring in the photosensitive material is measured under the circumstance of 25° C. and 20% RH. The reciprocal of this radii, 1/R, is defined as the curling degree. The expression "state of no warpage under the circumstances of 25° C. and 55% RH" means, in the present invention, that the radii of the curvature is 1 m or above under the circumstances of 25° C. and 55% RH.

Since a photosensitive material is usually stored in the form of being wound into a roll, the support thereof has a curl tendency as long as the material is kept intact. So it is impossible to measure the curling degree defined above by the present invention. One method for bringing a photosensitive material having such a curl tendency to a state of no warpage under the circumstances of 25° C. and 55% RH consists in that the photosensitive material is placed on a flat substance and kept still as a pressure of about 1 kg/100 $cm^2$ is applied uniformly thereto. In removing the warpage by application of pressure, it is required that neither scratches nor creases are made on the photosensitive material.

The curling degree which is plus (a positive value) indicates that the photosensitive material surface is in a concave state on the photosensitive layer-coated side, while the curling degree which is minus (a negative value) indicates that the photosensitive material surface is in a convex state on the photosensitive layer-coated side.

In the present invention, the curling degree of silver halide photographic material varies depending on various factors. For instance, such factors include the kind and amount of gelatin used in photosensitive layers, the proportions of gelatin to oil-soluble compounds used, the concentrations of salts used, the types and amounts of gelatin hardeners used, and the time elapsed after preparing the photographic material. In addition, the curling degree varies also with the properties and thickness of a support used, and the properties and amount of a laminated layer provided on a support.

Adjustment of the curling degree to the range of −15 to +15 in the present invention can be achieved by providing a gelatin layer on the photosensitive-layer-uncoated side of a support, or changing the amount of laminate on the support. Of these methods, making an appropriate change in the amount of laminate provided on the photosensitive-layer-uncoated side of the support is one of the preferred modes.

In the silver halide color photographic material of the present invention, preferably the fourth embodiment of the present invention, it is preferable that the silver halide emulsion incorporated in at least one of the color-forming-coupler-containing silver halide emulsion layers is adjusted so as to have its spectral sensitivity distribution in the following range by selection of types of sensitizing dyes and addition methods thereof.

Specifically, in the silver halide color photographic material of the present invention, preferably the fourth embodiment of the present invention, it is appropriate that at least one peak in the spectral sensitivity distribution be in a region of 450 to 490 nm and a difference between exposure wavelengths on long-wavelength and short-wavelength sides which provide 70% of the maximum sensitivity in the spectral sensitivity peak be from 20 nm to 100 nm, preferably from 20 nm to 80 nm, particularly preferably from 30 nm to 80 nm. Herein, the foregoing expression "difference between exposure wavelengths" refers to the difference between the exposure wavelength providing the sensitivity equivalent to 70% of the sensitivity at the spectral-sensitivity peak (maximum sensitivity) on the long-wavelength side of a spectral-sensitivity peak present in the wavelength region of 450 to 490 nm and the exposure wavelength providing the sensitivity equivalent to 70% of the sensitivity at the spectral-sensitivity peak (maximum sensitivity) on the short-wavelength side of the spectral-sensitivity peak, and suggests that the absolute value of this difference preferably falls in the range of 20 to 100 nm.

The spectral sensitivity distributions of the silver halide color photographic material of the present invention vary depending on various factors. When two or more spectral sensitizing dyes, for example, are used for spectral sensitization of a silver halide emulsion, the spectral sensitivity distribution of the emulsion varies greatly depending on the addition times, speeds and order of the dyes, the time interval between additions of the dyes, and the agitation condition, the pH and temperature of the emulsion to which the dyes are added. For achieving the spectral sensitivity distribution defined above in the silver halide photographic material of the present invention, preferably the fourth embodiment of the present invention, it is appropriate to add spectral sensitizing dyes in the emulsion-ripening process after removal of salts by flocculation. Further, it is preferable to add sensitizing dyes during a period from the start of emulsion-ripening process to no later than chemical sensitization during the ripening process. In the case of adding two or more kinds of dyes, it is one of preferred modes that a solution containing a mixture of the dyes is prepared in advance and the solution prepared is added. And it may also add two or more kinds of dyes successively. Herein, the time interval between additions of different kinds of dyes is preferably at least 30 seconds, far preferably at least 1 minute. During the addition of sensitizing dyes, it is preferable to perform vigorous agitation (so as to attain a Reynolds number of, preferably 20,000 to 130,000, far preferably 20,000 to 120,000, particularly preferably 20,000 to 100,000) and to make appropriate adjustments to solution temperature and pH. The term "Reynolds number" in the present invention refers to the quantity determined by the rotation speed of agitator blades, the blade's diameter and the viscosity and density of a solution agitated. The greater number signifies that the agitation is in the more vigorous condition (See *Kagaku Daijiten* (Encyclopedia Dictionary of Chemistry), 1st ed., 6th printing, page 2537, Tokyo Kagaku Dojin Co., Ltd. (2001)). When the dyes are added individually and simultaneously besides, but not in the form of a solution of mixed dyes, and further with moderate stirring, there occurs a distribution of conditions of dye adsorption among silver halide grains, and the spectral sensitivity distribution comes to have a broad peak (a peak too large in difference between exposure wavelengths) or a steep peak (a peak too small in difference between exposure wavelengths).

In the silver halide color photographic material of the present invention, preferably the fourth embodiment of the present invention, it is preferred to use a sensitizing dye represented by the following formula (II).

Formula (II)

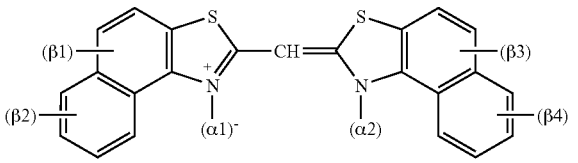

wherein α1, α2 and β1 to β4 each represent a hydrogen atom, an alkyl group, an alkenyl group, an alkynyl group, an aryl group, a heterocyclic group, an acyl group, an amino group, an alkoxy group, a hydroxyl group or a carbamoyl group, and each of these groups may be substituted.

Sensitizing dyes represented by formula (II) are illustrated below in detail.

In formula (II), α1 and α2 each represent a hydrogen atom, an alkyl group, an alkenyl group, an alkynyl group, an aryl group, a heterocyclic group, an acyl group, an amino group, an alkoxy group, a hydroxyl group or a carbamoyl group, and these groups each may be substituted. The alkyl group in the formula is a linear, branched or cyclic substituted or unsubstituted alkyl group. Suitable examples of such an alkyl group include substituted or unsubstituted, linear or branched alkyl groups having 1 to 30 carbon atoms (such as a methyl group, an ethyl group, an isopropyl group, an n-propyl group, an n-butyl group, a t-butyl group, a 2-pentyl group, an n-hexyl group, an n-octyl group, a t-octyl group, a 2-ethylhexyl group, a 1,5-dimethylhexyl group, an n-decyl group, an n-dodecyl group, an n-tetradecyl group, an n-hexadecyl group, a hydroxyethyl group, a hydroxypropyl group, a 2,3-dihydroxypropyl group, a carboxymethyl group, a carboxyethyl group, a sulfoethyl group, a sulfopropyl group, a sulfobutyl group, a diethylaminoethyl group, a diethylaminopropyl group, a butoxypropyl group, an ethoxyethoxyethyl group and an n-hexyloxypropyl group), and substituted or unsubstituted cycloalkyl groups having 3 to 18 carbon atoms (such as a cyclopropyl group, a cyclopentyl group, a cyclohexyl group, a cyclooctyl group, an adamantyl group and a cyclododecyl group). Further, therein are included substituted or unsubstituted bicycloalkyl groups having 5 to 30 carbon atoms (namely, monovalent groups formed by removing one hydrogen atom from each individual bicycloalkane, such as bicyclo[1,2,2]heptan-2-yl and bicyclo[2,2,2]octan-3-yl) and alkyl groups having polycyclic structures, such as a tricyclic structure. The alkenyl group represented by α1 and α2 each includes alkenyl groups having 2 to 16 carbon atoms (such as an allyl group, a 2-butenyl group and a 3-pentenyl group), and the alkynyl group represented by α1 and α2 each includes alkynyl groups having 2 to 10 carbon atoms (such as a propargyl group and 3-pentynyl group).

Examples of an aryl group represented by α1 and α2 each include substituted or unsubstituted phenyl groups or naphthyl groups having 6 to 20 carbon atoms (such as an unsubstituted phenyl group, an substituted naphthyl group, a 3,5-dimethylphenyl group, a 4-butoxyphenyl group and 4-dimethylaminophenyl group), and examples of a heterocyclic group include a pyridyl group, a furyl group, an imidazolyl group, a piperidyl group and a morpholinyl group.

In formula (II), examples of an acyl group represented by α1 and α2 each include an acetyl group, a formyl group, a benzoyl group, a pivaroyl group, a caproyl group and an n-nonanoyl group, and examples of an amino group represented by α1 and α2 each include an unsubstituted amino group, a methylamino group, a hydroxyethylamino group, an n-octylamino group, a dibenzylamino group, a dimethylamino group and a diethylamino group. Examples of an alkoxy group include a methoxy group, an ethoxy group, an n-butyloxy group, a cyclohexyloxy group, an n-octyloxy group and an n-decyloxy group, and examples of a carbamoyl group include an unsubstituted carbamoyl group, an N, N-diethylcarbamoyl group and an N-phenylcarbamoyl group.

Additionally, α1 and α2 each in formula (II) may have the greatest possible number of substituents, and examples of such substituents include halogen atoms (e.g., fluorine, chlorine, bromine and iodine atoms), alkyl groups (such as linear, branched and cyclic alkyl groups, including bicycloalkyl groups and an active methine group), alkenyl groups, alkynyl groups, aryl groups, heterocyclic groups (irrespective of substitution site), acyl groups, alkoxycarbonyl groups, aryloxycarbonyl groups, heterocyclyloxycarbonyl groups, carbamoyl groups, N-hydroxycarbamoyl groups, N-acylcarbamoyl groups, N-sulfonylcarbamoyl groups, N-carbamoylcarbamoyl groups, thiocarbamoyl groups, N-sulfamoylcarbamoyl groups, carbazoyl groups, a carboxyl group or salts thereof, oxalyl groups, oxamoyl groups, a cyano group, carbonimidoyl groups, a formyl group, a hydroxyl group, alkoxy groups (including groups having ethyleneoxy or propyleneoxy units by repetition), aryloxy groups, heterocyclyloxy groups, acyloxy groups, alkoxy- or aryloxy-carbonyloxy groups, carbamoyloxy groups, sulfonyloxy groups, amino groups, alkyl-, aryl- or heterocyclyl-amino groups, acylamino groups, sulfonamido groups, ureido groups, thioureido groups, N-hydroxyureido groups, imido groups, alkoxy-or aryloxy-carbonylamino groups, sulfamoylamino groups, semicarbazido groups, thiosemicarbazido groups, hydrazino groups, an ammonio group, oxamoylamino groups, N-alkyl- or N-aryl-sulfonylureido groups, N-acylureido groups, N-acylsulfamoylamino groups, hydroxyamino groups, a nitro group, quaternary-nitrogen-containing heterocyclic groups (such as pyridinio, imidazolio, quinolinio and isoquinolinio groups), an isocyano group, an imino group, a mercapto group, alkyl-, aryl- or heterocyclyl-thio groups, alkyl-, aryl- or heterocyclyl-dithio groups, alkyl- or arylsulfonyl groups, alkyl- or aryl-sulfinyl groups, a sulfo group or salts thereof, sulfamoyl groups, N-acylsulfamoyl groups, N-sulfonylsulfamoyl groups and salts thereof, phosphino groups, phosphinyl groups, phosphinyloxy groups, phosphinylamino groups and silyl groups. Additionally, the term "active methine group" used above refers to the methine group substituted with two electron-attracting groups, and the term "electron-attracting group" used herein is intended to include an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group and a carbonimidoyl group. Herein, two electron-attracting groups may combine with each other to form a ring structure. And the term "salts" used above means inorganic cations, such as alkali metal, alkaline earth metal and heavy metal ions, or organic cations, such as ammonium and phosphonium ions. The substituents as recited above may further be substituted with any of the substituents as recited above.

Each of β1 to β4 is defined as with α1 and α2 each. Additionally, when two or more β1s are present, they may be the same or different. And the same thing can be said for β2, β3 and β4 each.

As to the compounds represented by formula (II), cases are preferred where α1, α2 and β1 to β4 are each a hydrogen atom, a substituted alkyl group, an alkenyl group, an aryl group, a heterocyclic group or acyl group, cases are far preferred where α1, α2 and β1 to β4 are each a hydrogen atom, a substituted alkyl group, an alkenyl group or an aryl group, and cases are especially preferred where α1, α2 and β1 to β4 are each a hydrogen atom, a substituted alkyl group or an aryl group.

Of the compounds represented by formula (II) and used in silver halide color photographic material of the present invention, preferably the fourth embodiment of the present invention, compounds represented by the following formula (IIA) are used to greater advantage.

In the following formula (IIA), α1 and α2 have the same meanings as those in formula (II), respectively, while γ1 and γ2 each have the same meaning as β2, γ3 and γ4 each have the same meaning as β4, and suitable ranges of them are the same as β2 and β4, respectively. Typical examples of such a compound are illustrated below, but the present invention should not be construed as being limited to these examples.

| Sensitizing dye No. | α 1 | α 2 | γ 1 | γ 2 | γ 3 | γ 4 |
|---|---|---|---|---|---|---|
| BS-1 | $—(CH_2)_2—COO^-$ | $—(CH_2)_2—COOH$ | —H | —H | —H | —H |
| BS-2 | $—(CH_2)_3—SO_3^-$ | $—CH_2)_3—SO_3HN(C_2H_5)_3$ | —H | —H | —H | —H |
| BS-3 | $—CH_2—COOH$ | $—(CH_2)_3—SO_3^-$ | $—OCH_3$ | $—OCH_3$ | —H | —H |
| BS-4 | $—(CH_2)_3—SO_3^-$ | $—(CH_2)_3—SO_3HN(C_2H_5)_3$ | $—OCH_3$ | $—OCH_3$ | $—OCH_3$ | $—OCH_3$ |
| BS-5 | $—(CH_2)_3—SO_3^-$ | $—C_2H_5$ | —H | —H | —H | —H |
| BS-6 | $—(CH_2)_4—SO_3^-$ | $—(CH_2)_4—SO_3HN(C_2H_5)_3$ | —H | —H | $—OCH_3$ | $—OCH_3$ |
| BS-7 | $—(CH_2)_2—SO_3^-$ | $—(CH_2)_3—SO_3HN(C_2H_5)_3$ | —H | —H | $—OCH_3$ | —H |
| BS-8 | $—CH_2—SO_3^-$ | $—(CH_2)_3—SO_3HN(C_2H_5)_3$ | —H | —H | —Cl | —H |

Formula (II A)

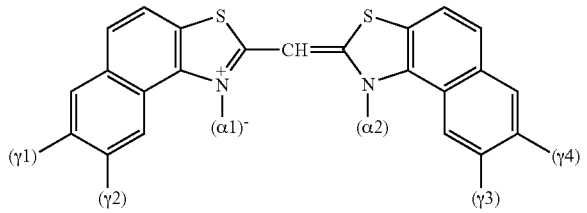

The compounds represented by formula (II) used in silver halide color photographic material of the present invention, preferably the fourth embodiment of the present invention, can be easily synthesized in accordance with the methods disclosed in British Patent No. 660,408, U.S. Pat. No. 3,149,105 and JP-A-50-4127, or the methods described in F. M. Hamer, *The Cyanine Dyes and Related Compounds*, Interscience Publishers, New York, pages 32-75 (1969), or by methods following those methods.

The photosensitive materials of the present invention are described below in further detail.

In the photosensitive material of the present invention, use may be made of known photographic materials or additives.

For example, as a photographic support (base), a transmissive type support or a reflective type support may be used. As the transmissive type support, it is preferred to use a transparent film, such as a cellulose triacetate film, cellulose nitrate film, and a polyethylene terephthalate film; or a polyester of 2,6-naphthalenedicarboxylic acid (NDCA) and ethylene glycol (EG), or a polyester of NDCA, terephthalic acid, and EG, provided thereon with an information-recording layer such as a magnetic layer. As the reflective type support, it is especially preferable to use a reflective support having a substrate laminated thereon with a plurality of polyethylene layers or polyester layers, at least one of the water-proof resin layers (laminate layers) contains a white pigment such as titanium oxide. In the present invention, it is preferred to use the reflective type support (or reflective support).

A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range of 0.1 to 0.15.

Further, it is also preferable for enhancing rigidity of the reflective support, that a polyolefin layer be provided on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer to be provided on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent may be dispersed and contained in a hydrophilic colloid layer, which is formed separately form the above layers in the light-sensitive material. Preferred fluorescent whitening agents which can be used, include benzoxazole-series, coumarin-series, and pyrazoline-series compounds. Further, fluorescent whitening agents of benzoxazolyinaphthalene-series and benzoxazolylstilbene-series are more preferably used. Specific examples of the fluorescent whitening agent that is contained in a water-resistant resin layer, include, for example, 4,4'-bis(benzoxazolyl)stilbene, 4,4'-bis(5-methylbenzoxazolyl)stilbene, and mixture thereof. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer be provided on the silver halide emulsion layer side or the reverse side of the support. In particular, it is preferable that the transmission density of support be adjusted to the range of 0.35 to 0.8 so that a display may be enjoyed by means of both transmitted and reflected rays of light.

In the light-sensitive material of the present invention, in order to improve, e.g., the sharpness of an image, a dye (particularly an oxonole-series dye) that can be discolored by processing, as described in European Patent No. 0,337,490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohols (e.g., trimethylolethane) to a water-proof resin layer of the support.

The light-sensitive material of the present invention preferably contains, in the hydrophilic colloid layer, a dye (particularly oxonole dyes and cyanine dyes) that can be discolored by processing, as described in European Patent No. 0337490A2, pages 27 to 76, in order to prevent irradiation or halation or to enhance safelight safety, and the like. Further, a dye described in European Patent No. 0819977 may also be preferably added to the light-sensitive materials in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (i.e. a layer closer to the support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-particles of a dye in solid state, for example, JP-A-2-308244, pages 4 to 13, describes a method in which fine-particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the method of incorporating fine particles of dye and the method of using colloidal silver.

The silver halide photographic materials of the present invention can be used as color negative films, color positive films, color reversal films, color reversal photographic papers, color photographic papers, display photosensitive materials, digital color proofs, motion picture color positives or motion picture color negatives, or the like. Of these photosensitive materials, display photosensitive materials, digital color proofs, motion picture color positives, color reversal photographic papers and color photographic papers are preferred over the others as uses of the present silver halide photographic materials, and the use as color photographic papers is particularly preferable.

The silver halide color photographic light-sensitive material (e.g. color photographic paper) of the present invention preferably has, on a support, at least one yellow-color-forming blue-sensitive silver halide emulsion layer (yellow-dye-forming-coupler-containing silver halide emulsion layer), at least one magenta-color-forming green-sensitive silver halide emulsion layer (magenta-dye-forming-coupler-containing silver halide emulsion layer), and at least one cyan-color-forming red-sensitive silver halide emulsion layer (cyan-dye-forming-coupler-containing silver halide emulsion layer). In general the arranging order of these silver halide emulsion layers in the direction that goes away from a support is a yellow-color-forming silver halide emulsion layer, a magenta-color-forming silver halide emulsion layer, and a cyan-color-forming silver halide emulsion layer.

However, other layer arrangements which are different from the above, may be adopted.

In the light-sensitive material, the silver halide emulsion contained in the blue-sensitive silver halide emulsion layer preferably has a relatively high sensitivity as compared with the green-sensitive silver halide emulsion and red-sensitive silver halide emulsion, in consideration of yellow mask of a negative or spectroscopic characteristics of halogen that is the light source at the time of exposure. For this purpose, the side length of the grains in the blue-sensitive emulsion is greater than that of the grains in other layers. Further, the generally known molar extinction coefficient of the coloring dye formed by a yellow coupler is low as compared with those of the coloring dyes formed by the magenta coupler and the cyan coupler, so that increasing yellow coupler coating amount is accompanied by an increasing coating amount of the blue-sensitive emulsion. The yellow color-forming blue-sensitive silver halide emulsion layer is disadvantageous as compared with other layers when taking into consideration the resistance to pressure applied from the surface of the photosensitive material, such as scratching, and it is preferably positioned on a side closer to the support.

A yellow coupler-containing silver halide emulsion layer may be provided at any position on a support. In the case where silver halide tabular grains are contained in the yellow coupler-containing layer, it is preferable that the yellow coupler-containing layer be positioned more apart from a support than at least one of a magenta-coupler-containing silver halide emulsion layer and a cyan-coupler-containing silver halide emulsion layer. Further, it is preferable that the yellow coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan coupler-containing silver halide emulsion layer be disposed in the middle of the other silver halide emulsion layers, from the viewpoint of reducing blix fading. On the other hand, it is preferable that the cyan coupler-containing silver halide emulsion layer be the lowest layer, from the viewpoint of reducing light fading. Further, each of the yellow-color-forming layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) that can be used in the present invention, photographic constituting layers (arrangement of the layers or the like), and processing methods for processing the photographic materials and additives for processing, are disclosed in JP-A-62-215272, JP-A-2-33144, and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following Table 1 are particularly preferably can be used or used in combination in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |

TABLE 1-continued

| Element | JP-A-7-104448 | JP-A-7-77775 | JP-A-7-301895 |
|---|---|---|---|
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

As cyan, magenta, and yellow couplers which can be used or used in combination in the present invention other than the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the light-sensitive materials of the present invention to add compounds represented by formula (II) or (III) in WO 98/33760 and compounds represented by formula (D) described in JP-A-10-221825.

As the cyan dye-forming coupler (hereinafter also simply referred to as "cyan coupler") which can be used in the present invention, pyrrolotriazole-series couplers are preferably used, and more specifically, couplers represented by formula (I) or (II) in JP-A-5-313324, couplers represented by formula (I) in JP-A-6-347960, and exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1); 2,5-diacylamino phenol couplers described in U.S. Pat. No. 5,888,716; pyrazoloazole-type cyan couplers having an electron-withdrawing group or a group bonding via hydrogen bond at the 6-position, as described in U.S. Pat. Nos. 4,873,183 and 4,916,051; and particularly, pyrazoloazole-type cyan couplers having a carbamoyl group at the 6-position, as described in JP-A-8-171185, JP-A-8-311360, and JP-A-8-339060.

Further, as a cyan coupler, use can also be made of a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group; and couplers (6) and (9), enumerated as specific examples are particularly preferable) described in European patent 0333185 A2; a cyclic active methylene-series cyan coupler (particularly couplers 3, 8, and 34 enumerated as specific examples are particularly preferable) described in JP-A-64-32260; a pyrrolopyrazole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference as a part of the present specification.

The magenta dye-forming couplers (which may be referred to simply as "magenta coupler" hereinafter) that can be used in the present invention can be 5-pyrazolone-series magenta couplers and pyrazoloazole-series magenta couplers, such as those described in the above-mentioned patent publications in the above table. Among these, preferred are pyrazolotriazole couplers in which a secondary or tertiary alkyl group is directly bonded to the 2-, 3-, or 6-position of the pyrazolotriazble ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference as a part of the present specification. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as "yellow coupler" herein), preferably use can be made, in the present invention, of acylacetamide-type yellow couplers in which the acyl group has a 3-membered to 5-membered ring structure, such as those described in European Patent No. 0447969 A1; malondianilide-type yellow couplers having a ring structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; acylacetamide-type yellow couplers having a dioxane structure, such as those described in U.S. Pat. No. 5,118,599; acetanilide-type yellow couplers wherein the acyl group is substituted by a hetero ring, such as those described in JP-A-2003-173007, other than the compounds described in the above-mentioned table. Of these couplers, the acylacetamide-type yellow couplers whose acyl groups are 1-alkylcyclopropane-1-carbonyl groups, the malondianilide-type yellow couplers wherein either anilide forms an indoline ring, the acetanilide-type yellow couplers wherein the acyl group is substituted by a hetero ring are preferably used. These couplers may be used singly or in combination. Of these couplers, the acylacetamide-type yellow couplers whose acyl groups are 1-alkylcyclopropane-1-carbonyl groups, the malondianilide-type yellow couplers wherein either anilide forms an indoline ring, the acetanilide-type yellow couplers wherein the acyl group is substituted by a hetero ring are preferably used. These couplers may be used singly or in combination.

In the photosensitive material, the dye-forming coupler is added to a photographically useful substance or a high-boiling organic solvent, emulsified and dispersed together with the substance or solvent, and incorporated into a photosensitive material as a resulting dispersion. This solution (dispersion) is emulsified and dispersed in fine grain form, into a hydrophilic colloid, preferably into an aqueous gelatin solution, together with a dispersant which is, for example, a surfactant, by use of a known apparatus such as an ultrasonic device, a colloid mill, a homogenizer, a Manton-Gaulin, or a high-speed dissolver, to obtain a dispersion.

The high-boiling organic solvent that can be used in the present invention is not particularly limited, and an ordinary one may be used. Examples of which include those described in U.S. Pat. No. 2,322,027 and JP-A-7-152129.

Further, an auxiliary solvent may be used together with the high-boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, s-ethoxyethyl acetate, methyl cellosolve acetate, methyl carbitol acetate, and cyclohexanone.

Further, if necessary, an organic solvent that completely admix with water, such as methyl alcohol, ethyl alcohol, acetone, tetrahydrofuran, and dimethylformamide, can be additionally used as a part of the auxiliary solvent. These organic solvents can be used in combination with two or more.

For the purpose of, for example, improving stability with the lapse of time at storage in the state of an emulsified dispersion, and improving stability with the lapse of time and inhibiting the fluctuation of photographic property of the end-composition for coating (applying) that is mixed with an emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine-particle dispersion obtained in this way is 0.04 to 0.50 μm, more preferably 0.05 to 0.30 μm, and most preferably 0.06 to 0.20 μm. The average grain size can be measured by using Coulter Submicron Particle Analyzer Model N4 (manufactured by Coulter Electronics Co.) or the like.

Also, a pigment for coloration may be co-emulsified into the emulsion used in the silver halide color photographic light-sensitive material of the present invention in order to adjust coloration of the white background, or it may coexist in an organic solvent that dissolves the photographically useful compound, such as the coupler, used in the photosensitive material of the present invention to be co-emulsified, thereby preparing an emulsion.

It is preferred that couplers for use in the present invention, are pregnanted into a loadable latex polymer (as described, for example, in U.S. Pat. No. 4,203,716) in the presence (or absence) of the foregoing high-boiling-point organic solvent, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homo-polymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the present invention, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615, and German Patent No. 19629142 A1, may be used. Particularly, in order to accelerate developing speed by increasing the pH of a developing solution, redox compounds described in, for example, German Patent No. 19,618,786 A1, European Patent Nos. 839,623 A1 and 842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, compounds described in the following patent publications can be used. These compounds are preferably added to the light-sensitive layer or/and the light-insensitive. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As a binder (hydrophilic binder) or a protective colloid usable in the photosensitive materials of the present invention, gelatin is used to advantage, but it is also possible that hydrophilic colloids of other gelatin derivatives, graft polymers of gelatin and other high polymers, proteins other than gelatin, sugar derivatives, cellulose derivatives or synthetic high-molecular hydrophilic compounds, such as homo- or copolymers, are used alone or in combination with gelatin. Gelatin to be used in the silver halide color photographic light-sensitive material of the present invention may be either lime-treated or acid-treated gelatin or may be gelatin produced from any of cow bone, cowhide, pig skin, or the like, as the raw material, preferably lime-treated gelatin produced from cow bone or pig skin as the raw material. It is preferable for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the film pH of the light-sensitive material is preferably in the range of 4.0 to 7.0, more preferably in the range of 4.0 to 6.5.

The total coating amount of gelatin in the photographic constituent layers of the present photosensitive material is preferably from 3.0 g/m$^2$ to 7.0 g/m$^2$, far preferably from 3.0 g/m$^2$ to 6.5 g/m$^2$, further preferably from 3.0 g/m$^2$ to 6.0 g/m$^2$, particularly preferably from 3 g/m$^2$ to 5 g/m$^2$. The expression "the total coating amount of gelatin in the photographic constituent layers of the photosensitive material" refers to the total amount of hydrophilic binders contained in all the hydrophilic colloid layers provided between a support and the hydrophilic colloid layer farthest from the support on the silver-halide-emulsions-coated side of the support, including light-sensitive silver halide emulsion layers and light-insensitive hydrophilic colloid layers. A too large amount of hydrophilic binders sometimes lowers effects of the invention through impairment of color-development processing rapidity, aggravation of blix discoloration and deterioration of rapid processability in a rinsing process (including washing and/or stabilizing steps). On the other hand, a too small amount of hydrophilic binders often yields detrimental effects associated with insufficient film strength, such as pressure-induced streaked fog. In order to ensure satisfactory development progress, fixation-bleach properties, and residual color, even when super-rapid processing is carried out, the total thickness of the photographic constituent layers is preferably from 3 μm to 7.5 μm, more preferably from 3 μm to 6.5 μm. Evaluation of dried film thickness can be made by measuring a difference in film thickness between before and after delamination of the dried film or by observing the film profile under an optical microscope or an electron microscope. In the present invention, for achievement of both expeditious progress of development and increase in drying speed, it is preferable that the swollen film thickness be from 8 μm to 19 μm, more preferably 9 μm to 18 μm. The swollen film thickness can be measured by application of a dotting method to a photosensitive material brought into a condition of swelling equilibrium by immersing the dried photosensitive material in a 35° C. aqueous solution. The total amount of silver coated in the present invention is preferably 0.5 $g/m^2$ or below, far preferably from 0.2 $g/m^2$ to 0.5 $g/m^2$, further preferably from 0.2 $g/m^2$ to 0.45 $g/m^2$, especially preferably from 0.2 $g/m^2$ to 0.40 $g/m^2$. The term "total amount of silver coated" as used herein refers to the sum total of coating amounts of silver in all the photographic constituent layers of the present photosensitive material.

In the present invention, a surfactant may be added to the light-sensitive material, in view of improvement in coating-stability, prevention of static electricity from being occurred, and adjustment of the charge amount, and the like. As the surfactant, mention can be made of anionic, cationic, betaine, and nonionic surfactants. Examples thereof include those described in JP-A-5-333492. As the surfactant that can be used in the present invention, a fluorine-containing surfactant is particularly preferred. The fluorine-containing surfactant may be used singly, or in combination with known other surfactant. The fluorine-containing surfactant is preferably used in combination with known other surfactant. The amount of the surfactant to be added to the light-sensitive material is not particularly limited, but it is generally in the range of $1\times10^{-5}$ to 1 $g/m^2$, preferably in the range of $1\times10^{-4}$ to $1\times10^{-1}$ $g/m^2$, and more preferably in the range of $1\times10^{-3}$ to $1\times10^{-2}$ $g/m^2$.

The photosensitive material of the present invention can form an image, via an exposure step in which the photosensitive material is irradiated with light according to image information, and a development step in which the photosensitive material irradiated with light is developed.

The light-sensitive material of the present invention can be adapted, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green, and blue, and fluorophoroes which can emit a light in a region of yellow, orange, purple, or infrared can also be used. Particularly, a cathode ray tube which emits a white light by means of a mixture of these light-emitting materials, is often used.

In the case where the light-sensitive material has a plurality of light-sensitive layers each having different spectral sensitivity distribution from each other, and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting colors other than the emitted color, i.e., an area (or surface) sequential exposure, may be used. Generally, among these methods, the area sequential exposure is preferred from the viewpoint of high image quality enhancement, because a cathode ray tube having a high resolving power can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in usual three wavelength regions of blue, green, and red. The exposure time in such a scanning exposure is defined as the time period necessary to expose the size of the picture element (pixel) with the density of the picture element being 400 dpi (or 300 dpi), and a preferred exposure time is $1\times10^{-4}$ sec or less, more preferably $1\times10^{-6}$ sec or less.

When the present invention is applied to silver halide color photographic light-sensitive materials, it is preferable to perform image-wise exposure using coherent light of blue lasers with emission wavelengths of 420 nm to 460 nm. Of the blue lasers, blue semiconductor lasers are particularly preferably used.

Specific examples of the laser light source that can be preferably used, include a blue-light semiconductor laser having a wavelength of 430 to 450 nm (Presentation by Nichia Corporation at the 48th Applied Physics Related Joint Meeting, in March of 2001); a blue laser at about 470 nm obtained by wavelength modulation of a semiconductor laser (oscillation wavelength about 940 nm) with a SHG crystal of $LiNbO_3$ having a reversed domain structure in the form of a wave guide; a green-light laser at about 530 nm obtained by wavelength modulation of a semiconductor laser (oscillation wavelength about 1,060 nm) with SHG crystal of $LiNbO_3$ having a reversed domain structure in the form of a wave guide; a red-light semiconductor laser of the wavelength at about 685 nm (Type No. HL6738MG (trade name) manufactured by Hitachi, Ltd.); and a red-light semiconductor laser of the wavelength at about 650 nm (Type No. HL6501MG (trade name) manufactured by Hitachi, Ltd.).

The silver halide color photosensitive material of the present invention is preferably used in combination with the exposure and development systems described in the following known literatures. Example of the development system include the automatic print and development system described in JP-A-10-333253, the photosensitive material conveying apparatus described in JP-A-2000-10206, a recording system including the image reading apparatus, as described in JP-A-11-215312, exposure systems with the color image recording method, as described in JP-A-11-88619 and JP-A-10-202950, a digital photo print system including the remote diagnosis method, as described in JP-A-10-210206, and a photo print system including the image recording apparatus, as described in JP-A-2000-310822.

The preferred scanning exposure methods which can be applied to the present invention are described in detail in the publications listed in the table shown above.

It is preferred to use a band stop filter, as described in U.S. Pat. No. 4,880,726, when the light-sensitive material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

In order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative for use in the developing solution, compounds described in the patent publications listed in the above table can be preferably used.

The first embodiment of the present invention can be applied to a light-sensitive material having rapid processing suitability. The color-developing time is 28 sec or less, preferably from 25 sec to 6 sec, and more preferably from 20 sec to 6 sec. Likewise, the blix time is preferably 30 sec or less, more preferably from 25 sec to 6 sec, and further preferably from 20 sec to 6 sec. Further, the washing or stabilizing time is preferably 60 sec or less, and more preferably from 40 sec to 6 sec.

The silver halide color photographic light-sensitive material as the second embodiment of the present invention can also be preferably applied to a light-sensitive material having rapid processing suitability. In the case of conducting rapid processing, the color-developing time is preferably 60 sec or less, more preferably from 50 sec to 6 sec, further more preferably from 30 sec to 6 sec, and most preferably from 20 sec to 6 sec. Likewise, the blix time is preferably 60 sec or less, more preferably from 50 sec to 6 sec, further more preferably from 30 sec to 6 sec, and most preferably from 20 sec to 6 sec. Further, the washing or stabilizing time is preferably 150 sec or less, and more preferably from 130 sec to 6 sec.

The silver halide color photographic light-sensitive material as the third embodiment of the present invention can be preferably applied to rapid processing suitability. In the case of conducting rapid processing, the color-developing time is preferably 40 sec or less, more preferably from 30 sec to 6 sec, and most preferably from 20 sec to 6 sec. Likewise, the blix time is preferably 40 sec or less, more preferably from 30 sec to 6 sec, and most preferably from 20 sec to 6 sec. Further, the washing or stabilizing time is preferably 100 sec or less, and more preferably from 80 sec to 6 sec.

The light-sensitive material as the fourth embodiment of the present invention can also be preferably applied to a light-sensitive material having rapid processing suitability. In the case of conducting rapid processing, the color-developing time is preferably 30 sec or less, more preferably from 25 sec to 6 sec, and further more preferably from 25 sec to 6 sec. Likewise, the blix time is preferably 30 sec or less, more preferably from 25 sec to 6 sec, and particularly preferably from 20 sec to 6 sec. Further, the washing or stabilizing time is preferably 60 sec or less, and more preferably from 40 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when a processing is carried out using an autoprocessor or the like, the color developing time is the sum total of a time in which a light-sensitive material has been dipped in a color developing solution (so-called "time in the solution") and a time in which the light-sensitive material has left the color developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

Examples of a development method after exposure, applicable to the light-sensitive material of the present invention, include a wet method, such as a conventional development method using a developing solution containing an alkali agent and a developing agent (especially p-phenylenediamine series color developing agent), and a development method wherein a developing agent is incorporated in the light-sensitive material and an activator solution, e.g., an alkaline solution free of developing agent, is employed for the development, as well as a heat development method using no processing solution. In particular, the activator method is preferred over the other methods, because the processing solutions contain no developing agent, thereby it enables easy management and handling of the processing solutions and reduction in waste solution disposal or processing-related load to make for environmental preservation.

Additionally, the present invention prefers the method of developing with a developer containing an alkali agent and a developing agent (especially a p-phenylenediamine series color developing agent).

The preferable developing agents or their precursors incorporated in the light-sensitive materials in the case of adopting the activator method, include the hydrazine-type compounds described in, for example, JP-A-8-234388, JP-A-9-152686, JP-A-9-152693, JP-A-9-211814 and JP-A-9-160193.

Further, the development method in which the light-sensitive material reduced in the amount of silver to be applied, undergoes the image amplification processing using hydrogen peroxide (intensification processing), can be employed preferably. In particular, it is preferable to apply this development method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from light-sensitive materials by means of a scanner or the like, is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536-541 (September 1994), and JP-A-8-234388 can be used in the present invention.

The silver halide color photographic light-sensitive materials of the present invention can provide a white background of excellent quality even by undergoing rapid processing. Further, they have high suitability for digital exposures, typified by laser scanning exposure. In addition, the light-sensitive materials can provide a white background of excellent quality even when they are used after time-lapse storage.

The silver halide color photographic light-sensitive materials of the present invention have high -sensitivity, cause low fog, and suffer slight changes in properties, such as fog, even when variations in processing conditions occur.

In rapid processing, the silver halide color photographic light-sensitive materials of the present invention can achieve excellent effects of ensuring high sensitivity and high color saturation, reproducing high gray density and reducing the occurrence of unevenness.

Even in rapid processing after digital exposure, the silver halide color photographic light-sensitive materials of the present invention can ensure high sensitivity and low fog, and can produce color images reduced in dullness. Further, the present silver halide color photographic light-sensitive materials are reduced in dependence of sensitivity on emulsion-making scale and superior in running processing suitability.

Furthermore, the present silver halide color photographic light-sensitive materials can ensure high sensitivity, low fog, excellent gradation characteristic, and reduced property changes in the process of preparing emulsions.

The present invention will be described in more detail based on the following examples, but the invention is not intended to be limited thereto.

EXAMPLES

Example 1-1

(Preparation of Emulsion B-1)

Using a method of simultaneously adding an aqueous silver nitrate solution and an aqueous sodium chloride solution mixed into stirring deionized distilled water containing a deionized gelatin, high silver chloride cubic grains were prepared. In the process of this preparation, the time period over which up to 3% of silver nitrate addition was finished was allocated to the nucleation section. At the step of from 3% to 80% addition of the entire silver nitrate amount, the addition speeds of the aqueous solution of silver nitrate and the aqueous solution of sodium chloride were picked up as a linear function of time. At the step of from 80% to 100% addition of the entire silver nitrate amount, potassium bromide (4.0 mol % per mol of the finished silver halide) was added. Potassium iodide (0.3 mol % per mol of the finished silver halide) was added with a vigorous stirring, at the step of completion of 90% addition of the entire silver nitrate amount. $K_4[Ru(CN)_6]$ was added at the step of from 92% to 97% addition of the entire silver nitrate amount. The thus-obtained emulsion grains were monodisperse cubic silver iodobromochloride grains having a side length of 0.50 μm and a variation coefficient of 9.0% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion B-2)

An emulsion B-2 was prepared in the same manner as Emulsion B-1, except that $K_2[IrCl_5(H_2O)]$ ($1.0\times10^{-7}$ mol, per mol of the finished silver halide) and $K[IrCl_4(H_2O)_2]$ ($1.0\times10^{-8}$ mol, per mol of the finished silver halide) were added over a period from 92 to 97% addition of the entire silver nitrate amount in the emulsion preparation.

(Preparation of Emulsion B-3)

An emulsion B-3 was prepared in the same manner as Emulsion B-2, except that $K_2[IrCl_5$(5-methylthiazole)] ($3.4\times10^{-8}$ mol, per mol of the finished silver halide) were added over a period from 82 to 88% addition of the entire silver nitrate amount in the emulsion preparation.

(Preparation of Emulsion B-4)

Emulsion B-4 was prepared in the same manner as Emulsion B-3, except that the addition amounts of $K_2[IrCl_5(H_2O)]$, $K[IrCl_4(H_2O)_2]$ and $K_2[IrCl_5$(5-methylthiazole)] were each increased by three times as the relative proportion of these complexes was left unchanged.

(Preparation of Emulsion B-5)

Emulsion B-5 was prepared in the same manner as Emulsion B-3, except that the addition amounts of $K_2[IrCl_5(H_2O)]$, $K[IrCl_4(H_2O)_2]$ and $K_2[IrCl_5$(5-methylthiazole)] were each increased by ten times as the relative proportion of these complexes was left unchanged.

(Preparation of Emulsion B-6)

Emulsion B-6 was prepared in the same manner as Emulsion B-3, except that the addition amounts of $K_2[IrCl_5(H_2O)]$, $K[IrCl_4(H_2O)_2]$ and $K_2[IrCl_5$(5-methylthiazole)] were each increased by thirty times as the relative proportion of these complexes was left unchanged.

(Preparation of Emulsion B-7)

Emulsion B-4 was prepared in the same manner as Emulsion B-3, except that the addition amounts of $K_2[IrCl_5(H_2O)]$, $K[IrCl_4(H_2O)_2]$ and $K_2[IrCl_5(5\text{-methylthiazole})]$ were each increased by one hundred times as the relative proportion of these complexes was left unchanged.

(Preparation of Emulsions B-8 to B-14)

Emulsions B-8 to B-14 were prepared in the same manner as Emulsions B-1 to B-7, except that $K_2[RuCl_5(NO)]$ ($3.4\times10^{-9}$ mole, per mole of the finished silver halide) was added over a period from 0 to 3% addition of the entire silver nitrate amount in the emulsion preparation.

(Preparation of Emulsion B-1a)

The re-dispersed emulsion was dissolved at 40° C., and sodium benzenethiosulfonate, 1-(5-methylureidophenyl)-5-mercaptotetrazole (1/10 of the addition amount at the completion of chemical sensitization), triethylthiourea as a sulfur sensitizer, bis(1,4,5-trimethyl-1,2,4-triazolium-3-thiolato) aurate(I) tetrafluoroborate as a gold sensitizer were added. The resulting emulsion was ripened at 60° C. under the most favorable chemical sensitization condition for achieving the hardest gradation under $1\times10^{-6}$-second exposure. Thereafter, the temperature of the emulsion was cooled to 40° C., and 1-phenyl-5-mercaptotetrazole; 1-(3-acetoamidophenyl)-5-mercaptotetrazole; 1-(5-methylureidophenyl)-5-mercaptotetrazole; Compound-2; a mixture whose major components are compounds represented by Compound-3 in which the repeating unit is 2 or 3 (both ends $X_1$ and $X_2$ are each a hydroxyl group); Compound-4, and potassium bromide (0.30 mol % per mol of the finished silver halide) were added. Further, prior to addition of the sensitizers, Sensitizing Dyes S-1, S-2, S-3 and S-9 were added, to conduct spectral sensitization. The thus-obtained emulsion was referred to as Emulsion B-1a.

(Preparation of Emulsions B-2a to B-7a)

Emulsions B-2a to B-7a were prepared in the same manner as emulsion B-1a, respectively, except that the emulsions B-2 to B-7 were used in place of the emulsion B-1 in the preparation of the emulsion B-1a.

(Preparation of Emulsion B-1b)

The re-dispersed emulsion was dissolved at 40° C., and sodium benzenethiosulfonate, 1-(5-methylureidophenyl)-5-mercaptotetrazole (1/10 of the addition amount at the completion of chemical sensitization), the exemplified Compound (SE3-29) as a selenium sensitizer, bis(1,4,5-trimethyl-1,2,4-triazolium-3-thiolato)aurate(I) tetrafluoroborate as a gold sensitizer were added. The resulting emulsion was ripened at 60° C. under the most favorable chemical sensitization condition for achieving the hardest gradation under $1\times10^{-6}$-second exposure. Thereafter, the temperature of the emulsion was cooled to 40° C., and 1-phenyl-5-mercaptotetrazole; 1-(3-acetoamidophenyl)-5-mercaptotetrazole; 1-(5-methylureidophenyl)-5-mercaptotetrazole; Compound-2; a mixture whose major components are compounds represented by Compound-3 in which the repeating unit is 2 or 3 (both ends $X_1$ and $X_2$ are each a hydroxyl group); Compound-4, and potassium bromide (0.30 mol % per mol of the finished silver halide) were added. Further, prior to addition of the sensitizers, Sensitizing Dyes S-1, S-2, and S-3 were added, to conduct spectral sensitization. The thus-obtained emulsion was referred to as Emulsion B-1b.

(Preparation of Emulsions B-2b to B-7b)

Emulsions B-2b to B-7b were prepared in the same manner as emulsion B-1b, respectively, except that the emulsions B-2 to B-7 were used in place of the emulsion B-1 in the preparation of the emulsion B-1b.

(Preparation of Emulsions B-8b to B-14b)

Emulsions B-8b to B-14b were prepared in the same manner as emulsion B-1b, respectively, except that the emulsions B-8 to B-14 were used in place of the emulsion B-1 in the preparation of the emulsion B-1b.

(Preparation of Emulsion G-1)

In the preparation of Emulsion B-1, the addition speed in the nucleation section was changed. The addition amount of potassium iodide was changed to 0.2 mole % per mole of finished silver halide. In the same manner as Emulsion B-1, excepting the changes mentioned above, Emulsion G-1 was prepared. The thus-obtained emulsion grains were monodisperse cubic silver iodobromochloride grains having a side length of 0.40 μm and a variation coefficient of 9.5% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion G-2)

An emulsion G-2 was prepared in the same manner as Emulsion G-1, except that $K_2[IrCl_5(H_2O)]$ ($2.0\times10^{-8}$ mol, per mol of the finished silver halide) and $K[IrCl_4(H_2O)_2]$ ($2.0\times10^{-7}$ mol, per mol of the finished silver halide) were added over a period from 92 to 97% addition of the entire silver nitrate amount in the emulsion preparation.

(Preparation of Emulsion G-3)

An emulsion G-3 was prepared in the same manner as Emulsion G-2, except that $K_2[IrCl_5(5\text{-methylthiazole})]$ ($6.6\times10^{-8}$ mol, per mol of the finished silver halide) were added over a period from 82 to 88% addition of the entire silver nitrate amount in the emulsion preparation.

(Preparation of Emulsions G-4 to G-7)

Emulsions G-4 to G-7 ware prepared in the same manner as Emulsion G-3, except that the addition amounts of $K_2[IrCl_5(H_2O)]$, $K[IrCl_4(H_2O)_2]$ and $K_2[IrCl_5(5\text{-methylthiazole})]$ were each increased by three times, ten times, thirty times, and one hundred times, respectively, as the relative proportion of these complexes was left unchanged.

(Preparation of Emulsions G-8 to G-14)

Emulsions G-8 to G-14 were prepared in the same manner as Emulsions G-1 to G-7, except that $K_2[RuCl_5(NO)]$ ($6.6\times10^{-9}$ mole, per mole of the finished silver halide) was added over a period from 0 to 3% addition of the entire silver nitrate amount in the emulsion preparation.

(Preparation of Emulsion G-1a)

The re-dispersed emulsion was dissolved at 40° C., and sodium benzenethiosulfonate, p-glutaramidophenyldisulfide, sodium thiosulfate as a sulfur sensitizer, bis(1,4,5-trimethyl-1,2,4-triazolium-3-thiolato)aurate(I) tetrafluoroborate as a gold sensitizer were added. The resulting emulsion was ripened at 65° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.35 mol % per mol of the finished silver halide) were added. Further, prior to addition of the sensitizers, Sensitizing Dyes S-4, S-5, S-6 and S-7 were added, to conduct spectral sensitization. The thus-obtained emulsion was referred to as Emulsion G-1a.

(Preparation of Emulsions G-2a to G-7a)

Emulsions G-2a to G-7a were prepared in the same manner as emulsion G-1a, except that the emulsions G-2 to G-7 were used in place of the emulsion G-1 in the preparation of the emulsion G-1a.

(Preparation of Emulsion G-1b)

The re-dispersed emulsion was dissolved at 40° C., and sodium benzenethiosulfonate, p-glutaramidophenyidisulfide, the exemplified Compound (SE3-29) as a selenium sensitizer, bis(1,4,5-trimethyl-1,2,4-triazolium-3-thiolato)aurate(I) tetrafluoroborate as a gold sensitizer were added. The resulting emulsion was ripened at 65° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.35 mol % per mol of the finished silver halide) were added. Further, prior to addition of the sensitizers, Sensitizing Dyes S-4, S-5, S-6 and S-7 were added, to conduct spectral sensitization. The thus-obtained emulsion was referred to as Emulsion G-1b.

(Preparation of Emulsions G-2b to G-7b)

Emulsions G-2b to G-7b were prepared in the same manner as emulsion G-1b, respectively, except that the emulsions G-2 to G-7 were used in place of the emulsion G-1 in the preparation of the emulsion G-1b.

(Preparation of Emulsions G-8b to G-14b)

Emulsions G-8b to G-14b were prepared in the same manner as emulsion G-1b, respectively, except that the emulsions G-8 to G-14 were used in place of the emulsion G-1 in the preparation of the emulsion G-1b.

(Preparation of Emulsion R-1)

In the preparation of Emulsion B-1, the addition speed in the nucleation section was changed. The addition amount of potassium iodide was changed to 0.1 mole % per mole of finished silver halide. The addition amount of $K_4[Ru(CN)_6]$ was increased by three times. In the same manner as Emulsion B-1, excepting the changes mentioned above, Emulsion R-1 was prepared. The thus-obtained emulsion grains were monodisperse cubic silver iodobromochloride grains having a side length of 0.40 μm and a variation coefficient of 9.5% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion R-2)

An emulsion R-2 was prepared in the same manner as Emulsion R-1, except that $K_2[IrCl_5(H_2O)]$ ($6.0\times10^{-8}$ mol, per mol of the finished silver halide) and $K[IrCl_4(H_2O)_2]$ ($6.0\times10^{-7}$ mol, per mol of the finished silver halide) were added over a period from 92 to 97% addition of the entire silver nitrate amount in the emulsion preparation.

(Preparation of Emulsion R-3)

An emulsion R-3 was prepared in the same manner as Emulsion R-2, except that $K_2[IrCl_5(5\text{-methylthiazole})]$ ($1.0\times10^{-7}$ mol, per mol of the finished silver halide) were added over a period from 82 to 88% addition of the entire silver nitrate amount in the emulsion preparation.

(Preparation of Emulsions R-4 to R-7)

Emulsions R-4 to R-7 ware prepared in the same manner as Emulsion R-3, except that the addition amounts of $K_2[IrCl_5(H_2O)]$, $K[IrCl_4(H_2O)_2]$ and $K_2[IrCl_5(5\text{-methylthiazole})]$ were each increased by three times, ten times, thirty times, and one hundred times, respectively, as the relative proportion of these complexes was left unchanged.

(Preparation of Emulsions R-8 to R-14)

Emulsions R-8 to R-14 were prepared in the same manner as Emulsions R-1 to R-7, except that $K_2[RuCl_5(NO)]$ ($3.3\times10^{-9}$ mole, per mole of the finished silver halide) was added over a period from 0 to 3% addition of the entire silver nitrate amount in the emulsion preparation.

(Preparation of Emulsion R-1a)

The re-dispersed emulsion was dissolved at 40° C., and sodium benzenethiosulfonate, Compound-1 as a sulfur sensitizer and a gold sensitizer, were added. The resulting emulsion was ripened at 55° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.35 mol % per mol of the finished silver halide) were added. Further, prior to addition of the sensitizers, Sensitizing Dye S-8 and Compound-5 were added, to conduct spectral sensitization. The thus-obtained emulsion was referred to as Emulsion R-1a.

(Preparation of Emulsions R-2a to R-7a)

Emulsions R-2a to R-7a were prepared in the same manner as emulsion R-1a, respectively, except that the emulsions R-2 to R-7 were used in place of the emulsion R-1 in the preparation of the emulsion R-1a.

(Preparation of Emulsion R-1b)

The re-dispersed emulsion was dissolved at 40° C., and sodium benzenethiosulfonate, the exemplified Compound (SE3-9) as a selenium sensitizer, bis(1,4,5-trimethyl-1,2,4-triazolium-3-thiolato)aurate(I) tetrafluoroborate as a gold sensitizer were added. The resulting emulsion was ripened at 55° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.35 mol % per mol of the finished silver halide) were added. Further, prior to addition of the sensitizers, Sensitizing Dye S-8 and Compound-5 were added, to conduct spectral sensitization. The thus-obtained emulsion was referred to as Emulsion R-1b.

(Preparation of Emulsions R-2b to R-7b)

Emulsions R-2b to R-7b were prepared in the same manner as emulsion R-1b, respectively, except that the emulsions R-2 to R-7 were used in place of the emulsion R-1 in the preparation of the emulsion R-1b.

(Preparation of Emulsions R-8b to R-14b)

Emulsions R-8b to R-14b were prepared in the same manner as emulsion R-1b, respectively, except that the emulsions R-8 to R-14 were used in place of the emulsion R-1 in the preparation of the emulsion R-1b.

Sensitizing dye S-1
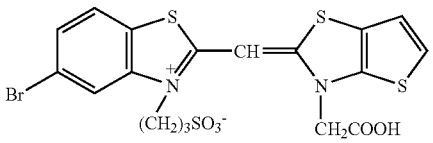
Sensitizing dye S-2
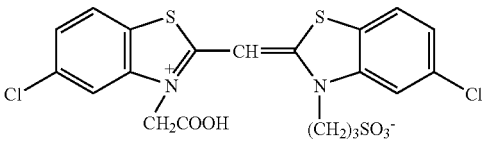
Sensitizing dye S-3
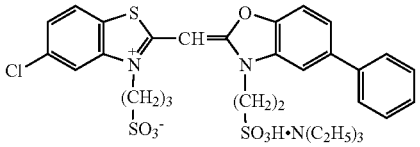
Compound-1
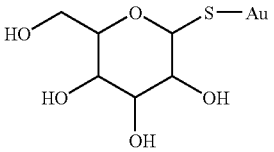
Compound-2
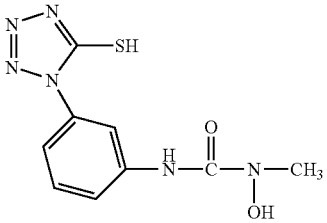
Compound-3
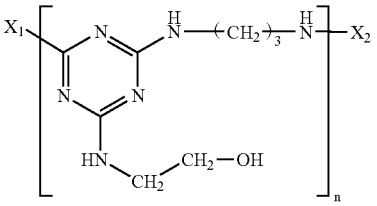
Compound-4
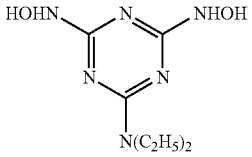
Sensitizing dye S-4
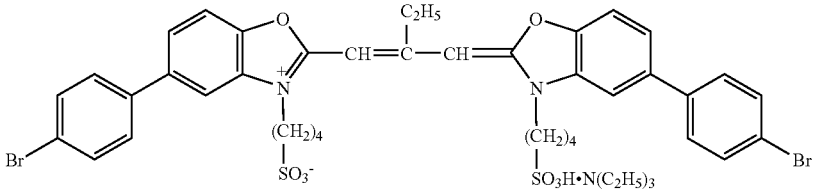
Sensitizing dye S-5
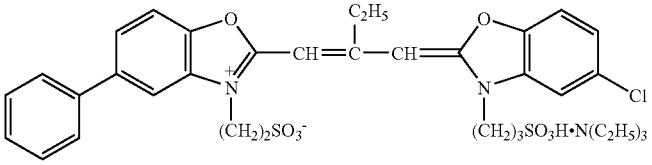
Sensitizing dye S-6
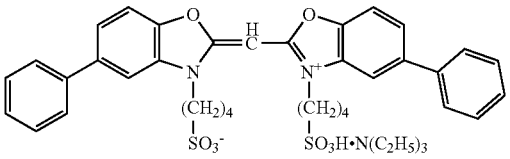
Sensitizing dye S-7
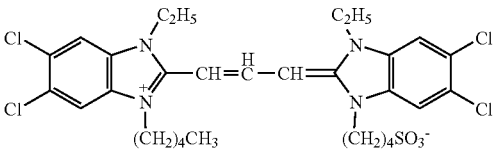

-continued

Sensitizing dye S-8

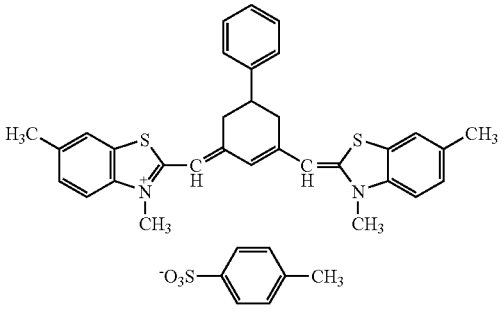

Sensitizing dye S-9

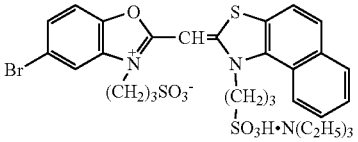

Compound - 5

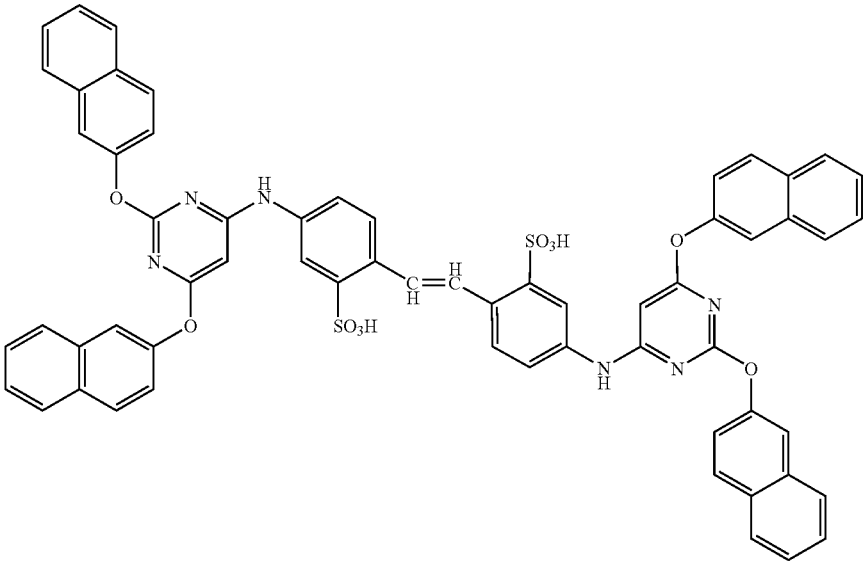

(Preparation of a Coating Solution for the First Layer)

Into 17 g of a solvent (Solv-4), 3 g of a solvent (Solv-6), 17 g of a solvent (Solv-9) and 45 ml of ethyl acetate were dissolved 24 g of a yellow coupler (Ex-Y), 6 g of a color-image stabilizer (Cpd-8), 1 g of a color-image stabilizer (Cpd-16), 1 g of a color-image stabilizer (Cpd-17), 11 g of a color-image stabilizer (Cpd-18), 1 g of a color-image stabilizer (Cpd-19), 11 g of a color-image stabilizer (Cpd-21), 0.1 g of an additive (ExC-3), and 1 g of a color-image stabilizer (UV-A). This solution was emulsified and dispersed in 205 g of a 20 mass % aqueous gelatin solution containing 3 g of sodium dodecylbenzenesulfonate with a high-speed stirring emulsifier (dissolver). Water was added thereto, to prepare 700 g of Emulsified dispersion A.

On the other hand, the above Emulsified dispersion A and the prescribed Emulsions B-1a were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added Ab-1, Ab-2, Ab-3, and Ab-4, so that the total amounts would be 10.0 mg/m$^2$, 43.0 mg/m$^2$, 3.5 mg/m$^2$, and 7.0 mg/m$^2$, respectively.

Further, to the second layer, the third layer, and the fifth layer, was added 1-(3-methylureidophenyl)-5-mercaptotetrazole in amounts of 1.20 mg/m$^2$, 0.36 mg/m$^2$, and 0.44 mg/m$^2$, respectively. Further, to the first layer and the fifth layer, was added 4-hydroxy-6-methyl-1,3,3a,7-tetrazaindene in amounts of $1.5\times10^{-4}$ mol and $1.8\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the second layer, the third layer, and the fifth layer so that coating amounts would be 25 mg/m$^2$, 11 mg/m$^2$, and 14 mg/m$^2$, respectively. Further, to each layer, sodium polystyrene sulfonate was added to adjust viscosity of the coating solutions, if necessary. Further, in order to prevent irradiation, the following water-soluble dyes Dye-1 to Dye-4 (coating amounts are shown in parentheses) were added.

(Dye-1)

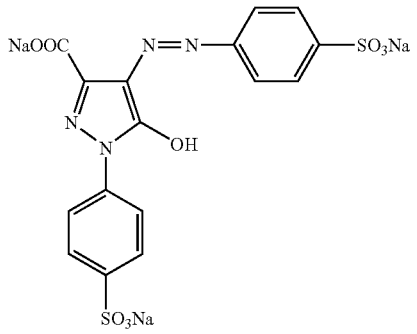

(3mg/m²)

(Dye-2)

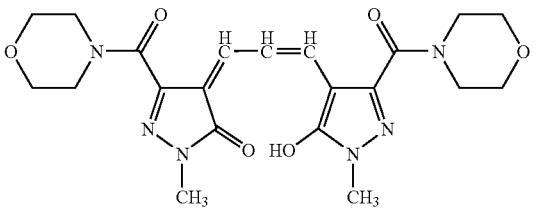

(3mg/m²)

(Dye-3)

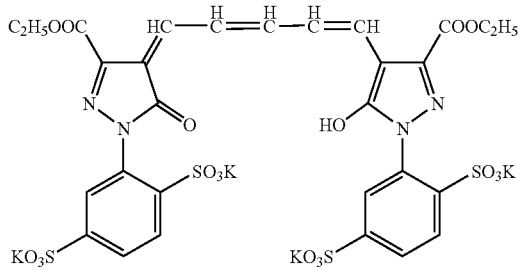

(8mg/m²)

(Dye-4)

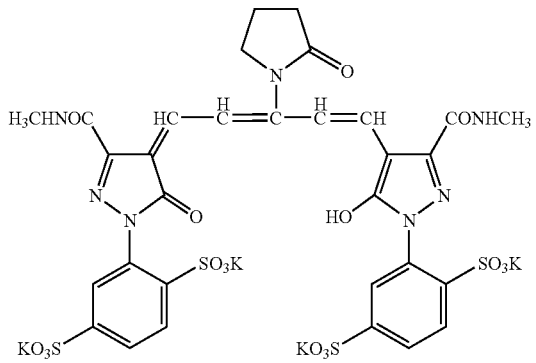

(16mg/m²)

(Ab-1) Antiseptic

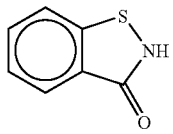

-continued (Ab-2) Antiseptic

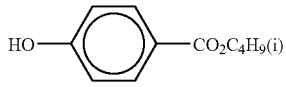

(Ab-3) Antiseptic

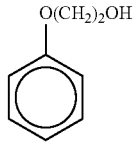

(Ab-4) Antiseptic

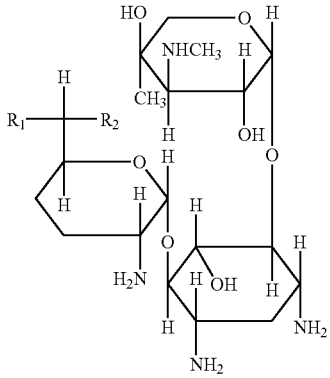

A mixture in 1:1:1:1 of a, b, c, and d (mol ratio)

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

(H-1) Hardener

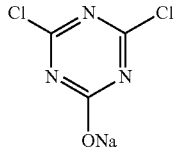

(H-2) Hardener

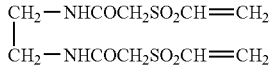

(H-3) Hardener

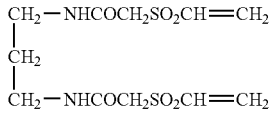

(Layer Constitution)

The composition of each layer is shown below. The numbers show coating amounts (g/m²). In the case of the silver halide emulsion, the coating amount is in terms of silver.

Sample 101 had a total coating amount of gelatin of 4.44 g/m², a total coating amount of silver of 0.33 g/m², a film thickness of 6.2 μm, and a swollen film thickness of 16.7 μm.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| | |
|---|---|
| First layer (Blue-sensitive emulsion layer) | |
| Emulsion (B-1a) | 0.14 |
| Gelatin | 1.00 |
| Yellow coupler (Ex-Y) | 0.250 |
| Color-image stabilizer (Cpd-8) | 0.063 |
| Color-image stabilizer (Cpd-16) | 0.010 |
| Color-image stabilizer (Cpd-17) | 0.010 |
| Color-image stabilizer (Cpd-18) | 0.115 |
| Color-image stabilizer (Cpd-19) | 0.010 |
| Color-image stabilizer (Cpd-21) | 0.115 |
| Additive (ExC-3) | 0.001 |
| Color-image stabilizer (UV-A) | 0.010 |
| Solvent (Solv-4) | 0.177 |
| Solvent (Solv-6) | 0.031 |
| Solvent (Solv-9) | 0.177 |
| Second layer (Intermediate color-forming layer) | |
| Gelatin | 0.34 |
| Yellow coupler (Ex-Y) | 0.085 |
| Color-image stabilizer (Cpd-8) | 0.021 |
| Color-image stabilizer (Cpd-16) | 0.004 |
| Color-image stabilizer (Cpd-17) | 0.004 |
| Color-image stabilizer (Cpd-18) | 0.039 |
| Color-image stabilizer (Cpd-19) | 0.004 |
| Color-image stabilizer (Cpd-21) | 0.039 |
| Additive (ExC-3) | 0.0004 |
| Color-image stabilizer (UV-A) | 0.004 |
| Solvent (Solv-4) | 0.060 |
| Solvent (Solv-6) | 0.011 |
| Solvent (Solv-9) | 0.060 |
| Third layer (Color-mixing-inhibiting layer) | |
| Gelatin | 0.32 |
| Color-mixing inhibitor (Cpd-4) | 0.020 |
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| Fourth layer (Red-sensitive emulsion layer) | |
| Emulsion (R-1a) | 0.10 |
| Gelatin | 0.80 |
| Cyan coupler (ExC-1) | 0.175 |
| Cyan coupler (ExC-2) | 0.005 |
| Cyan coupler (ExC-3) | 0.015 |
| Color-image stabilizer (Cpd-1) | 0.011 |
| Color-image stabilizer (Cpd-7) | 0.011 |
| Color-image stabilizer (Cpd-9) | 0.033 |
| Color-image stabilizer (Cpd-10) | 0.001 |
| Color-image stabilizer (Cpd-14) | 0.001 |
| Color-image stabilizer (Cpd-15) | 0.165 |
| Color-image stabilizer (Cpd-16) | 0.035 |
| Color-image stabilizer (Cpd-17) | 0.022 |
| Color-image stabilizer (UV-5) | 0.077 |
| Solvent (Solv-5) | 0.077 |
| Fifth layer (Color-mixing-inhibiting layer) | |
| Gelatin | 0.38 |
| Color-mixing inhibitor (Cpd-4) | 0.024 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.024 |
| Color-image stabilizer (UV-A) | 0.024 |
| Color-image stabilizer (Cpd-7) | 0.002 |

-continued

| | |
|---|---|
| Solvent (Solv-1) | 0.029 |
| Solvent (Solv-2) | 0.029 |
| Solvent (Solv-5) | 0.033 |
| Solvent (Solv-8) | 0.033 |
| Sixth layer (Green-sensitive emulsion layer) | |
| Emulsion (G-1a) | 0.09 |
| Gelatin | 1.10 |
| Magenta coupler (Ex-M) | 0.14 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.26 |
| Solvent (Solv-3) | 0.04 |
| Solvent (Solv-4) | 0.08 |
| Solvent (Solv-6) | 0.05 |
| Solvent (Solv-9) | 0.12 |
| Solvent (Solv-7) | 0.11 |
| Compound (S1-4) | 0.0015 |
| Seventh layer (Protective layer) | |
| Gelatin | 0.50 |
| Additive (Cpd-20) | 0.015 |
| Liquid paraffin | 0.01 |
| Surfactant (Cpd-13) | 0.01 |

(Ex-Y) Yellow coupler

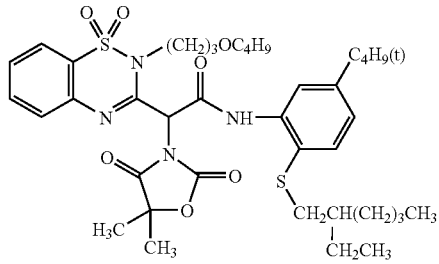

(Ex-M) Magenta coupler A mixture in 40:40:20 (mol ratio) of

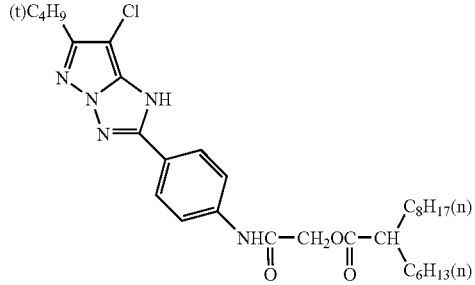

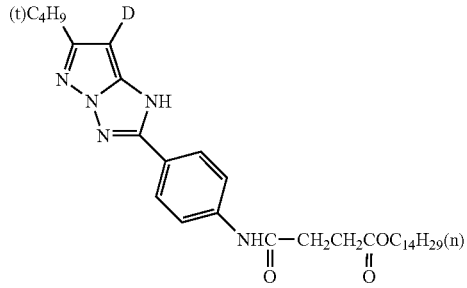

and

-continued

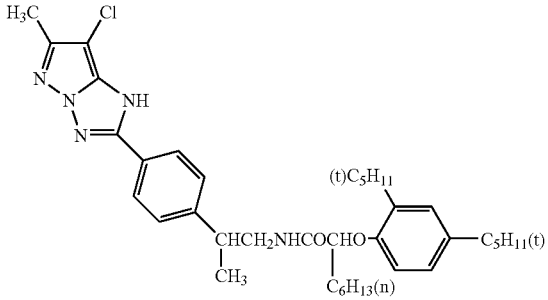

(ExC-1) Cyan coupler

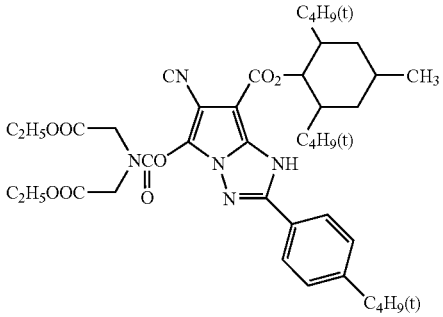

(ExC-2) Cyan coupler

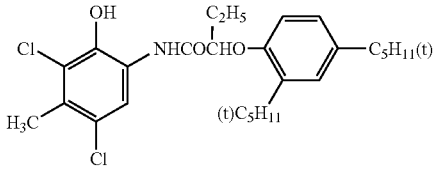

(ExC-3) Cyan coupler

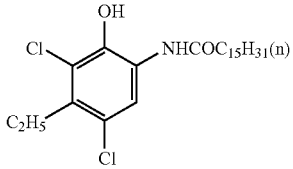

(Cpd-1) Color-image stabilizer

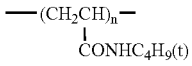

Number-average molecular weight 60,000

(Cpd-2) Color-image stabilizer

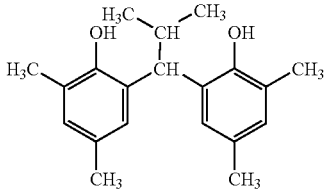

(Cpd-3) Color-image stabilizer

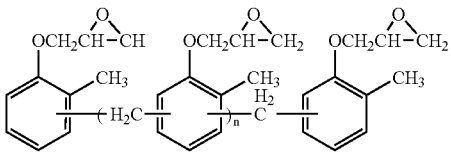

n = 7~8 (Average value)

-continued (Cpd-4) Color-image stabilizer

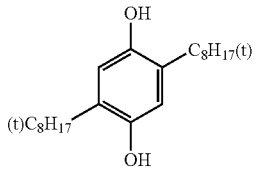

(Cpd-5) Color-image stabilizer

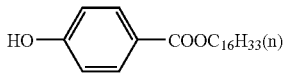

(Cpd-6) Color-image stabilizer

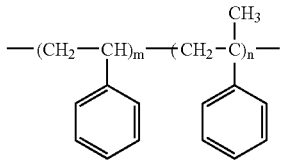

Number-average molecular weight 600, m/n = 10/90

(Cpd-7) Color-image stabilizer

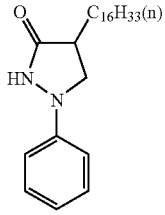

(Cpd-8) Color-image stabilizer

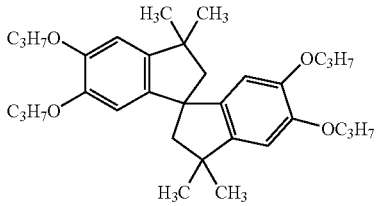

(Cpd-9) Color-image stabilizer

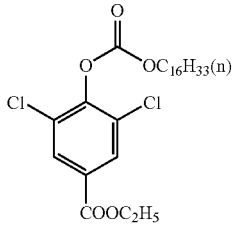

(Cpd-10) Color-image stabilizer

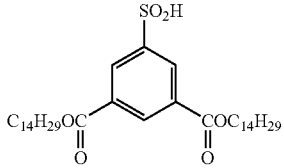

-continued
(Cpd-11)
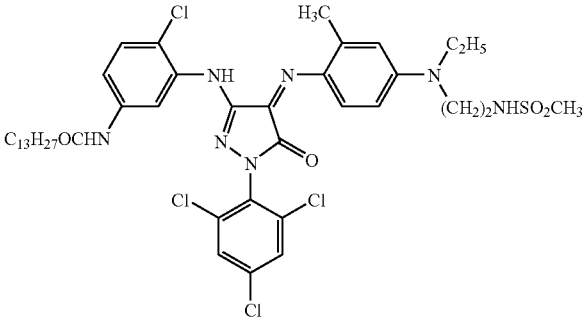
(Cpd-12)
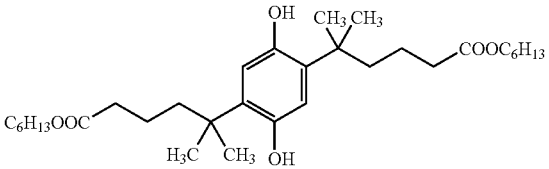
(Cpd-13) A mixture in 6:2:2 (mol ratio) of (a)/(b)/(c)
(a)
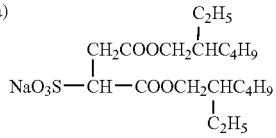
(b)$C_{13}H_{27}CONH(CH_2)_3$
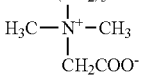
(c)
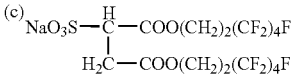
(Cpd-14)
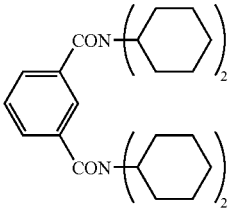
(Cpd-15)
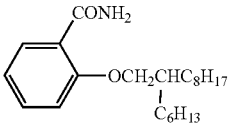
(Cpd-16)
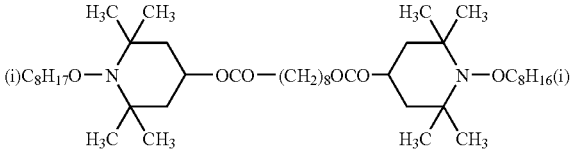
(Cpd-17)
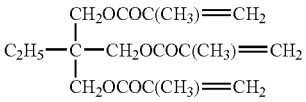
-continued
(Cpd-18)
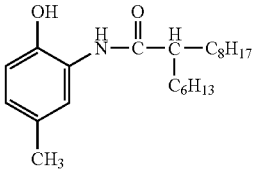
(Cpd-19)
$C(CH_2COCH_2CH_2SC_{12}H_{25})_4$ (O)
(Cpd-20)
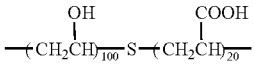
(Mass ratio)
(Cpd-21)
KAYARAD DPCA-30 (trade name, manufactured by Nippon Kayaku Co. Ltd.)
(Solv-1)
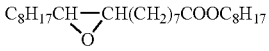
(Solv-2)
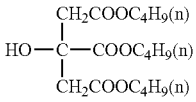
(Solv-3)
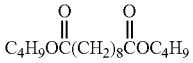
(Solv-4)
$O{=}P(OC_6H_{13}(n))_3$
(Solv-5)
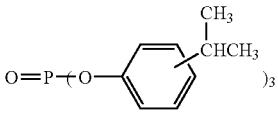
(Solv-6)
$C_8H_{17}CH{=}CHC_8H_{16}OH$
(Solv-7)
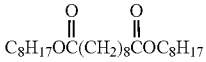
(Solv-8)
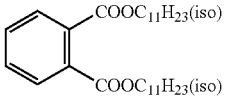
(Solv-9)
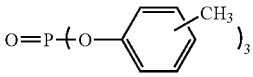
(S1-4)
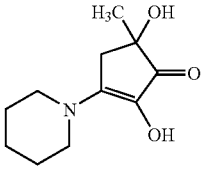
UV-A A mixture (Mass ratio) of (UV-1)/(UV-4)/(UV-5) = 1/7/2
UV-B A mixture (Mass ratio) of (UV-1)/(UV-2)/(UV-3)/(UV-4)/(UV-5) = 1/1/2/3/3

-continued (UV-1)

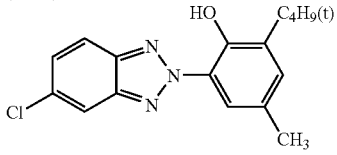

(UV-2)

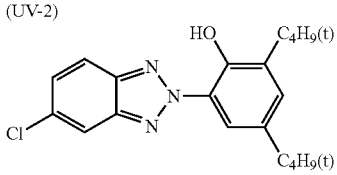

(UV-3)

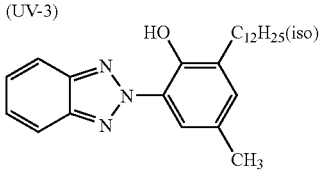

(UV-4)

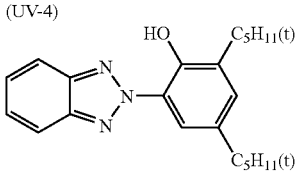

(UV-5)

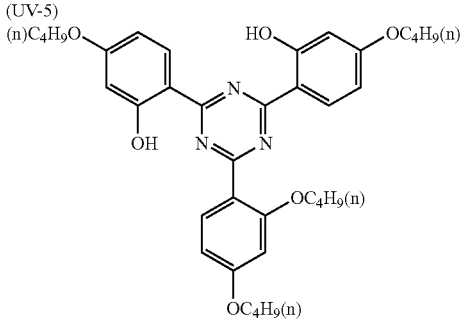

The sample made as described above was referred to as Sample 101. Other photosensitive materials were made by replacing the light-sensitive emulsions in the first, fourth and sixth layers of Sample 101 with the foregoing emulsions having the same silver contents, respectively. The sample number and contents of each photosensitive material are shown in Table 2.

TABLE 2

| Sample No. | First layer emulsion | Fourth layer emulsion | Sixth layer emulsion |
|---|---|---|---|
| 101 | B-1a | R-1a | G-1a |
| 102 | B-2a | R-2a | G-2a |
| 103 | B-3a | R-3a | G-3a |
| 104 | B-4a | R-4a | G-4a |
| 105 | B-5a | R-5a | G-5a |
| 106 | B-6a | R-6a | G-6a |
| 107 | B-7a | R-7a | G-7a |
| 108 | B-1b | R-1b | G-1b |
| 109 | B-2b | R-2b | G-2b |
| 110 | B-3b | R-3b | G-3b |
| 111 | B-4b | R-4b | G-4b |
| 112 | B-5b | R-5b | G-5b |
| 113 | B-6b | R-6b | G-6b |

TABLE 2-continued

| Sample No. | First layer emulsion | Fourth layer emulsion | Sixth layer emulsion |
|---|---|---|---|
| 114 | B-7b | R-7b | G-7b |
| 115 | B-8b | R-8b | G-8b |
| 116 | B-9b | R-9b | G-9b |
| 117 | B-10b | R-10b | G-10b |
| 118 | B-11b | R-11b | G-11b |
| 119 | B-12b | R-12b | G-12b |
| 120 | B-13b | R-13b | G-13b |
| 121 | B-14b | R-14b | G-14b |

Each example after coating was made to age for 10 days in an atmosphere of 25° C. and 55% RH so that harding reaction therein proceeded to the full. The samples thus obtained were used for evaluations.

(Evaluation 1: Characteristic Curve Measurement and Evaluation in High-illumination Exposure Case)

To each sample, $1\times10^{-6}$-second wedge exposure was applied by means of a high-illumination sensitometer (Model HIE, trade name, made by Yamashita Denso Co., Ltd.).

As to the exposure, the so-called blue-separation exposure, the so-called green-separation exposure or the so-called red-separation exposure was carried out via a filter, SP-1, SP-2 or SP-3 (trade name ), madee by Fuji Photo Film Co., Ltd., respectively. The thus exposed sample was allowed to stand for 30 minutes, and then subjected to color-development processing in accordance with the following Processing A. The reflection densities of yellow, magenta or cyan images thus formed were measured with an optical densitometer, and a characteristic curve of images of each color was prepared by plotting the density data obtained, with reflection density (D) as ordinate and exposure amount expressed in a logarithmic scale (logE) as abscissa. In each sample, yellow images were associated with the characteristic curve of the blue-sensitive emulsion layer, magenta images with the characteristic curve of the green-sensitive emulsion layer, and cyan images with the characteristic curve of the red-sensitive emulsion layer.

In each of the characteristic curves plotted, the minimum density (Dmin) corresponding to an unexposed portion was defined as fog. In addition, the reciprocal of an exposure amount at the point A providing the reflection density of 0.5 was defined as sensitivity $S_H$. The greater $S_H$ value signifies the higher sensitivity and the greater benefit. Further, the point providing the reflection density of 1.5 was termed B, and the slope of a straight line linking the two points A and B was defined as gradient $\gamma_H$. The greater $\gamma_H$ value, the harder the gradation.

(Evaluation 2: Characteristic Curve Measurement and Evaluation in Low-illumination Exposure Case)

To each sample, 100-second wedge exposure was applied by means of a sensitometer (Model FWH, trade name, made by Fuji Photo Film Co., Ltd.). As to the exposure, the so-called blue-separation exposure, the so-called green-separation exposure or the so-called red-separation exposure was carried out via a filter, SP-1, SP-2 or SP-3 (trade name), made by Fuji Photo Film Co., Ltd., respectively. The thus exposed sample was allowed to stand for 30 minutes, and then subjected to color-development processing in accordance,with the following Processing A. In the same way as Evaluation 1 was made, a characteristic curve of images of each color was prepared, and thereby were determined both sensitivity $S_L$ and gradient $\gamma_L$. Incidentally, the fog is independent of exposure conditions, and the value thereof is the same as in Evaluation 1.

(Evaluation 3: Storability Evaluation)

Each sample was stored for 30 days in an atmosphere of 40° C. and 55% RH, and then subjected successively to the same exposure, color-development processing and density measurements as in Evaluation 1, and thereby a characteristic curve thereof was prepared. For each sample, the variations in fog and sensitivity are symbolized by ΔFog and $\Delta S_H$, respectively, and calculated with reference to the data obtained in Evaluation 1. Since ΔFog is a variation in fog densities, the value of ±0 signifying no variation is favorable. $\Delta S_H$ is expressed in terms of relative value with the sensitivity in Evaluation 1 being taken as 100. So, the closer to 100 the $\Delta S_H$ value, the smaller the change in sensitivities, which offers the greater benefit.

Processing A

Standard photographic images were produced on a 127 mm-wide roll film sample, EVER-BEAUTY PAPER TYPE II for LASER (trade name, a product of Fuji Photo Film Co., Ltd.), by means of the printer installed in Digital Minilab Frontier 350 (trade name, made by Fuji Photo Film Co., Ltd.). Thereafter, the exposed sample was continuously processed (running test) in the following processing steps, until an accumulated replenisher amount of the color developing solution reached to be equal to twice the color developer tank volume. A processing with this running processing solutions was named processing A.

As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The temperature of the semiconductor laser was kept constant by using a Peltier device to prevent the quantity of light from being changed by temperature.

| Processing step | Temperature | Time | Replenisher amount |
|---|---|---|---|
| Color development | 38.5° C. | 45 sec | 45 mL |
| Bleach-fixing | 38.0° C. | 45 sec | Replenisher A 17.5 mL<br>Replenisher B 17.5 mL |
| Rinse 1 | 38.0° C. | 20 sec | — |
| Rinse 2 | 38.0° C. | 20 sec | — |
| Rinse 3 | 38.0° C. | 20 sec | — |
| Rinse 4 | 38.0° C. | 20 sec | 121 mL |
| Drying | 80° C. | | |

(Note)

* Replenisher amount per $m^2$ of the photosensitive material to be processed

** A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated liquid was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The compositions of each processing solution were as follows.

| (Color developer) | (Tank solution) | (Replenisher) |
|---|---|---|
| Water | 800 mL | 800 mL |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline 3/2 sulfate monohydrate | 4.8 g | 14.0 g |
| Potassium carbonate | 26.3 g | 26.3 g |
| Water to make | 1000 mL | 1000 mL |
| pH (25° C., adjusted using sulfuric acid and KOH) | 10.15 | 12.40 |

| (Bleach-fixing solution) | (Tank solution) | (Replenisher A) | (Replenisher B) |
|---|---|---|---|
| Water | 800 mL | 500 mL | 300 mL |
| Ammonium thiosulfate (750 g/l) | 107 mL | — | 386 mL |
| Ammonium hydrogen sulfite (65%) | 30.0 g | — | 190 g |
| Ammonium iron (III) Ethylenediaminetetraacetate | 47.0 g | 133 g | — |
| Ethylenediaminetetraacetic acid | 1.4 g | 5 g | 6 g |
| Nitric acid (67%) | 16.5 g | 66.0 g | — |
| Imidazole | 14.6 g | 50.0 g | — |
| m-Carboxybenzenesulfinic acid | 8.3 g | 33.0 g | — |

-continued

| | | | |
|---|---|---|---|
| Water to make | 1000 mL | 1000 mL | 1000 mL |
| pH (25° C., adjusted using nitric acid and aqueous ammonia) | 6.5 6.0 | 6.0 | |
| (Rinse solution) | (Tank solution) | | (Replenisher) |
| Sodium chlorinated-isocyanurate | 0.02 g | | 0.02 g |
| Deionized water (conductivity: 5 μS/cm or less) | 1000 mL | | 1000 mL |
| pH (25° C.) | 6.5 6.5 | | |

FL-1

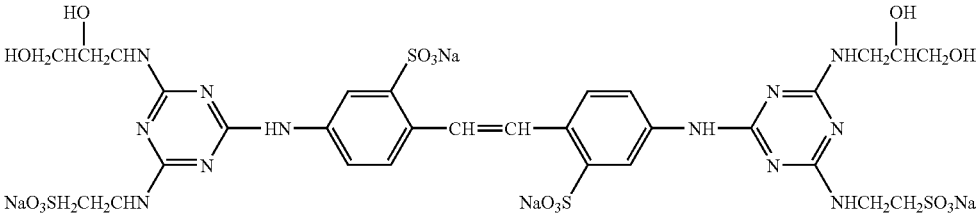

FL-2

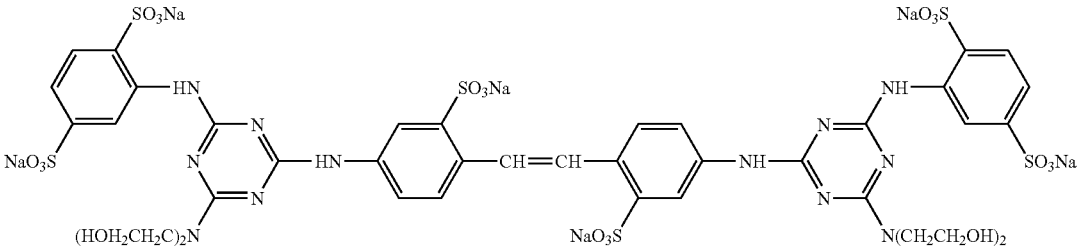

The thus obtained results on yellow images are shown in Table 3. The sensitivities $S_L$ and $S_H$ are shown as relative values, with those of Sample 101 being taken as 100, respectively. So, the greater the value, the higher the sensitivity.

TABLE 3

| | | | | | Storability | | |
|---|---|---|---|---|---|---|---|
| Sample No. | Fog | Sensitivity $S_L$ | Sensitivity $S_H$ | $\gamma_H/\gamma_L$ | Δ Fog | Sensitivity Δ $S_H$ | Remarks |
| 101 | 0.085 | 100 | 100 | 0.25 | +0.010 | 117 | Comparative example |
| 102 | 0.083 | 93 | 178 | 0.30 | +0.008 | 112 | Comparative example |
| 103 | 0.081 | 100 | 251 | 0.55 | +0.007 | 110 | Comparative example |
| 104 | 0.080 | 95 | 282 | 0.80 | +0.006 | 105 | Comparative example |
| 105 | 0.080 | 91 | 316 | 1.00 | +0.006 | 100 | Comparative example |
| 106 | 0.079 | 85 | 295 | 1.35 | 0.005 | 95 | Comparative example |
| 107 | 0.079 | 79 | 234 | 1.70 | +0.005 | 87 | Comparative example |
| 108 | 0.090 | 141 | 158 | 0.30 | +0.025 | 126 | Camparative example |
| 109 | 0.086 | 141 | 282 | 0.40 | +0.020 | 120 | Comparative example |
| 110 | 0.083 | 158 | 407 | 0.70 | +0.010 | 110 | This invention |
| 111 | 0.080 | 158 | 447 | 1.00 | +0.007 | 105 | This invention |
| 112 | 0.079 | 158 | 501 | 1.25 | +0.005 | 100 | This invention |
| 113 | 0.079 | 148 | 468 | 1.70 | +0.005 | 95 | This invention |
| 114 | 0.079 | 138 | 372 | 2.10 | +0.005 | 89 | Comparative example |
| 115 | 0.089 | 126 | 141 | 0.30 | +0.024 | 129 | Comparative example |
| 116 | 0.084 | 126 | 251 | 0.40 | +0.018 | 123 | Comparative |
| 117 | 0.080 | 141 | 363 | 0.65 | +0.008 | 112 | This invention |
| 118 | 0.077 | 141 | 398 | 0.95 | +0.005 | 107 | This inveotion |

TABLE 3-continued

| Sample No. | Fog | Sensitivity $S_L$ | Sensitivity $S_H$ | $\gamma_H/\gamma_L$ | Storability Δ Fog | Storability Sensitivity Δ $S_H$ | Remarks |
|---|---|---|---|---|---|---|---|
| 119 | 0.075 | 141 | 447 | 1.20 | +0.003 | 102 | This nvention |
| 120 | 0.075 | 132 | 417 | 1.65 | +0.003 | 98 | This invention |
| 121 | 0.075 | 123 | 331 | 2.05 | +0.003 | 91 | Comparative example |

As shown in Table 3, the samples according to the present invention attained good results that their fog densities were reduced as they retained high sensitivities and their storabilities were also excellent, compared with the samples for comparison. The samples according to the present invention yielded high sensitivity and hard gradation, especially in the high-illumination exposure case, so they were highly suitable for digital exposure. Although the use of selenium compounds increases fog besides sensitivity and exacerbates storability, the present invention can achieve high sensitivity while maintaining fog low. Further, the present invention makes it possible to retain low fog even after time-lapse storage, and can ensure properties suitable for color print materials.

A landmark in the present invention consists in a discovery that these excellent properties are in correlation with $\gamma_H/\gamma_L$. More specifically, it is found that there exists a specific preferable range in regard to the $\gamma_H/\gamma_L$ ratio for achieving high sensitivity, hard gradation, low fog and excellent storability with the use of selenium compounds in the case of digital exposure.

Additionally, characteristic curves for magenta and cyan images were each prepared in the same manner as mentioned above, and evaluations of sensitivity, fog, gradation and storabilities were made. As in the case with the yellow images, the samples according to the present invention attained excellent results on both magenta and cyan images, compared with the samples for comparison.

Further, image-wise exposure via digital data was applied to each sample by means of the exposure unit installed in Digital Minilab Frontier 350 (trade name, made by Fuji Photo Film Co., Ltd.), and then the following Processing A was performed. As a result, it was found that each of the samples according to the present invention can deliver high sensitivity, hard gradation and excellent white background.

Example 1-2

(Preparation of Emulsion B-15)

In the preparation of Emulsion B-8, the addition speed in the nucleation section was changed. The addition amount of $K_2[RuCl_5(NO)]$ was increased by twice. In the same manner as Emulsion B-8, excepting the changes mentioned above, Emulsion B-15 was prepared. The thus-obtained emulsion grains were monodisperse cubic silver iodobromochloride grains having a side length of 0.40 μm and a variation coefficient of 9.5% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion B-16)

An emulsion B-16 was prepared in the same manner as Emulsion B-15, except that $K_2[IrCl_5(H_2O)]$ ($2.0\times10^{-7}$ mol, per mol of the finished silver halide) and $K[IrCl_4(H_2O)_2]$ ($2.0\times10^{-8}$ mol, per mol of the finished silver halide) were added over a period from 92 to 97% addition of the entire silver nitrate amount in the emulsion preparation.

(Preparation of Emulsion B-17)

An emulsion B-17 was prepared in the same manner as Emulsion B-16, except that $K_2[IrCl_5(5\text{-methylthiazole})]$ ($6.7\times10^{-8}$ mol, per mol of the finished silver halide) were added over a period from 82 to 88% addition of the entire silver nitrate amount in the emulsion preparation.

(Preparation of Emulsion B-18)

Emulsion B-18 was prepared in the same manner as Emulsion B-17, except that the addition amounts of $K_2[IrCl_5(H_2O)]$, $K[IrCl_4(H_2O)_2]$ and $K_2[IrCl_5(5\text{-methylthiazole})]$ were each increased by three times as the relative proportion of these complexes was left unchanged.

(Preparation of Emulsion B-19)

Emulsion B-19 was prepared in the same manner as Emulsion B-17, except that the addition amounts of $K_2[IrCl_5(H_2O)]$, $K[IrCl_4(H_2O)_2]$ and $K_2[IrCl_5(5\text{-methylthiazole})]$ were each increased by ten times as the relative proportion of these complexes was left unchanged.

(Preparation of Emulsion B-20)

Emulsion B-20 was prepared in the same manner as Emulsion B-17, except that the addition amounts of $K_2[IrCl_5(H_2O)]$, $K[IrCl_4(H_2O)_2]$ and $K_2[IrCl_5(5\text{-methylthiazole})]$ were each increased by thirty times as the relative proportion of these complexes was left unchanged.

(Preparation of Emulsion B-21)

Emulsion B-21 was prepared in the same manner as Emulsion B-17, except that the addition amounts of $K_2[IrCl_5(H_2O)]$, $K[IrCl_4(H_2O)_2]$ and $K_2[IrCl_5(5\text{-methylthiazole})]$ were each increased by one hundred times as the relative proportion of these complexes was left unchanged.

(Preparation of Emulsion B-15b)

The re-dispersed emulsion was dissolved at 40° C., and sodium benzenethiosulfonate, 1-(5-methylureidophenyl)-5-mercaptotetrazole (1/10 of the addition amount at the completion of chemical sensitization), the exemplified Compound (SE3-29) as a selenium sensitizer, bis(1,4,5-trimethyl-1,2,4-triazolium-3-thiolato)aurate(I) tetrafluoroborate as a gold sensitizer were added. The resulting emulsion was ripened at 60° C. under the most favorable chemical sensitization condition for achieving the hardest gradation under $1\times10^{-6}$-second exposure. Thereafter, the temperature of the emulsion was cooled to 40° C., and 1-phenyl-5-mercaptotetrazole; 1-(3-acetoamidophenyl)-5-mercaptotetrazole; 1-(5-methylureidophenyl)-5-mercaptotetrazole; Compound-2; a mixture whose major components are compounds represented by Compound-3 in which the repeating unit is 2 or 3 (both ends $X_1$ and $X_2$ are each a hydroxyl group); Compound-4, and potassium bromide (0.38 mol % per mol of the finished silver halide) were added.

Further, prior to addition of the sensitizers, Sensitizing Dyes S-1, S-2, and S-3 were added, to conduct spectral sensitization. The thus-obtained emulsion was referred to as Emulsion B-15b.

(Preparation of Emulsions B-16b to B-21b)

Emulsions B-16b to B-21b were prepared in the same manner as emulsion B-15b, respectively, except that the emulsions B-16 to B-21 were used in place of the emulsion B-15 in the preparation of the emulsion B-15b.

(Preparation of Emulsion G-15)

In the preparation of Emulsion G-8, the addition speed in the nucleation section was changed.

The addition amount of $K_2[RuCl_5(NO)]$ was increased by 2.4 times. In the same manner as Emulsion G-8, excepting the changes mentioned above, Emulsion G-15 was prepared. The thus-obtained emulsion grains were monodisperse cubic silver iodobromochloride grains having a side length of 0.30 μm and a variation coefficient of 9.9% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion G-16)

An emulsion G-16 was prepared in the same manner as Emulsion G-15, except that $K_2[IrCl_5(H_2O)]$ ($4.8\times10^{-8}$ mol, per mol of the finished silver halide) and $K[IrCl_4(H_2O)_2]$ ($4.8\times10^{-7}$ mol, per mol of the finished silver halide) were added over a period from 92 to 97% addition of the entire silver nitrate amount in the emulsion preparation.

(Preparation of Emulsion G-17)

An emulsion G-17 was prepared in the same manner as Emulsion G-16, except that $K_2[IrCl_5(5\text{-methylthiazole})]$ ($1.6\times10^{-7}$ mol, per mol of the finished silver halide) were added over a period from 82 to 88% addition of the entire silver nitrate amount in the emulsion preparation.

(Preparation of Emulsions G-18 to G-21)

Emulsions G-18 to G-21 ware prepared in the same manner as Emulsion G-17, except that the addition amounts of $K_2[IrCl_5(H_2O)]$, $K[IrCl_4(H_2O)_2]$ and $K_2[IrCl_5(5\text{-methylthiazole})]$ were each increased by three times, ten times, thirty times, and one hundred times, respectively, as the relative proportion of these complexes was left unchanged.

(Preparation of Emulsion G-15b)

The re-dispersed emulsion was dissolved at 40° C., and sodium benzenethiosulfonate, p-glutaramidophenyidisulfide, the exemplified Compound (SE3-29) as a selenium sensitizer, bis(1,4,5-trimethyl-1,2,4-triazolium-3-thiolato)aurate(I) tetrafluoroborate as a gold sensitizer were added. The resulting emulsion was ripened at 65° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.47 mol % per mol of the finished silver halide) were added. Further, prior to addition of the sensitizers, Sensitizing Dyes S-4, S-5, S-6, and S-7 were added, to conduct spectral sensitization. The thus-obtained emulsion was referred to as Emulsion G-15b.

(Preparation of Emulsions G-16b to G-21b)

Emulsions G-16b to G-21b were prepared in the same manner as emulsion G-15b, except that the emulsions G-16 to G-21 were used in place of the emulsion G-15 in the preparation of the emulsion G-15b.

(Preparation of Emulsion R-15)

In the preparation of Emulsion R-8, the addition speed in the nucleation section was changed. The addition amount of $K_2[RuCl_5(NO)]$ was increased by 2.4 times. In the same manner as Emulsion R-8, excepting the changes mentioned above, Emulsion R-15 was prepared. The thus-obtained emulsion grains were monodisperse cubic silver iodobromochloride grains having a side length of 0.30 ,μm and a variation coefficient of 9.9% by observations and measurements using transmission electron micrographs (direct method). After being subjected to a sedimentation desalting treatment, the following were added to the resulting emulsion: deionized gelatin, Compounds Ab-1, Ab-2, and Ab-3, and calcium nitrate, and the emulsion was re-dispersed.

(Preparation of Emulsion R-16)

An emulsion R-16 was prepared in the same manner as Emulsion R-15, except that $K_2[IrCl_5(H_2O)]$ ($1.4\times10^{-7}$ mol, per mol of the finished silver halide) and $K[IrCl_4(H_2O)_2]$ ($1.4\times10^{-8}$ mol, per mol of the finished silver halide) were added over a period from 92 to 97% addition of the entire silver nitrate amount in the emulsion preparation.

(Preparation of Emulsion R-17)

An emulsion R-17 was prepared in the same manner as Emulsion R-16, except that $K_2[IrCl_5(5\text{-methylthiazole})]$ ($2.4\times10^{-7}$ mol, per mol of the finished silver halide) were added over a period from 82 to 88% addition of the entire silver nitrate amount in the emulsion preparation.

(Preparation of Emulsions R-18 to R-21)

Emulsions R-18 to R-21 ware prepared in the same manner as Emulsion R-17, except that the addition amounts of $K_2[IrCl_5(H_2O)]$, $K[IrCl_4(H_2O)_2]$ and $K_2[IrCl_5(5\text{-methylthiazole})]$ were each increased by three times, ten times, thirty times, and one hundred times, respectively, as the relative proportion of these complexes was left unchanged.

(Preparation of Emulsion R-15b)

The re-dispersed emulsion was dissolved at 40° C., and sodium benzenethiosulfonate, the exemplified Compound (SE3-9) as a selenium sensitizer, bis(1,4,5-trimethyl-1,2,4-triazolium-3-thiolato)aurate(I) tetrafluoroborate as a gold sensitizer were added. The resulting emulsion was ripened at 55° C. under the most favorable chemical sensitization condition for achieving the hardest gradation under $1\times10^{-6}$-second exposure. Thereafter, 1-(3-acetoamidophenyl)-5-mercaptotetrazole; 1-(5-methylureidophenyl)-5-mercaptotetrazole; Compound-2; Compound-4, and potassium bromide (0.47 mol % per mol of the finished silver halide) were added. Further, prior to addition of the sensitizers, Sensitizing Dye S-8 and Compound-5 were added, to conduct spectral sensitization. The thus-obtained emulsion was referred to as Emulsion R-15b.

(Preparation of Emulsions R-16b to R-21b)

Emulsions R-16b to R-21b were prepared in the same manner as emulsion R-15b, respectively, except that the emulsions R-16 to R-21 were used in place of the emulsion R-15 in the preparation of the emulsion R-15b.

Other photosensitive materials were made by replacing the light-sensitive emulsions in the first, fourth and sixth layers of Sample 101 with the foregoing emulsions having the same silver contents, respectively. The sample number and contents of each photosensitive material are shown in Table 4.

TABLE 4

| Sample No. | First layer emulsion | Fourth layer emulsion | Sixth layer emulsion |
|---|---|---|---|
| 201 | B-15b | R-15b | G-15b |
| 202 | B-16b | R-16b | G-16b |
| 203 | B-17b | R-17b | G-17b |
| 204 | B-18b | R-18b | G-18b |
| 205 | B-19b | R-19b | G-19b |
| 206 | B-20b | R-20b | G-20b |
| 207 | B-21b | R-21b | G-21b |

Each sample after coating was made to age for 10 days in an atmosphere of 25° C. and 55% RH so that hardening reaction therein proceeded to the full, and then evaluations were made thereon. The same examinations as in Example 1-1 were done on each of these Samples 201 to 207, and results obtained with respect to yellow images are shown in Table 5 in comparison with the results of Samples 101 to 107.

TABLE 5

| | | | | | Storability | | |
|---|---|---|---|---|---|---|---|
| Sample No. | Fog | Sensitivity $S_L$ | Sensitivity $S_H$ | $\gamma_H/\gamma_L$ | Δ Fog | Sensitivity Δ $S_H$ | Remarks |
| 101 | 0.085 | 100 | 100 | 0.25 | +0.010 | 117 | Comparative example |
| 102 | 0.083 | 93 | 178 | 0.30 | +0.008 | 112 | Comparative example |
| 103 | 0.081 | 100 | 251 | 0.55 | +0.007 | 110 | Comparative example |
| 104 | 0.080 | 95 | 282 | 0.80 | +0.006 | 105 | Comparative example |
| 105 | 0.080 | 91 | 316 | 1.00 | +0.006 | 100 | Comparative example |
| 106 | 0.079 | 85 | 295 | 1.35 | +0.005 | 95 | Comparative example |
| 107 | 0.079 | 79 | 234 | 1.70 | +0.005 | 87 | Comparative example |
| 201 | 0.080 | 89 | 105 | 0.35 | +0.022 | 132 | Comparative example |
| 202 | 0.078 | 89 | 186 | 0.45 | +0.017 | 123 | Comparative |
| 203 | 0.075 | 100 | 269 | 0.70 | +0.007 | 110 | This invention |
| 204 | 0.072 | 100 | 295 | 1.00 | +0.005 | 105 | This invention |
| 205 | 0.071 | 100 | 324 | 1.25 | +0.003 | 100 | This invention |
| 206 | 0.071 | 93 | 295 | 1.75 | +0.003 | 93 | This invention |
| 207 | 0.070 | 87 | 229 | 2.15 | +0.003 | 83 | Comparative example |

As shown in Table 5, the samples according to the present invention were high in sensitivity under the high-illumination exposure, compared with the samples for comparison, while having low-illumination exposure sensitivities equivalent to those of the samples for comparison, and besides, they were low in fog and had excellent storability. In addition, the similar results were obtained on both magenta and cyan images also. Thus the present invention can provide color photographic light-sensitive materials suitable for high-illumination exposure and capable of delivering excellent white background.

Further, image-wise exposure via digital data was applied to each sample by means of the exposure unit installed in Digital Minilab Frontier 350 (trade name, made by Fuji Photo Film Co., Ltd.), and then the following Processing A was performed. As a result, it was found that each of the samples according to the present invention can deliver high sensitivity, hard gradation and excellent white background.

Example 1-3

The evaluations were made according to the same method as in Example 1-2, except that the following Processing B was used in place of Processing A adopted in Example 1-2. The results obtained on the yellow images are shown in Table 6.

Standard photographic images were produced on a 127 mm-wide roll film sample, EVER-BEAUTY PAPER TYPE II for LASER (trade name, a product of Fuji Photo Film Co., Ltd.), by means of the following laser exposure. Thereafter, the exposed sample was continuously processed (running test) in the following processing steps, until an accumulated replenisher amount of the color developing solution reached to be equal to twice the color developer tank volume, using Digital Minilab Frontier 340 (trade name manufactured by Fuji Photo Film Co., Ltd.). A processing with this running processing solutions was named processing B. Additionally, in order to attain the following processing times in the processor, changes to the transport speed were made by modifications to processing racks.

(Processing B)

| Processing step | Temperature | Time | Replenisher amount |
|---|---|---|---|
| Color development | 45.0° C. | 12 sec | 35 mL |
| Bleach-fixing | 40.0° C. | 12 sec | Replenisher A 15 mL<br>Replenisher B 15 mL |
| Rinse 1 | 45.0° C. | 4 sec | — |
| Rinse 2 | 45.0° C. | 2 sec | — |
| Rinse 3 | 45.0° C. | 2 sec | — |
| Rinse 4 | 45.0° C. | 3 sec | 175 mL |
| Drying | 80° C. | 15 sec | |

(Note)
* Replenisher amount per $m^2$ of the light-sensitive material to be processed.

As the laser light sources, a blue-light semiconductor laser of wavelength 440 nm (Presentation by Nichia Corporation at the 48th Applied Physics Related Joint Meeting, in March of 2001), a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG (trade name), manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The temperature of the semiconductor laser was kept constant by using a Peltier device to prevent the quantity of light from being changed by temperature.

The composition of each processing solution was as follows.

| (Color developer) | (Tank solution) | (Replenisher) |
|---|---|---|
| Water | 800 mL | 800 mL |
| Fluorescent whitening agent (FL-3) | 4.0 g | 10.0 g |
| Residual color reducing agent (SR-1) | 3.0 g | 3.0 g |
| m-Carboxybenzenesulfinic acid | 2.0 g | 4.0 g |
| Sodium p-toluenesulfonate | 10.0 g | 10.0 g |
| Ethylenediaminetetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethyl-N-(β-methanesulfonamidoethyl) aniline 3/2 sulfate monohydrate | 7.0 g | 19.0 g |
| Potassium carbonate | 26.3 g | 26.3 g |
| Water to make | 1000 mL | 1000 mL |
| pH (25° C., adjusted using sulfuric acid and KOH) | 10.25 | 12.8 |

| (Bleach-fixing solution) | (Tank solution) | (ReplenisherA) | (ReplenisherB) |
|---|---|---|---|
| Water | 700 mL | 300 mL | 300 mL |
| Ammonium thiosulfate (750 g/l) | 107 mL | — | 400 mL |
| Ammonium sulfite | 30.0 g | — | — |
| Ammonium iron (III) ethylenediaminetetraacetate | 47.0 g | 200 g | — |
| Ethylenediaminetetraacetic acid | 1.4 g | 0.5 g | 10.0 g |
| Nitric acid (67%) | 7.0 g | 30.0 g | — |
| m-Carboxybenzenesulfinic acid | 3.0 g | 13.0 g | — |
| Ammonium hydrogen sulfite (65%) | — | — | 200 g |
| Succinic acid | 7.0 g | 30.0 g | — |
| Water to make | 1000 mL | 1000 mL | 1000 mL |
| pH (25° C./adjusted using nitric acid and aqua ammonia) | 6.0 | 2.0 | 5.6 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 mL | 1000 mL |
| pH (25° C.) | 6.5 | 6.5 |

FL-3

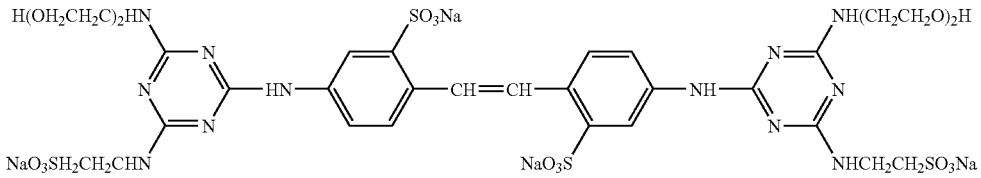

SR-1

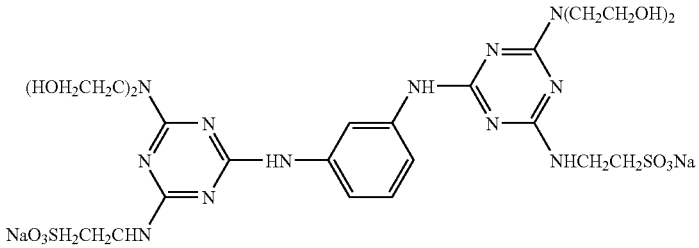

TABLE 5

| Sample No. | Fog | Sensitivity $S_L$ | Sensitivity $S_H$ | $\gamma_H/\gamma_L$ | Storability Δ Fog | Storability Sensitivity Δ $S_H$ | Remarks |
|---|---|---|---|---|---|---|---|
| 101 | 0.087 | 100 | 100 | 0.25 | +0.012 | 120 | Comparative example |
| 102 | 0.085 | 95 | 182 | 0.30 | +0.010 | 115 | Comparative example |
| 103 | 0.083 | 102 | 257 | 0.55 | +0.009 | 110 | Comparative example |
| 104 | 0.082 | 95 | 288 | 0.80 | +0.008 | 105 | Comparative example |
| 105 | 0.082 | 91 | 316 | 1.00 | +0.008 | 102 | Comparative example |
| 106 | 0.081 | 83 | 288 | 1.35 | +0.008 | 98 | Comparative example |
| 107 | 0.081 | 76 | 224 | 1.70 | +0.007 | 91 | Comparative example |
| 201 | 0.091 | 91 | 110 | 0.35 | +0.026 | 135 | Comparative example |
| 202 | 0.087 | 93 | 195 | 0.45 | +0.020 | 123 | Comparative example |
| 203 | 0.082 | 100 | 282 | 0.70 | +0.011 | 110 | This invetion |
| 204 | 0.079 | 102 | 302 | 1.00 | +0.008 | 102 | This invention |
| 205 | 0.077 | 105 | 339 | 1.25 | +0.006 | 98 | This invention |
| 206 | 0.077 | 100 | 295 | 1.75 | +0.006 | 95 | This invention |
| 207 | 0.076 | 91 | 224 | 2.15 | +0.006 | 89 | Comparative example |

As shown in Table 6, the samples according to the present invention were high in sensitivity under the high-illumination exposure, compared with the samples for comparison, while having low-illumination exposure sensitivities equivalent to those of the samples for comparison, and besides, they were low in fog and had excellent storability. Comparison with the results obtained in Example 1-2 clearly indicates that, though the samples using selenium compounds had a propensity to suffer from increased fog in the case of rapid processing, this drawback was controlled by the present invention and preferable results were produced. Additionally, the similar results were obtained on both magenta and cyan images also. Thus the present invention can provide color photographic light-sensitive materials suitable for rapid processing and capable of delivering excellent white background.

Further, image-wise exposure via digital data was applied to each sample by means of the laser exposure unit used at the time of preparation of the running processing solutions, and then Processing B was performed. As a result, it was found that each of the samples according to the present invention can deliver high sensitivity, hard gradation and excellent white background.

Example 2-1

(Preparation of Blue-sensitive Layer (Yellow-color-forming Layer) Emulsion BH-1)

Using a method of simultaneously adding silver nitrate and sodium chloride mixed into stirring deionized distilled water containing a deionized gelatin, high silver chloride cubic grains were prepared. In the preparation, at the step of from 10% to 20% addition of the entire silver nitrate amount, $Cs_2[OsCl_5(NO)]$ was added. At the step of from 70% to 85% addition of the entire silver nitrate amount, potassium bromide (3 mol % per mol of the finished silver halide) and $K_4[Fe(CN)_6]$ were added. At the step of from 75% to 80% addition of the entire silver nitrate amount, $K_2[IrCl_6]$ was added. Further, $K_2[IrCl_5(H_2O)]$ and $K[IrCl_4(H_2O)_2]$ were added at the step of from 88% to 98% addition of the entire silver nitrate amount. Potassium iodide (0.3 mol % per mol of the finished silver halide) was added with a vigorous stirring, at the step of completion of 93% addition of the entire silver nitrate amount. The thus-obtained emulsion grains were monodisperse cubic silver iodobromochloride grains having a side length of 0.43 μm and a variation coefficient of 9.5%. After being subjected to a sedimentation desalting treatment, the following were added to the resulting emulsion: gelatin, Compounds Ab-1, Ab-2, and Ab-3, and calcium nitrate, and the emulsion was re-dispersed.

The re-dispersed emulsion was dissolved at 40° C., and Oxidant 1 as a compound having an action of oxidizing metallic silver clusters, triethylthiourea as a sulfur sensitizer, Compound-1as a gold-sulfur sensitizer were added. The resulting emulsion was ripened for optimal chemical sensitization. Thereafter, 1-(3-acetoamidophenyl)-5-mercaptotetrazole; 1-(5-methylureidophenyl)-5-mercaptotetrazole; Compound-2; a mixture whose major components are compounds represented by Compound-3 in which the repeating unit is 2 or 3 (both ends $X_1$ and $X_2$ are each a hydroxyl group); Compound-4, and potassium bromide. Further, in a midway of the emulsion preparation step, Sensitizing Dyes S-1, S-2 and S-10 were added, to conduct spectral sensitization. The thus-obtained emulsion was referred to as Emulsion BH-1 (wherein the silver chloride content in the finished emulsion was 96.3 mole %).

Sensitizing dye S-10

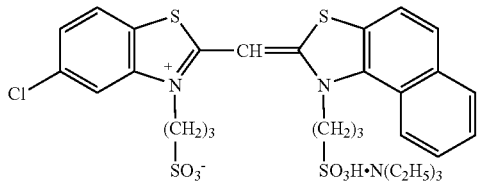

-continued

Oxidizing agent 1

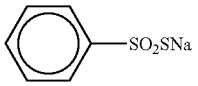

Oxidizing agent 2

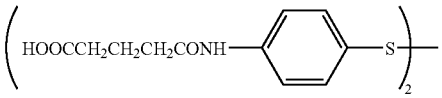

(Preparation of Blue-sensitive Layer (Yellow-color-forming Layer) Emulsion BH-2)

Emulsion BH-2 was prepared in the same manner as Emulsion BH-1, except that the selenium sensitizer SE3-9 was added in place of the sulfur sensitizer triethylthiourea, bis(1,4,5-trimethyl-1,2,4-triazolium-3-thiolato)aurate(I) tetrafluoroborate was added as gold sensitizer in place of the gold-sulfur sensitizer Compound-1, and alterations were made to the amounts of compounds added (wherein the silver chloride content in the finished emulsion was 96.3 mole %).

(Preparation of Blue-sensitive Layer (Yellow-color-forming Layer) Emulsion BH-3)

Emulsion BH-3 was prepared in the same manner as in the preparation of emulsion BH-2, except that SE3-29 was added in place of the selenium sensitizer SE3-9, and that amounts of the compounds to be added were changed from those in BH-2 (wherein the silver chloride content in the finished emulsion was 96.3 mole %).

(Preparation of Blue-sensitive Layer (Yellow-color-forming Layer) Emulsion BH-4)

Emulsion BH-4 was prepared in the same manner as in the preparation of emulsion BH-2, except that PF1-1 was added in place of the selenium sensitizer SE3-9, and that amounts of the compounds to be added were changed from those in BH-2 (wherein the silver chloride content in the finished emulsion was 96.3 mole %).

(Preparation of Blue-sensitive Layer (Yellow-color-forming Layer) Emulsion BH-5)

Emulsion BH-5 was prepared in the same manner as Emulsion BH-4, except that $1.0\times10^{-5}$ mole/mole Ag of Oxidant 2 was added as a compound having an action of oxidizing metallic silver clusters (wherein the silver chloride content in the finished emulsion was 96.3 mole %).

(Preparation of Green-sensitive Layer (Magenta-color-forming Layer) Emulsion GH-1)

Using a method of simultaneously adding silver nitrate and sodium chloride mixed into stirring deionized distilled water containing a deionized gelatin, high silver chloride cubic grains were prepared. In this preparation, at the step of from 70% to 85% addition of the entire silver nitrate amount, $K_4[Ru(CN)_6]$ was added. At the step of from 70% to 85% addition of the entire silver nitrate amount, potassium bromide (1 mol % per mol of the finished silver halide) was added. Further, $K_2[IrCl_6]$ and $K_2[RhBr_5(H_2O)]$ were added at the step of from 70% to 85% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 87% to 98% addition of the entire silver nitrate amount. The thus-obtained emulsion grains were monodisperse cubic silver iodobromochloride grains having a side length of 0.31 μm and a variation coefficient of 9.5%. The resulting emulsion was subjected to a sedimentation desalting treatment and re-dispersing treatment in the same manner as described in the above.

The re-dispersed emulsion was dissolved at 40° C., and Oxidant 1 as a compound having an action of oxidizing metallic silver clusters, Compound-1 as a gold-sulfur sensitizer, triethylthiourea as a sulfur sensitizer, and (bis(1,4,5-trimethyl-1,2,4-triazolium-3-thiolate)aurate (I) tetrafluoroborate) as a gold sensitizer, were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dyes S-4, S-5, S-6, and S-7 were added as sensitizing dyes, to conduct spectral sensitization. The thus-obtained emulsion was referred to as Emulsion GH-1. (wherein the silver chloride content in the finished emulsion was 98.3 mole %)

(Preparation of Green-sensitive Layer (Magenta-color-forming Layer) Emulsion GH-2)

Emulsion GH-2 was prepared in the same manner as in the preparation of emulsion GH-1, except that the selenium sensitizer SE3-9 was added in place of the sulfer sensitizer triethylthiourea, and that amounts of the compounds to be added were changed from those in GH-1(wherein the silver chloride content in the finished emulsion was 98.3 mole %).

(Preparation of Green-sensitive Layer (Magenta-color-forming Layer) Emulsion GH-3)

Emulsion GH-3 was prepared in the same manner as in the preparation of emulsion GH-2, except that the selenium sensitizer SE3-29 was added in place of the selenium sensitizer SE3-9, and that amounts of the compounds to be added were changed from those in GH-2 (wherein the silver chloride content in the finished emulsion was 98.3 mole %).

(Preparation of Green-sensitive Layer (Magenta-color-forming Layer) Emulsion GH-4)

Emulsion GH-4 was prepared in the same manner as in the preparation of emulsion GH-2, except that the selenium sensitizer PF1-1 was added in place of the selenium sensitizer SE3-9, and that amounts of the compounds to be added were changed from those in GH-2 (wherein the silver chloride content in the finished emulsion was 98.3 mole %).

(Preparation of Green-sensitive Layer (Magenta-color-forming Layer) Emulsion GH-5)

Emulsion GH-5 was prepared in the same manner as Emulsion GH-4, except that $1.5\times10^{-5}$ mole/mole Ag of Oxidant 2 was added as a compound having an action of oxidizing metallic silver clusters (wherein the silver chloride content in the finished emulsion was 98.3 mole %).

(Preparation of Red-sensitive Layer (Cyan-color-forming layer) Emulsion RH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 93% to 98% addition of the entire silver nitrate amount, $K_4[Ru(CN)_6]$ was added. At the step of from 85% to 100% addition of the entire silver nitrate amount, potassium bromide (3 mol % per mol of the finished silver halide) was added. Further, $K_2[IrCl_5(5\text{-methylthiazole})]$ was added at the step of from 88% to 93% addition of the entire silver nitrate amount. Potassium iodide (0.1 mol % per mol of the finished silver halide) was added, with vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains having a side length of 0.32 μm and a variation coefficient of 9.5%. The resulting emulsion was subjected to a sedimentation desalting treatment and re-dispersing treatment in the same manner as described in the above.

The re-dispersed emulsion was dissolved at 40° C., and Sensitizing dye S-8, Compound-5, Oxidant 1 as a compound having an action of oxidizing metallic silver clusters, triethylthiourea as a sulfur sensitizer, and Compound-1 as a gold-sulfur sensitizer, were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1. (wherein the silver chloride content in the finished emulsion was 96.6 mole %)

(Preparation of Red-sensitive Layer (Cyan-color-forming layer) Emulsion RH-2)

Emulsion RH-2 was prepared in the same manner as Emulsion RH-1, except that SE3-9 was added in place of the sulfur sensitizer triethylthiourea, bis(1,4,5-trimethyl-1,2,4-triazolium-3-thiolato)aurate(I) tetrafluoroborate was added as gold sensitizer in place of Compound-1, and alterations were made to the amounts of compounds added (wherein the silver chloride content in the finished emulsion was 96.6 mole %).

(Preparation of Red-sensitive Layer (Cyan-color-forming Layer) Emulsion RH-3)

Emulsion RH-3 was prepared in the same manner as in the preparation of emulsion RH-2, except that SE3-29 was added in place of the selenium sensitizer SE3-9, and that amounts of the compounds to be added were changed from those in RH-2 (wherein the silver chloride content in the finished emulsion was 96.6 mole %).

(Preparation of Red-sensitive Layer (Cyan-color-forming Layer) Emulsion RH-4)

Emulsion RH-4 was prepared in the same manner as in the preparation of emulsion RH-2, except that PF1-1 was added in place of the selenium sensitizer SE3-9, and that amounts of the compounds to be added were changed from those in RH-2 (wherein the silver chloride content in the finished emulsion was 96.6 mole %).

(Preparation of Red-sensitive Layer (Cyan-color-forming Layer) Emulsion RH-5)

Emulsion RH-5 was prepared in the same manner as in the preparation of emulsion RH-1, except that SS-7 was added in place of the compound-5, and that amounts of the compounds to be added were changed from those in RH-1 (wherein the silver chloride content in the finished emulsion was 96.6 mole %).

(Preparation of Red-sensitive Layer (Cyan-color-forming Layer) Emulsion RH-6)

Emulsion RH-6 was prepared in the same manner as in the preparation of emulsion RH-3, except that SS-7 was added in place of the compound-5, and that amounts of the compounds to be added were changed from those in RH-3 (wherein the silver chloride content in the finished emulsion was 96.6 mole %).

(Preparation of Red-sensitive Layer (Cyan-color-forming Layer) Emulsion RH-7)

Emulsion RH-7 was prepared in the same manner as in the preparation of emulsion RH-4, except that SS-7 was added in place of the compound-5, and that amounts of the compounds to be added were changed from those in RH-4 (wherein the silver chloride content in the finished emulsion was 96.6 mole %).

(Preparation of Red-sensitive Layer (Cyan-color-forming Layer) Emulsion RH-8)

Emulsion RH-8 was prepared in the same manner as Emulsion RH-7, except that $9.0\times10^{-6}$ mole/mole Ag of Oxidant 2 was added as a compound having an action of oxidizing metallic silver clusters (wherein the silver chloride content in the finished emulsion was 96.6 mole %).

(Preparation of a Coating Solution for the First Layer)

Into 17 g of a solvent (Solv-4), 5 g of a solvent (Solv-6), 17 g of a solvent (Solv-9) and 45 ml of ethyl acetate were dissolved 24 g of a yellow coupler (Ex-Y), 7 g of a color-image stabilizer (Cpd-8), 1 g of a color-image stabilizer (Cpd-16), 1 g of a color-image stabilizer (Cpd-17), and 10 g of a color-image stabilizer (Cpd-18), 1 g of a color-image stabilizer (Cpd-19), 11 g of a color-image stabilizer (Cpd-21), 0.1 g of an additive (ExC-2), and 1 g of a color-image stabilizer (UV-A). This solution was emulsified and dispersed in 205 g of a 20 mass % aqueous gelatin solution containing 3 g of sodium dodecylbenzenesulfonate with a high-speed stirring emulsifier (dissolver). Water was added thereto, to prepare 700 g of Emulsified dispersion 2A.

On the other hand, the above Emulsified dispersion 2A and the prescribed Emulsions BH-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added Ab-1, Ab-2, Ab-3, and Ab-4, so that the total amounts would be 7.0 mg/m$^2$, 43.0 mg/m$^2$, 3.5 mg/m$^2$, and 10.0 mg/m$^2$, respectively.

Further, to the third layer, the fifth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the third layer, the fifth layer, and the sixth layer so that coating amounts would be 6 mg/m$^2$, 7 mg/m$^2$, and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

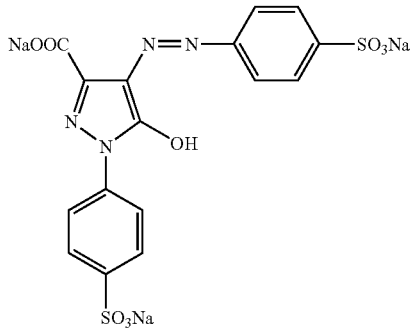

(2 mg/m′)

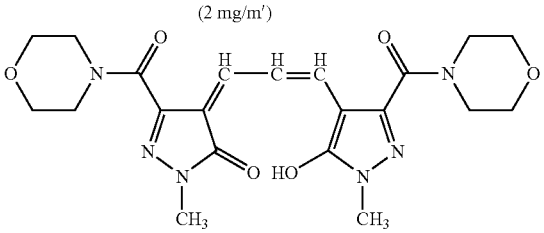

(3 mg/m′)

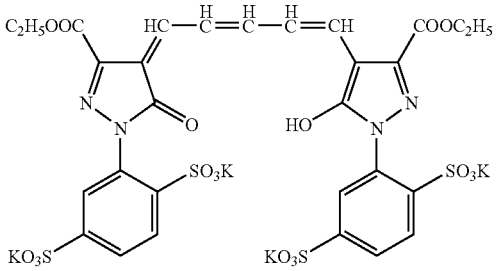

(10 mg/m′)

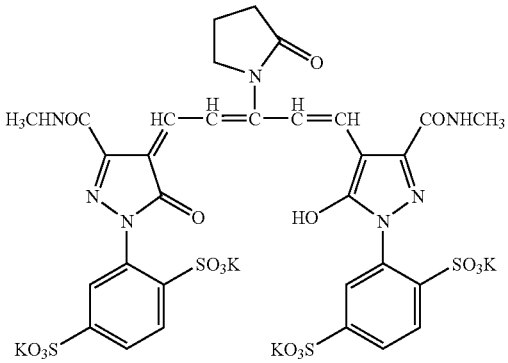

(16 mg/m′)

(Layer Constitution)

Individual constituent layers were configured so as to have the following compositions, and a silver halide color photographic light-sensitive material was prepared by using them. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| | |
|---|---|
| First layer (Blue-sensitive emulsion layer/yellow-dye-forming-coupler-containing silver halide emulsion layer) | |
| Emulsion (BH-1) | 0.26 |
| Gelatin | 1.30 |
| Yellow coupler (Ex-Y) | 0.48 |
| Color-image stabilizer (Cpd-8) | 0.14 |
| Color-image stabilizer (Cpd-16) | 0.02 |
| Color-image stabilizer (Cpd-17) | 0.02 |
| Color-image stabilizer (Cpd-18) | 0.21 |
| Color-image stabilizer (Cpd-19) | 0.02 |
| Color-image stabilizer (Cpd-21) | 0.22 |
| Additive (ExC-2) | 0.002 |
| Color-image stabilizer (UV-A) | 0.02 |
| Solvent (Solv-4) | 0.34 |
| Solvent (Solv-6) | 0.10 |
| Solvent (Solv-9) | 0.34 |
| Second layer (Color-mixing-inhibiting layer) | |
| Gelatin | 0.99 |
| Color-mixing inhibitor (Cpd-4) | 0.05 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.06 |
| Color-image stabilizer (UV-A) | 0.07 |
| Color-image stabilizer (Cpd-7) | 0.007 |
| Solvent (Solv-1) | 0.07 |
| Solvent (Solv-2) | 0.18 |
| Solvent (Solv-5) | 0.07 |
| Solvent (Solv-8) | 0.07 |
| Third layer (Green-sensitive emulsion layer/magenta-dye-forming-coupler-containing silver halide emulsion layer) | |
| Emulsion (GH-1) | 0.15 |
| Gelatin | 1.35 |
| Magenta coupler (Ex-M) | 0.15 |
| Ultraviolet absorber (UV-A) | 0.04 |
| Color-image stabilizer (Cpd-2) | 0.01 |
| Color-image stabilizer (Cpd-6) | 0.10 |
| Color-image stabilizer (Cpd-7) | 0.007 |
| Color-image stabilizer (Cpd-8) | 0.01 |
| Color-image stabilizer (Cpd-9) | 0.01 |
| Color-image stabilizer (Cpd-10) | 0.007 |
| Color-image stabilizer (Cpd-11) | 0.0002 |
| Color-image stabilizer (Cpd-18) | 0.01 |
| Solvent (Solv-3) | 0.08 |
| Solvent (Solv-4) | 0.16 |
| Solvent (Solv-6) | 0.07 |
| Solvent (Solv-9) | 0.18 |
| Fourth layer (Color-mixing-inhibiting layer) | |
| Gelatin | 0.71 |
| Color-mixing inhibitor (Cpd-4) | 0.06 |
| Color-mixing inhibitor (Cpd-12) | 0.01 |
| Color-image stabilizer (Cpd-3) | 0.01 |
| Color-image stabilizer (Cpd-5) | 0.005 |
| Color-image stabilizer (Cpd-6) | 0.04 |
| Color-image stabilizer (UV-A) | 0.05 |
| Color-image stabilizer (Cpd-7) | 0.005 |
| Solvent (Solv-1) | 0.05 |
| Solvent (Solv-2) | 0.05 |
| Solvent (Solv-5) | 0.06 |
| Solvent (Solv-8) | 0.06 |
| Fifth layer (Red-sensitive emulsion layer/cyan-dye-forming-coupler-containing silver halide emulsion layer) | |
| Emulsion (RH-1) | 0.13 |
| Gelatin | 1.11 |
| Cyan coupler (ExC-1) | 0.14 |
| Cyan coupler (ExC-3) | 0.01 |
| Cyan coupler (ExC-2) | 0.05 |
| Color-image stabilizer (Cpd-1) | 0.04 |
| Color-image stabilizer (Cpd-7) | 0.01 |
| Color-image stabilizer (Cpd-9) | 0.05 |

-continued

| | |
|---|---|
| Color-image stabilizer (Cpd-10) | 0.001 |
| Color-image stabilizer (Cpd-14) | 0.002 |
| Color-image stabilizer (Cpd-15) | 0.023 |
| Color-image stabilizer (Cpd-16) | 0.06 |
| Color-image stabilizer (Cpd-17) | 0.06 |
| Color-image stabilizer (UV-5) | 0.13 |
| Solvent (Solv-5) | 0.24 |
| Sixth layer (Ultraviolet absorbing layer) | |
| Gelatin | 0.46 |
| Ultraviolet absorber (UV-B) | 0.45 |
| Compound (S1-4) | 0.0015 |
| Solvent (Solv-7) | 0.25 |
| Seventh layer (Protective layer) | |
| Gelatin | 1.00 |
| Additive (Cpd-20) | 0.04 |
| Liquid paraffin | 0.02 |
| Surfactant (Cpd-13) | 0.02 |

A sample thus prepared was referred to as Sample 2-101. Further, other samples referred to as Sample 2-102 to Sample 2-106 were each prepared in the same manner as Sample 2-101, except that the emulsion for the blue-sensitive emulsion layer, the emulsion for the red-sensitive emulsion layer and the yellow coupler were those shown in Table 7, respectively. Herein, the addition amount of each yellow coupler was chosen so that the ratio between the silver content and the molar concentration of the coupler was left unchanged.

In addition, silver halide color photographic light-sensitive materials were prepared in the same manner as Sample 2-101, except that the total amount of silver coated was changed variously by modifying the compositions of photographic constituent layers as described below.

| | |
|---|---|
| First layer (Blue-sensitive emulsion layer/yellow-dye-forming-coupler-containing silver halide emulsion layer) | |
| Emulsion (BH-1) | 0.16 |
| Gelatin | 0.75 |
| Yellow coupler (Ex-Y) | 0.31 |
| Color-image stabilizer (Cpd-8) | 0.07 |
| Color-image stabilizer (Cpd-16) | 0.01 |
| Color-image stabilizer (Cpd-17) | 0.01 |
| Color-image stabilizer (Cpd-18) | 0.17 |
| Color-image stabilizer (Cpd-19) | 0.01 |
| Color-image stabilizer (Cpd-21) | 0.14 |
| Additive (ExC-2) | 0.001 |
| Color-image stabilizer (UV-A) | 0.01 |
| Solvent (Solv-4) | 0.21 |
| Solvent (Solv-6) | 0.06 |
| Solvent (Solv-9) | 0.21 |
| Second layer (Color-mixing-inhibiting layer) | |
| Gelatin | 0.60 |
| Color-mixing inhibitor (Cpd-17) | 0.09 |
| Color-image stabilizer (Cpd-5) | 0.007 |
| Color-image stabilizer (Cpd-7) | 0.007 |
| Ultraviolet absorber (UV-B) | 0.05 |
| Solvent (Solv-5) | 0.11 |
| Third layer (Green-sensitive emulsion layer/magenta-dye-forming-coupler-containing silver halide emulsion layer) | |
| Emulsion (GH-1) | 0.14 |
| Gelatin | 0.73 |
| Magenta coupler (Ex-M) | 0.15 |
| Ultraviolet absorber (UV-A) | 0.05 |
| Color-image stabilizer (Cpd-2) | 0.02 |
| Color-image stabilizer (Cpd-8) | 0.07 |
| Color-image stabilizer (Cpd-9) | 0.03 |

-continued

| | |
|---|---|
| Color-image stabilizer (Cpd-10) | 0.009 |
| Color-image stabilizer (Cpd-11) | 0.0001 |
| Solvent (Solv-6) | 0.05 |
| Solvent (Solv-9) | 0.12 |
| Solvent (Solv-7) | 0.11 |
| Compound (S1-4) | 0.0015 |
| Fourth layer (Color-mixing-inhibiting layer) | |
| Gelatin | 0.48 |
| Color-mixing inhibiting layer (Cpd-4) | 0.07 |
| Color-image stabilizer (Cpd-5) | 0.006 |
| Color-image stabilizer (Cpd-7) | 0.006 |
| Ultraviolet absorber (UV-B) | 0.04 |
| Solvent (Solv-5) | 0.09 |
| Fifth layer (Red-sensitive emulsion layer/cyan-dye-forming-coupler-containing silver halide emulsion layer) | |
| Emulsion (RH-1) | 0.12 |
| Gelatin | 0.59 |
| Cyan coupler (ExC-1) | 0.16 |
| Cyan coupler (ExC-3) | 0.016 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.16 |
| Color-image stabilizer (Cpd-16) | 0.04 |
| Color-image stabilizer (Cpd-17) | 0.02 |
| Color-image stabilizer (UV-5) | 0.07 |
| Solvent (Solv-5) | 0.07 |
| Sixth layer (Ultraviolet absorbing layer) | |
| Gelatin | 0.32 |
| Ultraviolet absorber (UV-B) | 0.42 |
| Solvent (Solv-7) | 0.08 |
| Seventh layer (Protective layer) | |
| Gelatin | 0.70 |
| Additive (Cpd-20) | 0.015 |
| Acryl modified copolymer of polyvinyl alcohol (degree of modification: 17%) | 0.04 |
| Liquid paraffin | 0.01 |
| Surfactant (Cpd-13) | 0.01 |
| Polydimethylsiloxane | 0.01 |
| Silica | 0.003 |

A sample thus prepared was referred to as Sample 2-111. Further, other samples referred to as Sample 2-112 to Sample 2-118 were each prepared in the same manner as Sample 2-111, except that the emulsion for the blue-sensitive emulsion layer, the emulsion for the red-sensitive emulsion layer and the yellow coupler were those shown in Table 7, respectively. Herein, the addition amount of each yellow coupler was chosen so that the ratio between the silver content and the molar concentration of the coupler was left unchanged.

TABLE 7

| Sample No. | total amount of silver coated (g/m$^2$) | total amount of gelatin coated (g/m$^2$) | Emulsion for the blue-sensitive emulsion layer | Emulsion for the green-sensitive emulsion layer | Emulsion for the red-sensitive emulsion layer | Yellow coupler | Remarks |
|---|---|---|---|---|---|---|---|
| 2-101 | 0.54 | 6.92 | BH-1 | GH-1 | RH-1 | Ex-Y | Comparative example |
| 2-102 | 0.54 | 6.92 | BH-1 | GH-1 | RH-5 | Y-19 | Comparative example |
| 2-103 | 0.54 | 6.92 | BH-2 | GH-2 | RH-2 | Ex-Y | Comparative example |
| 2-104 | 0.54 | 6.92 | BH-3 | GH-3 | RH-6 | Ex-Y | Comparative example |
| 2-105 | 0.54 | 6.92 | BH-3 | GH-3 | RH-3 | Y-11 | Comparative example |
| 2-106 | 0.54 | 6.92 | BH-3 | GH-3 | RH-6 | Y-11 | Comparative example |
| 2-111 | 0.42 | 4.17 | BH-1 | GH-1 | RH-1 | Ex-Y | Comparative example |
| 2-112 | 0.42 | 4.17 | BH-1 | GH-1 | RH-5 | Y-19 | Comparative example |
| 2-113 | 0.42 | 4.17 | BH-2 | GH-2 | RH-2 | Ex-Y | Comparative example |
| 2-114 | 0.42 | 4.17 | BH-3 | GH-3 | RH-6 | Ex-Y | This invention |
| 2-115 | 0.42 | 4.17 | BH-3 | GH-3 | RH-3 | Y-11 | This invention |
| 2-116 | 0.42 | 4.17 | BH-3 | GH-3 | RH-6 | Y-19 | This invention |
| 2-117 | 0.42 | 4.17 | BH-4 | GH-4 | RH-7 | Y-11 | This invention |
| 2-118 | 0.42 | 4.17 | BH-5 | GH-5 | RH-8 | Y-11 | This invention |

As shown in Table 7, it was able to prepare silver halide color photographic light-sensitive materials of the present invention as Sample 2-114 to Sample 2-118 (examples according to this invention). On the other hand, silver halide color photographic light-sensitive materials for comparison were prepared as Sample 2-101 to Sample 2-113 (comparative examples).

Test Example 1

In order to examine photographic characteristics of these samples, the following experiments were carried out.

Processing 2A

The aforementioned Sample 2-101 was made into a roll with a width of 127 mm; the resultant sample was exposed to light with a standard photographic image, using Digital Minilab Frontier 340 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. Additionally, in order to attain the following processing times in the processor, changes to the transport speed were made by modifications to processing racks. A processing with this running processing solutions was named processing 2A.

| Processing step | Temperature | Time | Replenisher amount* |
|---|---|---|---|
| Color development | 45.0° C. | 13 sec | 35 mL |
| Bleach-fixing | 40.0° C. | 13 sed | Replenisher A 15 mL<br>Replenisher B 15 mL |
| Rinse1 | 45.0° C. | 4 sec | — |
| Rinse2 | 45.0° C. | 2 sec | — |
| Rinse3 | 45.0° C. | 2 sec | — |
| Rinse4 | 45.0° C. | 3 sec | 175 mL |
| Drying | 80° C. | 15 sec | |

(Note)
*Replenisher amount per m$^2$ of the photosensitive material to be processed The compositions of each processing solution were as follows.

| (Color developer A) | (Tank solution) | (Replenisher) |
|---|---|---|
| Water | 800 mL | 800 mL |
| Fluorescent whitening agent (FL-3) | 4.0 g | 10.0 g |
| Residual color reducing agent (SR-1) | 3.0 g | 3.0 g |
| m-Carboxybenzenesulfinic acid | 2.0 g | 4.0 g |
| Sodium p-toluenesulfonate | 10.0 g | 10.0 g |
| Ethylenediaminetetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline•3/2 sulfate•monohydrate | 7.0 g | 19.0 g |
| Potassium carbonate | 26.3 g | 26.3 g |
| Water to make | 1000 mL | 1000 mL |
| pH (25° C., adjusted using sulfuric acid and KOH) | 10.25 | 12.8 |

| (Bleach-fixing solution A) | (Tank solution) | (Replenisher A) | (Replenisher B) |
|---|---|---|---|
| Water | 700 mL | 300 mL | 300 mL |
| Ammonium thiosulfate (750 g/l) | 107 mL | — | 400 mL |
| Ammonium sulfite | 30.0 g | — | — |
| Ammonium iron (III) ethylenediaminetetraacetate | 47.0 g | 200 g | — |
| Ethylenediaminetetraacetic acid | 1.4 g | 0.5 g | 10.0 g |
| Nitric acid (67%) | 7.0 g | 30.0 g | — |
| m-Carboxybenzenesulfinic acid | 3.0 g | 13.0 g | — |

-continued

| | | | |
|---|---|---|---|
| Ammonium hydrogen sulfite (65%) | — | — | 200 g |
| Succinic acid | 7.0 g | 30.0 g | — |
| Water to make | 1000 mL | 1000 mL | 1000 mL |
| pH (25° C., adjusted using nitric acid and aqueous ammonia) | 6.0 | 2.0 | 5.6 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 mL | 1000 mL |
| pH (25° C.) | 6.5 | 6.5 |

Each sample was subjected to gradation exposure to impart gray in the following color-development processing 2A, with the following exposure apparatus; and then, at five seconds after the exposure was finished, the sample was subject to color-development processing by the processing 2A. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG; manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds.

Developed yellow densities, developed magenta densities, and developed cyan densities, of each sample after processing were measured, and thereby obtaining the characteristic curves. The sensitivity (S) was defined as antilogarithm of the reciprocal of the amount of light exposure providing a developed-color density 0.7 higher than the density in the unexposed area; the sensitivities of the samples concerned are shown as relative values, with the sensitivity of Sample 2-101 being taken as 100. The greater value a sample shows, the higher sensitivity it has. The fog density (Dmin) was defined as the value obtained by subtracting the base density from the each developed-color density in the unexposed area. So a smaller value means the more beautiful white background, so the smaller the better.

TABLE 8

| Sam- | yellow-color-forming layer | | magenta-color-forming layer | | cyan-color-forming layer | | |
|---|---|---|---|---|---|---|---|
| ple | S | Dmin | S | Dmin | S | Dmin | Remarks |
| 2-101 | 100 | 0.03 | 100 | 0.07 | 100 | 0.05 | Comparative example |
| 2-102 | 101 | 0.03 | 99 | 0.07 | 101 | 0.05 | Comparative example |
| 2-103 | 159 | 0.09 | 151 | 0.09 | 171 | 0.09 | Comparative example |
| 2-104 | 162 | 0.10 | 153 | 0.10 | 167 | 0.10 | Comparative example |
| 2-105 | 165 | 0.09 | 155 | 0.08 | 150 | 0.10 | Comparative example |
| 2-106 | 165 | 0.09 | 154 | 0.09 | 167 | 0.09 | Comparative example |

TABLE 8-continued

| Sam- | yellow-color-forming layer | | magenta-color-forming layer | | cyan-color-forming layer | | |
|---|---|---|---|---|---|---|---|
| ple | S | Dmin | S | Dmin | S | Dmin | Remarks |
| 2-111 | 100 | 0.02 | 101 | 0.05 | 99 | 0.04 | Comparative example |
| 2-112 | 100 | 0.02 | 100 | 0.06 | 101 | 0.03 | Comparative example |
| 2-113 | 159 | 0.07 | 152 | 0.09 | 173 | 0.08 | Comparative example |
| 2-114 | 165 | 0.04 | 153 | 0.06 | 171 | 0.04 | This invention |
| 2-115 | 166 | 0.03 | 152 | 0.06 | 161 | 0.04 | This invention |
| 2-116 | 169 | 0.02 | 155 | 0.05 | 173 | 0.03 | This invention |
| 2-117 | 178 | 0.02 | 161 | 0.05 | 178 | 0.03 | This invention |
| 2-118 | 178 | 0.02 | 161 | 0.04 | 178 | 0.03 | This invention |

As can be seen from Table 8, all the Samples 2-114 to 2-118 according to the present invention had advantages of high sensitivity and low fog density.

Test Example 2

A simulation testing of mixing of a bleach-fix solution into a color developer was done by using the foregoing Color Developer A and Bleach-fix Solution A.

Color Developer B was prepared by adding 1 ml of Bleach-fix Solution A per liter of the foregoing Color Developer A. Development processing was performed in the same manner as Processing 2A, except that Color Developer B was used in place of Color Developer A.

Developed-yellow densities of each sample after processing were measured, and a characteristic curve was obtained by plotting these measured values. The value obtained by subtracting the yellow density in the unexposed area after Processing 2A from the yellow density in the unexposed area after the simulation testing was referred to as the fog density (DminY1). As to this value, the smaller the better, because the smaller the value, the lower the fog density and the more beautiful the white background. Similarly, developed-magenta densities and developed-cyan densities were measured, and fog densities (DminM1) and (DminC1) were each determined.

TABLE 9

| Sample | DminY1 | DminM1 | DminC1 | Remarks |
|---|---|---|---|---|
| 2-101 | 0.05 | 0.07 | 0.08 | Comparative example |
| 2-102 | 0.05 | 0.07 | 0.07 | Comparative example |
| 2-103 | 0.13 | 0.14 | 0.12 | Comparative example |
| 2-104 | 0.15 | 0.12 | 0.13 | Comparative example |
| 2-105 | 0.14 | 0.13 | 0.14 | Comparative example |
| 2-106 | 0.12 | 0.13 | 0.13 | Comparative example |
| 2-111 | 0.04 | 0.06 | 0.07 | Comparative example |
| 2-112 | 0.03 | 0.06 | 0.05 | Comparative example |

TABLE 9-continued

| Sample | DminY1 | DminM1 | DminC1 | Remarks |
|---|---|---|---|---|
| 2-113 | 0.12 | 0.11 | 0.12 | Comparative example |
| 2-114 | 0.07 | 0.07 | 0.07 | This invention |
| 2-115 | 0.05 | 0.07 | 0.07 | This invention |
| 2-116 | 0.03 | 0.06 | 0.05 | This invention |
| 2-117 | 0.02 | 0.06 | 0.05 | This invention |
| 2-118 | 0.02 | 0.03 | 0.03 | This invention |

As can be seen from Table 9, all the Samples 2-114 to 2-118 according to the present invention are favorable in the sense that changes in fog density by mixing of the bleach-fix solution into the color developer were small. In addition, it can be seen from Table 9 that the cases of using two kinds of compounds having an action of oxidizing metallic silver clusters produced greater effect.

Test Example 3

The samples' stabilities toward changes in pH of color developer were examined. Color developers C and D were prepared by adjusting the pH of Color Developer A used in Text example 1 to 10.0 and 10.7, respectively, and development processing was carried out using each of these color developers in the same way as in Processing 2A.

After processing, the developed yellow densities of each sample were measured, and by plotting these measured values a characteristic curve was obtained. The value obtained by subtracting the yellow density in the unexposed area after processing with Color Developer C from the yellow density in the unexposed area after processing with Color Developer D was referred to as the fog density (ΔDY2). The smaller this value, the more stable and the better a sample examined. Likewise, developed-magenta densities and developed-cyan densities were measured, and from these data were determined fog densities (ΔDM2) and (ΔDC2), respectively.

TABLE 10

| Sample No. | ⊿DY2 | ⊿DM2 | ⊿DC2 | Remarks |
|---|---|---|---|---|
| 2-103 | 0.04 | 0.02 | 0.03 | Comparative example |
| 2-104 | 0.03 | 0.01 | 0.02 | Comparative example |
| 2-105 | 0.02 | 0.02 | 0.03 | Comparative example |
| 2-106 | 0.03 | 0.02 | 0.02 | Comparative example |
| 2-113 | 0.03 | 0.02 | 0.02 | Comparative example |
| 2-114 | 0.01 | 0.005 | 0.01 | This invention |
| 2-115 | 0.02 | 0.005 | 0.01 | This invention |
| 2-116 | 0.005 | 0.00 | 0.01 | This invention |
| 2-117 | 0.005 | 0.00 | 0.005 | This invention |

As can be seen from the results shown in Table 10, all the Samples 2-114 to 2-117 according to the present invention were small in fog-density changes by mixing of the bleach-fix solution into the color developer, so they were found to be favorable.

Test Example 4

Further, fog variation by temperature change to 48° C. from 38° C. during the color-development processing were examined, and all the samples according to the present invention were found to be small in the fog variations and favorable.

From the results of these Examples and Comparative Examples, it can be seen that the photosensitive materials of the present invention have high sensitivities and are reduced in fog variations under processing condition changes, and they are favorable.

Example 3-1

(Preparation of Blue-sensitive Emulsions B-31 to B-33)

Using a method of simultaneously adding silver nitrate and sodium chloride mixed into stirring deionized distilled water containing deionized gelatin, high silver chloride cubic grains were prepared. In this preparation, at the step of from 25% to 30% addition of the entire silver nitrate amount, $Cs_2[OsCl_5(NO)]$ was added. At the step of from 60% to 70% addition of the entire silver nitrate amount, potassium bromide (3.0 mol % per mol of the finished silver halide) and $K_4[Fe(CN)_6]$ were added. Further, $K_2[IrCl_6]$, $K_2[IrCl_5(H_2O)]$ and $K[IrCl_4(H_2O)_2]$ were added at the step of from 70% to 75% addition of the entire silver nitrate amount. Potassium iodide (0.35 mol % per mol of the finished silver halide) was added, with vigorous stirring, at the step of completion of 93% addition of the entire silver nitrate amount. The thus-obtained emulsion grains were monodisperse cubic silver iodobromochloride grains having a side length of 0.38 μm and a variation coefficient of 9.8%. After being subjected to a sedimentation desalting treatment, the following were added to the resulting emulsion: gelatin, Compounds (Ab-1), (Ab-2), (Ab-3), and (Ab-4), and calcium nitrate, and the emulsion was re-dispersed.

The re-dispersed emulsion was dissolved at 40° C., and sodium benzenethiosulfate, p-glutaramidophenyldisulfide, triethylthiourea as a sulfur sensitizer, and Compound-1 as a gold-sulfur sensitizer were added, and the emulsion was ripened for optimal chemical sensitization. Thereafter, 1-(3-acetamidophenyl)-5-mercaptotetrazole, 1-(5-methyl ureidophenyl)-5-mercaptotetrazole, Compound-2, a mixture whose major components are compounds represented by Compound-3 in which the repeating unit is 2 or 3 (both ends $X_1$ and $X_2$ are each a hydroxyl group); Compound-4, and potassium bromide were added. Further, in a midway of the emulsion preparation step, Sensitizing dye S-1, Sensitizing dye S-2, and Sensitizing dye S-10 were added as sensitizing dyes, to conduct spectral sensitization. The thus-obtained emulsion was referred to as Emulsion B-31.

Emulsion B-32 was prepared in the same manner as in the preparation of Emulsion B-31, except that the temperature and the addition rate at the step of mixing silver nitrate and sodium chloride by simultaneous addition were changed. The thus-obtained emulsion grains were monodisperse cubic silver iodobromochloride grains having a side length of 0.55 μm and a variation coefficient of 9.3%.

Emulsion B-33 was prepared in the same manner as Emulsion B-31, except that the exemplified Compound (SE1-8) as a selenium sensitizer and bis(1,4,5-trimethyl-1,2,4-triazolium-3-thiolato)aurate(I) tetrafluroborate were used in place of the sulfur sensitizer and the gold-sulfur sensitizer, respectively. The grains in Emulsion B-33 were monodisperse cubic silver iodobromochloride grains having an side length of 0.38 μm and a variation coefficient of 9.7%.

(Preparation of Green-sensitive Emulsions G-31 to G-33)

Using a method of simultaneously adding silver nitrate and sodium chloride mixed into stirring deionized distilled water containing a deionized gelatin, high silver chloride cubic grains were prepared. In this preparation, at the step of from 75% to 80% addition of the entire silver nitrate amount, $K_4[Ru(CN)_6]$ was added. At the step of from 80% to 90% addition of the entire silver nitrate amount, potassium bromide (1.5 mol % per mol of the finished silver halide) was added. Further, $K_2[IrCl_6]$ and $K_2[RhBr_5(H_2O)]$ were added at the step of from 75% to 90% addition of the entire silver nitrate amount. Potassium iodide (0.15 mol % per mol of the finished silver halide) was added with a vigorous stirring, at the step of completion of 95% addition of the entire silver nitrate amount. $K_2[IrCl_5(H_2O)]$ and $K[IrCl_4(H_2O)_2]$ were added at the step of from 87% to 98% addition of the entire silver nitrate amount. The thus-obtained emulsion grains were monodisperse cubic silver iodobromochloride grains having a side length of 0.35 μm and a variation coefficient of 9.0%. The resulting emulsion was subjected to a sedimentation desalting treatment and re-dispersing treatment in the same manner as described in the above.

The re-dispersed emulsion was dissolved at 40° C., and sodium benzenethiosulfate, p-glutaramidophenyldisulfide, sodium thiosulfate as a sulfur sensitizer, and chloroauric acid as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dye S-14, Sensitizing dye S-5, Sensitizing dye S-6, and Sensitizing dye S-7 were added as sensitizing dyes, to conduct spectral sensitization. The thus-obtained emulsion was referred to as Emulsion GH-31.

Sensitizing dye S-14

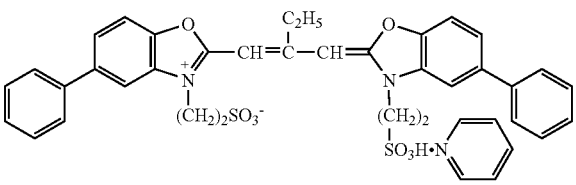

Emulsion G-32 was prepared in the same manner as in the preparation of Emulsion G-31, except that the temperature and the addition rate at the step of mixing silver nitrate and sodium chloride by simultaneous addition were changed. The thus-obtained emulsion grains were monodisperse cubic silver iodobromochloride grains having a side length of 0.44 μm and a variation coefficient of 9.3%.

Emulsion G-33 was prepared in the same manner as Emulsion G-31, except the exemplified Compound (SE2-12) was added as a selenium sensitizer in addition to the sulfur sensitizer in such a amount that the ratio of selenium to sulfur was 1:3 and the resulting emulsion was chemically sensitized at the optimum. The grains in Emulsion G-33 were monodisperse cubic silver iodobromochloride grains having an side length of 0.35 μm and a variation coefficient of 9.7%.

(Preparation of Red-sensitive Emulsions R-31 to R-33)

Using a method of simultaneously adding silver nitrate and sodium chloride mixed into stirring deionized distilled water containing deionized gelatin, high silver chloride cubic grains were prepared. In this preparation, at the step of from 40% to 80% addition of the entire silver nitrate amount, $K_2[RuCl_5(NO)]$ was added. At the step of from 93% to 98% addition of the entire silver nitrate amount, $K_4[Fe(CN)_6]$ was added. At the step of from 85% to 100% addition of the entire silver nitrate amount, potassium bromide (3.5 mol % per mol of the finished silver halide) was added. Further, $K_2[IrCl_5(5\text{-methylthiazole})]$ was added at the step of from 88% to 93% addition of the entire silver nitrate amount. Potassium iodide (0.10 mol % per mol of the finished silver halide) was added, with vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains having a side length of 0.40 μm and a variation coefficient of 9.5%. The resulting emulsion was subjected to a sedimentation desalting treatment and re-dispersing treatment in the same manner as described in the above.

The re-dispersed emulsion was dissolved at 40° C., and Sensitizing dye S-8, Compound-5, sodium benzenethiosulfate, p-glutaramidophenyidisulfide, sodium thiosulfate as a sulfur sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion R-31.

Emulsion R-32 was prepared in the same manner as in the preparation of Emulsion R-31, except that the temperature and the addition rate at the step of mixing silver nitrate and sodium chloride by simultaneous addition were changed. The thus-obtained emulsion grains were monodisperse cubic silver iodobromochloride grains having a side length of 0.50 μm and a variation coefficient of 9.0%.

Emulsion R-33 was prepared in the same manner as Emulsion R-31, except the exemplified Compound (SE2-12) was added as a selenium sensitizer in addition to the sulfur sensitizer in such a amount that the ratio of selenium to sulfur was 1:3 and the resulting emulsion was chemically sensitized at the optimum. The grains in Emulsion R-33 were monodisperse cubic silver iodobromochloride grains having an side length of 0.35 μm and a variation coefficient of 9.4%.

(Preparation of a Coating Solution for the First Layer)

Into 21 g of a solvent (Solv-1), and 80 ml of ethyl acetate were dissolved 57 g of a yellow coupler (Ex-Y), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of Emulsified dispersion 3A.

On the other hand, the above emulsified dispersion 3A and the prescribed emulsion B-31 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added (Ab-1), (Ab-2), (Ab-3), and (Ab4), so that the total amounts would be 14.0 mg/m$^2$, 62.0 mg/m$^2$, 5.0 mg/m$^2$, and 10.0 mg/m$^2$, respectively.

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of silver halide. Further, to the red-sensitive emulsion layer, was added a copolymer latex of methacrylic acid and butyl acrylate (1:1 in mass ratio;

average molecular weight, 200,000 to 400,000) in an amount of 0.05 g/m$^2$. Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

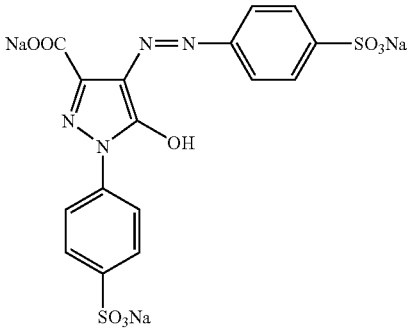

(1 mg/m′)

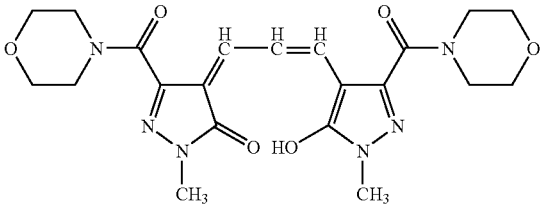

(6 mg/m′)

-continued

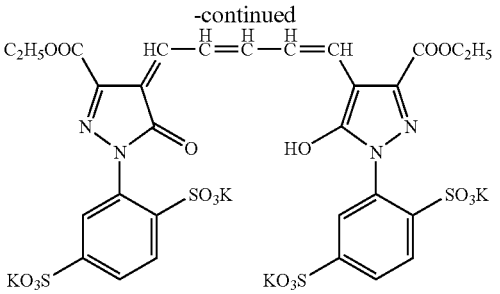

(8 mg/m′)

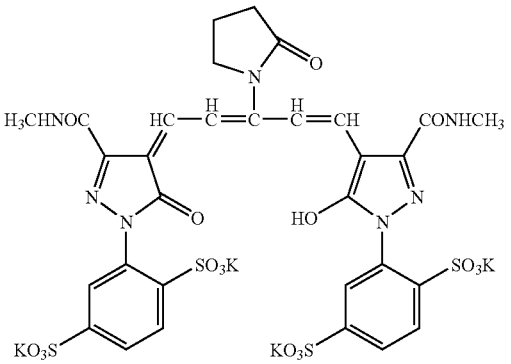

(16 mg/m′)

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 18 mass %; ZnO, content of 2 mass %), a fluorescent whitening agent (4,4'-bis(5-methylbenzoxazolyl)stilbene, content of 0.04 mass %) and a bluish dye (ultramarine, content of 0.28 mass %); and the amount of the polyethylene resin was 25.0 g/m$^2$.}

| First layer (Blue-sensitive emulsion layer) | |
|---|---|
| Emulsion B-31 | 0.24 |
| Gelatin | 1.25 |
| Yellow coupler (ExY) | 0.57 |
| Color-image stabilizer (Cpd- 1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent(Solv-1) | 0.21 |
| Second layer (Color-mixing-inhibiting layer) | |
| Gelatin | 0.99 |
| Color-mixing inhibitor (Cpd-l2) | 0.09 |
| Color-image stabilizer (Cpd-5) | 0.018 |
| Color-image stabilizer (Cpd-6) | 0.13 |
| Color-image stabilizer (Cpd-7) | 0.01 |
| Color-mixing inhibitor (Cpd-4) | 0.005 |
| Solvent (Solv-1) | 0.06 |
| Solvent (Solv-32) | 0.22 |

-continued

| | |
|---|---|
| Third layer (Green-sensitive emulsion layer) | |
| Emulsion G-31 | 0.14 |
| Gelatin | 1.36 |
| Magenta coupler (ExM) | 0.15 |
| Ultraviolet absorber (UV-1A) | 0.14 |
| Color-image stabilizer (Cpd-2) | 0.02 |
| Color-image stabilizer (Cpd-12) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd- 10) | 0.01 |
| Color-image stabilizer (Cpd-31) | 0.0001 |
| Solvent (Solv-3) | 0.11 |
| Solvent (Solv-4) | 0.22 |
| Solvent (Solv-5) | 0.20 |
| Fourth layer (Color-mixing-inhibiting layer) | |
| Gelatin | 0.71 |
| Color-mixing inhibitor (Cpd-12) | 0.06 |
| Color-image stabilizer (Cpd-5) | 0.013 |
| Color-image stabilizer (Cpd-6) | 0.10 |
| Color-image stabilizer (Cpd-7) | 0.007 |
| Color-mixing inhibitor (Cpd-4) | 0.003 |
| Solvent (Solv-1) | 0.04 |
| Solvent (Solv-32) | 0.16 |
| Fifth layer (Red-sensitive emulsion layer) | |
| Emulsion R-31 | 0.12 |
| Gelatin | 1.11 |
| Cyan coupler (ExC-32) | 0.13 |
| Cyan coupler (ExC-33) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-36) | 0.03 |
| Color-image stabilizer (Cpd-37) | 0.09 |
| Color-image stabilizer (Cpd-16) | 0.07 |
| Solvent (Solv-5) | 0.15 |
| Solvent (Solv-7) | 0.05 |
| Sixth layer (Ultraviolet absorbing layer) | |
| Gelatin | 0.46 |
| Ultraviolet absorber (UV-1B) | 0.45 |
| Compound (S1-4) | 0.0015 |
| Solvent (Solv-37) | 0.25 |
| Seventh layer (Protective layer) | |
| Gelatin | 1.00 |
| Acryl modified copolymer of polyvinyl alcohol (degree of modification: 17%) | 0.04 |
| Liquid paraffin | 0.02 |
| Surfactant (Cpd-33) | 0.01 |

(ExY) Yellow coupler A mixture in 70:30 (mol ratio) of

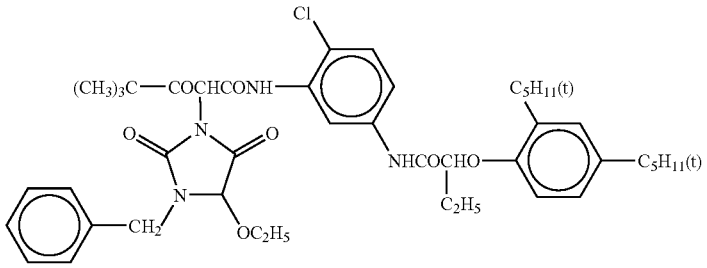

and

-continued
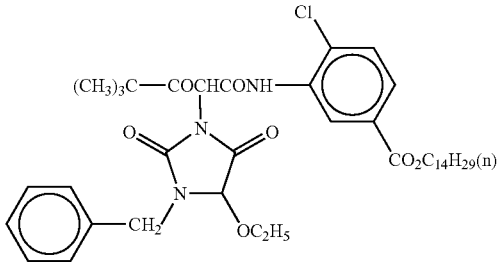
(ExM) Magenta coupler A mixture in 40:40:20 (mol ratio) of
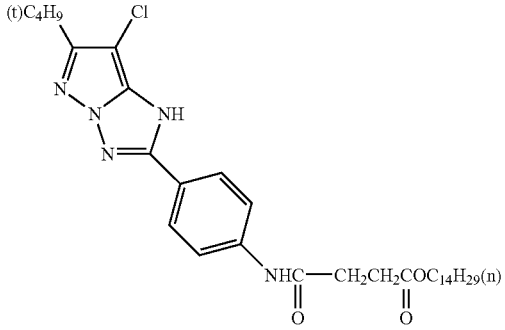
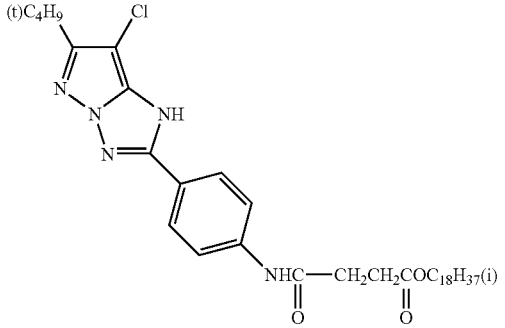
and
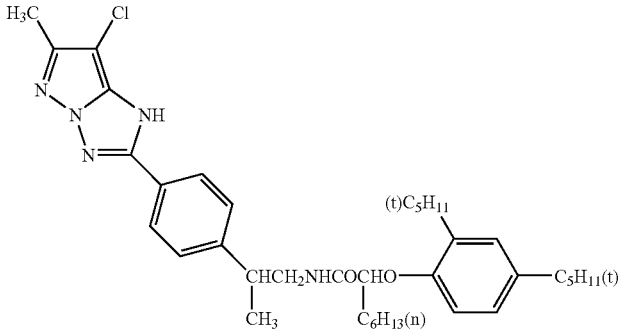

-continued
(ExC-32) Cyan coupler
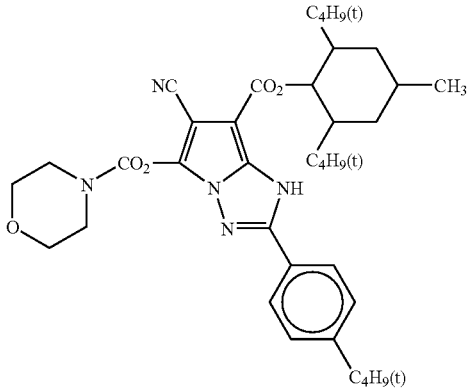
(ExC-33) Cyan coupler A mixture in 50:25:25 (mol ratio) of
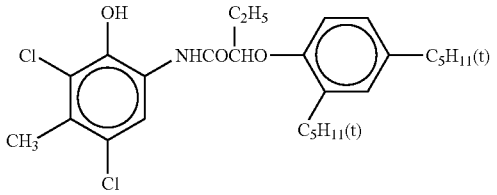
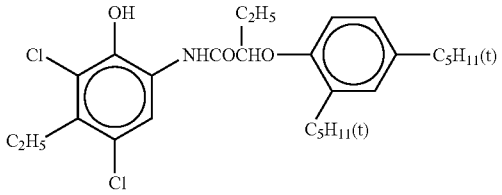
and
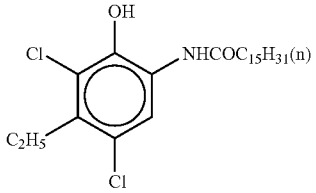
(Cpd-31)
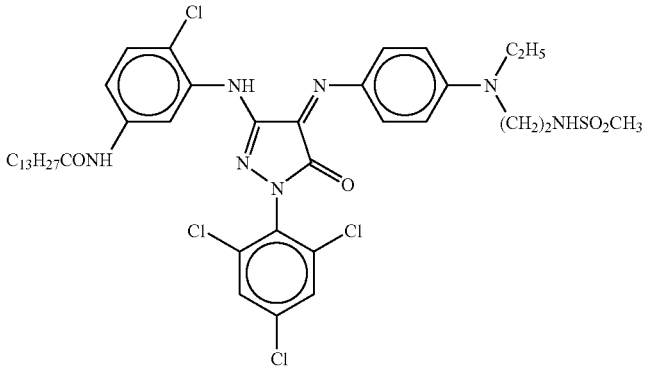
(Cpd-33) Surfactant A mixture in 7:3 (mol ratio) of
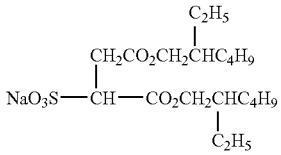
and
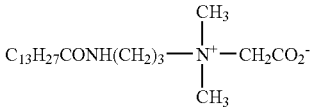

-continued (Cpd-36)

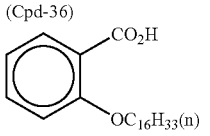

(Cpd-37)

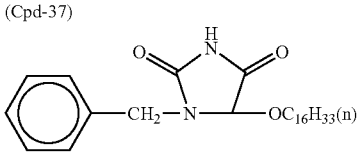

(UV-14) Ultraviolet absorber

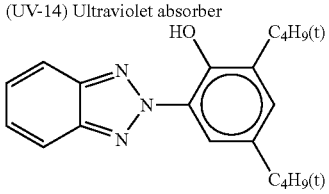

(UV-15) Ultraviolet absorber

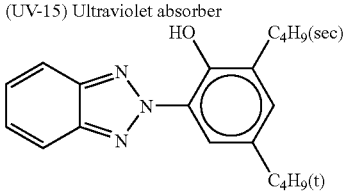

(UV-16) Ultraviolet absorber

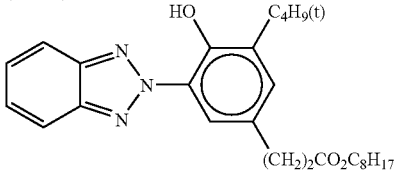

UV-1A: A mixture (Mass ratio) of UV-4/UV-1/UV-2/UV-14 = 4/2/2/3
UV-1B: A mixture (Mass ratio) of UV-4/UV-1/UV-2/UV-14/UV-15/UV-16 = 9/3/3/4/5/3
UV-1C: A mixture (Mass ratio) of UV-4/UV-14/UV-15 = 1/7/2
UV-1D: A mixture (Mass ratio) of UV-4/UV-1/UV-2/UV-14/UV-15 = 1/1/2/3/3

(Solv-32)

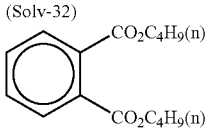

(Solv-37)

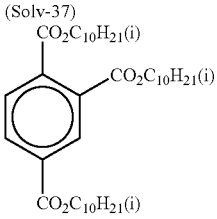

The photosensitive material produced in the manner as mentioned above was allowed to stand for 6 days in a dark place under the circumstances of 25° C. and 55% RH, and the resulting material was referred to as Sample 3-101.

Sample 3-102 was produced in the same manner as Sample 3-101, except that the number of days lapsed after production of the photosensitive material was changed to 21 from 6. Sample 3-103 and Sample 104 were produced in the same manner as Sample 3-102, except that Emulsions B-31, G-31 and R-31 incorporated in the first layer, the third layer and the fifth layer, respectively, were replaced with Emulsions B-32, G-32 and R-32, respectively, and further alterations were made to the amount of polyethylene laminated on the side of the support where no light-sensitive layers were coated. Sample 3-105 to Sample 3-108 were produced in the same manner as Sample 3-101 and Sample 3-102, except that the coating amounts of the first layer to the fifth layer were increased or decreased without changing the proportions of ingredients in each layer. Sample 3-109 and Sample 3-110 were produced in the same manner as Sample 3-101 and Sample 3-102, except that Emulsions B-31, G-31 and R-31 incorporated in the first layer, the third layer and the fifth layers, respectively, were replaced with Emulsions B-33, G-33 and R-33, respectively. Sample 3-111 to Sample 3-114 were produced in the same manner as Sample 3-109 and Sample 3-110, except that the coating amounts of the first layer to the fifth layer were increased or decreased without changing the proportions of ingredients in each layer. Sample 3-115 to Sample 3-119 were produced in the same manner as Sample 3-109 and Sample 3-110, except that alterations were made to the amount of polyethylene laminated on the side of the support where no light-sensitive layers were coated. Sample 3-120 and Sample 3-121 were produced in the same manner as Sample 3-110, except that the coating amounts of the first layer, the third layer, and the fifth layer were increased without changing the proportions of ingredients in each layer, and further alterations were made to the amount of polyethylene laminated on the side of the support where no light-sensitive layers were coated.

The curling degrees of these samples under circumstances of 25° C. and 20% RH were determined.

These samples were exposed to monochromatic light for $1\times10^{-4}$ second via a band-pass filter having a transmission wavelength peak at 470 nm (half width: 10 nm) and an optical wedge, and were performed the following processing.

[Processing 3A]

| Processing step | Temperature | Time |
|---|---|---|
| Color development | 38.5° C. | 45 sec |
| Bleach-fixing | 38.0° C. | 45 sec |
| Rinse (1) | 38.0° C. | 20 sec |

-continued

[Processing 3A]

| Processing step | Temperature | Time |
|---|---|---|
| Rinse (2) | 38.0° C. | 20 sec |
| Rinse (3) | 38.0° C. | 20 sec |
| Rinse (4) | 38.0° C. | 30 sec |

(The rinse was made in a four-tank counter-current system from (1) to (4).)

The compositions of each processing solution were as follows.

| | (Tank solution) |
|---|---|
| (Color developer) | |
| Water | 800 ml |
| Dimetylpolysiloxane-series Surfactant (Silicone KF351A, trade name: manufactured by Shinetsu Kagaku Kogyo Co.) | 0.1 g |
| Triisopropanolamine | 8.8 g |
| Ethylenediaminetetraacetic acid | 4.0 g |
| Polyethyleneglycol (molecular weight: 300) | 10.0 g |
| Sodium 4,5-dihydroxybenzene-1,3-disulfonate | 0.5 g |
| Potassium chloride | 10.0 g |
| Potassium bromide | 0.040 g |
| Triazinylaminostilbene-series Fluorescent whitening agent (Hacchol FWA-SF; trade name, manufactured by Showa Chemical Industry Co., Ltd.) | 2.5 g |
| Sodium sulfite | 0.1 g |
| Disodium-N,N-bis(sulfonatoethyl)-hydroxylamine | 8.5 g |
| N-ethyl-N-(-β-methanesulfonamidoethyl)-3-methyl-4-Aminoaniline•3/2 sulfate•monohydrate | 5.0 g |
| Potassium carbonate | 26.3 g |
| Water to make | 1000 ml |
| pH (25° C., adjusted using sulfuric acid and KOH) | 10.15 |
| (Bleach-fixing solution) | |
| Water | 700 ml |
| Ammonium iron (III) ethylenediaminetetraacetate | 47.0 g |
| Ethylenediaminetetraacetic acid | 1.4 g |
| m-Carboxybenzenesulfinic acid | 8.3 g |
| Nitric acid (67%) | 16.5 g |
| Imidazole | 14.6 g |
| Ammonium thiosulfate (750 g/l) | 107.0 ml |
| Ammonium sulfite | 16.0 g |

-continued

| | (Tank solution) |
|---|---|
| Ammonium bisulfite | 23.1 g |
| Water to make | 1000 ml |
| pH (25° C., adjusted using nitric acid and aqueous ammonia) | 6.0 |
| (Rinse solution) | |
| Sodium chlorinated-isocyanurate | 0.02 g |
| Deionized water (conductivity: 5 μS/cm or less) | 1000 ml |
| pH | 6.5 |

The thus processed samples were each examined for developed color densities by means of an HPD-type densitometer made by Fuji Photo Film Co., Ltd., and characteristic curves corresponding to color generation in their individual yellow-coupler-containing layers were plotted.

Further, characteristic curves corresponding to color generation in their individual magenta-coupler-containing layers and those corresponding to color generation in their individual cyan-coupler-containing layers were plotted in the same ways as described above, except that the transmission wavelength peak of the band-pass filter used at the time of exposure was changed from 470 nm to 550 nm and 700 nm, respectively. On these characteristic curves were read the maximum developed-yellow density (DYmax), the maximum developed-magenta density (DMmax) and the maximum developed-cyan density (DCmax).

In addition, characteristic curves corresponding to gray generation were plotted in the same way as the foregoing characteristic curves, except that simultaneous color generations of yellow-, magenta- and cyan-containing layers were performed by exposure via a filter for color correction of color prints (made by Fuji Photo Film Co., Ltd.) instead of the exposures via the band-pass filters. From these characteristic curves, the maximum developed-yellow density in gray generation (DGYmax), the maximum developed-magenta density in gray generation (DGMmax) and the maximum developed-cyan density in gray generation (DGCmax) were determined.

Layer structure, curling degrees and densities of those samples are shown in Table 11.

TABLE 11

| Sample No. | Layer structure | From preparation of sample to processing | Single layer generation DYmax | DMmax | DCmax | Gray generation DGYmax | DGMmax | DGCmax | Curl | Remarks |
|---|---|---|---|---|---|---|---|---|---|---|
| 3-101 | Sulfur-sensitized emulsion | 6 days | 2.02 | 2.11 | 2.08 | 2.18 | 2.48 | 2.23 | −22 | Comparative example |
| 3-102 | | 21 days | 2.01 | 2.10 | 2.07 | 2.15 | 2.46 | 2.20 | −18 | Comparative example |
| 3-103 | Sulfur-sensitized emulsion. | 21 days | 2.01 | 2.11 | 2.07 | 2.16 | 2.44 | 2.22 | −6 | Comparative example |
| 3-104 | Further enhancement of sensitivity by increasing emulsion grain sizes. Alteration to coating amount of laminated polyethylene. | 21 days | 2.01 | 2.11 | 2.07 | 2.16 | 2.44 | 2.22 | +5 | Comparative example |
| 3-105 | Sulfur-sensitized emulsion. 20% | 6 days | 2.24 | 2.24 | 2.33 | 2.38 | 2.66 | 2.41 | −25 | Comparative example |
| 3-106 | increase in coating amount of first, third and fifth layers each. | 21 days | 2.23 | 2.26 | 2.33 | 2.35 | 2.64 | 2.40 | −19 | Comparative example |
| 3-107 | Sulfur-sensitized emulsion. 30% | 6 days | 2.03 | 2.12 | 2.07 | 2.28 | 2.51 | 2.22 | −19 | Comparative example |
| 3-108 | decrease in coating amount of second and fourth layers each. | 21 days | 2.01 | 2.09 | 2.06 | 2.26 | 2.49 | 2.20 | −13 | Comparative example |
| 3-109 | Se-sensitized emulsion. | 6 days | 2.01 | 2.12 | 2.07 | 2.19 | 2.47 | 2.20 | −23 | Comparative example |
| 3-110 | | 21 days | 2.02 | 2.11 | 2.07 | 2.14 | 2.44 | 2.20 | −18 | Comparative example |
| 3-111 | Se-sensitized emulsion. 20% | 6 days | 2.25 | 2.26 | 2.36 | 2.37 | 2.66 | 2.40 | −24 | Comparative example |

TABLE 11-continued

| Sample No. | Layer structure | From preparation of sample to processing | Single layer generation DYmax | DMmax | DCmax | Gray generation DGYmax | DGMmax | DGCmax | Curl | Remarks |
|---|---|---|---|---|---|---|---|---|---|---|
| 3-112 | increase in coating amount of first, third and fifth layers each. | 21 days | 2.24 | 2.25 | 2.35 | 2.33 | 2.65 | 2.39 | −20 | Comparative example |
| 3-113 | Se-sensitized emulsion. 30% | 6 days | 2.03 | 2.13 | 2.05 | 2.28 | 2.50 | 2.21 | −18 | Comparative example |
| 3-114 | decrease in coating amount of second and fourth layers each. | 21 days | 2.01 | 2.11 | 2.06 | 2.27 | 2.49 | 2.20 | −14 | This invention |
| 3-115 | Se-sensitized emulsion. | 6 days | 2.01 | 2.13 | 2.08 | 2.20 | 2.49 | 2.22 | −15 | This invention |
| 3-116 | Alteration to coating amount | 21 days | 2.00 | 2.13 | 2.06 | 2.19 | 2.47 | 2.22 | −9 | This invention |
| 3-117 | of laminated polyethylene. | 21 days | 2.03 | 2.11 | 2.07 | 2.19 | 2.47 | 2.19 | +8 | This invention |
| 3-118 | | 21 days | 2.02 | 2.12 | 2.07 | 2.20 | 2.47 | 2.22 | +14 | This invention |
| 3-119 | | 21 days | 2.02 | 2.14 | 2.06 | 2.19 | 2.48 | 2.23 | +22 | Comparative example |
| 3-120 | Se-sensitized emulsion. 20% increase in coating amount of first, third and fifth layers each. Alteration to coating amount of laminated polyethylene. | 21 days | 2.26 | 2.26 | 2.38 | 2.38 | 2.68 | 2.42 | −5 | This invention |
| 3-120 | Se-sensitized emulsion. 20% increase in coating amount of first, third and fifth layers each. Alteration to coating amount of laminated polyethylene. | 21 days | 2.26 | 2.26 | 2.38 | 2.38 | 2.68 | 2.42 | −5 | This invention |

Each of the samples was subjected to separate grayscale exposures to blue light, green light and red light by using the following digital exposure system. After a 5-second lapse from the completion of exposure, the exposed samples were each subjected to rapid processing according to the Processing 3B described below.

[Digital Exposure System]

As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MC, manufactured by Hitachi, Ltd.) having a wavelength of about 650 nm, were used. Each of these three color laser lights was moved in a direction perpendicular to the scanning direction, while an exposure amount of each laser was controlled via external modulation device, by a polygon mirror so that it could be scanned to expose successively on a sample. Each of the semiconductor lasers is maintained at a constant temperature by means of a Peltier devise, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds.

Processing 3B

The Sample 3-101 was made into a roll with a width of 127 mm; the resultant sample was exposed to light with a standard photographic image, using the above digital exposure apparatus; and then, the exposed sample was continuously processed (running test) in the following processing steps, until an accumulated replenisher amount of the color developing solution reached to be equal to twice the color developer tank volume. A processing with this running processing solutions was named processing 3B.

| Processing step | Temperature | Time | Replenisher amount* |
|---|---|---|---|
| Color development | 45.0° C. | 25 sec | 35 mL |
| Bleach-fixing | 40.0° C. | 25 sec | 30 mL |
| Rinse 1 | 45.0° C. | 4 sec | — |
| Rinse 2 | 45.0° C. | 4 sec | — |
| Rinse 3 | 45.0° C. | 3 sec | — |
| Rinse 4 | 45.0° C. | 5 sec | 121 mL |
| Drying | 80° C. | 15 sec | |

(Note)
*Replenisher amount per $m^2$ of the light-sensitive material to be processed.
**A rinse cleaning system RC50D, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).

The composition of each processing solution was as follows.

| | (Tank solution) | (Replenisher) |
|---|---|---|
| (Color developer) | | |
| Water | 800 mL | 800 mL |
| Fluorescent whitening agent (FL-3) | 4.0 g | 8.0 g |

-continued

| | (Tank solution) | (Replenisher) |
|---|---|---|
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediaminetetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethy1-N-(β-methanesulfonamidoethyl) aniline•3/2 sulfate•monohydrate | 7.0 g | 19.0 g |
| Potassium carbonate | 26.3 g | 26.3 g |
| Water to make | 1000 mL | 1000 mL |
| pH (25° C./adjusted using sulfuric acid and KOH) | 10.25 | 12.6 |
| (Bleach-fixing solution) | | |
| Water | 800 mL | 800 mL |
| Ammonium thiosulfate (750 g/l) | 107 mL | 214 mL |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (25° C./adjusted using nitric acid and aqua ammonia) | 6.00 | 6.00 |
| (Rinse solution) | | |
| Sodium chlorinated-isocyanurate | 0.02 g | 0.02 g |
| Deionized water (conductivity: 5 μS/cm or less) | 1000 mL | 1000 mL |
| pH (25° C.) | 6.5 | 6.5 |

Developed yellow, magenta and cyan densities of each of the samples after undergoing the processing were measured, and characteristic curves were plotted. From each of the samples processed after exposure to blue light, the characteristic curve corresponding to color generation in its yellow-coupler-containing layer was determined. From each of the samples processed after exposure to green light, the characteristic curve corresponding to color generation in its magenta-coupler-containing layer was determined. From each of the samples processed after exposure to red light, the characteristic curve corresponding to color generation in its cyan-coupler-containing layer was determined. The sensitivity was defined as the reciprocal of an exposure amount providing a developed color density 0.3 higher than the unexposed-area density, and shown in relative sensitivity with Sample 3-101 being taken as 100. Accordingly, the greater this value the higher the sensitivity. From the characteristic curve corresponding to color generation in each yellow-coupler-containing layer, the magenta density at a yellow density of 1.7 (M in Y), the yellow density and the cyan density at a magenta density of 1.7 (Y in M and C in M) and the magenta density at a cyan density of 1.7 (M in C) were determined, and expression in variations from their corresponding values of Sample 3-101. These values were adopted as indexes of dullness of colors. The smaller these values, the less in dullness and the more desirable the developed colors.

Further, the amount of exposure providing a developed color density of 1.7 (E0.7) was determined from the characteristic curve corresponding to color generation in each of the coupler-containing layers. Each sample was exposed uniformly to blue light, green light and red light at the same time in that exposure amount (E0.7). After a lapse of 5 seconds from the exposure, rapid processing was performed in accordance with Processing 3B. After the processing, density measurements of each sample were made, and the developed yellow density in the gray image (DGY), the developed magenta density in the gray image (DGM) and the developed cyan density in the gray image (DGC) of each sample were determined. The greater these values the higher the gray density.

Furthermore, uniform exposure was applied to each sample by use of lasers of intensities adjusted so that the developed yellow, magenta and cyan densities each reached 0.3. After a lapse of 5 seconds from the exposure, the foregoing Processing 3B was performed to provide a uniform gray image. Ten 2L-size prints with such gray images were prepared for each sample, and streaky unevenness having developed therein was evaluated by visual observations in accordance with the following criteria:

[Criteria for Evaluation of Streaky Unevenness]

◎: No streak is seen at all.

○: Few streaks develop.

Δ: A few streaks develop, but they are on an acceptable level.

×: Quite a few streaks develop, and they are on an unacceptable level.

××: A great many streaks develop, and they are on a level very far from acceptance.

The results obtained are shown in Table 12.

TABLE 12

| Sample No. | Sensitivity: Yellow-color-forming layer | Sensitivity: Magenta-color-forming layer | Sensitivity: Cyan-color-forming layer | Evaluation of dullness of colors: M in Y | Evaluation of dullness of colors: Y in M | Evaluation of dullness of colors: C in M | Evaluation of dullness of colors: M in C | Gray generation density: DGY | Gray generation density: DGM | Gray generation density: DGC | Streaky in prints | Remarks |
|---|---|---|---|---|---|---|---|---|---|---|---|---|
| 3-101 | 100 | 100 | 100 | 0 | 0 | 0 | 0 | 1.79 | 2.01 | 1.85 | Δ | Comparative example |
| 3-102 | 99 | 100 | 101 | −0.01 | −0.01 | −0.01 | 0 | 1.55 | 1.65 | 1.65 | Δ | Comparative example |
| 3-103 | 179 | 155 | 161 | 0.12 | 0.05 | 0.08 | 0.02 | 1.48 | 1.95 | 1.75 | X | Comparative example |
| 3-104 | 178 | 155 | 160 | 0.10 | 0.03 | 0.07 | 0.02 | 1.46 | 1.93 | 1.76 | X | Comparative example |
| 3-105 | 104 | 103 | 103 | 0.05 | 0.03 | 0.04 | 0.02 | 1.66 | 2.03 | 1.95 | Δ | Comparative example |
| 3-106 | 102 | 102 | 102 | 0.04 | 0.02 | 0.03 | 0.01 | 1.54 | 1.98 | 1.93 | Δ | Comparative example |
| 3-107 | 101 | 101 | 100 | 0.11 | 0.07 | 0.10 | 0.05 | 1.79 | 2.00 | 1.83 | X | Comparative example |
| 3-108 | 100 | 100 | 101 | 0.08 | 0.06 | 0.09 | 0.03 | 1.73 | 1.98 | 1.83 | X | Comparative example |
| 3-109 | 180 | 155 | 161 | −0.01 | −0.02 | −0.01 | −0.01 | 1.87 | 2.06 | 1.88 | X | Comparative example |
| 3-110 | 180 | 156 | 161 | −0.04 | −0.02 | −0.03 | −0.02 | 1.85 | 2.01 | 1.86 | X | Comparative example |
| 3-111 | 183 | 157 | 165 | 0 | 0 | 0 | 0 | 1.9 | 2.04 | 1.96 | XX | Comparative example |
| 3-112 | 182 | 157 | 164 | −0.01 | −0.01 | −0.01 | 0 | 1.88 | 2.01 | 1.93 | XX | Comparative example |
| 3-113 | 179 | 154 | 160 | 0.01 | 0 | 0.01 | 0 | 1.91 | 2.02 | 1.95 | X | Comparative example |
| 3-114 | 179 | 155 | 161 | −0.01 | −0.02 | −0.01 | 0 | 1.89 | 2.01 | 1.94 | Δ | This invention |
| 3-115 | 181 | 156 | 162 | 0 | −0.01 | −0.01 | −0.01 | 1.87 | 2.05 | 1.89 | Δ | This invention |
| 3-116 | 180 | 156 | 161 | −0.03 | −0.02 | −0.03 | −0.03 | 1.86 | 2.03 | 1.86 | ○ | This invention |
| 3-117 | 180 | 155 | 162 | −0.04 | −0.03 | −0.03 | −0.04 | 1.86 | 2.03 | 1.86 | ○ | This invention |
| 3-118 | 180 | 154 | 162 | −0.04 | −0.03 | −0.03 | −0.04 | 1.86 | 2.03 | 1.86 | Δ | This invention |
| 3-119 | 181 | 156 | 161 | −0.04 | −0.03 | −0.03 | −0.04 | 1.86 | 2.03 | 1.86 | XX | Comparative example |
| 3-120 | 185 | 157 | 164 | 0 | 0 | 0 | −0.01 | 1.89 | 2.00 | 1.92 | ○ | This invention |
| 3-121 | 187 | 160 | 167 | 0.033 | 0.008 | 0.035 | 0.019 | 1.71 | 1.90 | 1.85 | X | Comparative example |

The following can be seen from Table 11 and Table 12.

Table 11 indicates that, as far as samples had the same layer structure, whether the emulsions used therein were sulfur-sensitized emulsions or selenium-sensitized emulsions, they had little difference in the maximum density of gray color developed by Processing 3A after high-illumination exposure. On the other hand, from Table 12 showing the results of utilizing the combination of scanning exposure and rapid processing, it is clearly seen that the samples using selenium-sensitized emulsions were high in sensitivity, reduced in dullness of developed colors and high in gray densities, especially DGY, compared with the samples which were identical in layer structure and time lapsed from the sample preparation to the processing but contained no selenium-sensitized emulsions. Further, it can be noticed that the sensitivity can be enhanced by increasing the sizes of sulfur-sensitized emulsion grains, but thereby dullness of developed colors was increased and reduction in gray densities were caused. In addition, it is also apparent that, in the case of samples not containing any selenium-sensitized emulsions, changes in dullness of developed colors and gray densities can be achieved by making alterations to the coating amounts of constituent layers, but even the samples thus altered were inferior in gray densities, especially DGY, to the samples containing selenium-sensitized emulsions.

The gray density superiority of samples containing selenium-sensitized emulsions over those containing sulfur-sensitized emulsions was a phenomenon occurring only in the cases shown in Table 12 where scanning exposure and rapid processing were combined, and it was an unexpected and surprising effect.

In the case of the samples containing selenium-sensitized emulsions, it can be seen that, though streaky unevenness developed and raised a problem as a matter of practicality, improvements therein were achieved by adjusting their curling degrees to the range specified by the present invention. The improvement in streaky unevenness by the curing degree adjustment was a phenomenon observed only in the case of samples containing selenium-sensitized emulsions, and it was also an unexpected and surprising effect. Further, it has been found that, although the curling degrees of the samples containing selenium-sensitized emulsions varied with the time lapsed from the sample preparation to the processing, the curling degree adjustment to the range specified by the present invention enabled reduction of the streaky unevenness even in the case where the time lapsed from the sample preparation to the processing was shortened. This curling degree adjustment has proved advantageous from the viewpoint of deliverability to the photosensitive-material market, too. Additionally, it is clear that the effect of improving streaky unevenness by the curling degree adjustment is produced so long as the values of DYmax, DMmax, DCmax, DGYmax, DGMmax and DGCmax are within the ranges specified individually in the present invention.

From the results mentioned above, the advantages of the present invention are apparent.

Example 3-2

(Preparation of Blue-sensitive Emulsions B-34 and B-35)

Emulsions B-34 and B-35 ware prepared in the same manner as in the preparation of Emulsion B-31, except that the temperature and the addition rate at the step of mixing silver nitrate and sodium chloride by simultaneous addition were changed, and the combination of sensitizing dyes S-10 and S-12 were used in place of the sensitizing dye S-2. The thus-obtained emulsion B-34 grains were monodisperse cubic silver iodobromochloride grains having a side length of 0.42 μm and a variation coefficient of 9.1%, and the emulsion B-35 grains were monodisperse cubic silver iodobromochloride grains having a side length of 0.35 μm and a variation coefficient of 9.8%.

Sensitizing dye S-19

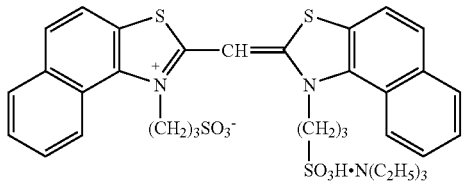

(Preparation of Green-sensitive Layer Emulsions G-34 and G-35)

Emulsions G-34 and G-35 ware prepared in the same manner as in the preparation of Emulsion G-31, except that the temperature and the addition rate at the step of mixing silver nitrate and sodium chloride by simultaneous addition were changed, and the sensitizing dye S-4 was added in addition to the sensitizing dyes S-14, S-5, S-6, and S-7. The thus-obtained emulsion G-34 grains were monodisperse cubic silver iodobromochloride grains having a side length of 0.33 μm and a variation coefficient of 9.5%, and the emulsion G-35 grains were monodisperse cubic silver iodobromochloride grains having a side length of 0.27 μm and a variation coefficient of 9.8%.

(Preparation of Red-sensitive Layer Emulsions R-34 and R-35)

Using a method of simultaneously adding silver nitrate and sodium chloride mixed into stirring deionized distilled water containing deionized gelatin, high silver chloride cubic grains were prepared. In this preparation, at the step of from 40% to 80% addition of the entire silver nitrate amount, $Cs_2[OsCl_5(NO)]$ was added. At the step of from 93% to 98% addition of the entire silver nitrate amount, $K_4[Ru(CN)_6]$ was added. At the step of from 85% to 100% addition of the entire silver nitrate amount, potassium bromide (3.5 mol % per mol of the finished silver halide) was added. Further, $K_2[IrCl_5$(5-methylthiazole)] was added at the step of from 88% to 93% addition of the entire silver nitrate amount. Potassium iodide (0.20 mol % per mol of the finished silver halide) was added, with vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains having a side length of 0.38 μm and a variation coefficient of 9.5%. The resulting emulsion was subjected to a sedimentation desalting treatment and re-dispersing treatment in the same manner as described in the above.

The re-dispersed emulsion was dissolved at 40° C., and Sensitizing dye S-11, Sensitizing dye S-12, Compound-6, sodium benzenethiosulfate, p-glutaramidophenyldisulfide, sodium thiosulfate as a sulfur sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-phenyl-5-mercaptotetrazole, 1-(4-ethoxyphenyl)-5-mercaptotetrazole, Compound-4, and potassium bromide were added. The thus-obtained emulsion was referred to as Emulsion R-34.

Emulsion R-35 was prepared in the same manner as in the preparation of Emulsion R-34, except that the temperature and the addition rate at the step of mixing silver nitrate and sodium chloride by simultaneous addition were changed. The thus-obtained emulsion R-35 grains were monodisperse cubic silver iodobromochloride grains having a side length of 0.29 μm and a variation coefficient of 9.8%.

Sensitizing dye S-11

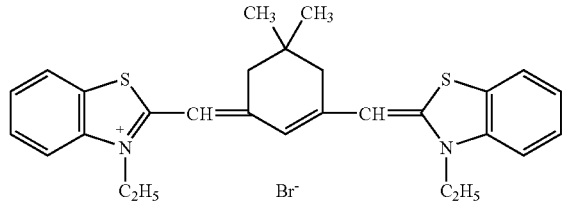

Sensitizing dye S-12

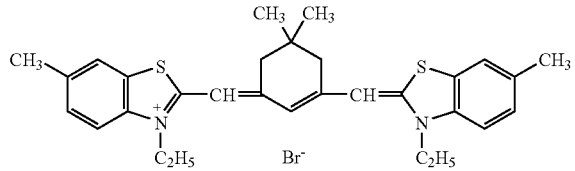

Compound-6

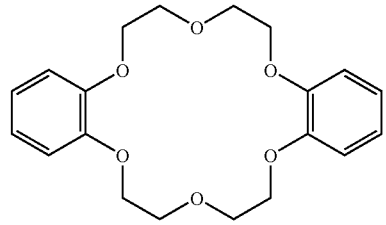

The coating solutions for the first layer to the seventh layer were prepared in the similar manner as that for Example 3-1 coating solution. As a gelatin hardener for each layer, 1-oxy-3,5-dichloro-s-triazine sodium salt (H-1), (H-2), and (H-3) were used. Further, to each layer, were added (Ab-1), (Ab-2), (Ab-3), and (Ab-4), so that the total amounts would be 10.0 mg/m$^2$, 60.0 mg/m$^2$, 10.0 mg/m$^2$, and 8.0 mg/m$^2$, respectively.

Further, to the second layer, the fourth layer, and the sixth layer, was added 1-(3-methylureidophenyl)-5-mercaptotetrazole in amounts of 0.3 mg/m$^2$, 0.2 mg/m$^2$, and 0.7 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $1\times10^{-4}$ mol, respectively, per mol of silver halide. Further, to the red-sensitive emulsion layer, was added a copolymer latex of methacrylic acid and butyl acrylate (1:1 in mass ratio; average molecular weight, 200,000 to 400,000) in an amount of 0.03 g/m$^2$. Disodium salt of catecol-3,5-disulfonic acid was added to the second layer, the fourth layer and the sixth layer so that coating amounts would be 4 mg/m$^2$, 8 mg/m$^2$ and 12 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added in the same manner as in Example 3-1.

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 20 mass %; ZnO, content of 1 mass %), a fluorescent whitening agent (4,4'-bis(5-methylbenzoxazolyl)stilbene, content of 0.03 mass %) and a bluish dye (ultramarine, content of 0.28 mass %); and the amount of the polyethylene resin was 28.0 g/m$^2$.}

| | |
|---|---|
| First layer (Blue-sensitive emulsion layer) | |
| Emulsion (a 5:5 mixture of B-34 and B-35 (mol ratio of silver)) | 0.16 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-16) | 0.01 |
| Color-image stabilizer (Cpd-18) | 0.15 |
| Color-image stabilizer (Cpd-19) | 0.01 |
| Color-image stabilizer (Cpd-21) | 0.15 |
| Color-image stabilizer (Cpd-17) | 0.02 |
| Additive (ExC-31) | 0.001 |
| Color-image stabilizer (UV-1C) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.78 |
| Color-mixing inhibitor (Cpd-12) | 0.05 |
| Color-mixing inhibitor (Cpd-12) | 0.01 |
| Color-image stabilizer (Cpd-5) | 0.006 |
| Color-image stabilizer (Cpd-6) | 0.05 |
| Color-image stabilizer (UV-1C) | 0.06 |
| Color-image stabilizer (Cpd-7) | 0.006 |
| Antiseptic (Ab-2) | 0.006 |
| Solvent (Solv-1) | 0.06 |
| Solvent (Solv-5) | 0.07 |
| Solvent (Solv-2) | 0.06 |
| Solvent (Solv-8) | 0.07 |
| Third layer (Green-sensitive emulsion layer) | |
| Emulsion (a 3:7 mixture of G-34 and G-35 (mol ratio of silver)) | 0.12 |
| Gelatin | 0.95 |
| Magenta coupler (ExM) | 0.12 |
| Ultraviolet absorber (UV-1C) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-31) | 0.000 |
| Color-image stabilizer (Cpd-18) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (Color-mixing-inhibiting layer) | |
| Gelatin | 0.65 |
| Color-mixing inhibitor (Cpd-12) | 0.04 |
| Color-mixing inhibitor (Cpd-12) | 0.01 |
| Color-image stabilizer (Cpd-5) | 0.005 |
| Color-image stabilizer (Cpd-6) | 0.04 |
| Color-image stabilizer (UV-1C) | 0.05 |
| Color-image stabilizer (Cpd-7) | 0.005 |
| Antiseptic (Ab-2) | 0.005 |
| Solvent (Solv-1) | 0.05 |
| Solvent (Solv-5) | 0.06 |
| Solvent (Solv-2) | 0.05 |
| Solvent (Solv-8) | 0.06 |
| Fifth layer (Red-sensitive emulsion layer) | |
| Emulsion (a 7:3 mixture of R-34 and R-35 (mol ratio of silver)) | 0.10 |
| Gelatin | 1.11 |
| Cyan coupler (ExC-34) | 0.16 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |

-continued

| | |
|---|---|
| Color-image stabilizer (Cpd-14) | 0.001 |
| Color-image stabilizer (Cpd-15) | 0.18 |
| Color-image stabilizer (Cpd-36) | 0.002 |
| Color-image stabilizer (Cpd-37) | 0.001 |
| Color-image stabilizer (Cpd-16) | 0.05 |
| Color-image stabilizer (Cpd-4) | 0.04 |
| Color-image stabilizer (UV-15) | 0.10 |
| Solvent (So1v-5) | 0.19 |
| Sixth layer (Ultraviolet absorbing layer) | |
| Gelatin | 0.34 |
| Ultraviolet absorber (UV-1D) | 0.24 |
| Compound (S1-4) | 0.0015 |
| Solvent (Solv-7) | 0.11 |
| Seventh layer (Protective layer) | |
| Gelatin | 0.82 |
| Additive (Cpd-20) | 0.03 |
| Liquid paraffin | 0.02 |
| Surfactant (Cpd-13) | 0.02 |

(ExC-31)

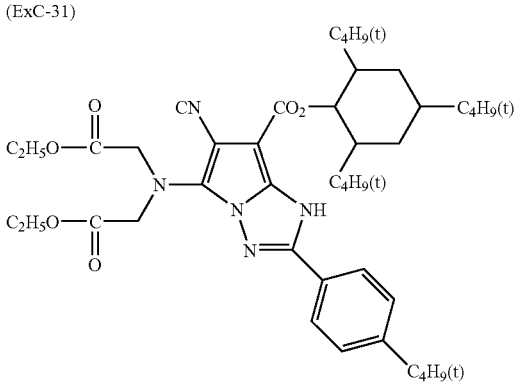

(ExC-34) Cyan coupler A mixture in 62.5:12.5:25 (Mass) of

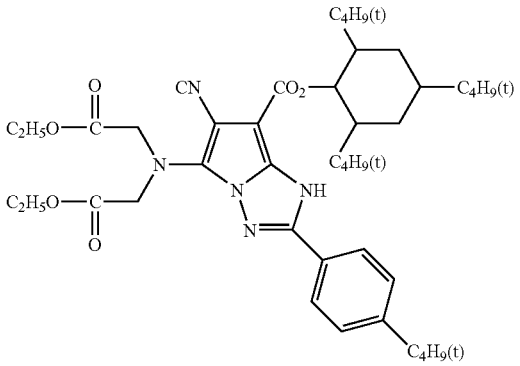

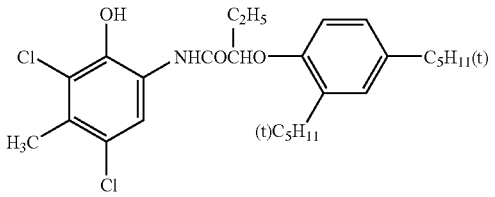

and

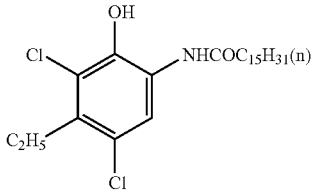

A photosensitive material was produced in the manner as described above, and allowed to stand for 14 days in a dark place under the circumstances of 25° C. and 55% RH. The resulting material was referred to as Sample 3-201. Other samples referred to as Sample 3-202 to Sample 3-205 were produced in the same manner as Sample 3-201, except that the sulfur sensitizers used at the time of preparation of Emulsions B-34 and B-35 for the first layer, Emulsions G-34 and G-35 for the third layer and Emulsions R-34 and R-35 for the fifth layer were replaced with the selenium sensitizers as shown in Table 13. In addition, Sample 3-206 to Sample 3-210 were produced in the same manners as Sample 3-201 to Sample 3-205, respectively, except that the alterations were made to the coating amount of polyethylene laminated on the side of the support where no light-sensitive layers were coated.

Sample 3-201 to Sample 3-210 were each subjected to the same exposure and processing as in Example 3-1. Herein, however, [Processing 3B] used in Example 3-1 was replaced by [Processing 3C] which was the same as [Processing 3B] except for a change made to the processing time. The thus processed samples were each evaluated in the same way as in Example 3-1, except that the values of sensitivity and dullness in developed colors were expressed as relative values based on Sample 3-201.

The results obtained are summarized in Table 13 and Table 14.

Processing 3C

The Sample 3-101 was made into a roll with a width of 127 mm; the resultant sample was exposed to light with a standard photographic image, using the above digital exposure apparatus; and then, the exposed sample was continuously processed (running test) in the following processing steps, until an accumulated replenisher amount of the color developing solution reached to be equal to twice the color developer tank volume. A processing with this running processing solutions was named processing 3C.

| Processing step | Temperature | Time | Replenisher amount* |
|---|---|---|---|
| Color development | 45.0° C. | 15 sec | 35 mL |
| Bleach-fixing | 40.0° C. | 15 sec | 30 mL |
| Rinse 1 | 45.0° C. | 3 sec | — |
| Rinse 2 | 45.0° C. | 3 sec | — |
| Rinse 3 | 45.0° C. | 3 sec | — |
| Rinse 4 | 45.0° C. | 4 sec | 121 mL |
| Drying | 80° C. | 12 sec | |

*In order to make the processing time shorter than in [Processing 3B], rack modifications and a change to the transport speed of photosensitive materials were made.

TABLE 13

| Sample | | Single layer generation | | | Gray generation | | | | |
|---|---|---|---|---|---|---|---|---|---|
| No. | Emulsion | DYmax | DMmax | DCmax | DGYmax | DGMmax | DGCmax | Curl | Remarks |
| 3-201 | Sulfur-sensitized emulsion | 2.02 | 2.11 | 2.08 | 2.18 | 2.48 | 2.23 | −17 | Comparative example |
| 3-202 | Selenium Sensitizer SE2-12 | 2.01 | 2.1 | 2.07 | 2.15 | 2.46 | 2.2 | −18 | Comparative example |
| 3-203 | Selenium Sensitizer SE3-9 | 2.24 | 2.24 | 2.33 | 2.38 | 2.66 | 2.41 | −17 | Comparative example |
| 3-204 | Selenium Sensitizer SE3-29 | 2.23 | 2.26 | 2.33 | 2.35 | 2.64 | 2.4 | −17 | Comparative example |
| 3-205 | Selenium Sensitizer PF1-1 | 2.03 | 2.12 | 2.07 | 2.28 | 2.51 | 2.22 | −18 | Comparative example |
| 3-206 | Sulfur-sensitized emulsion | 2.02 | 2.11 | 2.08 | 2.18 | 2.48 | 2.23 | −4 | Comparative example |
| 3-207 | Selenium Sensitizer SE2-12 | 2.01 | 2.1 | 2.07 | 2.15 | 2.46 | 2.2 | −5 | This invention |
| 3-208 | Selenium Sensitizer SE3-9 | 2.24 | 2.24 | 2.33 | 2.38 | 2.66 | 2.41 | −4 | This invention |
| 3-209 | Selenium Sensitizer SE3-29 | 2.23 | 2.26 | 2.33 | 2.35 | 2.64 | 2.4 | −4 | This invention |
| 3-210 | Selenium Sensitizer PF1-1 | 2.03 | 2.12 | 2.07 | 2.28 | 2.51 | 2.22 | −5 | This invention |

*Sample 3-206 to Sample 3-210 differ respectively from Sample 3-201 to Sample 3-205 in the coating amount of polyethylene laminated on the side of the support where no light-sensitive layers were coated.

TABLE 14

| Sample | Sensitivity | | | Evaluation of dullness of colors | | | | gray generation density | | | streaky | |
|---|---|---|---|---|---|---|---|---|---|---|---|---|
| No. | yellow-color-forming layer | magenta-color-forming layer | cyan-color-forming layer | M in Y | Y in M | C in M | M in C | DGY | DGM | DGC | in prints | Remarks |
| 3-201 | 100 | 100 | 100 | 0 | 0 | 0 | 0 | 1.33 | 1.58 | 1.61 | Δ | Comparative example |
| 3-202 | 178 | 170 | 161 | −0.02 | −0.01 | −0.01 | −0.02 | 1.72 | 1.99 | 1.98 | X | Comparative example |
| 3-203 | 185 | 177 | 170 | −0.04 | −0.02 | −0.03 | −0.02 | 1.86 | 2.04 | 2.01 | X | Comparative example |
| 3-204 | 199 | 195 | 201 | −0.07 | −0.04 | −0.04 | −0.04 | 1.86 | 2.08 | 2.01 | X | Comparative example |
| 3-205 | 210 | 210 | 215 | −0.07 | −0.03 | −0.05 | −0.04 | 1.89 | 2.06 | 2.03 | XX | Comparative example |
| 3-206 | 99 | 100 | 99 | 0 | 0.01 | 0 | 0 | 1.33 | 1.58 | 1.61 | Δ | Comparative example |
| 3-207 | 175 | 172 | 161 | −0.01 | −0.01 | −0.01 | −0.02 | 1.72 | 1.99 | 1.98 | Δ | This invention |
| 3-208 | 186 | 177 | 171 | −0.03 | −0.02 | −0.02 | −0.02 | 1.86 | 2.04 | 2.01 | ○ | This invention |
| 3-209 | 199 | 195 | 202 | −0.06 | −0.04 | −0.04 | −0.04 | 1.86 | 2.08 | 2.01 | ◎ | This invention |
| 3-210 | 210 | 211 | 214 | −0.07 | −0.04 | −0.05 | −0.04 | 1.89 | 2.06 | 2.03 | ◎ | This invention |

From Table 13 and Table 14, it is apparent that the effects of the present invention were also achieved in Example 3-2 where alterations were made to the structure of each photosensitive material in Example 3-1 and the processing more rapid than in Example 3-1 was performed.

Example 4-1

(Preparation of Blue-sensitive Layer (Yellow-color-forming Layer) Emulsion BmH-1)

Using a method of simultaneously adding silver nitrate and sodium chloride mixed into stirring deionized distilled water containing deionized gelatin, high silver chloride cubic grains were prepared. In this preparation, at the step of from 10% to 20% addition of the entire silver nitrate amount, $Cs_2[OsCl_5(NO)]$ was added. At the step of from 70% to 85% addition of the entire silver nitrate amount, potassium bromide (3.0 mol % per mol of the finished silver halide) and $K_4[Fe(CN)_6]$ were added. $K_2[IrCl_6]$ was added at the step of from 75% to 80% addition of the entire silver nitrate amount. Further, $K_2[IrCl_5(H_2O)]$ and $K[IrCl_4(H_2O)_2]$ were added at the step of from 88% to 98% addition of the entire silver nitrate amount. Potassium iodide (0.3 mol % per mol of the finished silver halide) was added, with vigorous stirring, at the step of completion of 93% addition of the entire silver nitrate amount. The thus-obtained emulsion grains were monodisperse cubic silver iodobromochloride grains having a side length of 0.64 μm (corresponded to an average sphere-equivalent grain diameter of 0.80 μm) and a variation coefficient of 9.5%. After being subjected to a sedimentation desalting treatment, the following were added to the resulting emulsion: gelatin, Compounds Ab-1, Ab-2, and Ab-3, and calcium nitrate, and the emulsion was re-dispersed.

To the emulsion dispersed again, separate solutions containing Sensitizing Dyes S-1, S-2 and S-10, respectively, were added simultaneously without interval while agitating under such a condition as to attain the Reynolds number of 6,000, thereby performing spectral sensitization. Thereafter, the emulsion was admixed with sodium benzenethiosulfonate and p-glutaramidophenyldisulfide, and ripened for 15 minutes. Further thereto, triethylthiourea and sodium thiosulfate were added as sulfur sensitizers, and bis(1,4,5-trimethyl-1,2,4-triazolium-3-thiorato)aurate(I) tetrafluoroborate was added as a gold sensitizer. Then, the resulting emulsion was raised in temperature and ripened so as to undergo an optimum chemical sensitization. To the thus chemically sensitized emulsion, 1-(3-acetoamidophenyl)-5-mercaptotetrazole, 1-(5-methylureidophenyl)-5-mercaptotetrazole, Compound-2, a compound containing 2 or 3 units of the repeating group represented by Compound-3 as a main constituent (wherein the terminals $X_1$ and $X_2$ were hydroxyl groups), Compound-4 and potassium bromide were added. The halide composition of the silver halide in the resulting emulsion contained 96.7% of chloride, 3.00% of bromide and 0.3% of iodide. The thus obtained emulsion was referred to as Emulsion BmH-1.

(Preparation of Blue-sensitive Layer (Yellow-color-forming Layer) Emulsion BmH-2)

As emulsion grains before receiving sedimentation treatment for desalting, monodisperse cubic silver iodobromochloride grains having an side length of 0.55 μm (corresponding to 0.69 μm in terms of average projected-area diameter) and a variation coefficient of 9.5% were prepared in the same manner as those in Emulsion BmH-1. The emulsion containing these emulsion grains was desalted by sedimentation treatment, and then dispersed again by adding thereto gelatin, Compounds Ab-1, Ab-2 and Ab-3, and calcium nitrate.

The emulsion dispersed again was chemically sensitized and spectrally sensitized in the same manners as in preparation of Emulsion BmH-1. The emulsion thus obtained was referred to as Emulsion BmH-2.

(Preparation of Blue-sensitive Layer (Yellow-color-forming Layer) emulsion BmH-3)

Emulsion BmH-3 was prepared in the same manner as Emulsion BmH-1, except that the addition method of spectral sensitizing dyes was modified as follows.

A mixed solution containing Sensitizing Dyes S-1, S-2 and S-10 was added to the emulsion dispersed again as the emulsion was agitated vigorously (at the number of rotation to attain a Reynolds number of 20,000 or above).

(Preparation of Blue-sensitive Layer (Yellow-color-forming Layer) Emulsion BmH-4)

Emulsion BmH-4 was prepared in the same manner as in the preparation of emulsion BmH-1, except that the selenium sensitizer SE3-9 was added in place of the sulfur sensitizer in the preparation of the emulsion BmH-1.

(Preparation of Blue-sensitive Layer (Yellow-color-forming Layer) Emulsion BmH-5)

Emulsion BmH-5 was prepared in the same manner as Emulsion BmH-2, except that the addition method of the sensitizing dyes was adapted to that used in preparing Emulsion BmH-3 and Selenium Sensitizer SE3-9 was added in place of the sulfur sensitizer.

(Preparation of Blue-sensitive Layer (Yellow-color-forming Layer) Emulsion BmH-6)

Emulsion BmH-6 was prepared in the same manner as in the preparation of emulsion BmH-2, except that the selenium sensitizer SE3-9 was added in place of the sulfur sensitizer in the preparation of the emulsion BmH-2.

(Preparation of Blue-sensitive Layer (Yellow-color-forming Layer) Emulsion BmH-7)

Emulsion BmH-7 was prepared in the same manner as in the preparation of emulsion BmH-2, except that the selenium sensitizer SE3-29 was added in place of the sulfur sensitizer in the preparation of the emulsion BmH-2.

(Preparation of Blue-sensitive Layer (Yellow-color-forming Layer) Emulsion BmH-8)

As emulsion grains before receiving sedimentation treatment for desalting, monodisperse cubic silver iodobromochloride grains having an side length of 0.38 μm and a variation coefficient of 9.7% were prepared in the same manner as those in Emulsion BmH-6. The emulsion containing these emulsion grains was desalted by sedimentation treatment, and then dispersed again by adding thereto gelatin, Compounds Ab-1, Ab-2 and Ab-3, and calcium nitrate.

The emulsion dispersed again was chemically sensitized and spectrally sensitized in the same manners as in preparation of Emulsion BmH-6. The emulsion thus obtained was referred to as Emulsion BmH-8.

(Preparation of Green-sensitive Layer (Magenta-color-forming Layer) Emulsion GmH-1)

Using a method of simultaneously adding silver nitrate and sodium chloride mixed into stirring deionized distilled water containing a deionized gelatin, high silver chloride cubic grains were prepared. In this preparation, at the step of from 70% to 85% addition of the entire silver nitrate amount, $K_4[Ru(CN)_6]$ was added. At the step of from 70% to 85% addition of the entire silver nitrate amount, potassium bromide (1 mol % per mol of the finished silver halide) was added. Further, $K_2[IrCl_6]$ and $K_2[RhBr_5(H_2O)]$ were added at the step of from 70% to 85% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 87% to 98% addition of the entire silver nitrate amount. The thus-obtained emulsion grains were monodisperse cubic silver iodobromochloride grains having a side length of 0.25 μm (corresponded to projected-area diameter of 0.31 μm) and a variation coefficient of 9.5%. The resulting emulsion was subjected to a sedimentation desalting treatment and re-dispersing treatment in the same manner as described in the above.

To this emulsion, sodium benzenethiosulfonate, p-glutaramidophenyldisulfide, a triethylthiourea/sodium thiosulfate combination as a sulfur sensitizer and bis(1,4,5-trimethyl-1,2,4-triazolium-3-thiorato)aurate(I) tetrafluoroborate as a gold sensitizer were added. Then, the resulting emulsion was raised in temperature and ripened so as to undergo an optimum chemical sensitization. To the emulsion thus ripened, 1-(3-acetoamidophenyl)-5-mercaptotetrazole, 1-(5-methylureidophenyl)-5-mercaptotetrazole, Compound-2, Compound-4 and potassium bromide were added. During the emulsion-making process, spectral sensitization was carried out by addition of Sensitizing Dyes S-4, S-5, S-6 and S-7. The halide composition of the silver halide in the emulsion under spectral sensitization contained 96.8% of chloride, 3.00% of bromide and 0.2% of iodide. The thus obtained emulsion was referred to as Emulsion GmH-1.

(Preparation of Red-sensitive Layer (Cyan-color-forming Layer) Emulsion RmH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 93% to 98% addition of the entire silver nitrate amount, $K_4[Ru(CN)_6]$ was added. At the step of from 85% to 100% addition of the entire silver nitrate amount, potassium bromide (3 mol % per mol of the finished silver halide) was added. Further, $K_2[IrCl_5$(5-methylthiazole)] was added at the step of from 88% to 93% addition of the entire silver nitrate amount. Potassium iodide (0.1 mol % per mol of the finished silver halide) was added, with vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains having a side length of 0.25 μm (corresponded to projected-area diameter of 0.31 μm) and a variation coefficient of 9.5%. The resulting emulsion was subjected to a sedimentation desalting treatment and re-dispersing treatment in the same manner as described in the above.

To this emulsion, Sensitizing Dye S-8, Compound-5, sodium benzenethiosulfonate, p-glutaramidophenyldisulfide, Compound-1 as a gold sensitizer, and a triethylthiourea/sodium thiosulfate combination as a sulfur sensitizer were added. Then, the resulting emulsion was raised in temperature and ripened so as to undergo an optimum chemical sensitization. To the emulsion thus ripened, 1-(3-acetoamidophenyl)-5-mercaptotetrazole, 1-(5-methylureidophenyl)-5-mercaptotetrazole, Compound-2, Compound-4 and potassium bromide were added. The halide composition of the silver halide in the emulsion under spectral sensitization contained 96.9% of chloride, 3.00% of bromide and 0.1% of iodide. The thus obtained emulsion was referred to as Emulsion RmH-1.

(Preparation of a Coating Solution for the First Layer)

Into 17 g of a solvent (Solv-4), 3 g of a solvent (Solv-6), 17 g of a solvent (Solv-9) and 45 ml of ethyl acetate were dissolved 24 g of a yellow coupler (Ex-Y1), 6 g of a color-image stabilizer (Cpd-8), 1 g of a color-image stabilizer (Cpd-16), 1 g of a color-image stabilizer (Cpd-17), and 11 g of a color-image stabilizer (Cpd-18), 1 g of a color-image stabilizer (Cpd-19), 11 g of a color-image stabilizer (Cpd-21), 0.1 g of an additive (ExC-2), and 1 g of a color-image stabilizer (UV-A). This solution was emulsified and dispersed in 205 g of a 20 mass % aqueous gelatin solution containing 3 g of sodium dodecylbenzenesulfonate with a high-speed stirring emulsifier (dissolver). Water was added thereto, to prepare 700 g of Emulsified dispersion 4A.

On the other hand, the above Emulsified dispersion 4A and the prescribed Emulsions BmH-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added Ab-1, Ab-2, Ab-3, and Ab-4, so that the total amounts would be 10.0 mg/m$^2$, 43.0 mg/m$^2$, 3.5 mg/m$^2$, and 7.0 mg/m$^2$, respectively.

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. In the case of a layer constitution in which the green sensitive layer and the red sensitive layer were changed their arrangement each other, the above chemicals to be added were also change appropriately. Disodium salt of catecol-3,5-disulfonic acid was added to the second layer, the fourth layer, and the sixth layer so that coating amounts would be 6 mg/m$^2$, 6 mg/m$^2$, and 18 mg/m$^2$, respectively. Further, Compound S1-4 was added in an amount of 1.5 mg/m$^2$, and to each layer, sodium polystyrene sulfonate was added to adjust viscosity of the coating solutions, if necessary. Further, in order to prevent irradiation, the following dyes (coating amounts are shown in parentheses) were added.

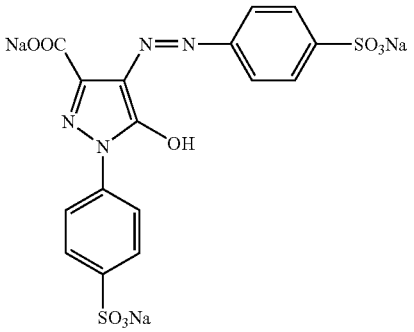

(2 mg/m′)

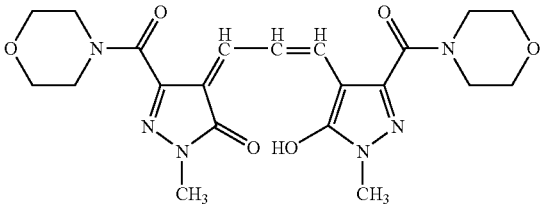

(3 mg/m′)

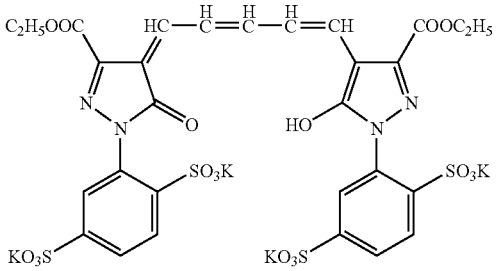

(10 mg/m′)

-continued

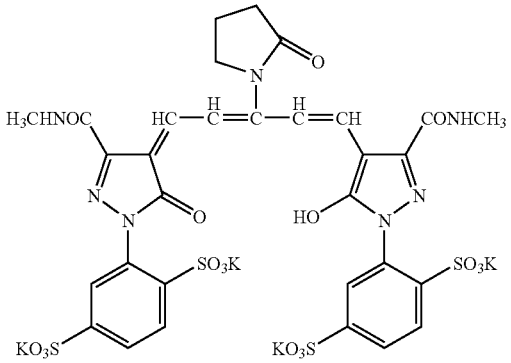

(16 mg/m′)

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

All samples had the same support

| | |
|---|---|
| First layer (Blue-sensitive emulsion layer/yellow-dye-forming-coupler-containing silver halide emulsion layer) :BL-1 | |
| Emulsion (BmH-1) | 0.13 |
| Gelatin | 1.33 |
| Yellow coupler (Ex-Y1) | 0.32 |
| Color-image stabilizer (Cpd-8) | 0.08 |
| Color-image stabilizer (Cpd-16) | 0.01 |
| Color-image stabilizer (Cpd-17) | 0.01 |
| Color-image stabilizer (Cpd-18) | 0.14 |
| Color-image stabilizer (Cpd-19) | 0.01 |
| Color-image stabilizer (Cpd-21) | 0.14 |
| Additive (ExC-2) | 0.001 |
| Color-image stabilizer (UV-A) | 0.01 |
| Solvent (Solv-4) | 0.22 |
| Solvent (Solv-6) | 0.04 |
| Solvent (Solv-9) | 0.22 |
| Second layer (Color-mixing-inhibiting layer):MCS1-1 | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |

-continued

| | |
|---|---|
| Third layer (Red-sensitive emulsion layer/cyan-dye-forming-coupler-containing silver halide emulsion layer):RL-1 | |
| Emulsion (RmH-1) | 0.07 |
| Gelatin | 0.77 |
| Cyan coupler (ExC-1) | 0.16 |
| Cyan coupler (ExC-3) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.00 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |
| Fourth layer (Color-mixing-inhibiting layer):MCS2-1 | |
| Gelatin | 0.47 |
| Color-mixing inhibitor (Cpd-4) | 0.030 |
| Color-mixing inhibitor (Cpd-12) | 0.006 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Fifth layer (Green-sensitive emulsion layer/magenta-dye-forming-coupler-containing silver halide emulsion layer):GL-1 | |
| Emulsion (GmH-1) | 0.11 |
| Gelatin | 0.75 |
| Magenta coupler (Ex-M) | 0.12 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.02 |
| Solvent (Solv-3) | 0.04 |
| Solvent (Solv-4) | 0.08 |
| Solvent (Solv-6) | 0.05 |
| Solvent (Solv-9) | 0.12 |
| Sixth layer (Ultraviolet absorbing layer):UV-1 | |
| Gelatin | 0.34 |
| Ultraviolet absorber (UV-B) | 0.24 |
| Solvent (Solv-7) | 0.11 |
| Seventh layer (Protective layer):PC-1 | |
| Gelatin | 0.44 |
| Additive (Gpd-20) | 0.015 |
| Liquid paraffin | 0.01 |
| Surfactant (Cpd-13) | 0.01 |

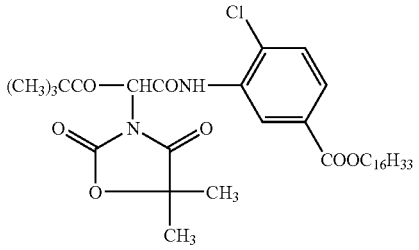

(Ex-Y1) Yellow coupler

The sample produced so that the layers thereof had the makeup described above was referred to as Sample 4-101 (Comparative Example).

Samples 4-108 to 4-110 as the present silver halide photographic light-sensitive materials (Examples of the present invention) were produced in the same manner as Sample 4-101, except that the emulsion and the coupler contained in the first layer were changed as shown in Table 15.

In addition, Samples 4-102 to 4-107 (Comparative Examples) were produced in the same manner as Sample 4-101, except that the emulsion and the coupler contained in the first layer were change as shown in Table 15.

(Processing)

Each sample was subjected to gradation exposure to impart gray in the following color-development processing 4B, with the following exposure apparatus; and then, at five seconds after the exposure was finished, the sample was subject to color-development processing by the processing 4A or 4B. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure; in order to obtain magenta color formed as the green laser light source, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure; and in order to obtain cyan color formed as the red laser light source, a red-light semiconductor laser (Type No. HL6501 MG, manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The temperature of the semiconductor laser was kept constant by using a Peltier device to prevent the quantity of light from being changed by temperature.

The conditions adopted for color-development processing of the present silver halide color photographic light-sensitive materials were as follows.

Processing 4A

The aforementioned Sample 4-101 was made into a roll with a width of 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing 4A.

| Processing step | Temperature | Time | Replenisher amount* |
|---|---|---|---|
| Color development | 38.5° C. | 45 sec | 45 mL |
| Bleach-fixing | 38.0° C. | 45 sec | Replenisher A 17.5 mL<br>Replenisher B 17.5 mL |

-continued

| Processing step | Temperature | Time | Replenisher amount* |
|---|---|---|---|
| Rinse 1 | 38.0° C. | 20 sec | — |
| Rinse 2 | 38.0° C. | 20 sec | — |
| Rinse 3 | 38.0° C. | 20 sec | — |
| Rinse 4 | 38.0° C. | 20 sec | 121 mL |
| Drying | 80° C. | | |

(Note)
*Replenisher amount per $m^2$ of the light-sensitive material to be processed.
**A rinse cleaning system RC50D, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).
The processing solutions used had the same compositions as those used in Example 1-1, respectively.

Processing 4B

The aforementioned Sample 4-101 was made into a roll with a width of 127 mm; the resultant sample was exposed to light with a standard photographic image, using Digital Minilab Frontier 340 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. Additionally, in order to attain the following processing times in the processor, changes to the transport speed were made by modifications to processing racks. A processing with this running processing solutions was named processing 4B.

| Processing step | Temperature | Time | Replenisher amount* |
|---|---|---|---|
| Color development | 45.0° C. | 12 sec | 35 mL |
| Bleach-fixing | 40.0° C. | 12 sec | Replenisher A 15 mL<br>Replenisher B 15 mL |
| Rinse1 | 45.0° C. | 4 sec | — |
| Rinse2 | 45.0° C. | 2 sec | — |
| Rinse3 | 45.0° C. | 2 sec | — |
| Rinse4 | 45.0° C. | 3 sec | 175 mL |
| Drying | 80° C. | 15 sec | |

(Note)
*Replenisher amount per $m^2$ of the light-sensitive material to be processed.
The processing solutions used had the same compositions as those used in Example 1-3, respectively.

Developed yellow densities of each sample after the processing were measured, and a characteristic curve was plotted. The sensitivity (S) was defined as the antilog of the reciprocal of an exposure amount providing a developed color density 1.0 higher than the unexposed-area density, and shown in relative sensitivity with Sample 4-101 after Processing 4A being taken as 100. Accordingly, the greater this value the higher the sensitivity and more preferable. The fog density (Dmin) was defined as the value obtained by subtracting the base density from the yellow density in the unexposed area. So the smaller this value the more beautiful and the more desirable the white background. Further, a characteristic curve corresponding to yellow-color generation was plotted in the same way as described above, except that the light source used in the foregoing exposure was replaced with a blue laser light source alone and gray-scale exposure was applied to each blue-sensitive layer. From the characteristic curve obtained, the magenta density at a yellow density of 2.1 (M in Y) was determined, and expressed in a variation from the corresponding value of Sample 4-101. This value was adopted as an index of dullness of color. Being smaller in this value indicates that the developed color has the less dullness and the better quality. For the purpose of comparing changes in various properties between different emulsion-making scales, emulsions were made on a scale of 1-mole silver (Ag) and a scale of 20-mole silver (Ag), respectively. The samples in which emulsions on these different emulsion-making scales were coated in place of the emulsions used in the Samples corresponding thereto were subjected to the same exposure, processing and measurements as mentioned above. Sensitivities of the samples using the emulsions on the scale of 1-mole Ag and those of the samples using the emulsions on the scale of 20-mole Ag were determined in the same way as mentioned above, and a difference in sensitivity between each sample pair differing in emulsion-making scale was calculated, and referred to as "sensitivity difference". The smaller sensitivity difference implies that photographic properties are the more stable to a change in emulsion-making scale. In addition, measurements of spectral sensitivity distribution was made on each sample, and the wavelength (nm) at which a peak sensitivity appeared in the range of about 400 nm to about 500 nm and a difference between the wavelengths (nm) at which the sensitivity was 70% of the peak sensitivity on the short-wavelength side and the long-wavelength side were determined.

Results obtained are shown in Tables 15 and 16.

The following can be seen from Tables 15 and 16.

The combined use of a selenium-sensitized emulsion and a yellow coupler represented by formula (Y) was able to impart high sensitivity and less dullness of developed color to the photosensitive materials, but caused an increase in property difference arising from the emulsion-making scale. On the other hand, the property difference arising from the emulsion-making scale can be reduced by adjusting the spectral sensitivity distribution to those of the photosensitive materials of the present invention, and besides, this adjustment can render the sensitivity higher and the fog density lower. These effects are noticeably found only in the photosensitive materials having the structure according to the present invention, and surprising results beyond expectations.

Samples were produced in the same manners as Samples 4-101 to 4-110, respectively, except that the layer receiving the replacement as mentioned above was changed to the third layer or the fifth layer from the first layer. The same measurements as mentioned above were made on these samples also, and the same tends as mentioned above were discernible therein.

Example 4-2

(Preparation of Blue-sensitive Layer (Yellow-color-forming Layer) Emulsion BmH-9)

Emulsion BmH-9 was prepared in the same manner as Emulsion BmH-6, except that a combination of Sensitizing

TABLE 15

| | First layer Emulsion | | | | | |
|---|---|---|---|---|---|---|
| Sample No. | Emulsion No. | Grain size (μm) | Sensitizer | peak spectral sensitivity/ difference between the wavelengths (nm) | Yellow coupler | Remarks |
| 4-101 | BmH-1 | 0.64 | S | 494/105 | Ex-Y1 | Comparative example |
| 4-102 | BmH-2 | 0.55 | S | 494/106 | Ex-Y1 | Comparative example |
| 4-103 | BmH-2 | 0.55 | S | 493/103 | Y-11 | Comparative example |
| 4-104 | BmH-3 | 0.64 | S | 474/61 | Y-11 | Comparative example |
| 4-105 | BmH-4 | 0.64 | Se | 494/104 | Ex-Y1 | Comparative example |
| 4-106 | BmH-5 | 0.55 | Se | 494/103 | Ex-Y1 | Comparative example |
| 4-107 | BmH-5 | 0.55 | Se | 494/103 | Y-11 | Comparative example |
| 4-108 | BmH-6 | 0.55 | Se | 473/60 | Y-11 | This invention |
| 4-109 | BmH-7 | 0.55 | Se | 473/60 | Y-11 | This invention |
| 4-110 | BmH-8 | 0.38 | Se | 473/62 | Y-11 | This invention |

TABLE 16

| | Processing A | | | | Processing B | | | | |
|---|---|---|---|---|---|---|---|---|---|
| Sample No. | Sensitivity | Fog | Dullness of colors (M in Y) | Difference between the sensitivities | Sensitivity | Fog | Dullness of colors (M in Y) | Difference between the sensitivities | Remarks |
| 4-101 | 100 | 0.04 | 0.00 | 12 | 100 | 0.04 | 0.00 | 13 | Comparative example |
| 4-102 | 75 | 0.02 | −0.01 | 10 | 95 | 0.02 | 0.00 | 10 | Comparative example |
| 4-103 | 77 | 0.02 | −0.06 | 11 | 85 | 0.02 | −0.06 | 12 | Comparative example |
| 4-104 | 76 | 0.02 | −0.05 | 10 | 83 | 0.02 | −0.06 | 10 | Comparative example |
| 4-105 | 183 | 0.09 | 0.02 | 12 | 135 | 0.09 | 0.03 | 19 | Comparative example |
| 4-106 | 166 | 0.03 | 0.02 | 13 | 165 | 0.03 | 0.03 | 21 | Comparative example |
| 4-107 | 167 | 0.03 | −0.01 | 19 | 160 | 0.03 | −0.03 | 35 | Comparative example |
| 4-108 | 195 | 0.02 | −0.06 | 8 | 220 | 0.02 | −0.08 | 9 | This invention |
| 4-109 | 201 | 0.02 | −0.06 | 8 | 228 | 0.02 | −0.08 | 5 | This invention |
| 4-110 | 102 | 0.02 | −0.07 | 8 | 115 | 0.02 | −0.08 | 8 | This invention |

Dye S-2 and the exemplified Compound BS-2 was used in place of the combination of Sensitizing Dyes S-1, S-2 and S-10.

Sample 4-201 was produced in the same manner as Sample 4-108, except that Emulsion BmH-6 was replaced with Emulsion BmH-9.

According to the same method as in Example 4-1, evaluations were made on Sample 4-101 for comparison, and Samples 4-108 and 4-201 as the present silver halide color photographic light-sensitive materials. Results obtained are shown in Table 17.

TABLE 17

| Sample No. | Processing A Sensitivity | Processing A Fog | Processing A Difference between the sensitivities | Processing B Sensitivity | Processing B Fog | Processing B Difference between the sensitivities | peak spectral sensitivity/ difference between the wavelengths (nm) | Remarks |
|---|---|---|---|---|---|---|---|---|
| 4-101 | 100 | 0.04 | 12 | 100 | 0.04 | 13 | 495/106 | Comparative example |
| 4-108 | 219 | 0.02 | 9 | 211 | 0.02 | 9 | 471/60 | This invention |
| 4-201 | 234 | 0.02 | 8 | 226 | 0.02 | 4 | 470/58 | This invention |

It can be seen from Table 17 showing the results in Example 4-1 that Sample 4-108 and Sample 4-201 containing Sensitizing Dye BS-2 in the silver halide emulsion incorporated in the first layer were more preferable because of their sensitivities were higher and the property difference arising from difference in emulsion-making scale was more greatly reduced.

Samples were produced in the same manners as Samples 4-101, 4-108 and 4-201, respectively, except that the third layer and the fifth layer in each sample were replaced. The same measurements as mentioned above were made on these samples also, and the same tendencies as mentioned above were discernible therein.

Example 4-3

Samples 4-301 and 4-302 were produced in the same manners as Sample 4-101 and 4-201, respectively, except that alterations were made to the amount of polyethylene laminated on the side of the support where no light-sensitive layers were coated.

Curling degree measurements were made on Samples 4-101 and 4-301 for comparison and Samples 4-201 and 4-302 as the present silver halide color photographic light-sensitive materials. Further, uniform exposure was applied to each of the foregoing Samples by use of lasers whose exposure intensities were controlled so as to provide a yellow density of 0.3, a magenta density of 0.3 and a cyan density of 0.3, respectively. After a 5-second lapse from the exposure, the forgoing Processing 4B or the following Processing 4C was performed, thereby producing uniform gray images.

Processing 4C

By modifications to processing racks used in Processing 4B, a change was made to the transport speed, the color-development processing time was adjusted to 9 seconds, the temperature of the bleach-fix bath was adjusted to 45° C., the bleach-fix processing time was adjusted to 9 seconds, and the other conditions were the same as those in Processing 4B.

In order to evaluate the running suitability, 300 sheets of each sample were subjected to gray exposure, and subsequently thereto they underwent Processing 4B or 4C. Densities coming from developed yellow densities in the 1st sheet and the 300th, respectively, were determined, and a difference between those densities was adopted as an index of running suitability. The smaller this difference the better the running suitability. Results obtained are shown in Table 18.

TABLE 18

| Sample No. | Curling degree | Running suitability: Processing B Difference between densities | Running suitability: Processing C Difference between densities | Remarks |
|---|---|---|---|---|
| 4-101 | +17 | 0.08 | 0.12 | Comparative example |
| 4-201 | +17 | 0.03 | 0.07 | This invention |
| 4-301 | +18 | 0.09 | 0.11 | Comparative example |
| 4-302 | +8 | 0.02 | 0.02 | This invention |

Table 18 indicates that when subjected to rapid processing the photosensitive materials of the present invention can undergo marked improvement in running suitability as far as their curling degrees are adjusted to the specified range, and can have a greater advantage. In more rapid processing also, it is found that the photosensitive materials of the present invention can undergo improvement in running suitability.

In addition, it is found that Sample 4-302 differing in curing degree from Sample 4-201 can have further improved running suitability in rapid processing.

Samples were produced in the same manners as Samples 4-101, 4-201, 4-301 and 4-302, respectively, except that the third layer and the fifth layer in each sample were replaced. The same measurements as mentioned above were made on these samples also, and the same tendencies as mentioned above were discernible therein.

Example 4-4

(Preparation of Green-sensitive Layer (Magenta-color-forming Layer)Emulsion GmH-2)

Emulsion GmH-2 was prepared in the same manner as in the preparation of emulsion GmH-1, except that the selenium sensitizer SE3-9 was added in place of the sulfur sensitizer in the preparation of the emulsion GmH-1.

(Preparation of Red-sensitive Layer (Cyan-color-forming Layer)Emulsion RmH-2)

Emulsion RmH-2 was prepared in the same manner as in the preparation of emulsion RmH-1, except that the selenium sensitizer SE3-9 was added in place of the sulfur sensitizer in the preparation of the emulsion RmH-1.

Sample 4-401 was produced in the same manner as Sample 4-201, except that Emulsion GmH-1 in the fifth layer was replaced with Emulsion GmH-2. Sample 4-402 was produced in the same manner as Sample 4-201, except that Emulsion RmH-1 in the third layer was replaced with Emulsion RmH-2. Sample 4-403 was produced in the same manner as Sample 4-201, except that Emulsion GmH-1 in the fifth layer was replaced with Emulsion GmH-2 and Emulsion RmH-1 in the third layer was replaced with Emulsion RmH-2.

According to the same method as in Example 4-3, running suitability evaluations were made on Sample 4-101 for comparison and Samples 4-201, 4-401, 4-402 and 4-403 as the silver halide color photographic light-sensitive materials of the present invention. Results obtained are shown in Table 19.

TABLE 19

| | Running suitability | | |
|---|---|---|---|
| Sample No. | Processing B Difference between densities | Processing C Difference between densities | Remarks |
| 4-101 | 0.09 | 0.13 | Comparative example |
| 4-201 | 0.03 | 0.08 | This invention |

TABLE 19-continued

| | Running suitability | | |
|---|---|---|---|
| Sample No. | Processing B Difference between densities | Processing C Difference between densities | Remarks |
| 4-401 | 0.03 | 0.05 | This invention |
| 4-402 | 0.03 | 0.06 | This invention |
| 4-403 | 0.02 | 0.03 | This invention |

Table 19 indicates that the use of selenium-sensitized emulsions in not only the yellow-color-forming layer but also the other layers can deliver further improvement in running suitability under rapid processing, so it is preferable.

Samples were produced in the same manners as Samples 4-101, 4-201, 4-401, 4-402 and 4-403, respectively, except that the third layer and the fifth layer in each sample were replaced. The same measurements as mentioned above were made on these samples also, and the same tendencies as mentioned above were discernible therein.

Example 4-5

A sample having the following layer structure was produced, and referred to as Sample 4-501. Each figure designates the coating amount (g/m$^2$). As to each of the silver halide emulsions, the figure represents the coating amount based on silver. Sample 4-502 was produced in the same manner as Sample 4-501, except that the yellow coupler used was changed to the exemplified Coupler Y-11 from Coupler Ex-Y1.

| | |
|---|---|
| First layer (Blue-sensitive emulsion layer/yellow-dye-forming-coupler-containing silver halide emulsioin layer): BL-2 | |
| Emulsion (BmH-7) | 0.24 |
| Gelatin | 1.10 |
| Yellow coupler (Ex-Y1) | 0.46 |
| Color-image stabilizer (ST-1) | 0.04 |
| Color-image stabilizer (ST-2) | 0.06 |
| Color-image stabilizer (ST-5) | 0.10 |
| Stain inhibitor (HQ-1) | 0.005 |
| Color-image stabilizer A | 0.07 |
| Color-image stabilizer B | 0.05 |
| Dmonyl phthalate | 0.06 |
| Dibutyl phthalate | 0.14 |
| Second layer (Color-mixing-preventing layer): MCS1-2 | |
| Gelatin | 1.20 |
| Stain inhibitor (HQ-1) | 0.02 |
| Stain inhibitor (HQ-2) | 0.03 |
| Stain inhibitor (HQ-3) | 0.055 |
| Stain inhibitor (HQ-4) | 0.035 |
| Stain inhibitor (HQ-5) | 0.03 |
| Di-i-decyl phthalate | 0.038 |
| Dibutyl phthalate | 0.022 |
| Third layer (Red-sensitive emulsion layer/cyan-dye-forming-coupler-containing silver halide emulsion layer): RL-2 | |
| Emulsion (RmH-1) | 0.17 |
| Gelatin | 1.00 |
| Cyan coupler (C-1) | 0.22 |
| Cyan coupler (C-2) | 0.06 |
| Color-image stabilizer (ST-1) | 0.055 |
| Stain inhibitor (HQ-1) | 0.003 |
| Dioctyl phthalat | 0.20 |
| Dibutyl phthalate | 0.10 |

-continued

| | |
|---|---|
| Fourth layer (Color-mixing-preventing layer): MCS2-2 | |
| Gelatin | 0.94 |
| Ultraviolet absorber (UV-A1) | 0.28 |
| Ultraviolet absorber (UV-4) | 0.16 |
| Stain inhibitor (HQ-5) | 0.06 |
| Fifth layer (Green-sensitive emulsion layer/magenta-dye-forming-coupler-containing silver halide emulsion layer): GL-2 | |
| Emulsion (GmH-1) | 0.12 |
| Gelatin | 1.30 |
| Magenta coupler (M-1) | 0.05 |
| Magenta coupler (M-2) | 0.15 |
| Color-image stabilizer (ST-3) | 0.10 |
| Color-image stabilizer (ST-4) | 0.02 |
| Di-i-decyl phthalate | 0.095 |
| Dibutylphthalate | 0.105 |
| Sixth layer (Ultraviolet-absorbing layer): UV-2 | |
| Gelatin | 0.40 |
| Ultraviolet absorber (UV-A1) | 0.12 |
| Ultraviolet absorber (UV-4) | 0.068 |
| Stain inhibitors (HQ-5) | 0.02 |
| Seventh layer (Protective layer): PC-2 | |
| Gelatin | 0.69 |
| Di-i-decyl phthalate | 0.0018 |
| Dibutyl phthalate | 0.0018 |
| Silica | 0.003 |

Details of additives used for production of Samples 4-501 and 4-502 are as follows.
HQ-1: 2,5-di-t-octylhydroquinone
HQ-2: 2,5-di-sec-dodecylhydroquinone
HQ-3: 2,5-di-sec-tetradecyihydroquinone
HQ-4: 2-sec-dodecyl-5-sec-tetradecylhydroquinone
HQ-5: 2,5-di[(1,1 -dimethyl-4-hexyloxycarbonyl)butyl]hydroquinone
Image stabilizer A: p-t-octylphenol
Image stabilizer B: poly(t-butylacrylamide)
Magenta coupler
M-1

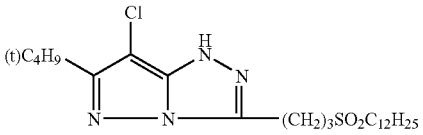

M-2

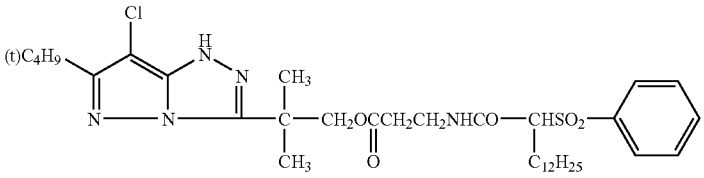

Cyan coupler
C-1

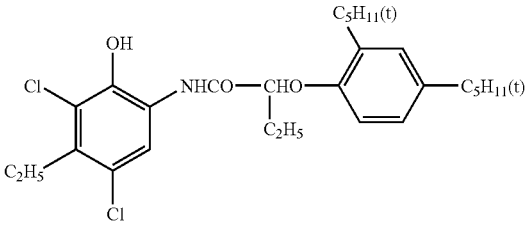

C-2

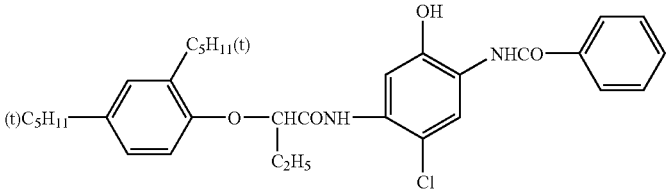

-continued

Color-image stabilizer

ST-1

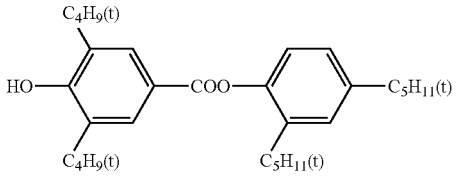

ST-2

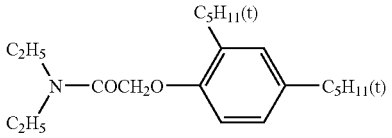

ST-3

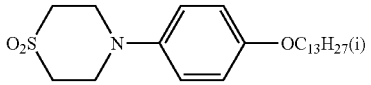

ST-4

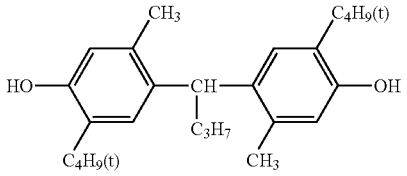

ST-5

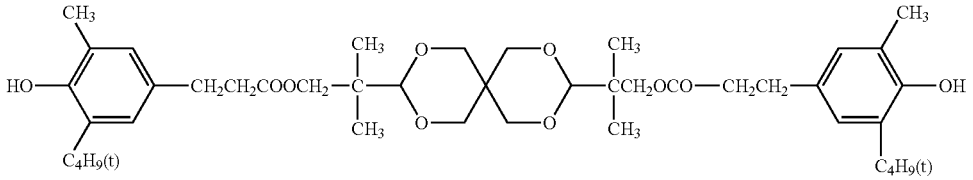

(UV-A1)

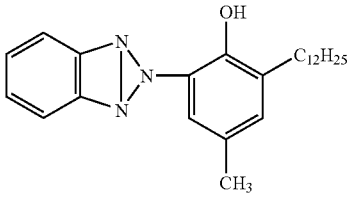

In addition, Sample 4-503 was produced in the same manner as Sample 4-501, except that Emulsion GL-2 was incorporated into the fifth layer in place of the third layer, Emulsion RL-2 was incorporated into the third layer in place of the fifth layer and the developed color density correction was made by changing the amount of silver in each layer. Sample 4-504 was produced in the same manner as Sample 4-503, except that the yellow coupler ExY1 in Emulsion BL-2 was replaced with the exemplified Coupler Y-11.

Evaluations according to the same method as in Example 4-1 were made on Sample 4-501, Sample 4-502, Sample 4-503 and Sample 4-504.

The evaluation results indicate that Samples 4-502 and 4-504 as the photosensitive materials of the present invention had good effects as in the case of Example 4-1, compared with Samples 4-501 and 4-503.

INDUSTRIAL APPLICABILITY

The silver halide color photographic light-sensitive materials of the present invention can be preferably used as, e.g., color negative films, color positive films, color reversal films, color reversal photographic printing paper, color photographic printing paper, display photosensitive materials, digital color proofs, motion picture color positives, and motion picture color negatives.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A silver halide color photographic light-sensitive material having, on a support, photographic constituent layers including at least one cyan-dye-forming-coupler-containing silver halide emulsion layer, at least one magenta-dye-forming-coupler-containing silver halide emulsion layer, at least one yellow-dye-forming-coupler-containing silver halide emulsion layer and at least one light-insensitive hydrophilic colloid layer, characterized in that a coating amount of total silver in the photographic constituent layers is 0.2 g/m$^2$ to 0.45 g/m$^2$, at least one of the silver halide emulsion layers contains a silver halide emulsion having a selenium-sensitized silver chloride content of 90 mole % or above, and at least one of the yellow-dye-forming-coupler-containing silver halide emulsion layers contains at least one of couplers represented by the following formula (Y);

Formula (Y)

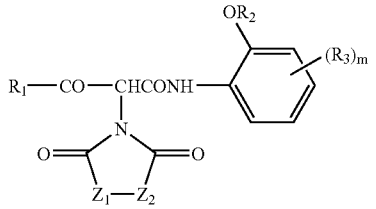

wherein $R_1$ represents an alkyl group or a cycloalkyl group; $R_2$ represents an alkyl group, a cycloalkyl group, an acyl group or an aryl group; $R_3$ represents a hydrogen atom, a halogen atom, an alkyl group, an alkoxy group, an aryloxy group, an alkoxycarbonyl group, an alkylsulfonyl group, an alkylcarbamoyl group, an arylcarbamoyl group, an alkylsulfamoyl group, an arylsulfamoyl group, an alkylcarbonamido group, an alkylsulfonamido group, an arylsulfonamido group, a sulfamoyl group or an imido group; m represents an integer of 0 or 1 to 4; $Z_1$ represents —O— or —$NR_A$—; and $Z_2$ represents —$NR_B$— or —$C(R_C)R_D$—, wherein $R_A$, $R_B$, $R_C$ and $R_D$ each independently represent a hydrogen atom or a substituent.

2. The silver halide color photographic light-sensitive material according to claim 1, wherein the selenium-sensitized silver halide emulsion further contains at least two types of compounds having oxidizing action on clusters of metal silver.

3. The silver halide color photographic light-sensitive material according to claim 1, wherein a coating amount of total gelatin is from 3 g/m$^2$ to 6 g/m$^2$.

4. The silver halide color photographic light-sensitive material as according to claim 1, wherein silver halide grains of the selenium-sensitized silver halide emulsion have an average sphere-equivalent diameter of 0.60 μm or below.

5. The silver halide color photographic light-sensitive material according to claim 1, wherein the total coated amount of silver in the photographic constituent layers is 0.2 g/m$^2$ to 0.40 g/m$^2$.

6. The silver halide color photographic light-sensitive material according to claim 1, wherein at least one crown ether is contained in said silver halide emulsion layer which contains a silver halide emulsion having a selenium-sensitized silver chloride content of 90 mole % or above.

7. The silver halide color photographic light-sensitive material according to claim 1, wherein an average sphere-equivalent diameter of silver halide grains contained in said yellow-dye-forming-coupler-containing silver halide emulsion layer is 0.75 μm or below.

8. The silver halide color photographic light-sensitive material according to claim 1, wherein the sum of coated amounts in the cyan-dye-forming coupler, the magenta-dye-forming coupler and the yellow-dye-forming coupler is 1.1 g/m$^2$ or below.

9. The silver halide color photographic light-sensitive material according to claim 1, wherein the selenium sensitizer in a selenium-sensitized silver halide emulsion is any of compounds represented by the following formulae (SE1), (SE2), (SE3) and (PF1) to (PF6):

Formula (SE1)

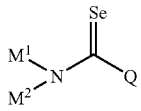

wherein, in formula (SE1), $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group or a carbamoyl group; Q represents an alkyl group, an alkenyl group, an alkynyl group, an aryl group, a heterocyclic group, $OM^3$, or $NM^4M^5$; $M^3$, $M^4$ and $M^5$ each independently represent a hydrogen atom, an alkyl group, an alkenyl group, an alkynyl group, an aryl group or a heterocyclic group; and any two groups of $M^1$, $M^2$ and Q may bond together, to form a cyclic structure;

Formula (SE2)

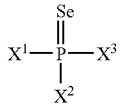

wherein, $X^1$, $X^2$ and $X^3$ each independently represent an alkyl group, an alkenyl group, an alkynyl group, an aryl group, a heterocyclic group, $OJ^1$, or $NJ^2J^3$; and $J^1$, $J^2$ and $J^3$ each independently represent a hydrogen atom, an alkyl group, an alkenyl group, an alkynyl group, an aryl group or a heterocyclic group;

$E^1$-Se-$E^2$ Formula (SE3)

wherein $E^1$ and $E^2$, which may be the same or different, each represent an alkyl group, an alkenyl group, an alkynyl group, an aryl group, a heterocyclic group, an acyl group, an alkoxycarbonyl group, an aryloxycarbonyl group or a carbamoyl group;

Formula (PF1)

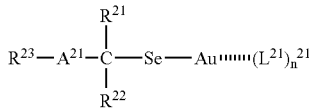

Formula (PF2)

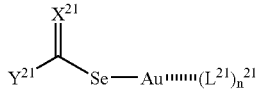

Formula (PF3)

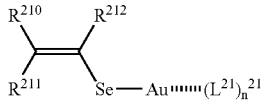

Formula (PF4)

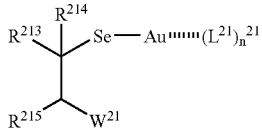

-continued

Formula (PF5)

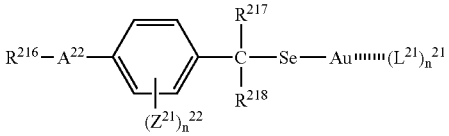

Formula (PF6)

$[Q^{21}\text{''''}Au\text{''''}(Q^{22})_{n^{23}}]J^{21}$ wherein, in formula (PF1), $L^{21}$ represents a compound capable of coordinating with gold via an N atom, an S atom, an Se atom, a Te atom or a P atom; $n^{21}$ represents 0 or 1; $A^{21}$ represents O, S or $NR^{24}$; $R^{21}$ to $R^{24}$ each represent a hydrogen atom or a substituent; and $R^{23}$ may form a 5- to 7-membered ring together with $R^{21}$ or $R^{22}$;

wherein, in formula (PF2), $L^{21}$ represents a compound capable of coordinating with gold via an N atom, an S atom, an Se atom, a Te atom or a P atom; $n^{21}$ represents 0 or 1; $X^{21}$ represents O, S or $NR^{25}$; $Y^{21}$ represents an alkyl group, an alkenyl group, an alkynyl group, an aryl group, a hetero ring group, $OR^{26}$, $SR^{27}$, or $N(R^{28})R^{29}$; $R^{25}$ to $R^{29}$ each represent a hydrogen atom, an alkyl group, an alkenyl group, an alkynyl group, an aryl group or a hetero ring group; and $X^{21}$ and $Y^{21}$ may be bound to each other to form a ring;

wherein, in formula (PF3), $L^{21}$ represents a compound capable of coordinating with gold via an N atom, an S atom, an Se atom, a Te atom or a P atom; $n^{21}$ represents 0 or 1; $R^{210}$, $R^{211}$ and $R^{212}$ each independently represent a hydrogen atom or a substituent, at least one of $R^{210}$ and $R^{211}$ represents an electron attractive group;

wherein, in formula (PF4), $L^{21}$ represents a compound capable of coordinating with gold via an N atom, an S atom, an Se atom, a Te atom or a P atom; $n^{21}$ represents 0 or 1; $W^{21}$ represents an electron attractive group; and $R^{213}$ to $R^{215}$ each represent a hydrogen atom or a substituent, with $W^{21}$ and $R^{213}$ optionally being bound to each other to form a cyclic structure;

wherein, in formula (PF5), $L^{21}$ represents a compound capable of coordinating with gold via an N atom, an S atom, an Se atom, a Te atom or a P atom; $n^{21}$ represents 0 or 1; $A^{22}$ represents O, S, Se, Te or $NR^{219}$; $R^{216}$ represents a hydrogen atom, an alkyl group, an alkenyl group, an alkynyl group, an aryl group, a hetero ring group or acyl group; $R^{217}$ to $R^{219}$ each represent a hydrogen atom, an alkyl group, an alkenyl group, an alkynyl group, an aryl group or a hetero ring group; $Z^{21}$ represents a substituent; $n^{22}$ represents an integer of from 0 to 4; and when $n^{22}$ is 2 or more, $Z^{21}$ may be the same or different from each other; and wherein, in formula (PF6), $Q^{21}$ and $Q^{22}$ represent compounds selected from among the selenium sensitizers of the formulae (SE1) to (SE3), the selenium atoms in $Q^{21}$ and $Q^{22}$ form coordinate bonds together with Au; $n^{23}$ represents 0 or 1; and $J^{21}$ represents a counter anion; when $n^{23}$ is 1, $Q^{21}$ and $Q^{22}$ may be the same or different; provided that the compounds represented by the formula (PF6) do not include the compounds represented by any of the formulae (PF1) to (PF5).

10. The silver halide color photographic light-sensitive material according to claim 1, wherein at least one sensitizing dye represented by the following formula (II) is contained in said yellow-dye-forming-coupler-containing silver halide emulsion layer:

Formula (II)

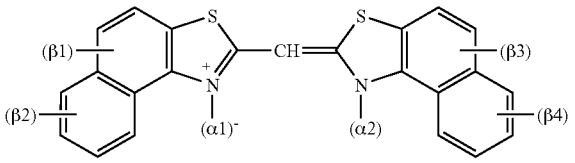

wherein α1, α2 and β1 to β4 each represent a hydrogen atom, an alkyl group, an alkenyl group, an alkynyl group, an aryl group, a heterocyclic group, an acyl group, an amino group, an alkoxy group, a hydroxyl group or a carbamoyl group, and each of these groups may be substituted.

* * * * *